US007703575B2

(12) United States Patent
Berger, II et al.

(10) Patent No.: US 7,703,575 B2
(45) Date of Patent: Apr. 27, 2010

(54) THREE-DIMENSIONAL TESSELLATED ACOUSTIC COMPONENTS

(75) Inventors: Russell E. Berger, II, Carrollton, TX (US); Charles M Chiles, Carrollton, TX (US); Richard Schrag, Dallas, TX (US)

(73) Assignee: pArtScience, LLC, Addison, TX (US)

( * ) Notice: Subject to any disclaimer, the term of this patent is extended or adjusted under 35 U.S.C. 154(b) by 585 days.

(21) Appl. No.: 11/526,343

(22) Filed: Sep. 25, 2006

(65) Prior Publication Data

US 2008/0073147 A1 Mar. 27, 2008

(51) Int. Cl.

| | |
|---|---|
| ***E04B 1/82*** | (2006.01) |
| ***E04B 1/84*** | (2006.01) |
| *E04B 1/86* | (2006.01) |
| *E04B 1/74* | (2006.01) |

(52) U.S. Cl. ..... 181/293; 181/295; 181/286

(58) Field of Classification Search ..... 181/293, 181/30, 295, 286, 284, 285, 290, 210; 52/144, 52/145

See application file for complete search history.

(56) References Cited

U.S. PATENT DOCUMENTS

| | | | | | |
|---|---|---|---|---|---|
| 143,835 | A | | 10/1873 | Muller | |
| 928,320 | A | | 7/1909 | Moore | |
| 1,554,180 | A | * | 9/1925 | Trader | 52/144 |
| 2,652,126 | A | * | 9/1953 | Mazer | 181/293 |
| 2,840,179 | A | * | 6/1958 | Junger | 181/286 |
| 3,229,439 | A | | 1/1966 | Strobel | |
| 3,617,336 | A | | 11/1971 | Gilard et al. | |
| D231,350 | S | | 4/1974 | Ishida et al. | |
| 4,122,915 | A | * | 10/1978 | Taguchi | 181/284 |
| 4,133,152 | A | | 1/1979 | Penrose | |
| 4,548,292 | A | * | 10/1985 | Noxon | 181/295 |
| 4,681,481 | A | | 7/1987 | Kapusta | |
| 4,821,839 | A | * | 4/1989 | D'Antonio et al. | 181/198 |
| 4,829,728 | A | * | 5/1989 | Castelli | 52/145 |
| 4,925,338 | A | | 5/1990 | Kapusta | |
| 5,141,073 | A | * | 8/1992 | Pelonis | 181/30 |
| 5,160,816 | A | * | 11/1992 | Chlop | 181/285 |
| 5,579,614 | A | * | 12/1996 | Dorn | 52/144 |
| 5,665,943 | A | * | 9/1997 | D'Antonio | 181/295 |
| 5,817,992 | A | * | 10/1998 | D'Antonio | 181/295 |
| 6,015,026 | A | * | 1/2000 | McGrath | 181/295 |

(Continued)

OTHER PUBLICATIONS

Studiofoam Sonomatt Acoustic foam sound absorption products from, dowloaded May 14, 2005 from http://www.auralex.com/acoustic_foam_sonomatt/acoustic_foam_sonoma.

(Continued)

*Primary Examiner*—Edgardo San Martin
(74) *Attorney, Agent, or Firm*—Robert H. Frantz

(57) ABSTRACT

A set of acoustic components having complementarily tessellated shapes such that they may be nested together to constitute a rectangular parellelepiped, suitable for efficient storage and shipping. Each component also has a flat side. The shape set is further defined such that many aesthetically attractive, sculpture-like configurations may be created through installation of the components on a flat surface of a building such as a wall or ceiling, while substantially modifying the acoustic properties of the building feature. Acoustically absorptive, reflective, and diffusive components can be used in combinations with each other in order to achieve desired acoustic treatment of the building feature. Several methods of fabrication of the acoustic components are disclosed.

48 Claims, 145 Drawing Sheets

U.S. PATENT DOCUMENTS

| | | | | |
|---|---|---|---|---|
| 6,112,852 | A * | 9/2000 | D'Antonio et al. | 181/295 |
| 6,772,859 | B2 * | 8/2004 | D'Antonio et al. | 181/293 |
| 6,793,037 | B1 * | 9/2004 | Babuke et al. | 181/293 |
| 7,178,630 | B1 * | 2/2007 | Perdue | 181/290 |
| 7,314,114 | B2 * | 1/2008 | Gardner et al. | 181/293 |
| 7,428,948 | B2 * | 9/2008 | D'Antonio et al. | 181/293 |
| 7,520,370 | B2 | 4/2009 | Gudim | |
| 7,534,949 | B1 | 5/2009 | Estes | |
| 2003/0006092 | A1 * | 1/2003 | D'Antonio et al. | 181/293 |
| 2006/0260870 | A1 * | 11/2006 | Nakagawa et al. | 181/295 |
| 2007/0267248 | A1 * | 11/2007 | Gudim | 181/293 |
| 2008/0308349 | A2 * | 12/2008 | Magyari | 181/295 |

OTHER PUBLICATIONS

Auralex Studio Foam Wedge 2-Inch@TrueSoundControl.com, downloaded May 14, 2005 from http://truesoundcontrol.com/products/2SFW24.html.

Sunburst Broadband Absorbers Acoustic foam sound absorption product, downloaded May 14, 2005 from http://www.auralex.com/acoustic_foam_sunburst/acoustic_foam_sunburst.

VersaTile Broadband Absorber Acoustic foam sound absorption product, downloaded May 14, 2005 from http://www.auralex.com/acoustic_foam_versatile/acoustic foam versatile.

General Concepts, downloaded May 14, 2005 from http://home.tir.com/~ms/concepts/concepts.html.

Room Acoustics,downloaded on May 14, 2005 from http://home.tir.com/~ms/roomacoustics/roomacoustics.html.

pArtScience, "AudioTile Shockwave Intallation Guidelines", retrieved on Aug. 8, 2009 from http://www.music123.com.

Expert Audio Center, retail listing for Auralex pArtScience Audio Tile ShockWave, 24-pack, retrieved on Aug. 8, 2009 from http://expertaudiocenter.com.

Full Compass, retail listing for Auralex pArtScience Audio Tile ShockWave, 96-pack, retrieved on Aug. 8, 2009 from http://www.fullcompass.com.

Music 123, retail listing for Auralex pArtScience Audio Tile ShockWave, retrieved on Aug. 8, 2009 from http://www.music123.com.

Pro-Audio-Warehouse, retail listing for Auralex pArtScience Audio Tile ShockWave, 96-pack, retrieved on Aug. 8, 2009 from http://www.pro-audio-warehouse.com.

Sam Ash, retail listing for Auralex pArtScience Audio Tile ShockWave, 24-pack, retrieved on Aug. 8, 2009 from http://www.samash.com.

Sameday Music, retail listing for Auralex pArtScience Audio Tile ShockWave, 96-pack, retrieved on Aug. 8, 2009 from http://www.samedaymusic.com.

Sweetwater, retail listing for Auralex pArtScience Audio Tile ShockWave, 48-pack, retrieved on Aug. 8, 2009 from http://www.sweetwater.com.

The Woodwind & Brasswind,retail listing for Auralex pArtScience Audio Tile ShockWave, 24-pack, retrieved on Aug. 8, 2009 from http://www.wwbw.com.

Zzounds, retail listing for Auralex pArtScience Audio Tile ShockWave, 24 and 96 packs, retrieved on Aug. 8, 2009 from http://www.zzounds.com.

Russ Berger Design Group, personnel biography for R. Berger, retrieved Sep. 8, 2009 from http://www.rbdg.com.

Russ Berger Design Group, personnel biography for C. Chiles, retrieved Sep. 8, 2009 from http://www.rbdg.com.

Russ Berger Design Group, personnel biography for R. Schrag, retrieved Sep. 8, 2009 from http://www.rbdg.com.

* cited by examiner

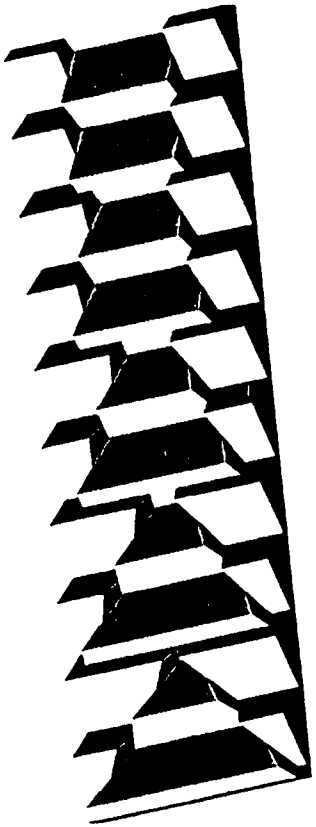
Fig. 6d
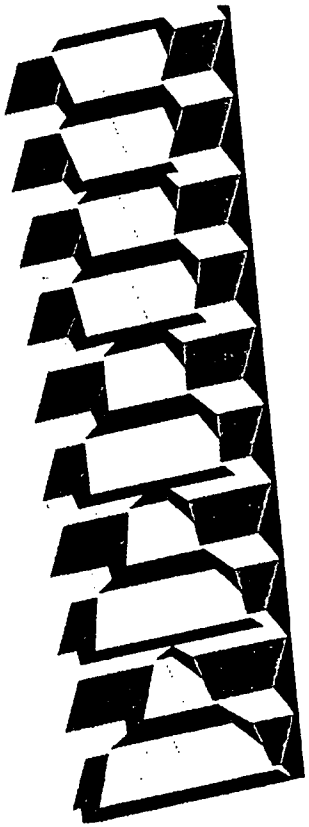
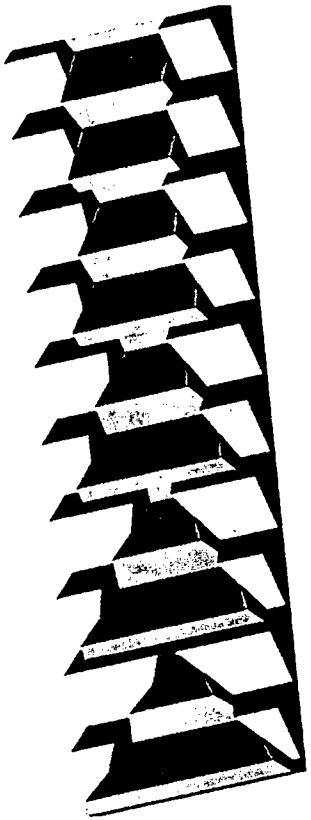
Fig. 6c
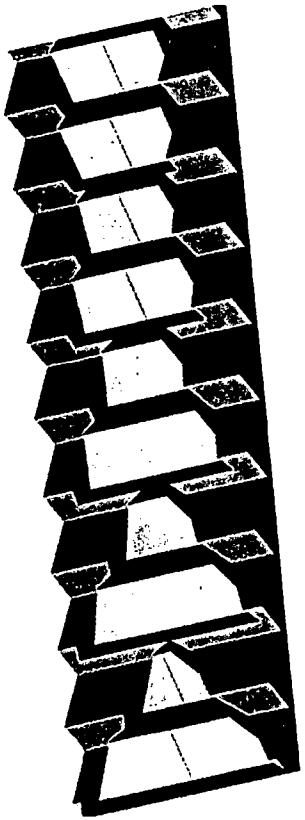

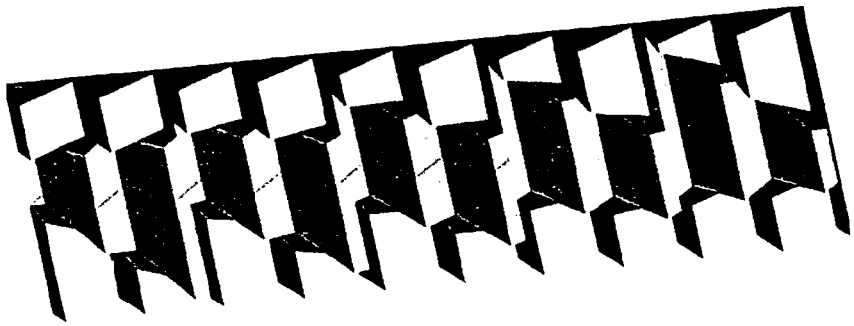
Fig. 6f
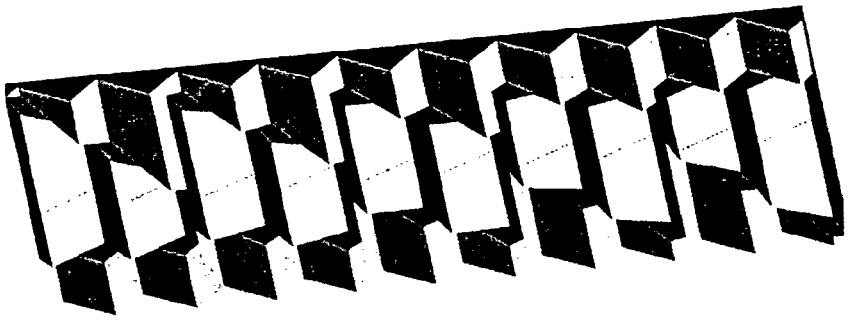
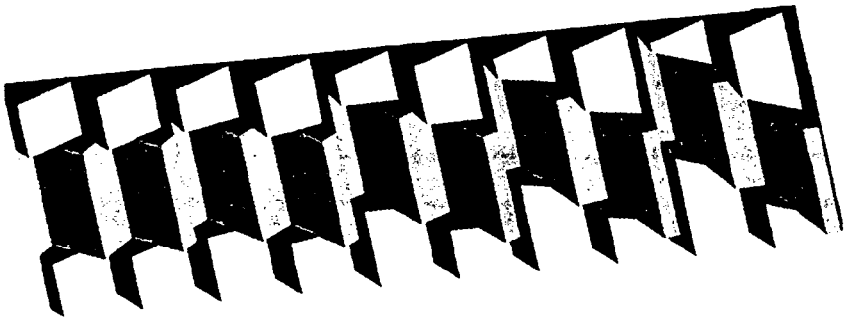
Fig. 6e
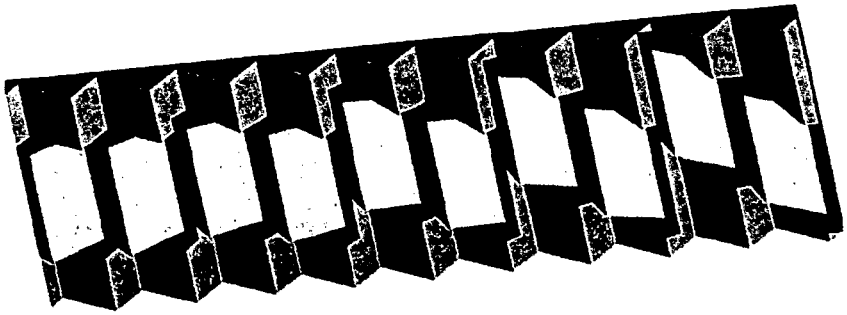

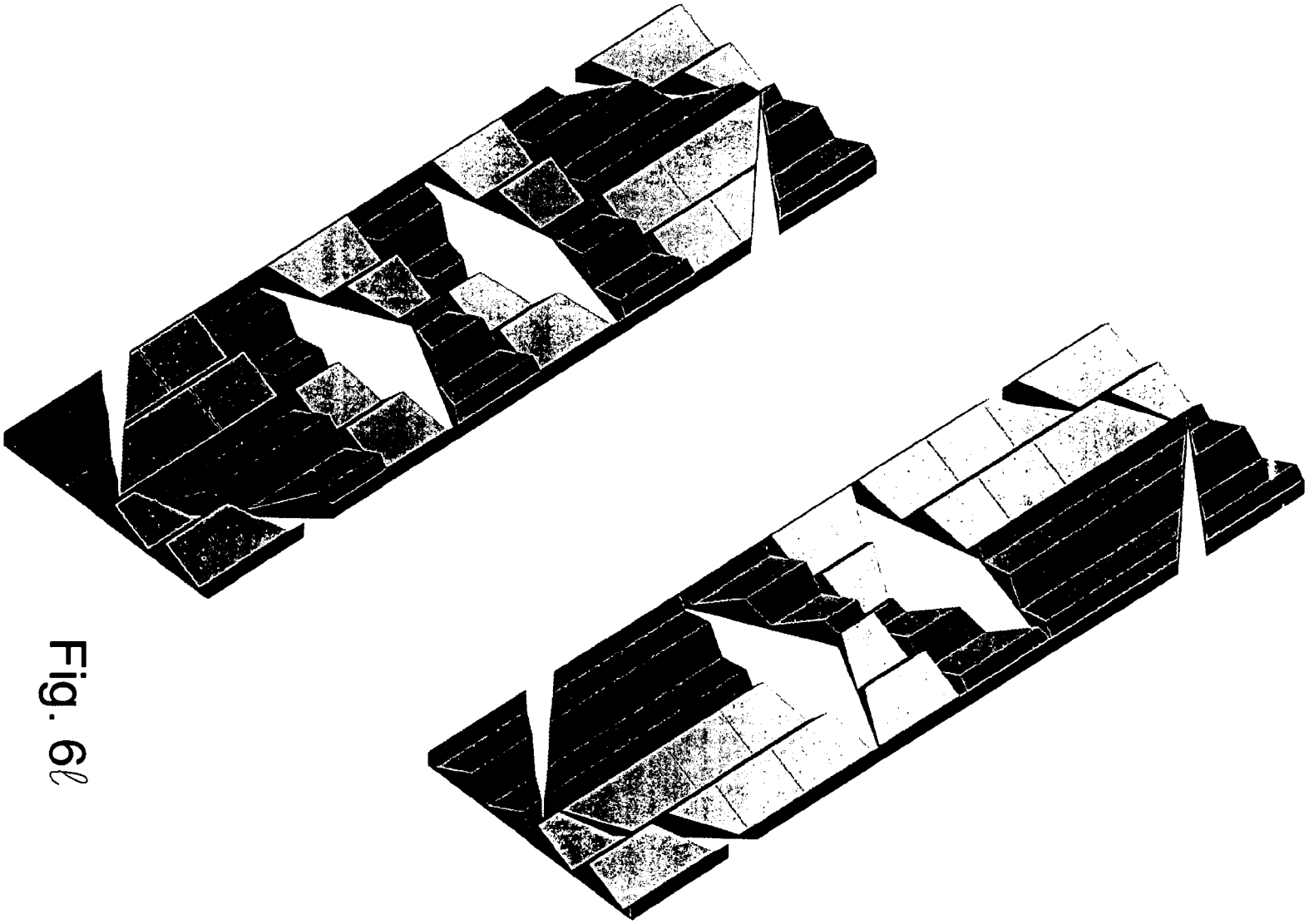
Fig. 6ℓ

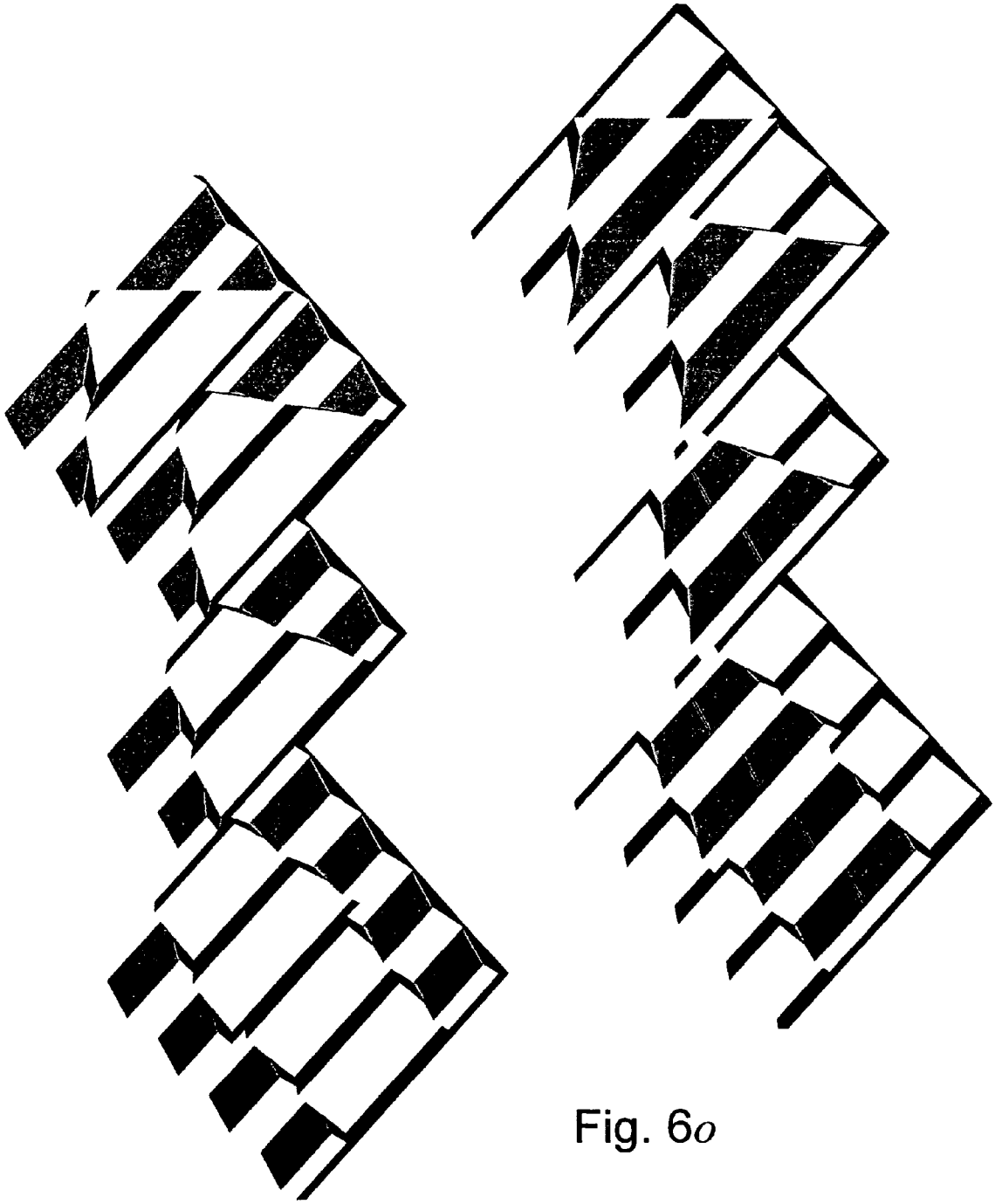
Fig. 6*o*

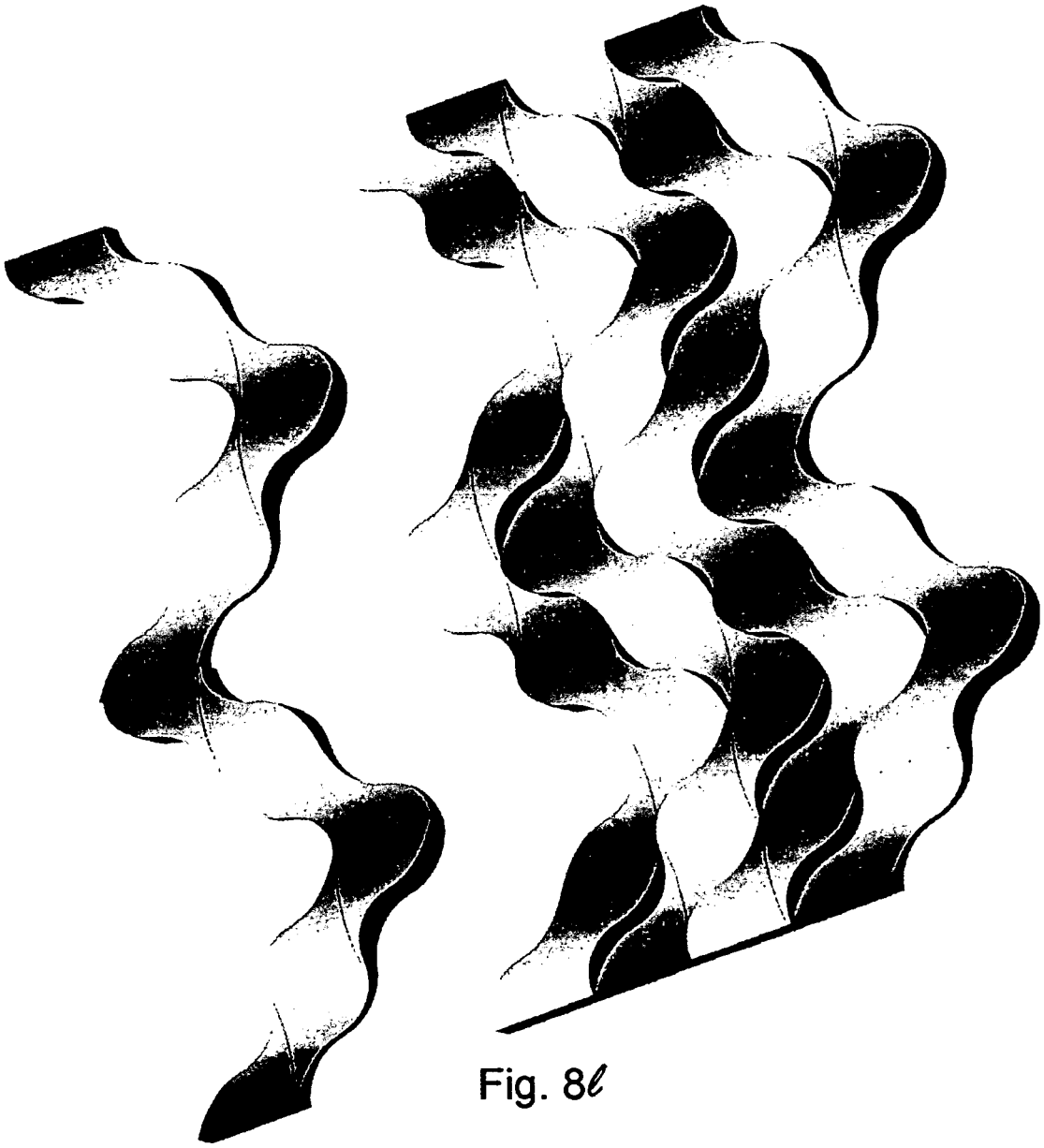
Fig. 8ℓ

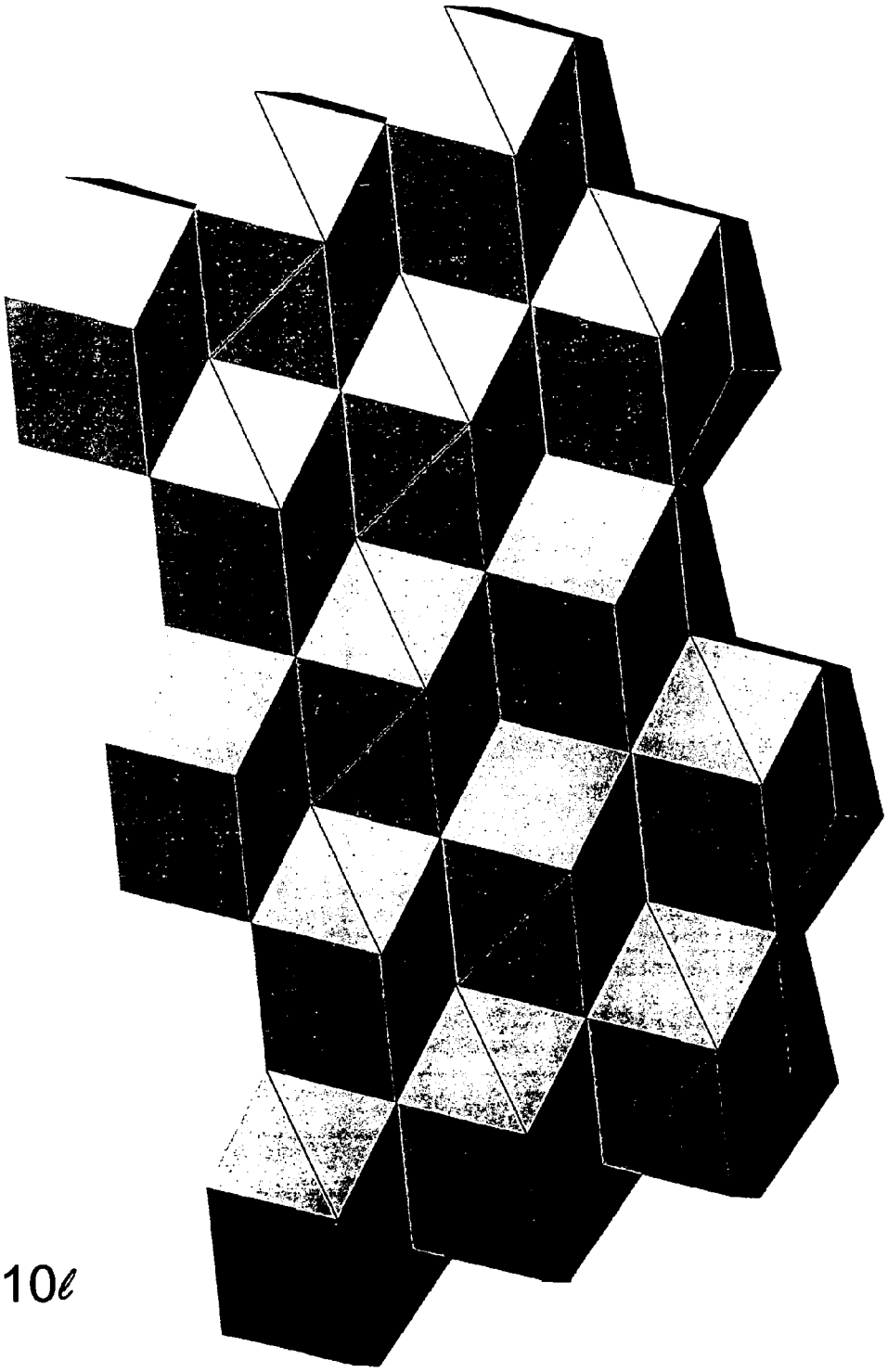
Fig. 10ℓ

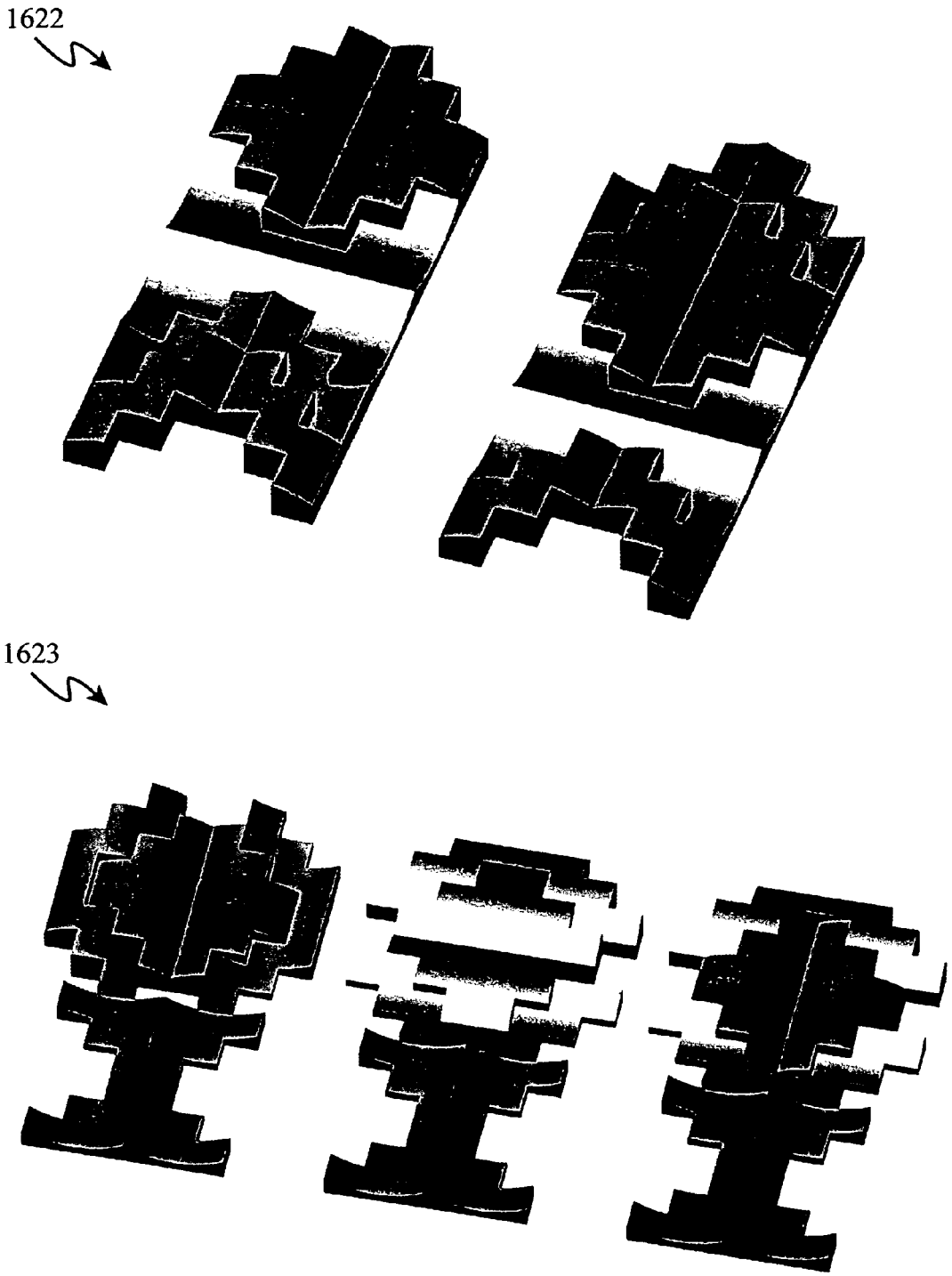
Fig. 16*l*

1626

1627

1628

1629

THREE-DIMENSIONAL TESSELLATED ACOUSTIC COMPONENTS

CROSS-REFERENCE TO RELATED APPLICATIONS (CLAIMING BENEFIT UNDER 35 U.S.C. 120)

This application claims benefit to U.S. provisional patent application No. 60/714,455 which evidences constructive reduction to practice of at least one embodiment of the present invention.

FEDERALLY SPONSORED RESEARCH AND DEVELOPMENT STATEMENT

This invention was not developed in conjunction with any Federally sponsored contract.

MICROFICHE APPENDIX

Not applicable.

INCORPORATION BY REFERENCE

None.

FIELD OF THE INVENTION

This invention relates to treatments for surfaces of rooms to improve or modify the acoustical characteristics of the surfaces, and by extension of the acoustical characteristics of the room, while also providing an aesthetic value.

BACKGROUND OF THE INVENTION

There are numerous types of rooms and spaces where acoustical behavior is important. They include any space where an audience will listen to a live musical performance or the spoken word, or where an audience will listen to prerecorded audio programs. They also include more specialized spaces that are used for recording audio or for monitoring previously recorded audio material.

As a result, acoustical performance is a critical component in recording studios, recital halls and auditoriums, movie theaters, legitimate theaters, music listening rooms, home theaters, music practice rooms, houses of worship, audio and video production rooms, and a variety of other related types of facilities.

The behavior of sound within these rooms is an essential aspect of their function. That behavior depends on the volume of the enclosed space, the shape of that space, and the acoustical characteristics of the surfaces and materials within the space.

Surface treatments can affect the sound that strikes them in three ways: 1) they can reflect the sound, changing its direction of travel, 2) they can absorb the sound, which attenuates the amount of sound within the space, or 3) they can diffuse the sound, spreading out the acoustic energy over time and/or space.

The characteristic acoustical response of a surface varies with the frequency of the incident sound. For example, a surface that is almost completely absorptive to sound at 2000 Hertz (Hz) may be almost completely reflective to sound at 50 Hz. Designers, contractors, and owners of acoustical spaces select surface treatments to enhance the acoustical environment. The selection process involves determining the desired type of surface treatment, its acoustical characteristics with respect to frequency, its placement within the space, its orientation to the possible sources and receivers of sound, and its relationship to the other surfaces within the space and their respective finishes.

Surface treatments can be selected to affect specific reflection paths, or can be chosen based on their influence on the overall acoustical characteristics of the space. The application of these surface treatments may be based on correcting anomalies, or intended to create an overall balance of reflection, absorption, and diffusion for the space as a whole.

One typical surface treatment is foam products, used to cover portions of walls and ceilings. In their traditional application foam products provide broadband sound absorption. They are typically more effective at absorbing sound in the upper portion of the audible frequency range—for example, above 500 Hz—than in the lower portion. Their low-frequency performance is primarily limited by the overall thickness of the material. Foam used for sound absorption is an inexpensive treatment relative to other commercially available alternatives.

Generally, the surface shapes of commercially available foam products are limited to three types: a continuous wedge pattern, a pyramidal pattern, or an "egg crate" (rounded pyramidal or conical) pattern. Generally, these products have only been available as square or rectangular tiles, such as Auralex™ StudioFoam™, and example of the latter being shown in FIG. 17*a* (installed) and FIG. 17*b* (installed on two walls).

Consequently, foam products used as an acoustical surface treatment have had limited aesthetic appeal, partly due to their unit shape, partly due to their simple surface shapes, and partly due to the appearance of the foam material itself. In addition, commercially available foam products have had limited acoustical utility, since in their intended application they have offered only sound absorption, and have not offered any adjustability with respect to frequency response. Indiscriminate application of traditional foam products often leads to an imbalance in acoustical response, especially in presenting too much high-frequency absorption relative to low- and mid-frequency performance.

Therefore, there is a need for an acoustic material which is suitable for application to surfaces in studios, theaters, and performance halls, to selectively enhance the frequency response of the surface, and which provides an aesthetic appearance suitable for use in non-technical environments (e.g. within a private home or public performance hall). Further, there is a need in the art for these materials to be producible at a low cost with high efficiency (e.g. minimized material waste), and to be transportable via standard shipping at minimized costs.

SUMMARY OF INVENTION

The present invention consists of sets of acoustic components having a flat side suitable for application to a surface such as a wall or ceiling. The components are fabricated in a three-dimensional tessellation pattern such that they stack and nest within each other to fit within a substantially rectangular parallelepiped volume, thereby increasing packing density to benefit shipping and storage costs, and in some embodiments, to minimize wasted material during production of the components. Acoustically absorptive components may be manufactured from materials such as acoustic foam, polyester, glass fiber, mineral fiber, or organic fiber. Acoustically non-absorptive components may be produced from wood, plastic, metal, etc.

The invention enables room designers and constructors to alternate absorptive and reflective surfaces which provide characteristics of not only absorption, but also reflection and diffusion. Likewise, when skins are added to the configurations in optional embodiments, those skinned surfaces directly add diffusion to the results, especially when the skinned surfaces are curved.

According to another aspect of the present invention, the shapes of the components are designed such that no or a very small amount of acoustic material is wasted. In some shape sets, cutting techniques can be employed instead of molding techniques, to yield the components from a block of material, which can, in some embodiments, provide production cost advantages. Component sets produced according to the present invention also may benefit shipping costs as the components can be efficiently packaged into a block with minimal wasted space in a carton, thus promoting lower packaging costs and reduced shipping volumes.

Further, the shapes are chosen such that various aesthetically pleasing formations of components can be made with each set of components to produce highly attractive, three-dimensional patterns on the wall or ceiling where they are installed. These formations can provide sculpture-like appearances, which enhance the value of the room in which they are employed.

Additionally, the shape sets allow for some formations which leave portions of the underlying surface exposed, thereby allowing a more selective acoustical effect by introducing acoustical diffusion that results from alternating absorptive and reflective surfaces, and by controlling the overall sound absorption characteristics of the combined surface area.

A further aspect of the present invention provides that with some formations using the tessellated shape sets, certain surfaces of the components may be coated with an acoustically reflective "skin", while others are left with an acoustically absorptive surface, which allows for even more precise control over the balance of absorption, reflection, and diffusion that the surface exhibits, and the relative acoustical performance across different frequency ranges.

BRIEF DESCRIPTION OF DRAWINGS

The patent or application file contains at least one drawing executed in color. Copies of this patent or patent application publication with color drawings will be provided by the Office upon request and payment of the necessary fee. The following detailed description when taken in conjunction with the figures presented herein provide a complete disclosure of the invention.

DESCRIPTION OF THE INVENTION

Figure 1:
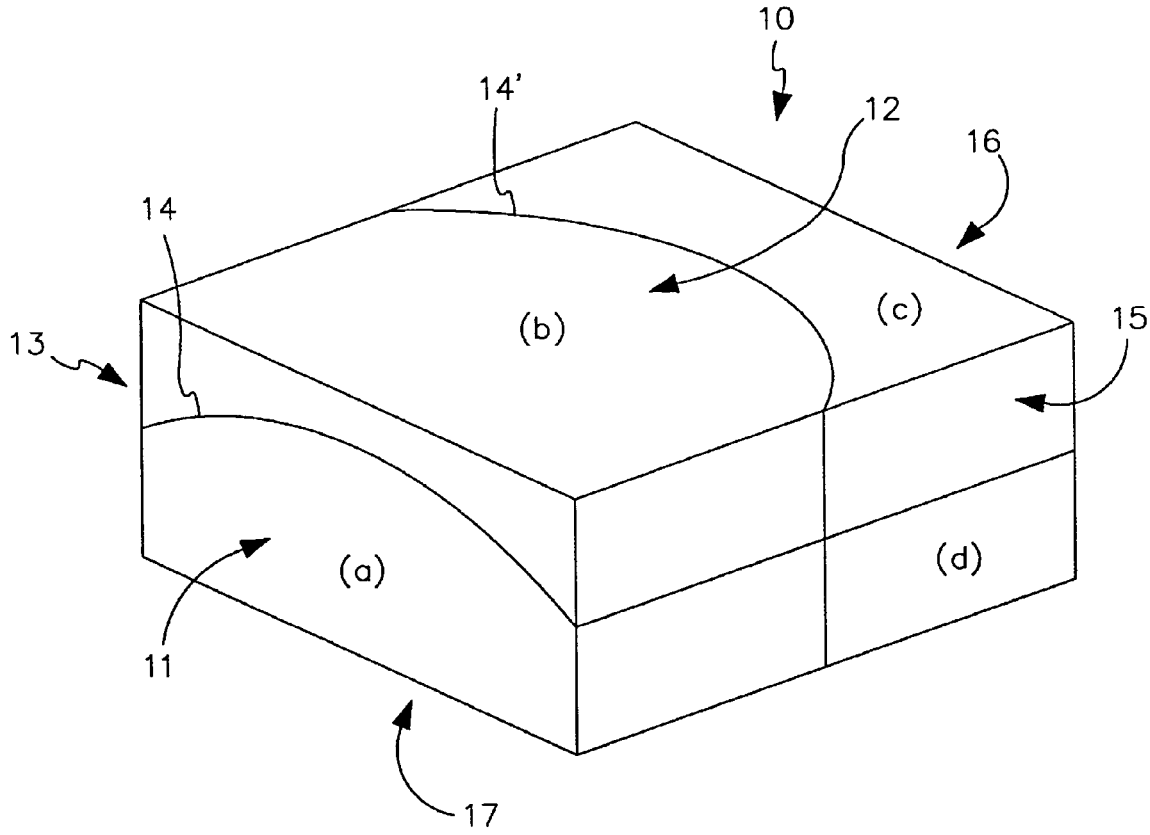
FIG. 1 shows a frontal view of a solid open-cell acoustic foam block that can be cut into four separate pieces.

When designing an acoustically critical space, such as a recording studio, various building materials are used to help address typical acoustic problems. One of these materials is cellular foam, which is used to absorb sound within a space. These foams can be described as a mass of bubbles composed of plastic and gas. The walls of the bubbles are distributed with plastic. These bubbles are referred to as cells, while the walls are known as windows.

Typically, there are two types of cellular foam: open cell and closed cell. A foam that is made up of open windows leaving many cells connected, so gas such as air may pass from one cell to another, is known as "open cell" foam. "Closed cell" foam does not conduct air from cell to cell. The air pockets in an open cell foam more readily absorb sound than closed cell foam, in general.

Our general embodiment of the present invention includes production methods and the products comprising tessellated three-dimensional ("3D") acoustic foam components, which not only resolve acoustic problems, but also address aesthetic value in interior design. U.S. provisional patent application No. 60/714,455 described one embodiment of the present invention, which is set forth in the following paragraphs. Further, additional alternate embodiments and additional methods of manufacture are disclosed, as well.

For the purposes of this disclosure, we will use the term "tessellated" as being a three-dimensional geometric relationship between multiple parts or components in which they may be rotated and repositioned to form a solid shape. "Block tessellated" is used to describe an aspect of the invention in which multiple components are formed and shaped such that they may be reassembled into a generally rectangular volume through rotation, repositioning and stacking. "Three dimensional planar tessellated" is used to describe an aspect of the sets of components in which they may also be rotated and repositioned to form a common, co-planar or bi-planar arrangement suitable for installation to a surface such as a wall or ceiling. "Cutting in at least two dimensions" is generally used to describe an aspect of an available method of fabrication of the components by cutting through a block of material in at least two of the following dimensions:

(a) front-to-back dimension;

(b) side-to-side dimension; and (c) top-to-bottom dimension.

Throughout this disclosure, a reference to a dimension as being "front-to-back" shall not imply that cutting is only performed in a direction of travel starting at the front surface proceeding to a back surface. Instead, such a convention is adopted for reference only, and cutting along the line may be in practice performed in any direction deemed appropriate, including back-to-front, as well as stamping the cut. Similarly, references such as "top-to-bottom", "side-to-side", etc., are to be understood and interpreted liberally, without restriction as to actual direction of travel of a cutting instrument.

In this disclosure we shall also refer to methods of manufacture as "cutting" to mean and include profile cutting, wire cutting, hot-knife cutting, laser cutting, water knife cutting, and other forms of cutting along which a cut is generally made linearly between two points.

"Molding" will be used to describe traditional processes in which a cavity (e.g. the mold) is produced using any number of well-known methods, the cavity in this case defining the shape of one or more components where the shapes have the tessellated relationship to each other. Molds can be created from a "positive" of each component, by data-driven mold fabrication systems using computer-aided design to define the shapes, or by other suitable means. Molding of the parts refers to various known methods for transforming a raw material, such as acoustical foam, polyester, glass fiber, mineral fiber, or organic fiber, into a final shape, including but not related to blow molding, injection molding, vacuum forming, and stamping.

Although one available method of fabrication generally employs cutting techniques, alternate techniques of molding, compression, and shaping may also be employed to yield the components of the invention. In practice, cutting may be used in combination with molding, stamping, die cutting, and shaping techniques to yield certain products.

Also, throughout this disclosure, we will refer to "edges" of components as being surfaces of the product components which are substantially perpendicular to the substrate surface on which the components are installed (e.g. the wall, floor, ceiling, etc.). Likewise, the term "surface" shall refer to the outer or exposed surface of the product components which are substantially parallel to the substrate surface on which the components are installed and substantially directly opposite a mounting surface, when the term is not otherwise specifically annotated to mean any other surface.

In the following paragraphs, disclosure of a method to fabricate the components using cutting from a block of material will be used to simultaneously illustrate one available method of manufacture, as well as the inter-relationship of the shapes of the components. However, it will be readily recognized by those skilled in the art that the same set of shapes of components may be fabricated using alternative methods, such as molding, stamping, or shaping, so long as the relationship between the component shapes remains three-dimensionally tessellated (e.g. complementarily tessellated).

Three-Dimensional Tessellated Geometric Components

Figure 2:
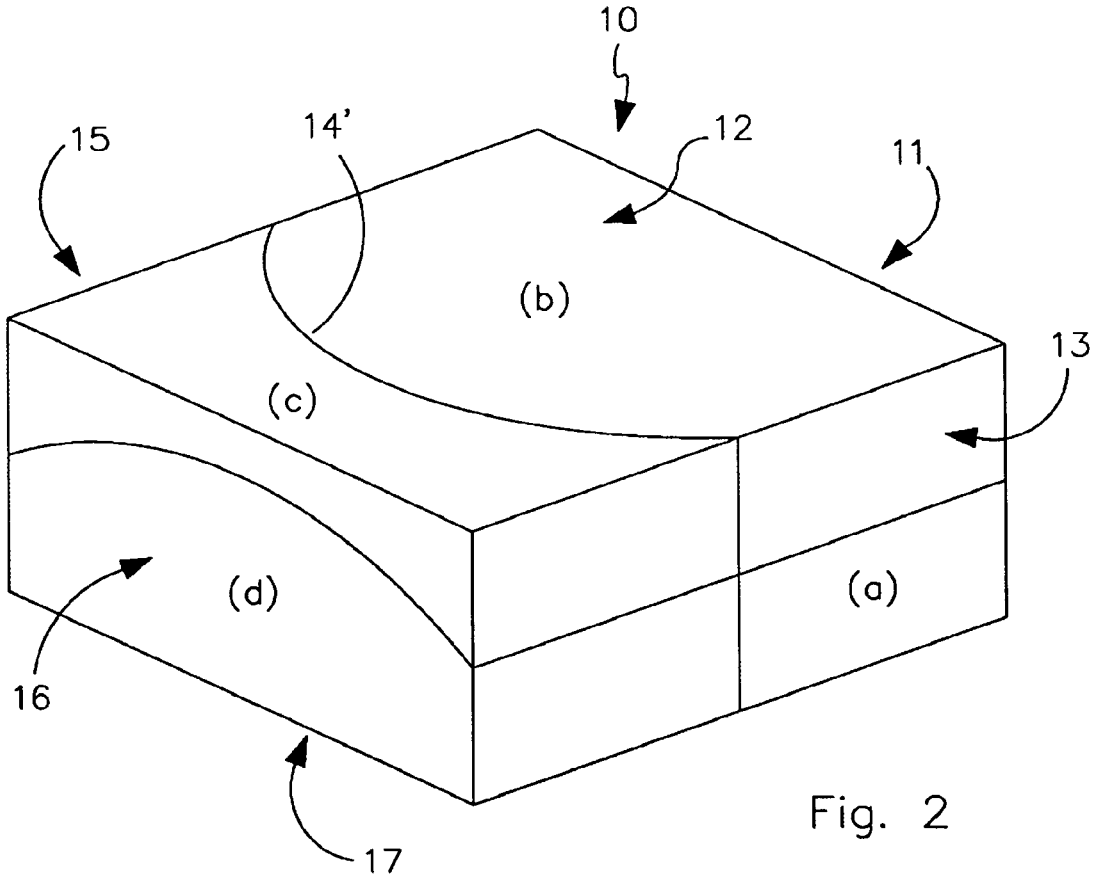
FIG. 2 depicts the rear view of the block of FIG. 1.

Turning to FIG. 1, the diagram shows an example of a set of three-dimensional tessellated geometric components using a frontal view of a solid acoustic foam portion having a substantially rectangular parallelepiped shape (10) having a front side (11), aback side (16), a right side (15), and a left side (13), which is cut into four separate pieces (a), (b), (c) and (d), by cutting along the lines from front-to-back (14), from top-to-bottom (14'). FIG. 2 provides a rear view of the same block (10) with the same cutting lines to yield the same tessellated components. Other suitable methods of yielding the components of these shapes are disclosed herein.

According to these two figures, using a foam cutting tool, the cuts are accomplished in any desirable order. This results in four separate smaller foam pieces (a), (b), (c) and (d), which are co-planar three-dimensional tessellated geometric components relative to each other.

Figure 3:
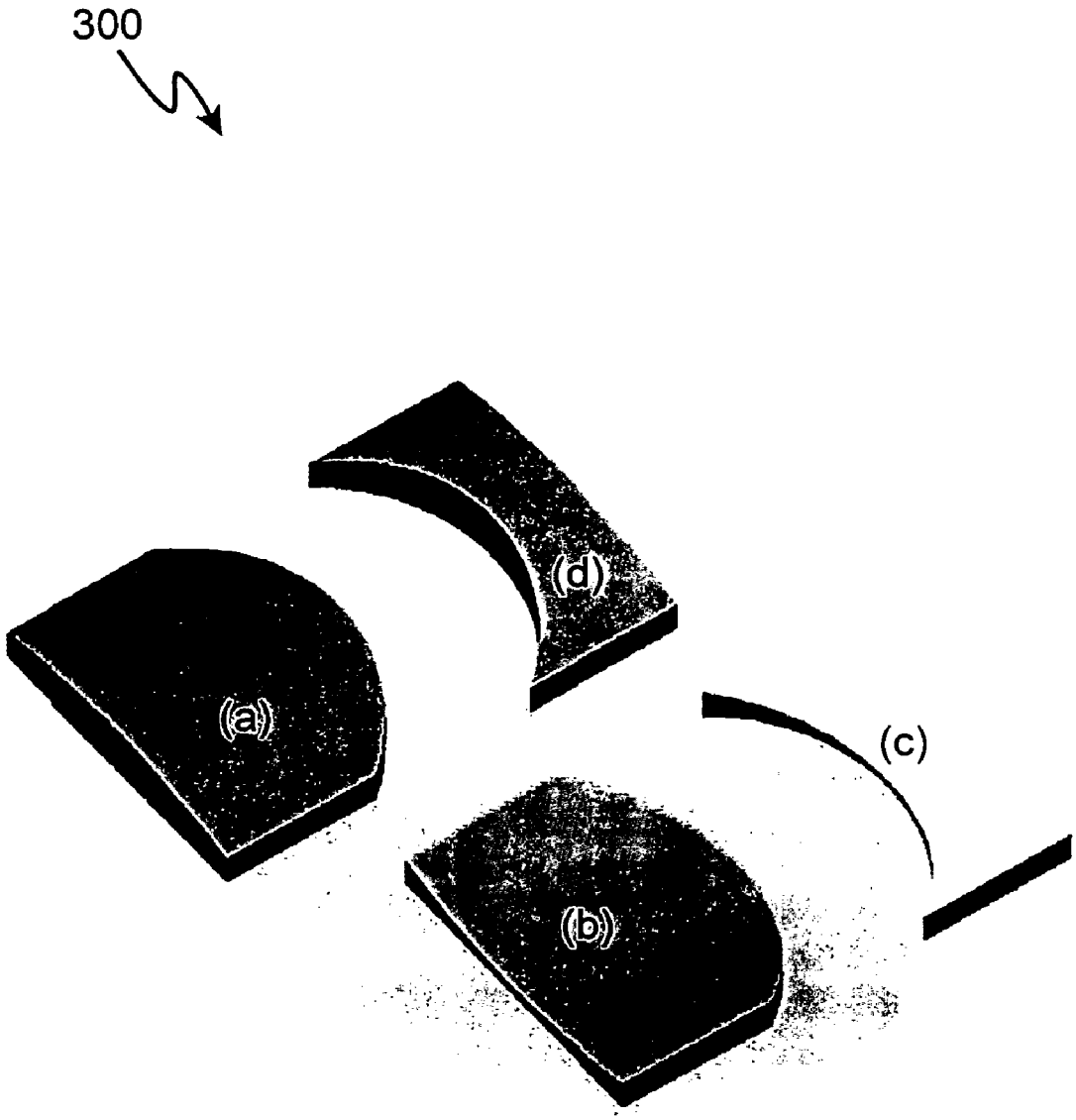
FIG. 3 represents four individual co-planar tessellated geometric components yielded from a block such as that in FIG. 1 as a result of fabrication according to the invention.

Turning to FIG. 3, individual components (a), (b), (c) and (d) are shown separated from their initial position of FIGS. 1 and 2, and rotated and repositioned in a manner such that one surface of each component is co-planar with a surface of each of the other components in the set. In this particular design of a set of components, each component yielded from the manufacturing process has a unique shape from the other components. Using these tessellated geometric shapes, the installer has the ability to arrange the shapes in various patterns and formations including not just rectangles and squares, but also three-dimensionally sculpted polygons, shapes, and contours.

Figure 4A:
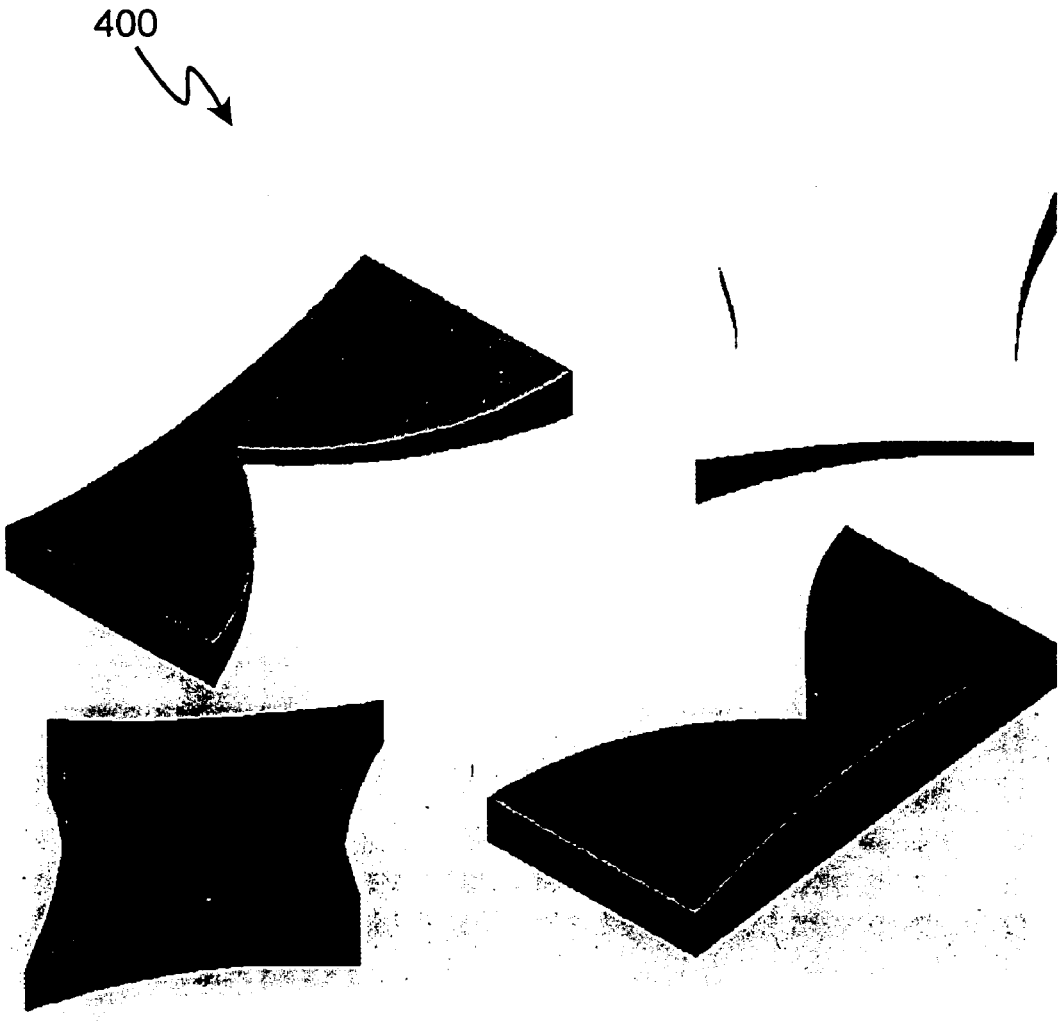
FIGS. 4*a* and 4*b* illustrate another embodiment of the invention, including an arrangement as installed on a wall or ceiling.
Figure 4B:
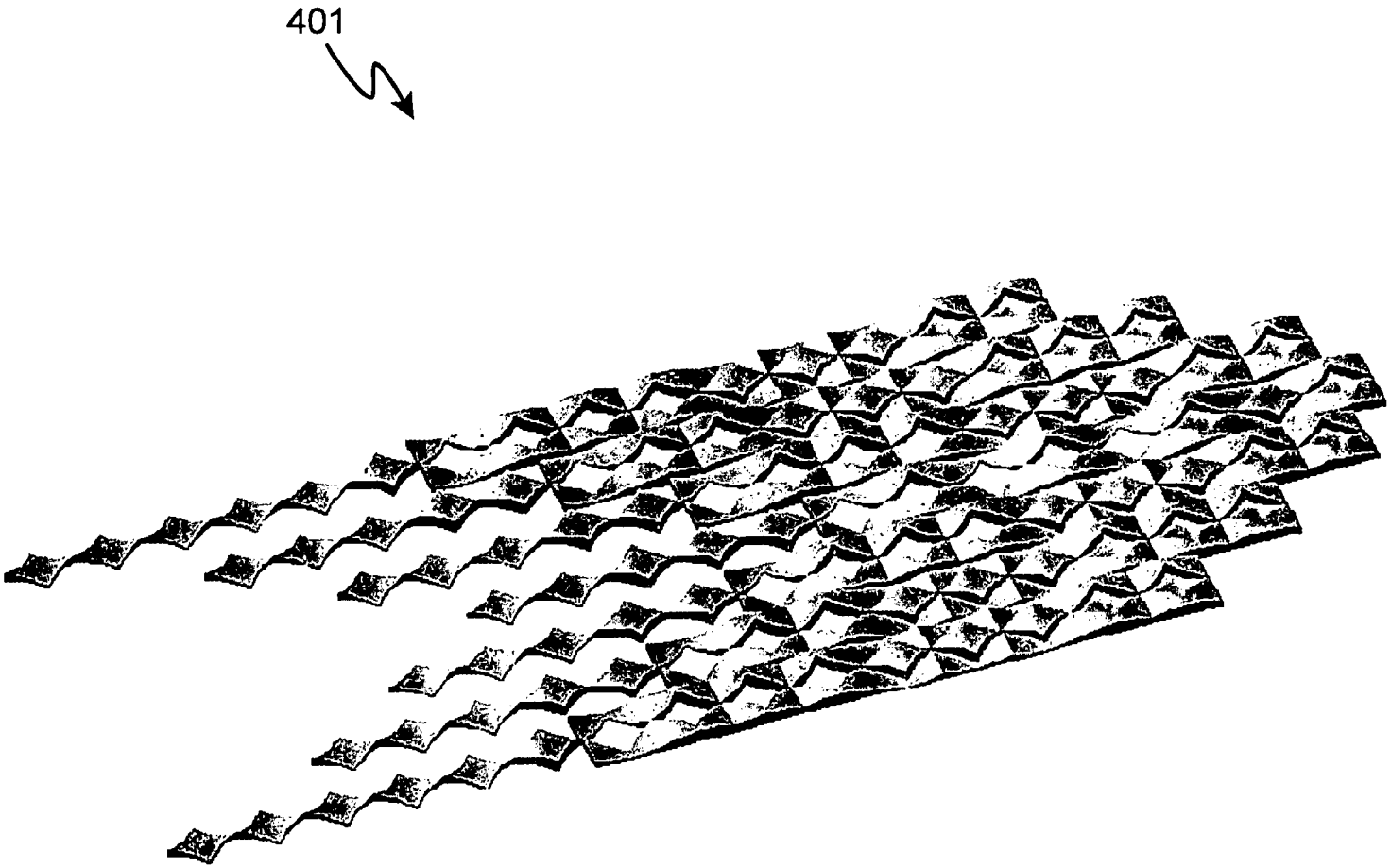

FIG. 4*b* shows one such available installation formation (401) of another set of components (400) as shown in FIG. 4*a*, which are also produced by cutting a rectangular parallelepiped portion of foam using the techniques of co-planar three-dimensional tessellation, including the minimum package configuration for shipping this example set of components.

Figure 5A:
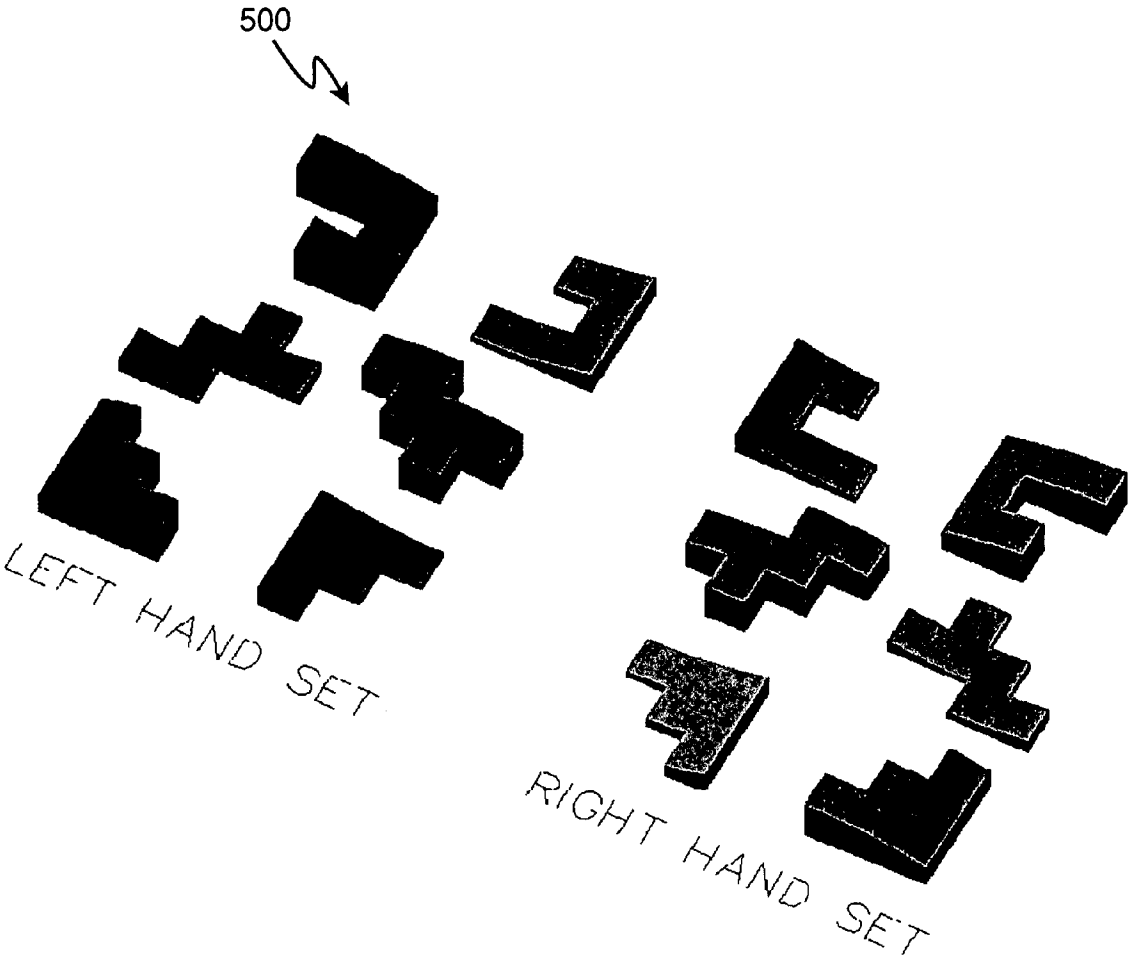
FIGS. 5*a* through 5*h* illustrate another embodiment of the invention, several arrangements as installed on a wall or ceiling, and a packing/unpacking configuration.
Figure 5B:
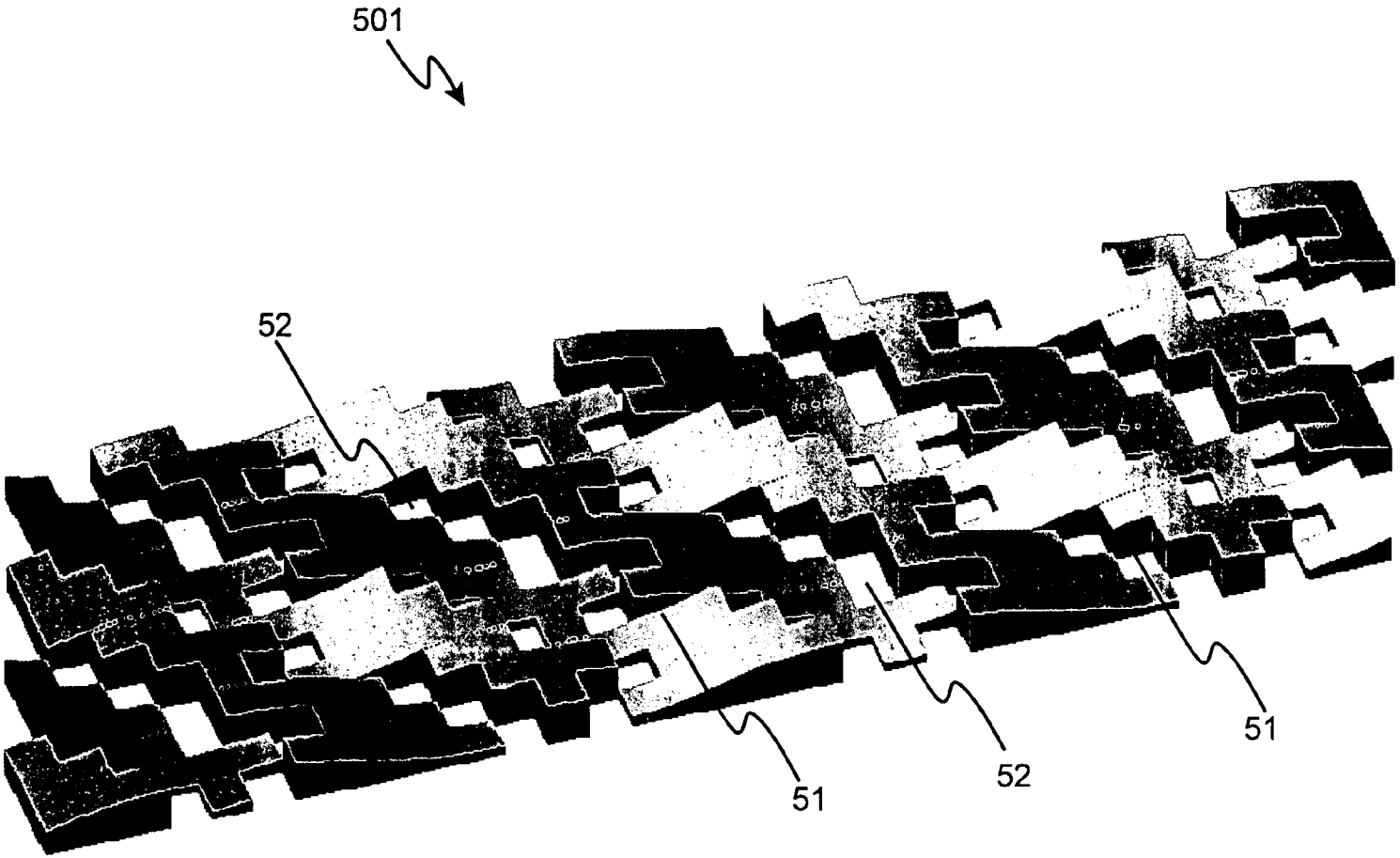
Figure 5C:
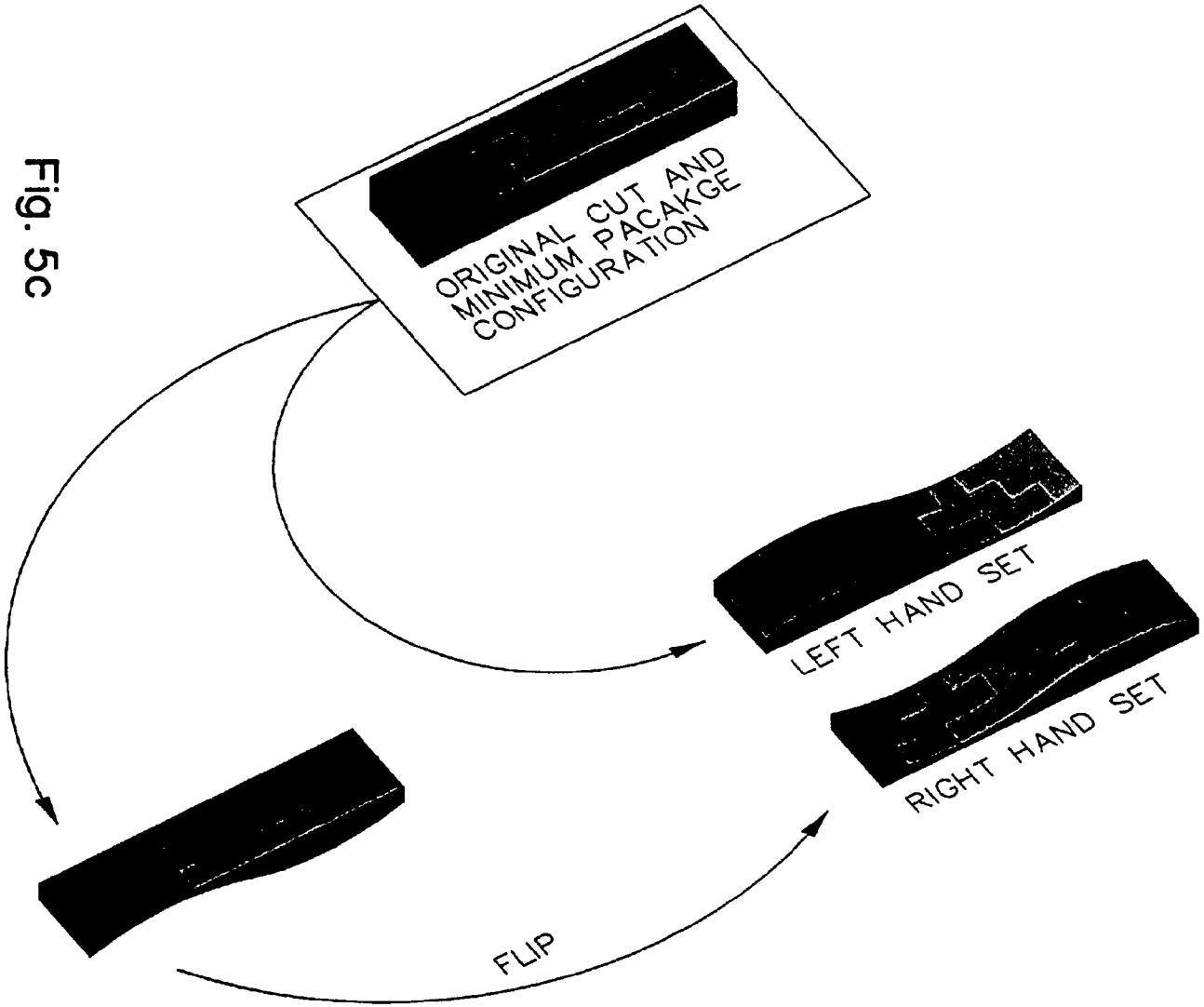
Figure 5D:
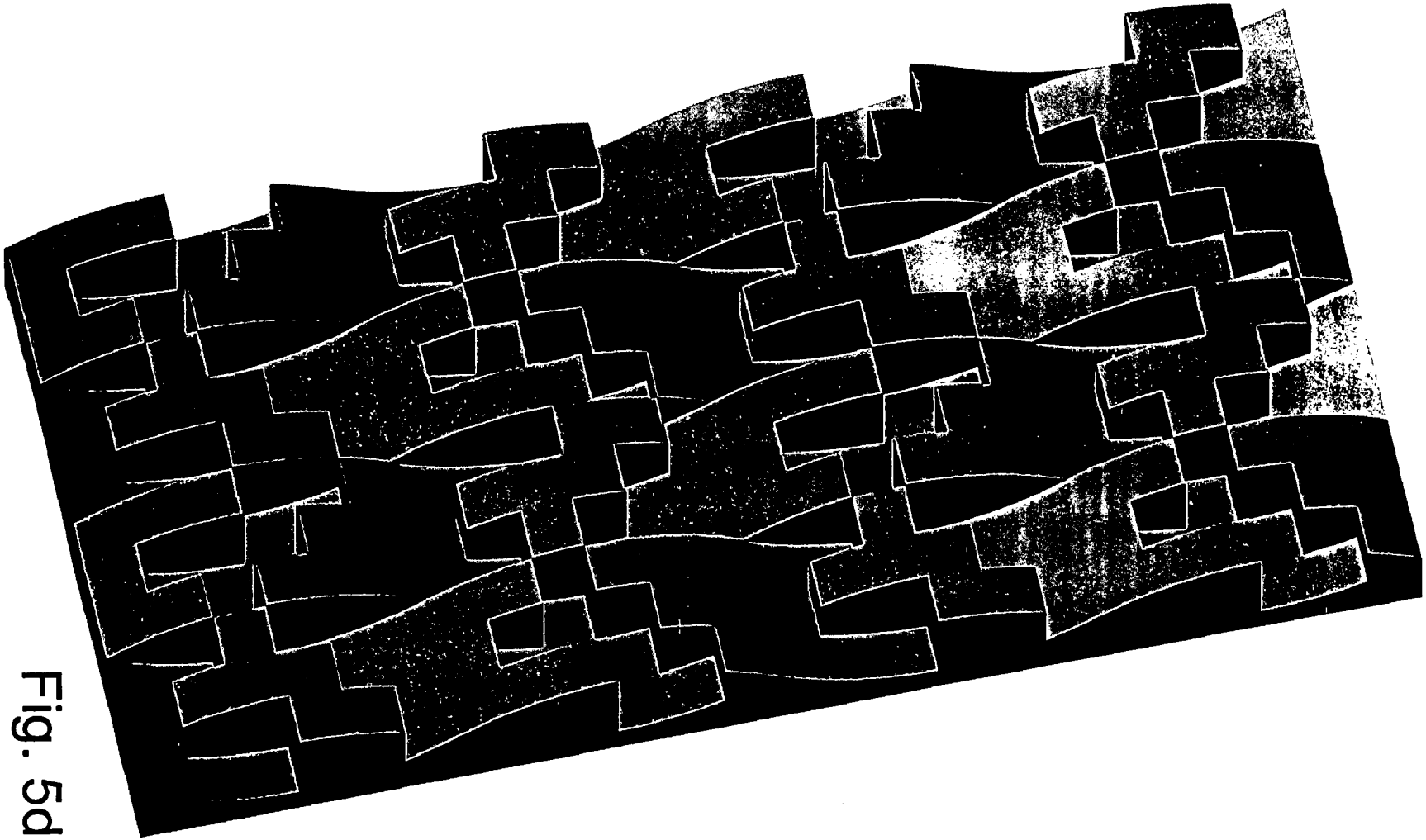
Figure 5E:
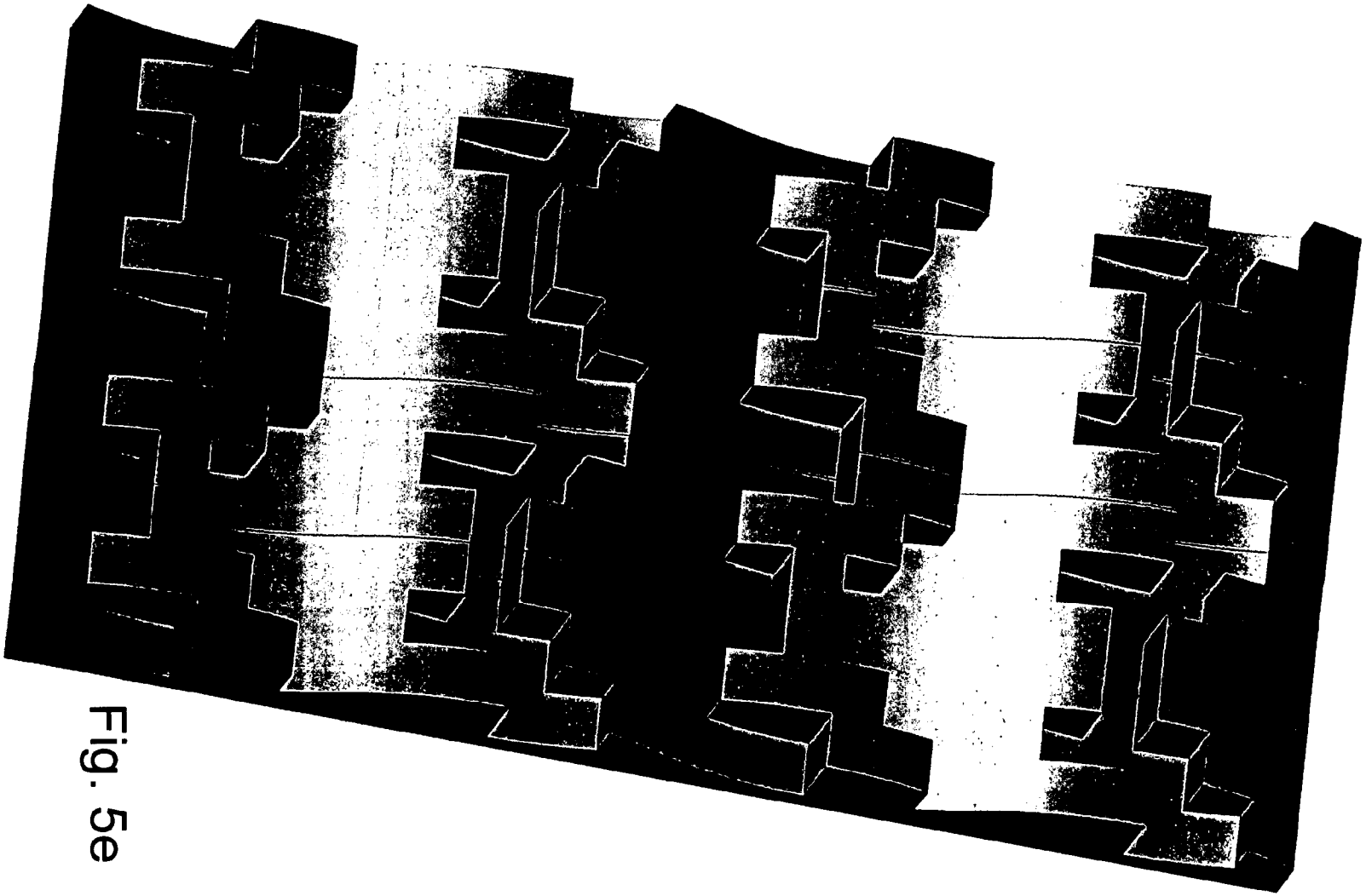
Figure 5F:
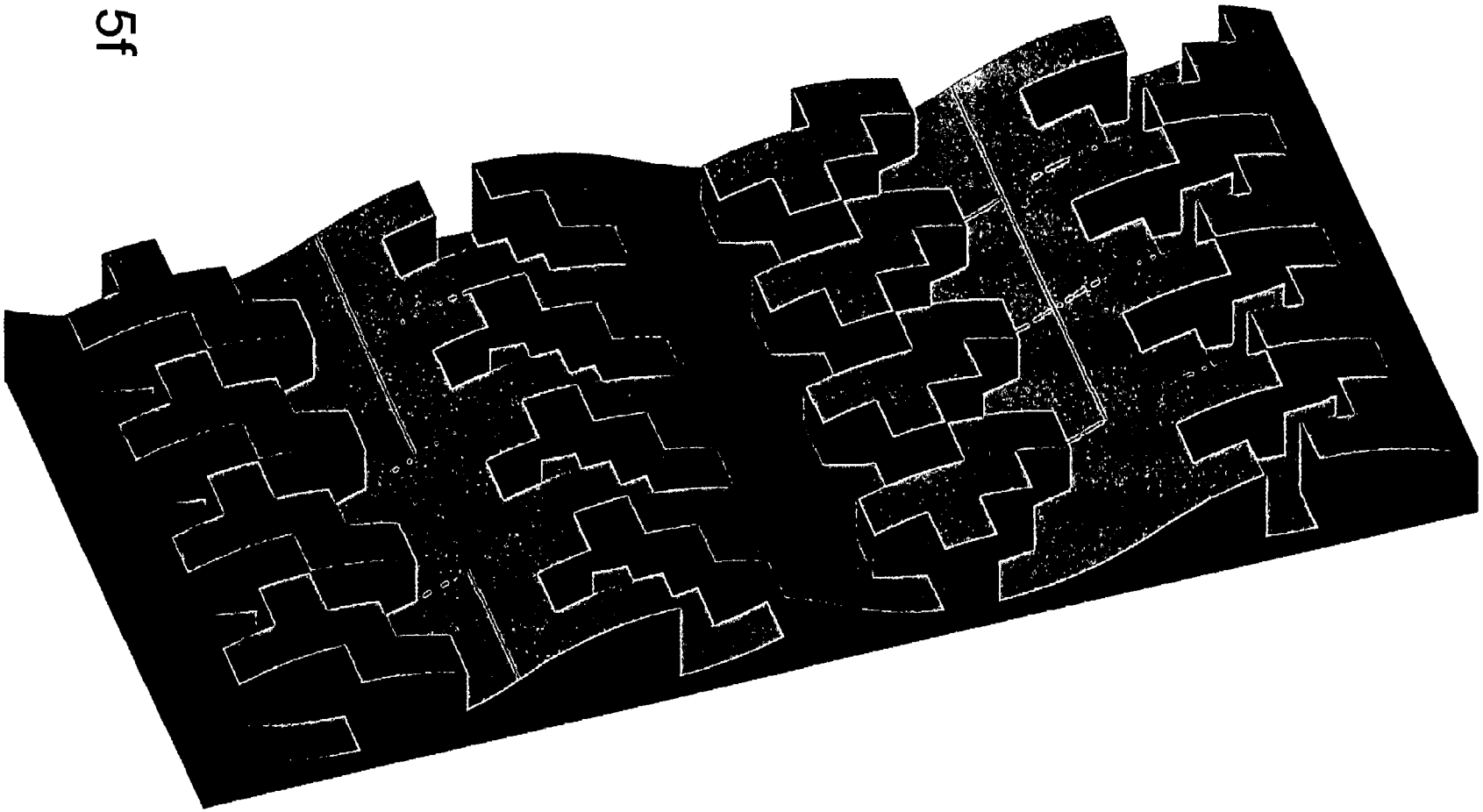
Figure 5G:
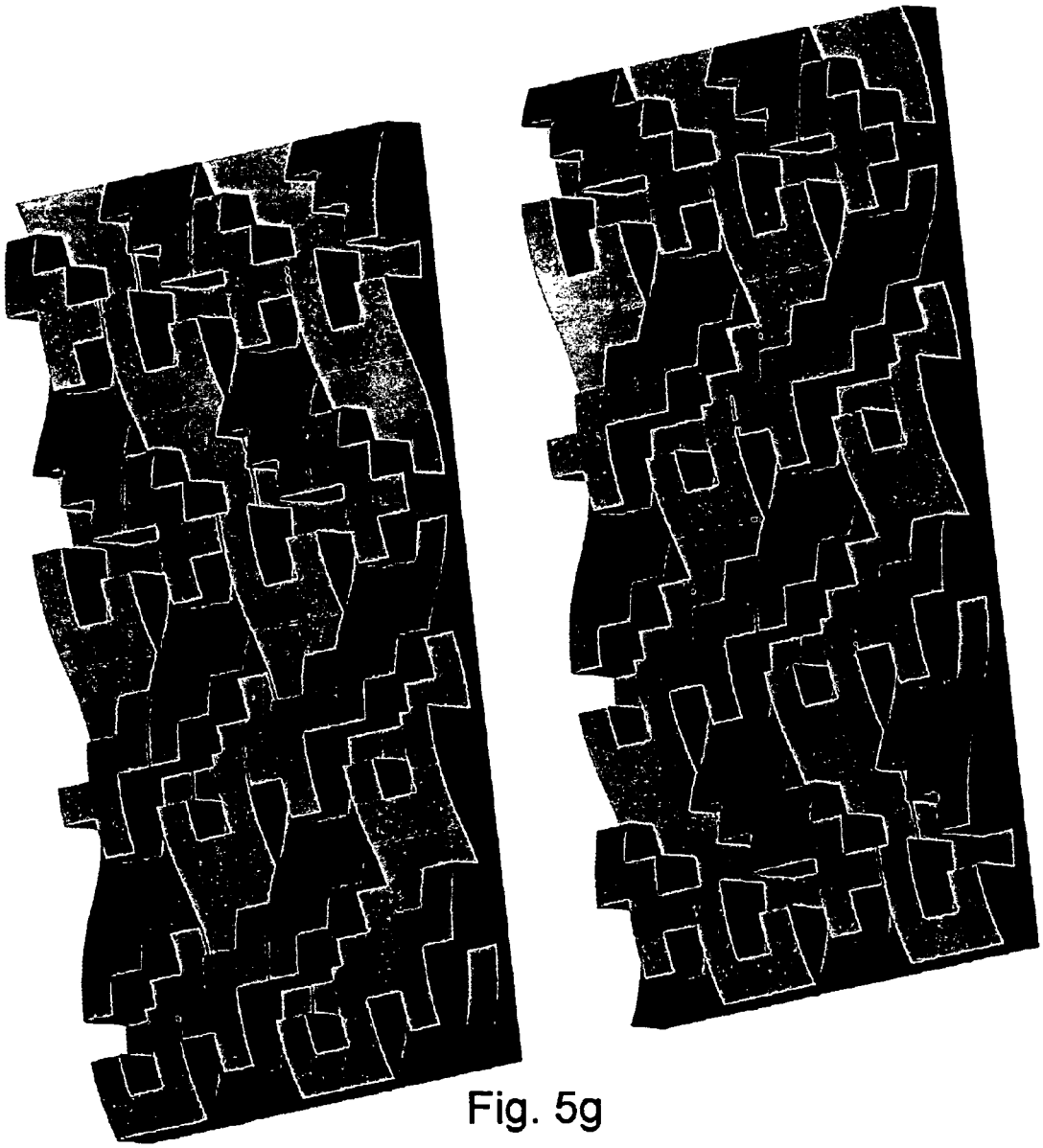
Figure 5H:
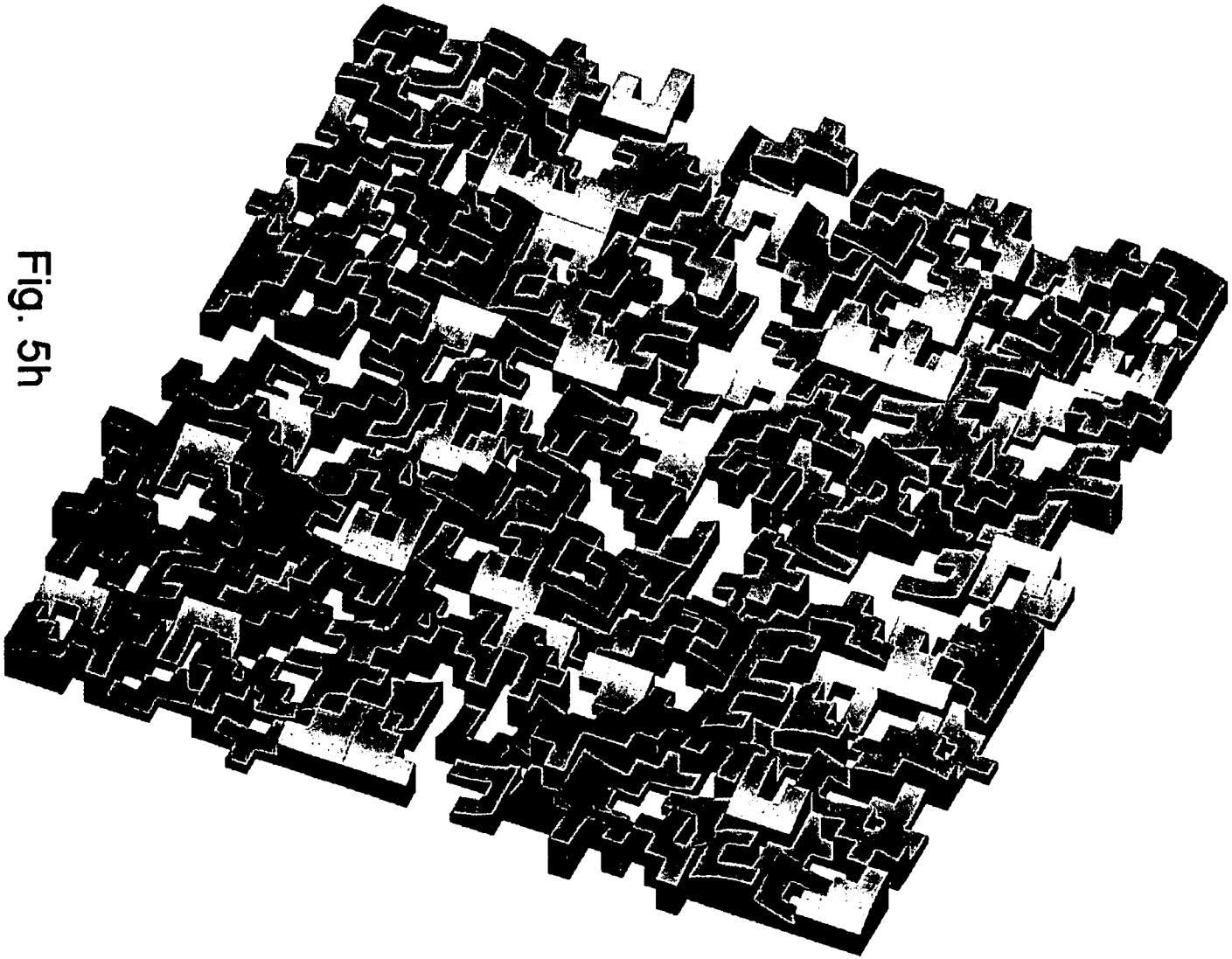

FIG. 5*a* shows yet another set of co-planar three-dimensional tessellated components (500), with an unpacking and arrangement process shown in FIG. 5*c*, and one possible co-planar installation shown in FIG. 5*b* (501). In this example, one set (e.g. the left hand set) is symmetrical to the other set (e.g. the right hand set). This arrangement (501) shows two available features upon installation, components with exposed component edges (51), and exposed portions (52) of the substrate (e.g. wall, ceiling, panel, etc.) on which the components are mounted. When sound is present in a room, it can strike these exposed edges (51) and exposed areas of substrate (52), as well as the surfaces of the components. Reflection from the exposed areas of substrate (52) also allow for some amount of sound energy reflection, absorption, or diffusion, depending on the characteristics of the substrate.

Skins and Veneers on Components

The component surfaces may optionally be selectively treated with a reflective coating or "skin" to allow a degree of reflection of sound energy from the pattern of components. In embodiments of the invention employing skins, veneers, or both, exposed component edges of the foam will continue to absorb while the curved skin surfaces will provide excellent diffusion characteristics. As such, the skins can be applied in a variety ways to produce different acoustical results, depending on the requirements of the room or the desired effect. Further, with part or all of the surfaces of the applied design being covered with a skin or veneer, a wide range of aesthetic possibilities are available to the room designer.

Figure 9A:
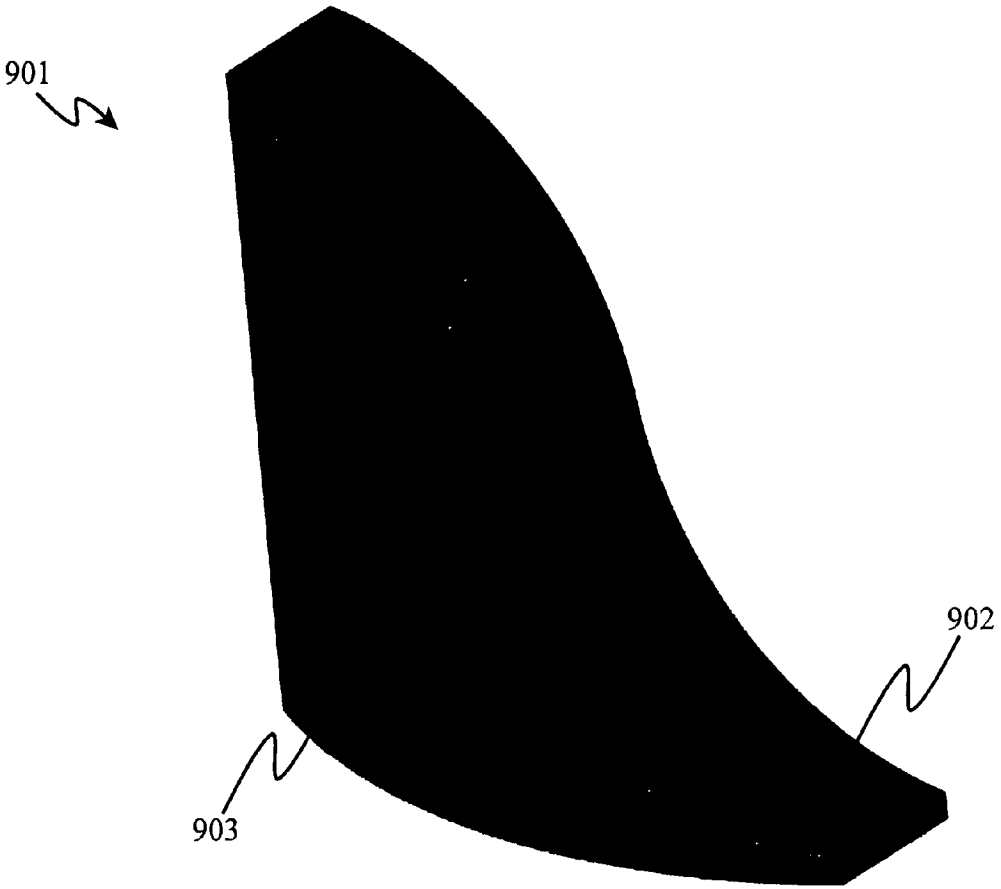
FIGS. 9*a* through 9*c* illustrate skins and veneers according to the present invention.
Figure 9B:
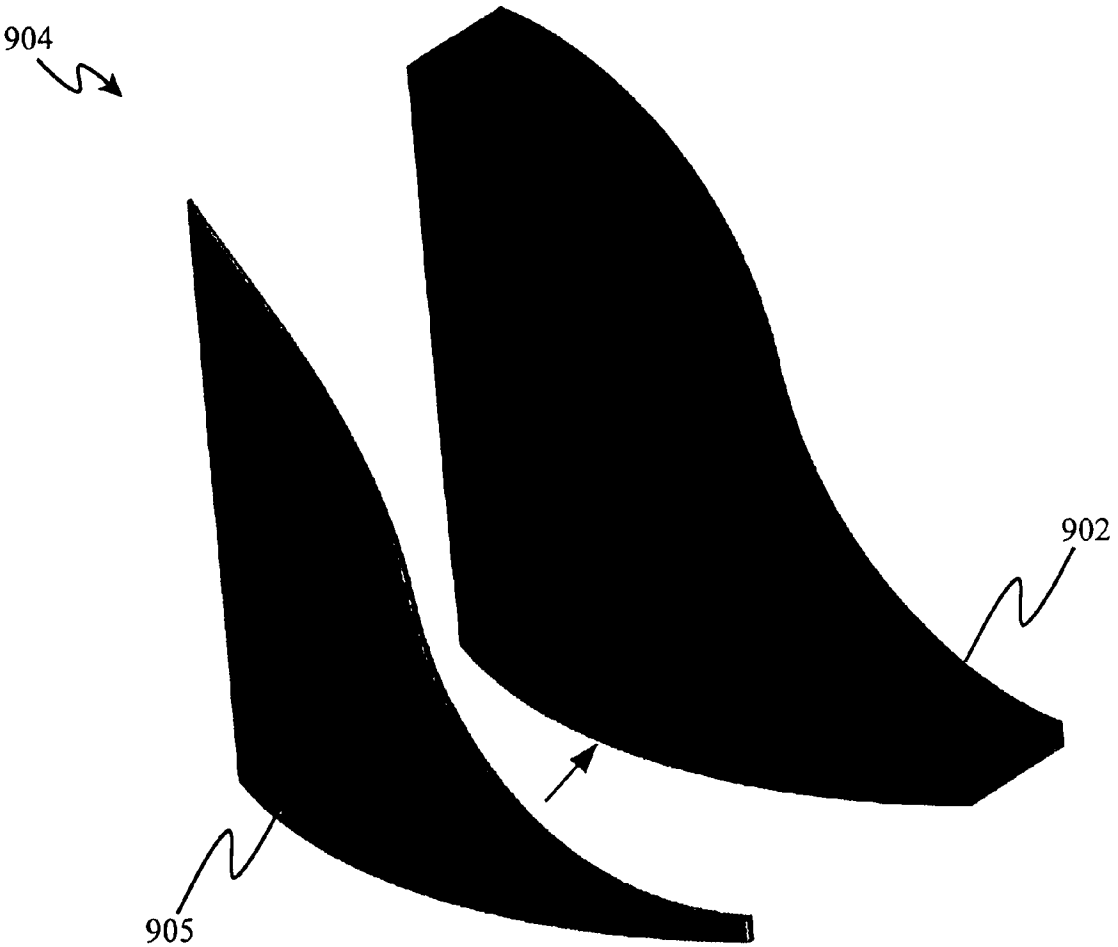

To produce a skin, coating materials, such as Polyvinyl Chloride ("PVC"), are directly applied to a component surface. Alternatively, skin materials are pre-formed to the component shape and laminated to the component surface using adhesives. Skins ensure that the components are not only exceptional at diffusing sound, but also resistant to oils and moisture. As shown (901) in FIG. 9*a*, a foam component (902) can be painted directly, forming an integral skin (903), using one of several well-known industrial paints, coatings, or surface finished suitable for adherence to the foam material. Alternatively, as shown (904) in FIG. 9*b*, a separate skin (905) can be thermoformed for application to the foam component (902). The skin's material can be of the desired color. Optionally, the skin can be of a substance that is both thermoformable as well as paintable, such as expanded PVC (e.g. Sintra Board or similar). This allows significant control of the appearance by the interior design professional.

Figure 9C:
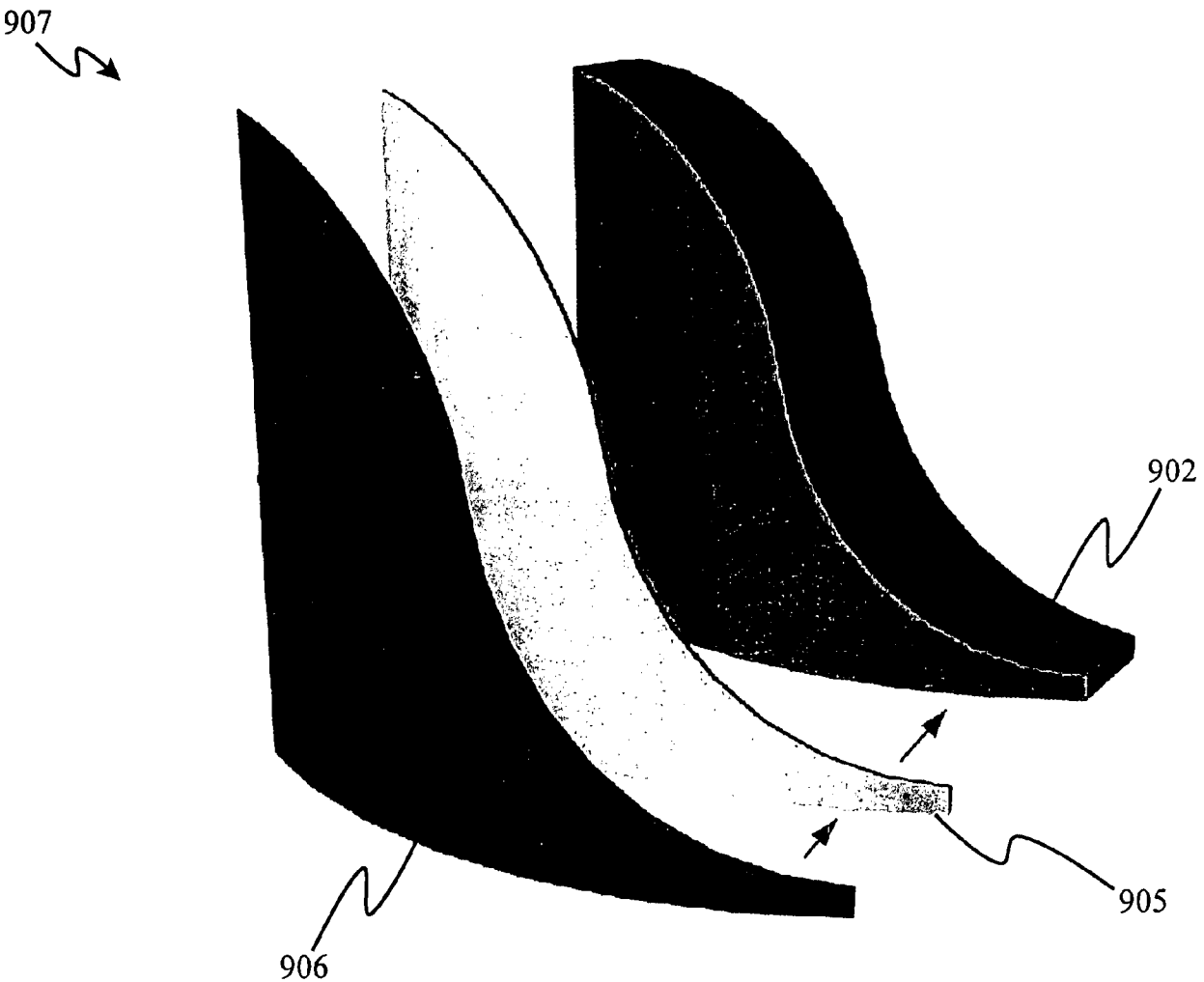

In yet another embodiment option, as shown (907) in FIG. 9*c*, a thermoformed skin (905) can receive a veneer (906), such as wood, metal, vinyl, or plastic, either before or after application to the foam component (902). Alternatively, veneers such as these can be pre-formed and applied directly to the component surfaces. Veneers may be applied to the skins to provide enhanced acoustical characteristics, enhanced appearance, or both.

Packing, Nesting, and Unpacking of Components

FIG. 5*c* illustrates an unpacking process whereby the components are originally stacked and arranged in a substantially rectangular parallelepiped combination, as during production and shipping, and then are unpacked and rearranged to achieve a final installation pattern, such as the patterns shown in FIGS. 5*d*-5*h*. According to the invention, all available embodiments provide this efficiency in packing to reduce shipping costs by reducing empty space and volume in shipping cartons.

Various Embodiments and Installation Patterns

Figure 6A:
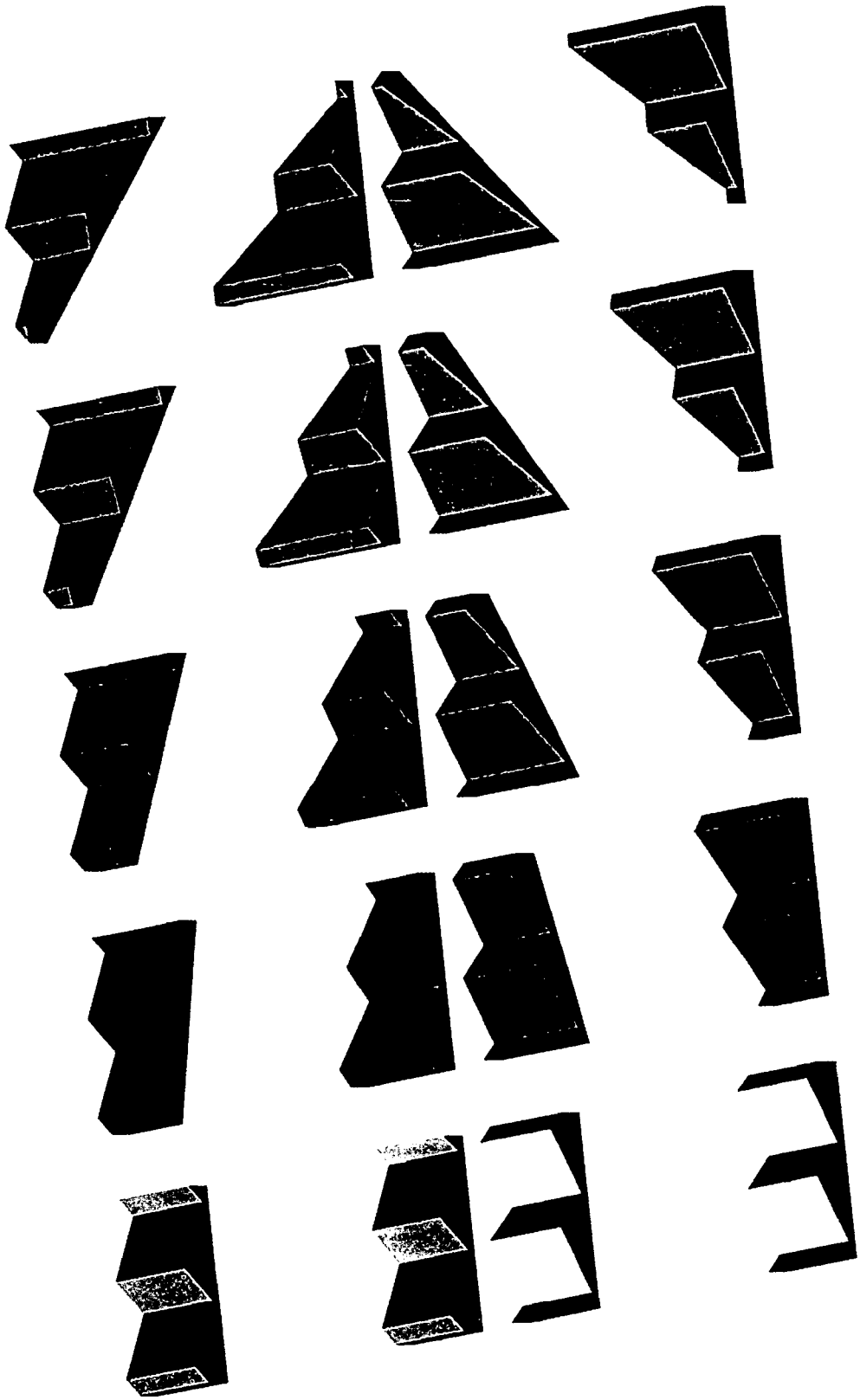
FIGS. 6*a* through 6*s* illustrate another embodiment of the invention, and several arrangements as installed on a wall or ceiling.
Figure 6B:
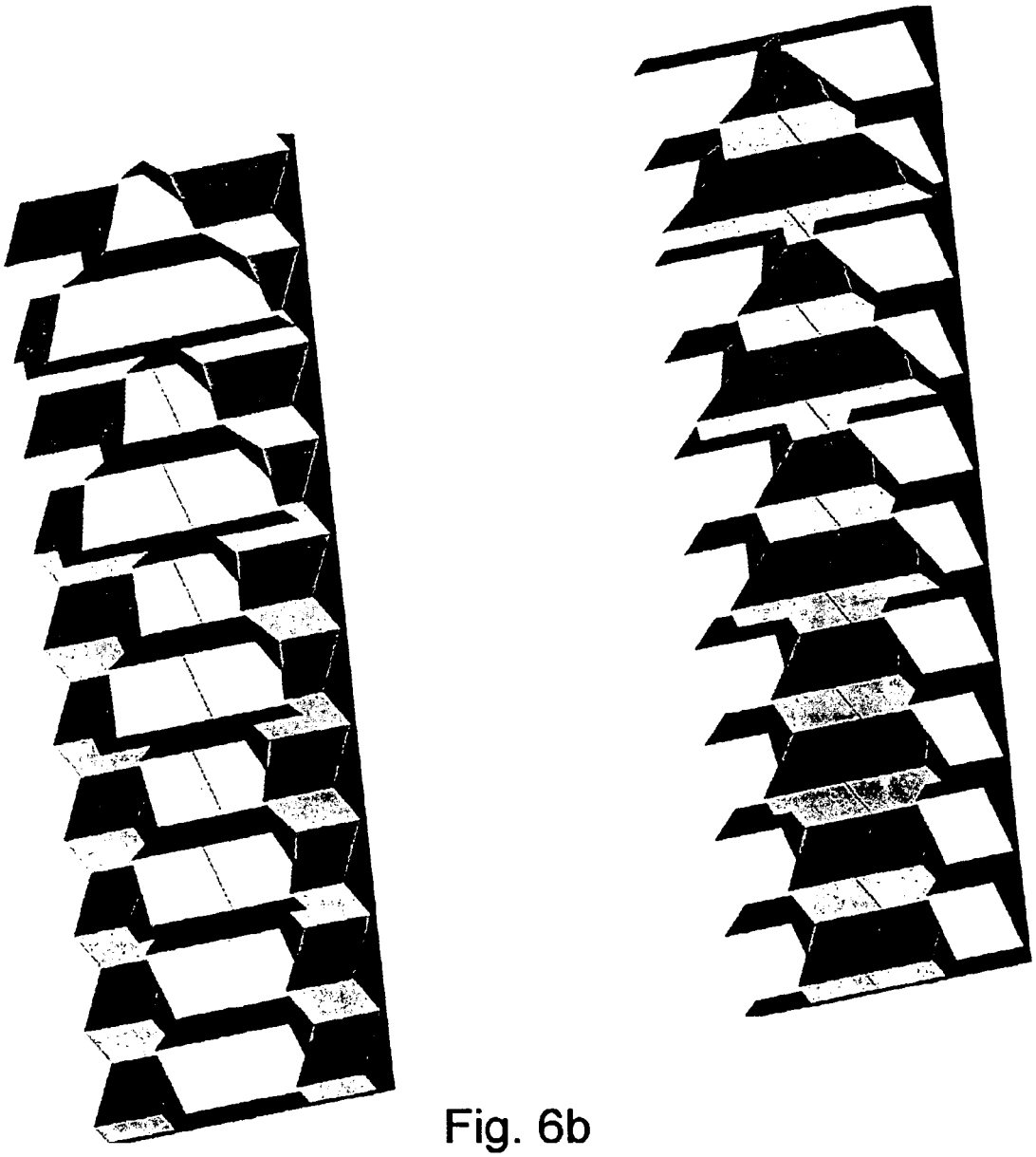
Figure 6G:
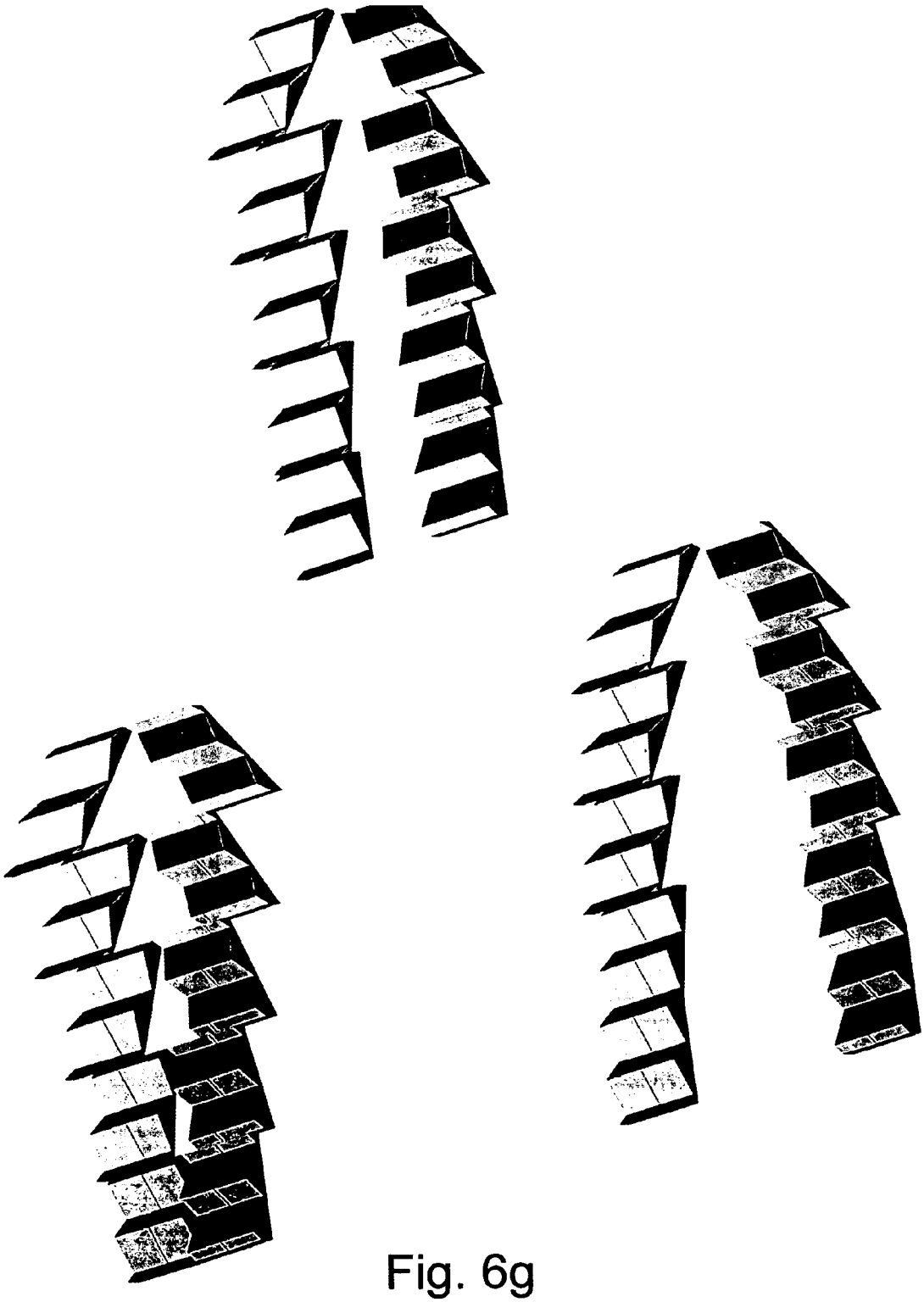
Figure 6H:
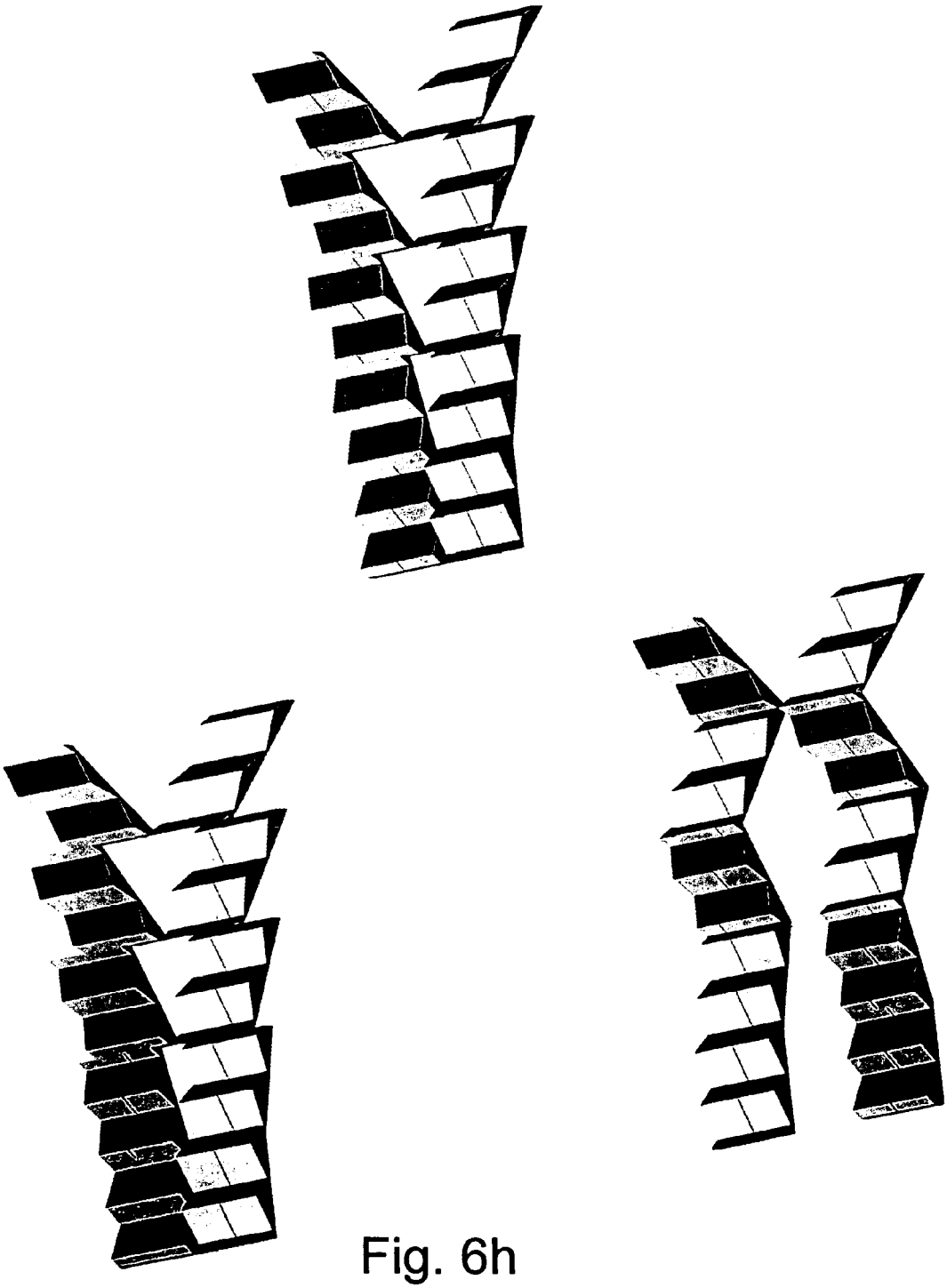
Figure 6I:
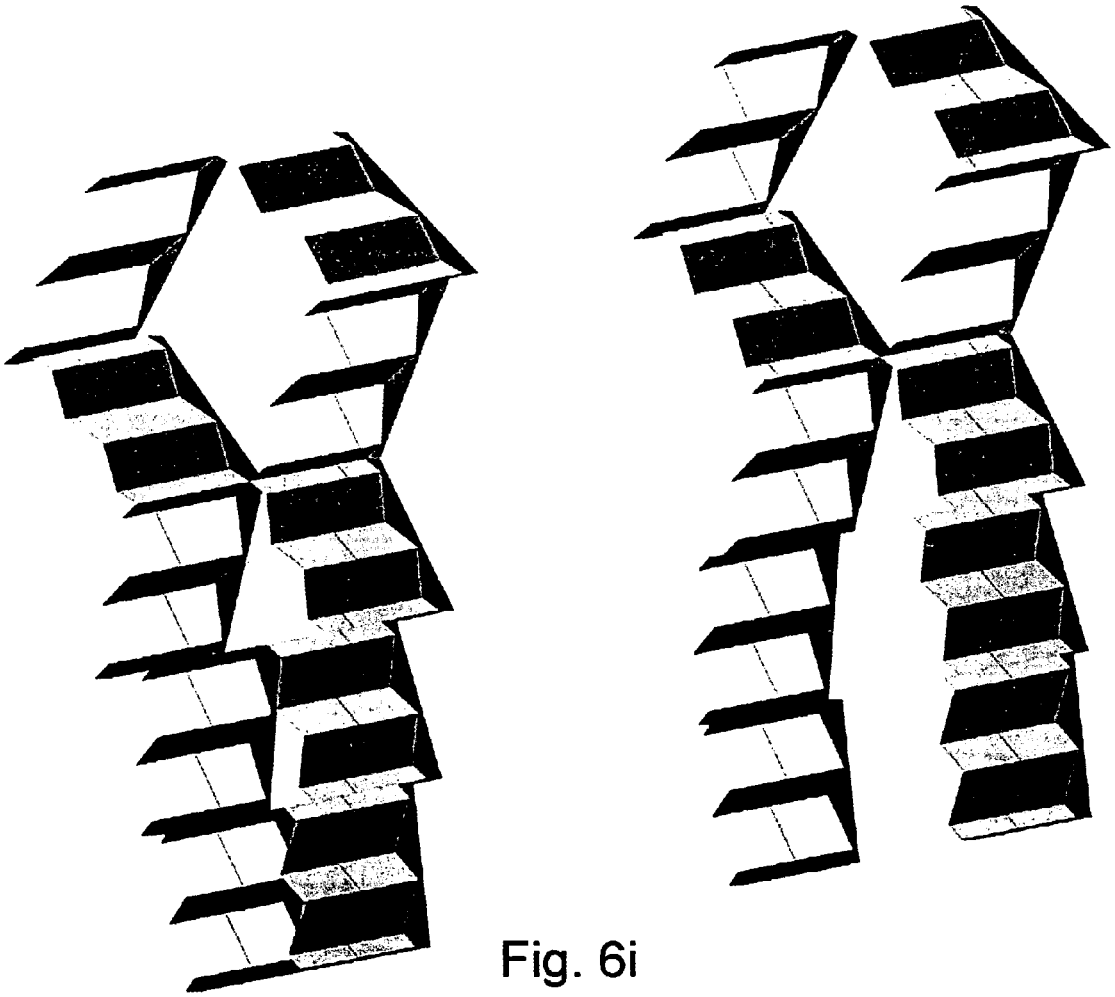
Figure 6J:
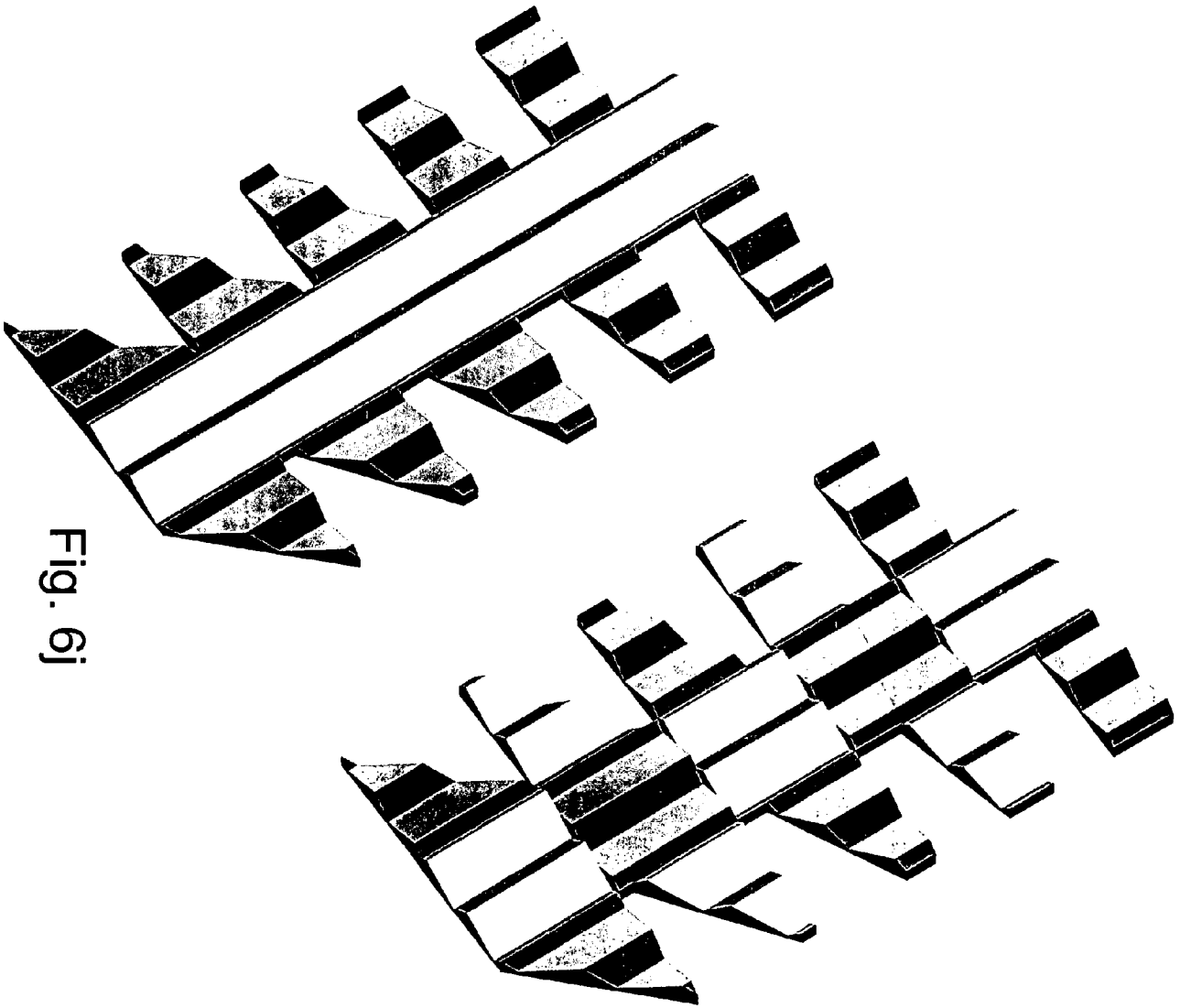
Figure 6K:
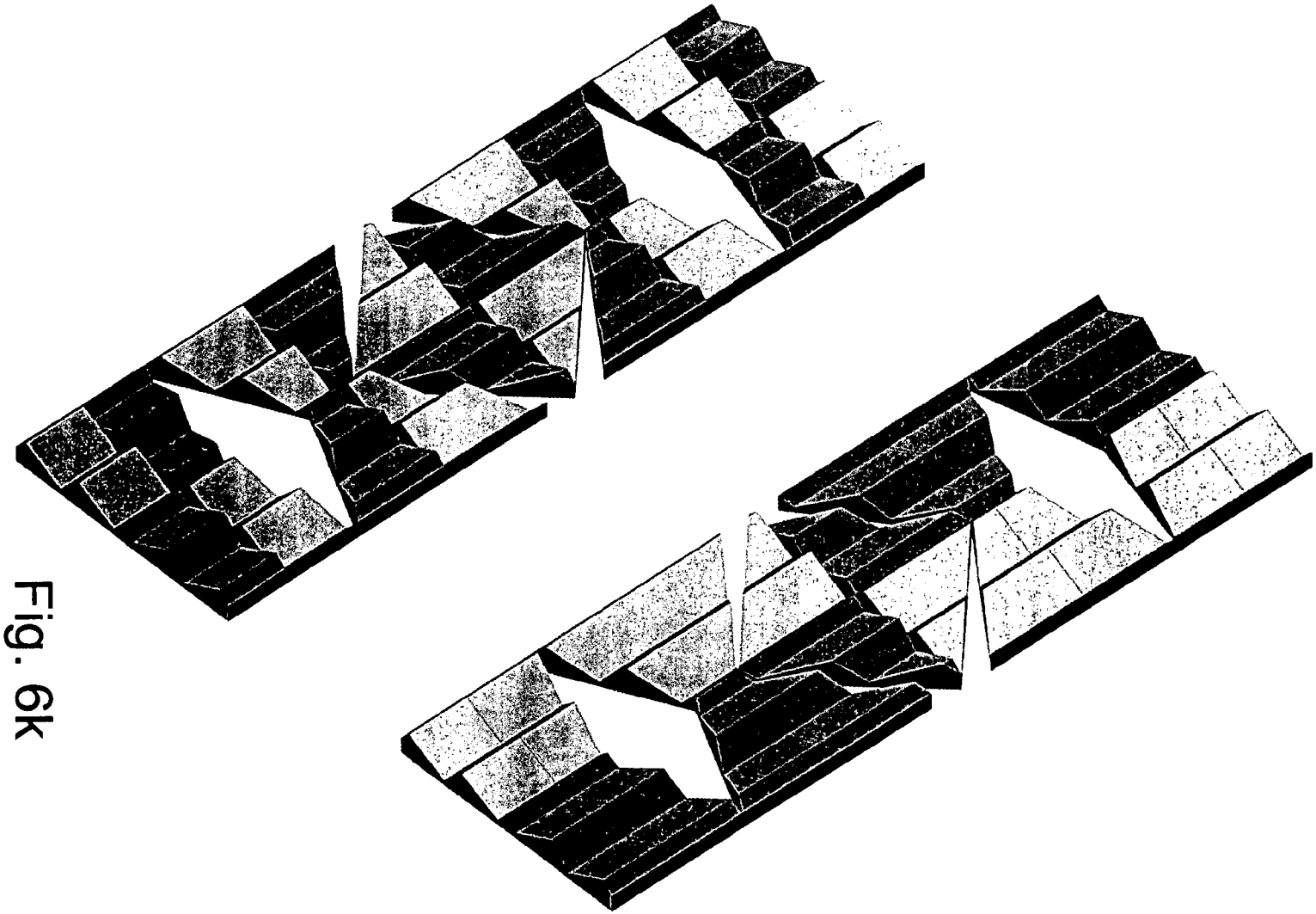
Figure 6M:
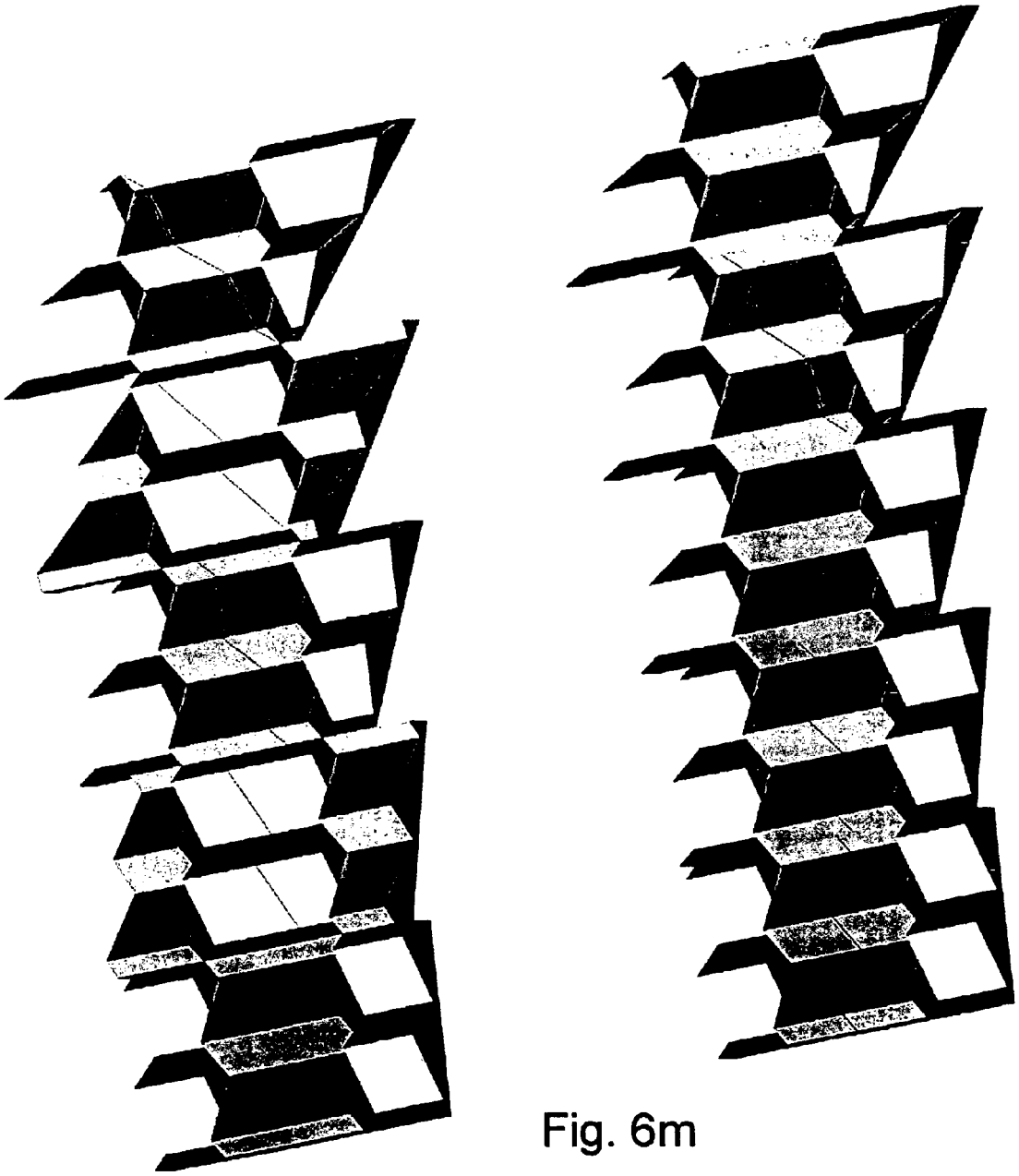
Figure 6N:
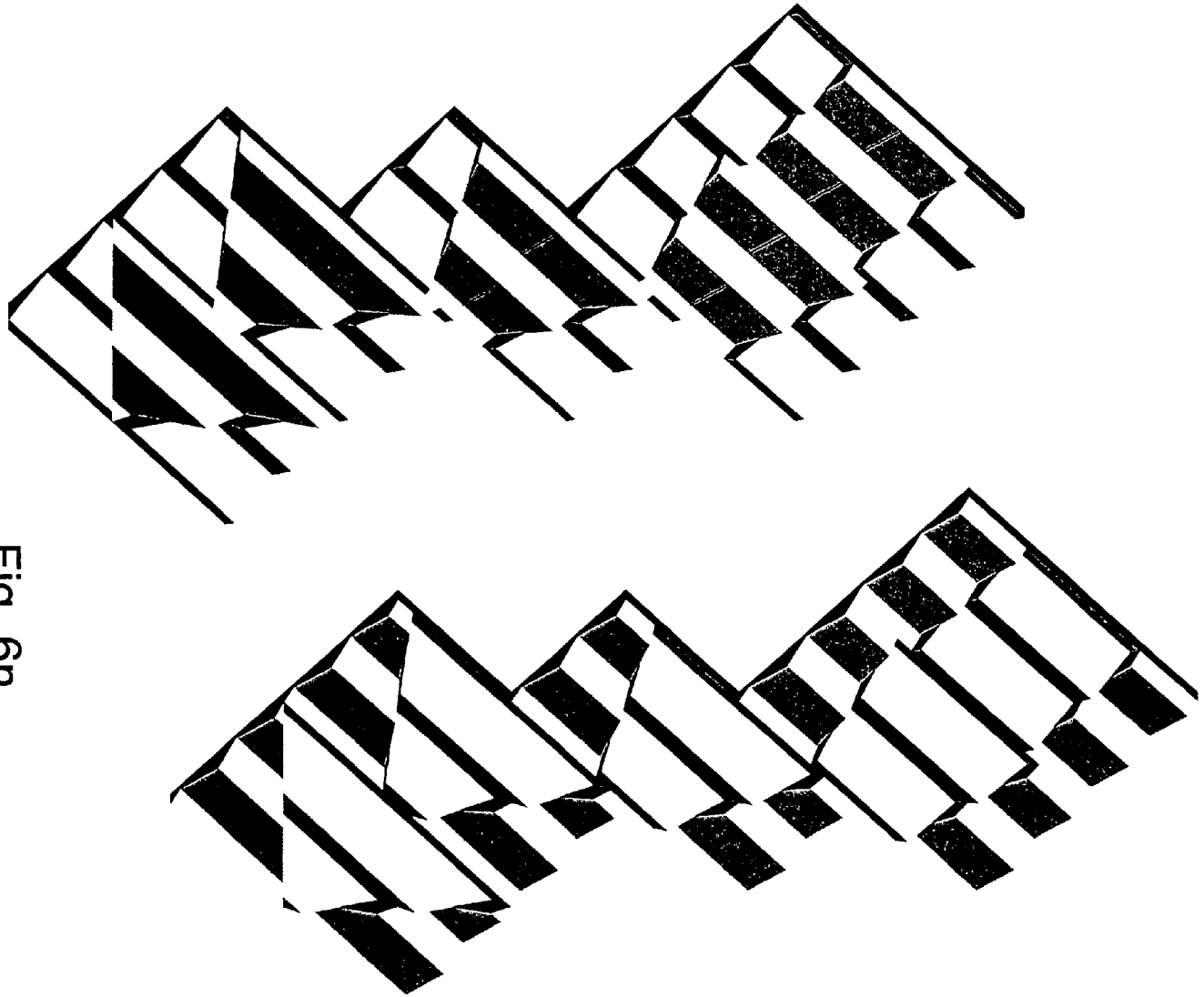
Figure 6P:
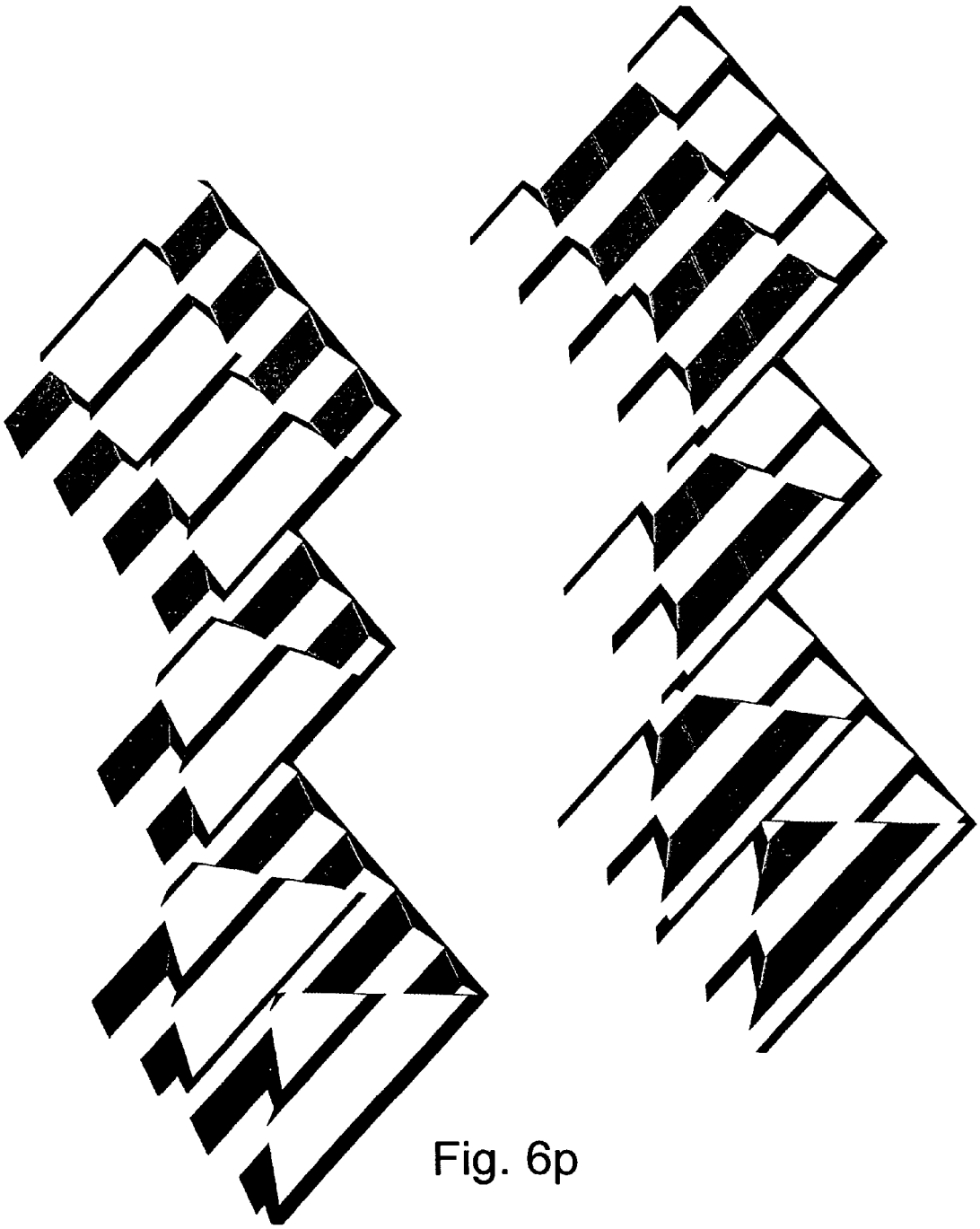
Figure 6Q:
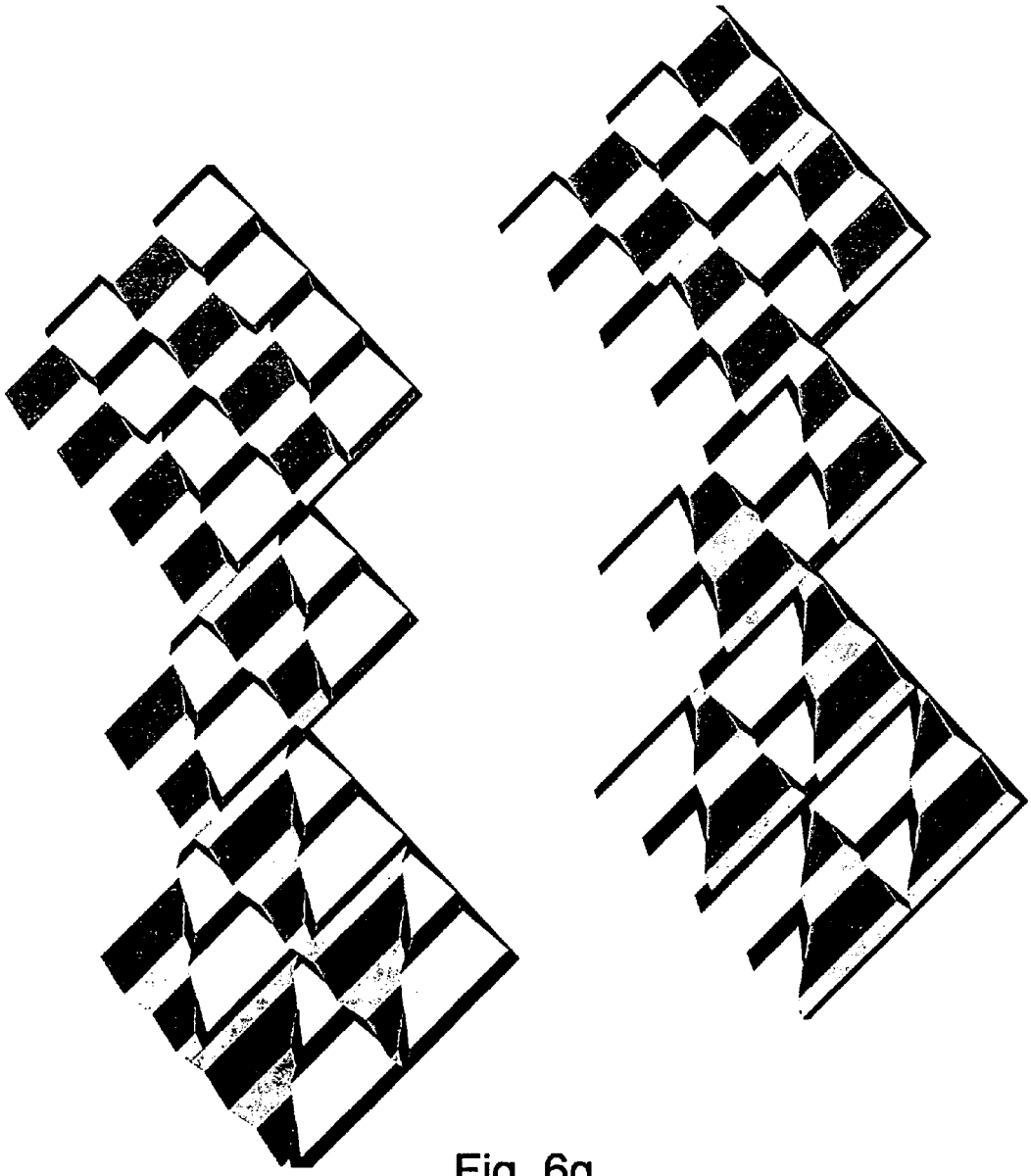
Figure 6R:
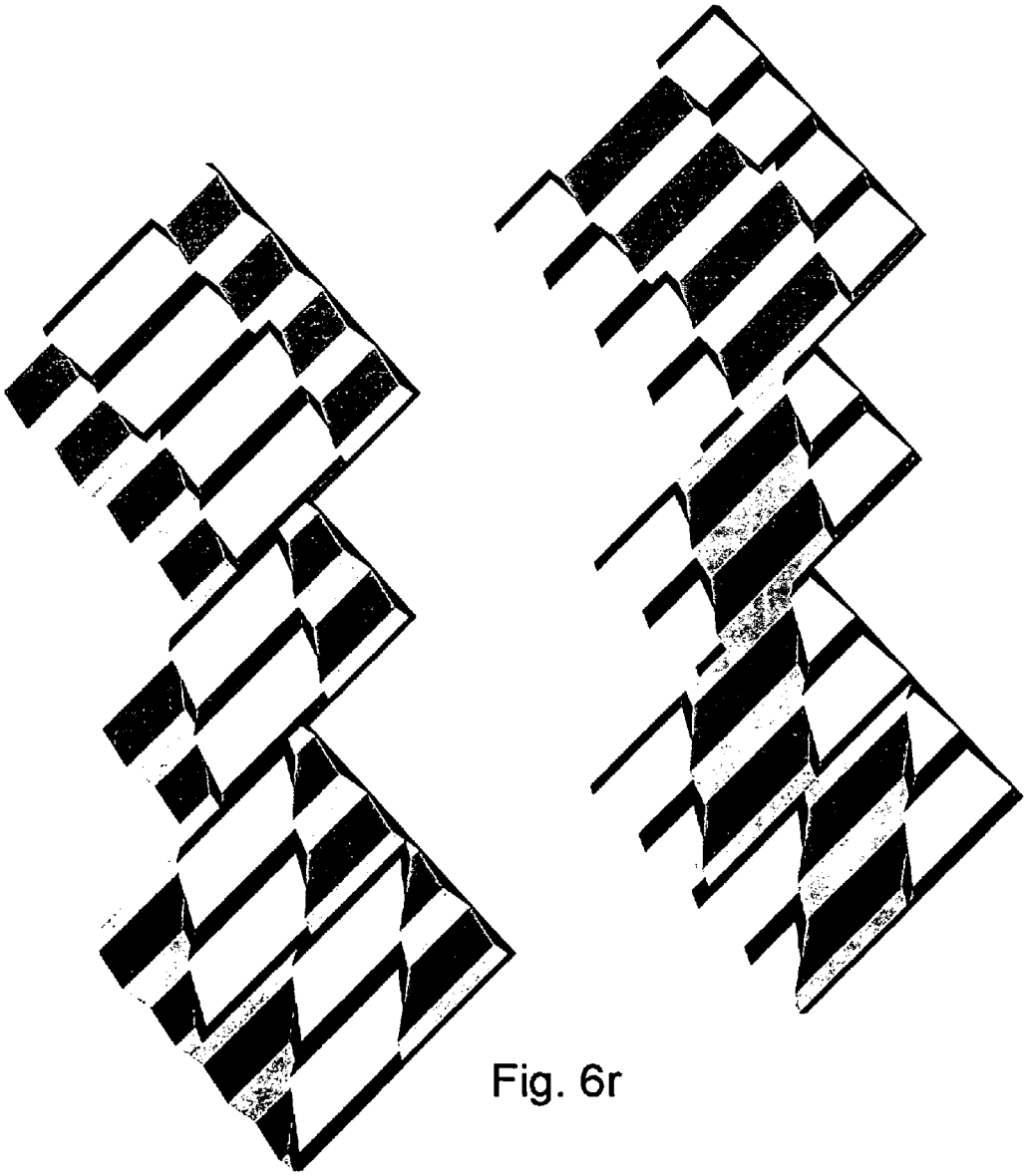
Figure 6S:
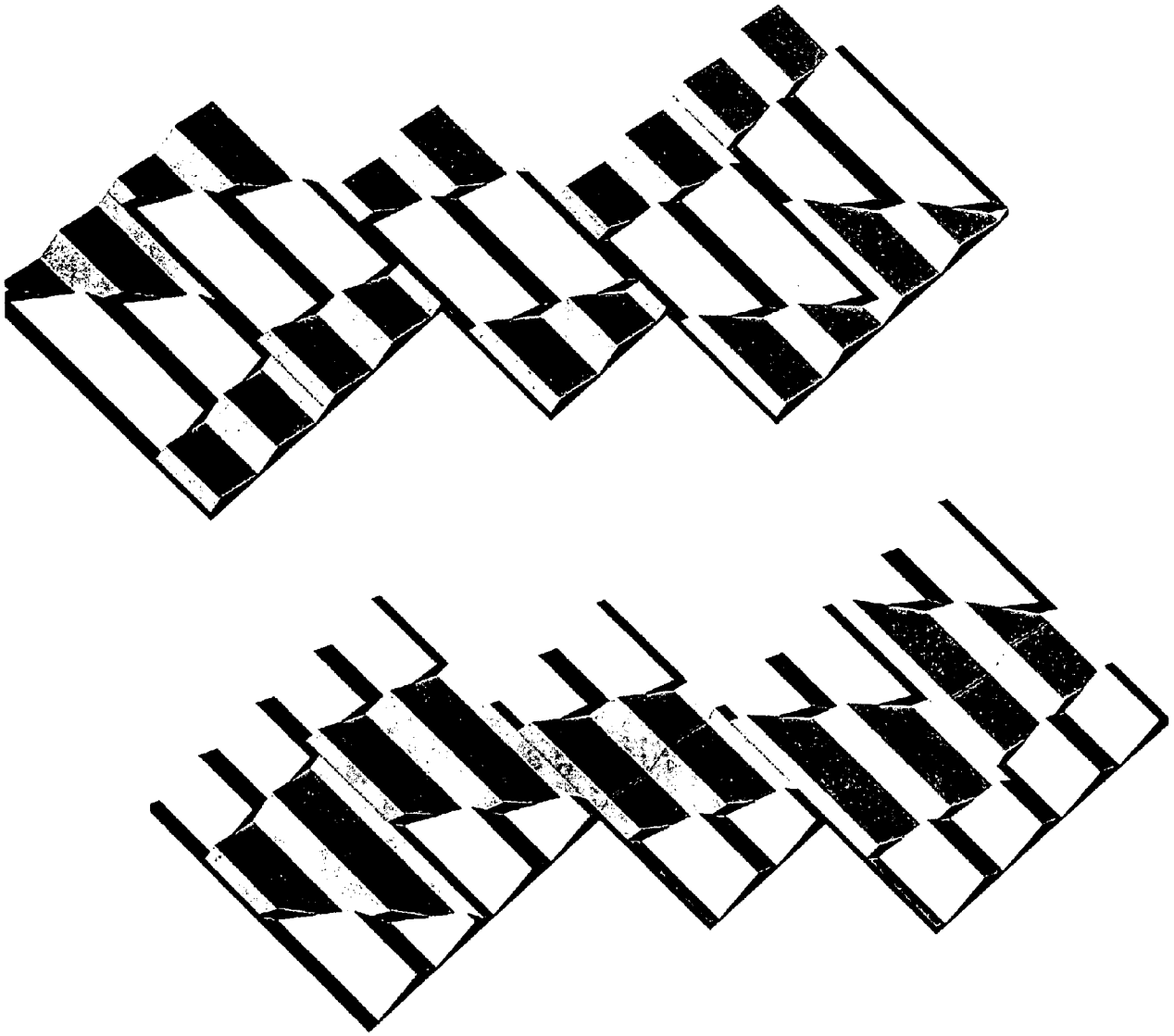
Figure 7B:
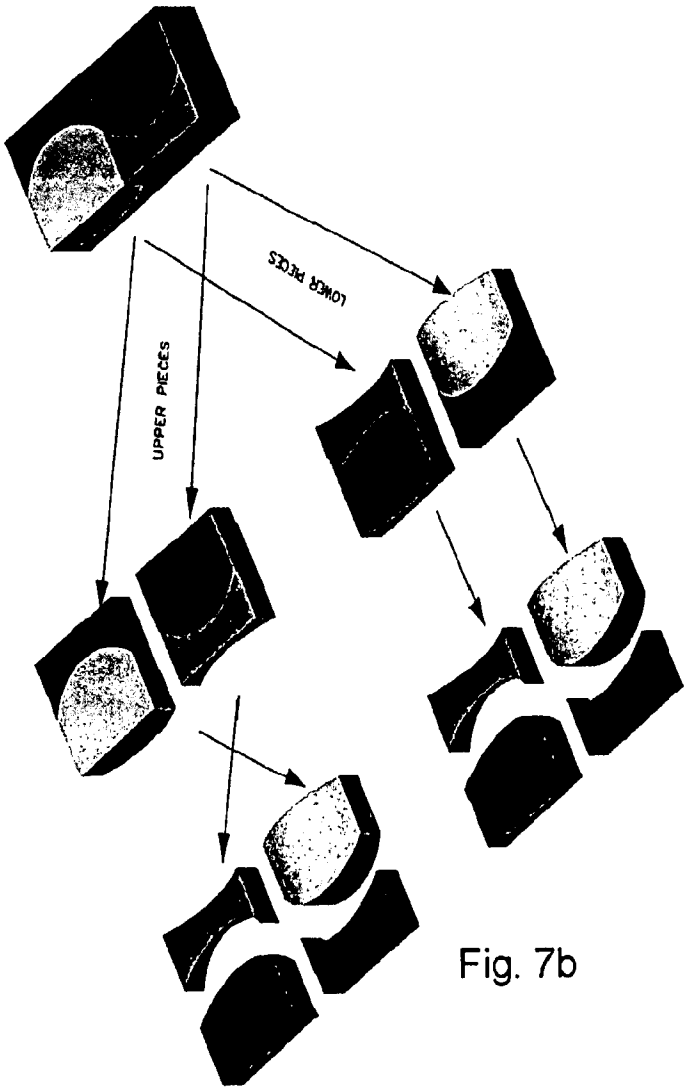
FIGS. 7*a* through 7*s* illustrate another embodiment of the invention, several arrangements as installed on a wall or ceiling, and a packing/unpacking configuration.
Figure 7A:
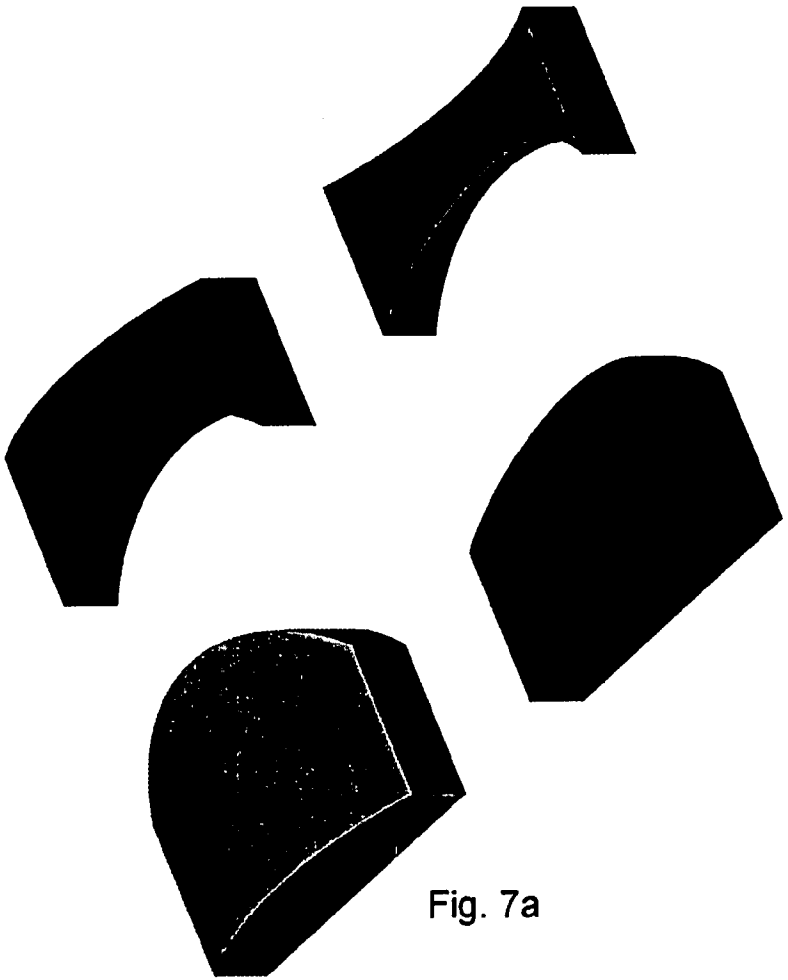
Figure 7D:
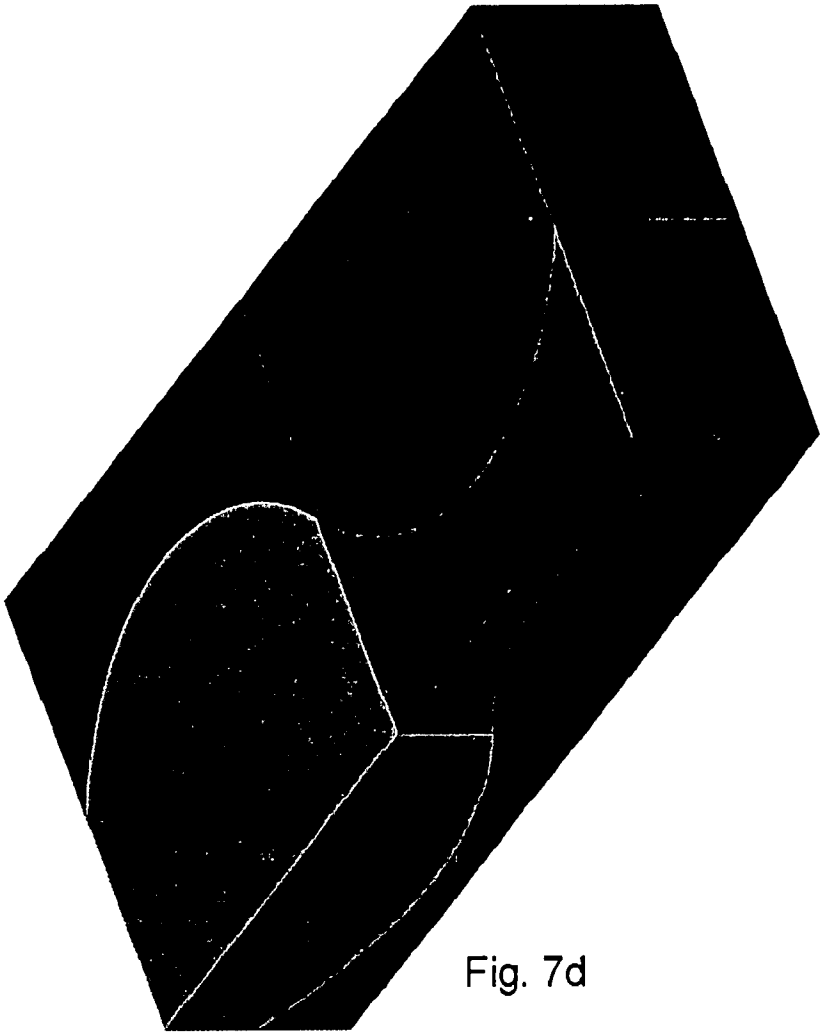
Figure 7C:
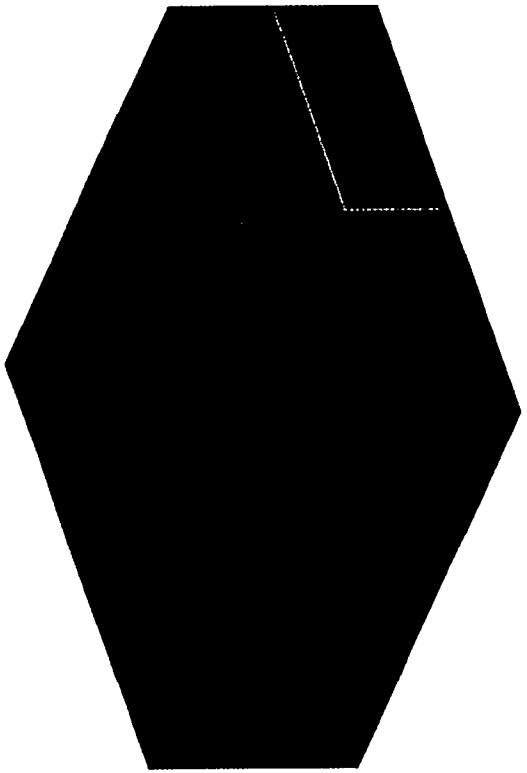
Figure 7F:
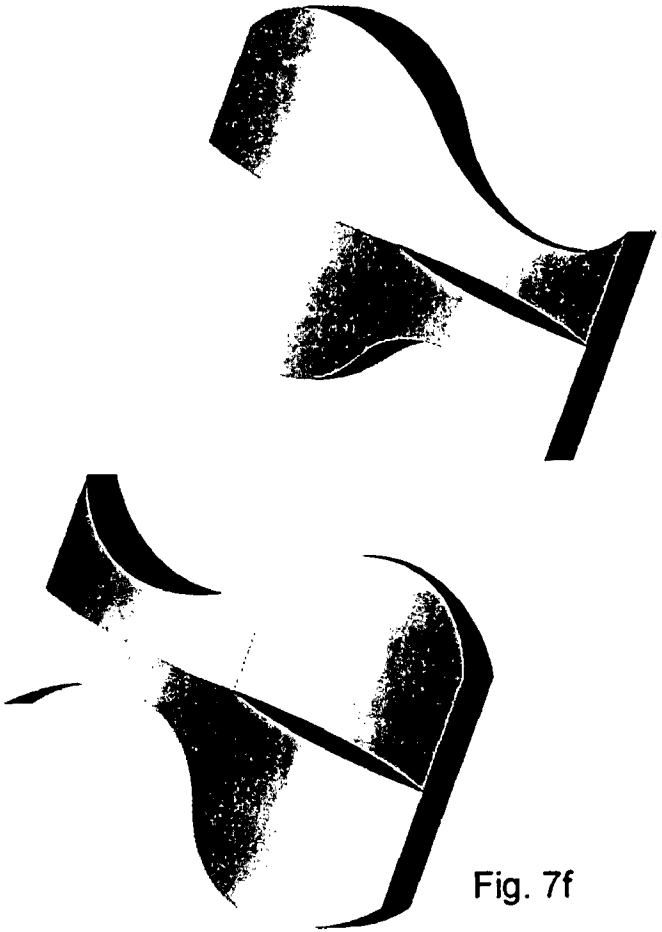
Figure 7E:
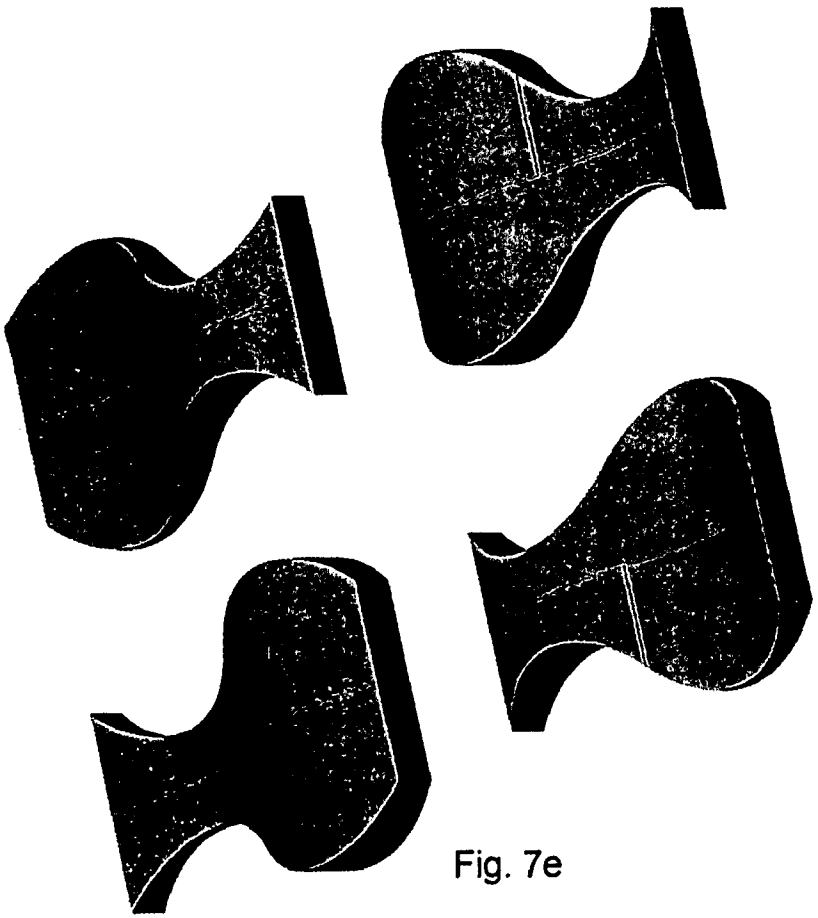
Figure 7H:
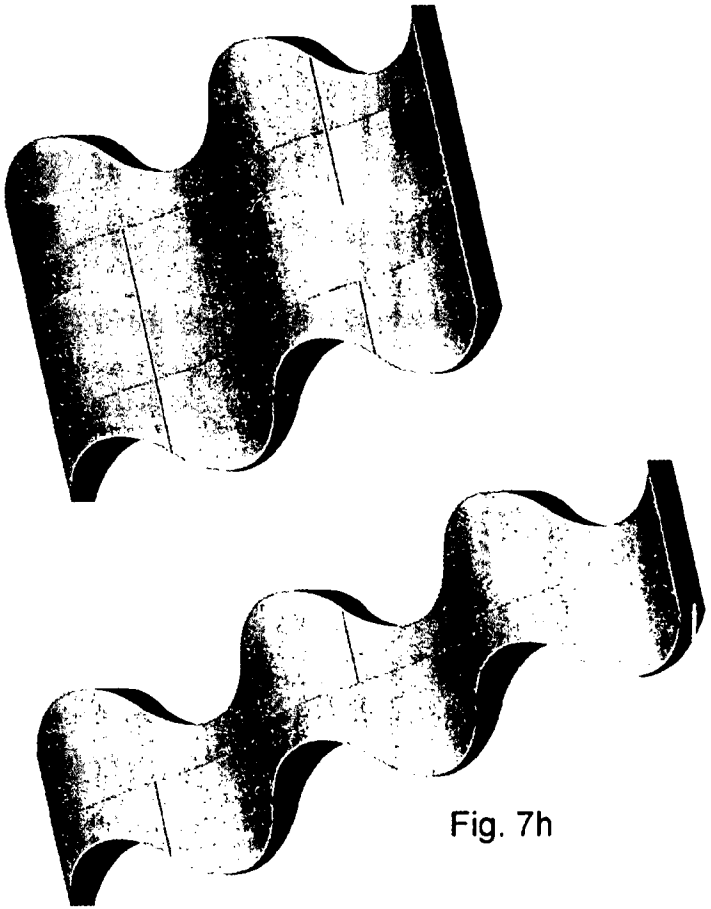
Figure 7G:
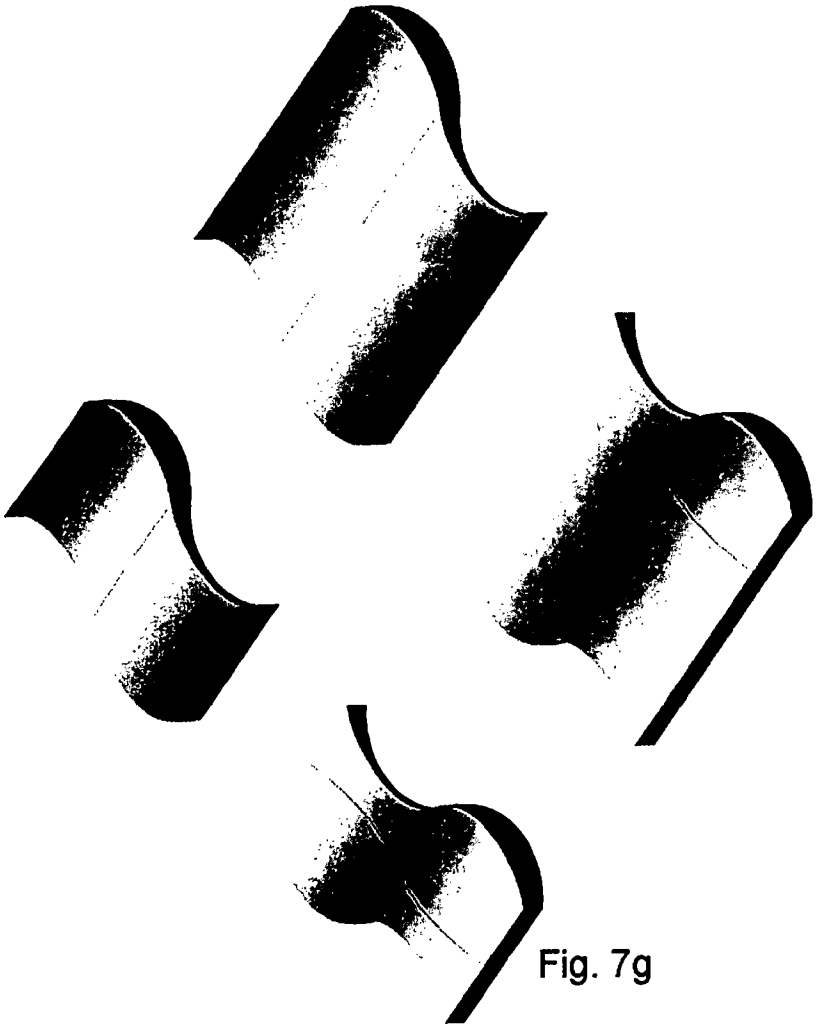
Figure 7J:
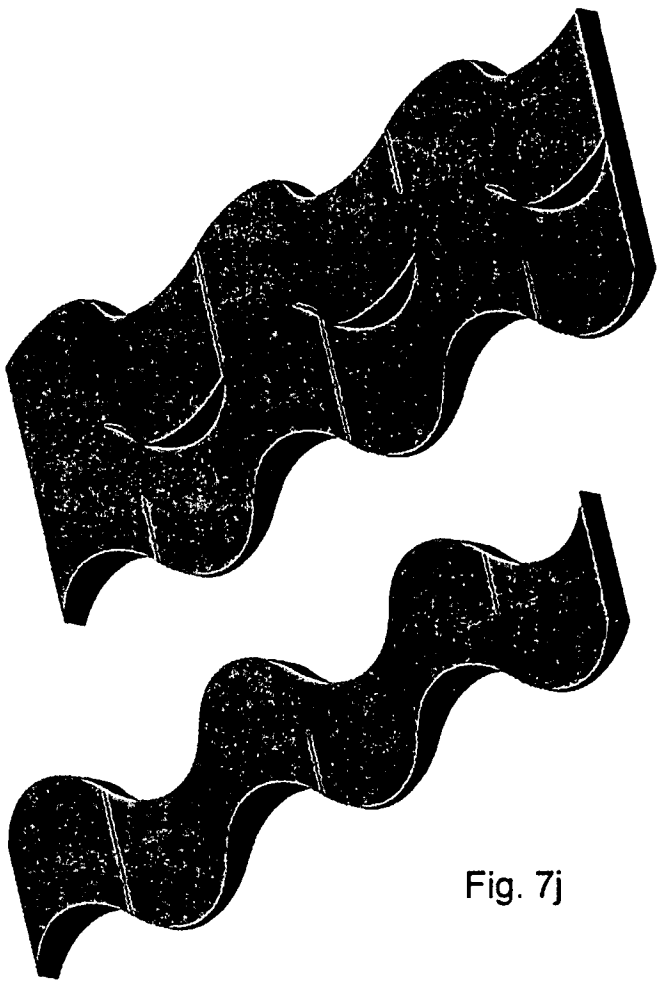
Figure 7I:
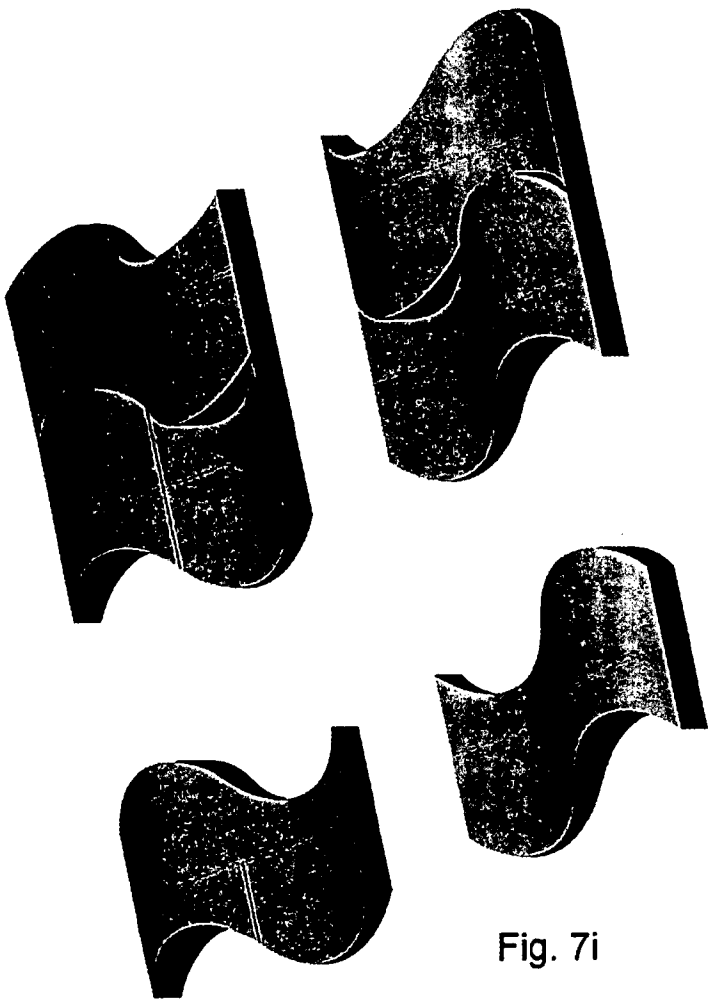
Figure 7L:
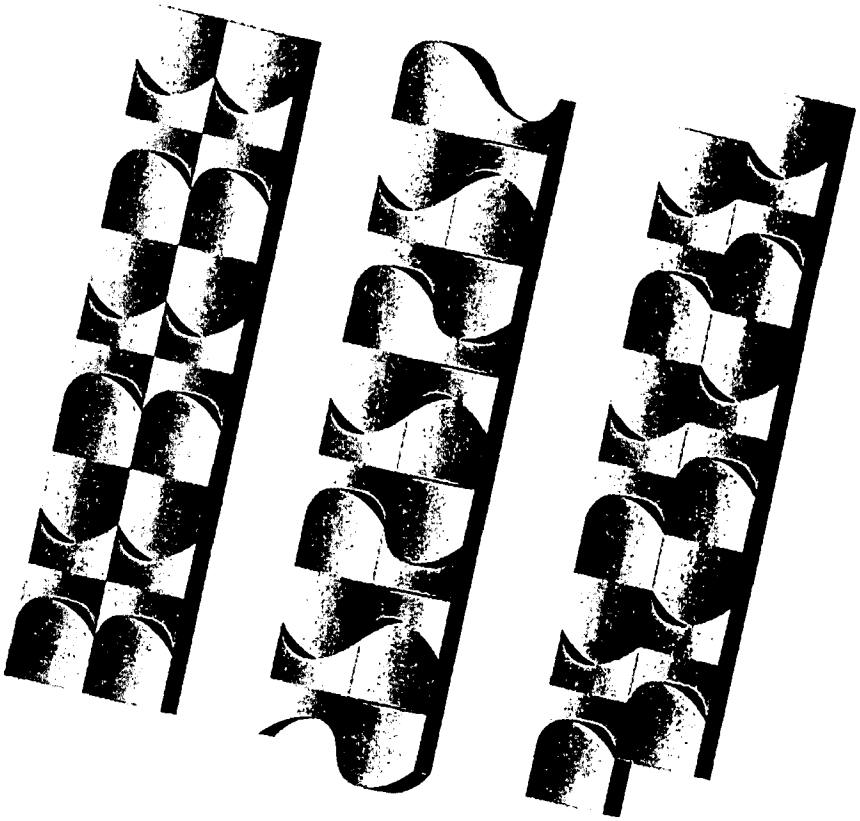
Figure 7K:
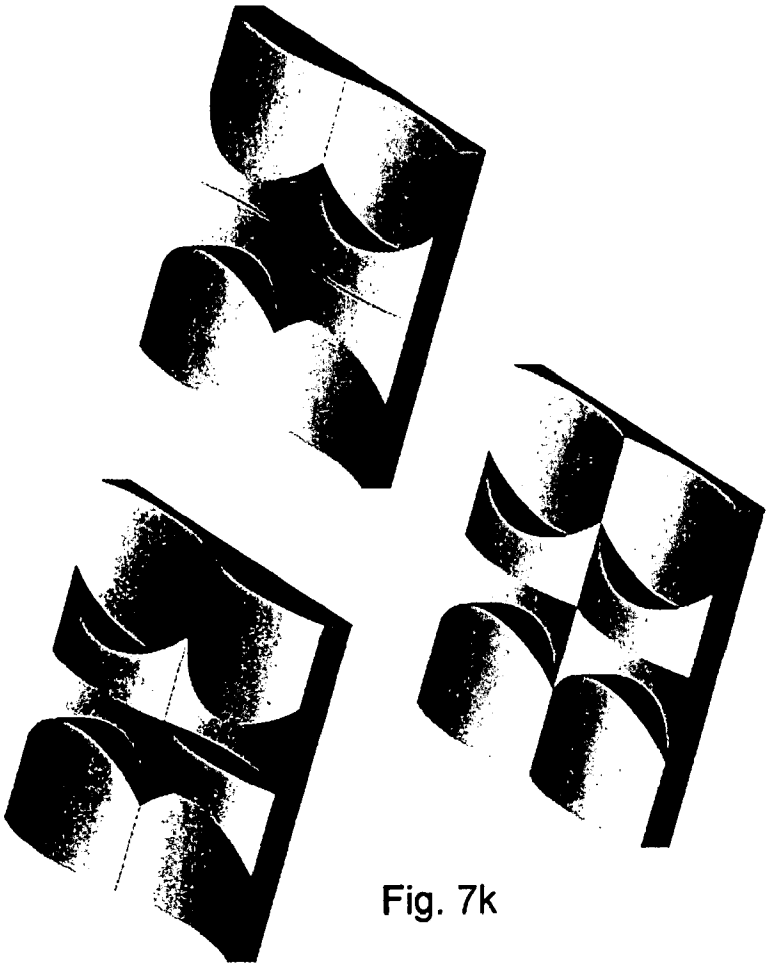
Figure 7N:
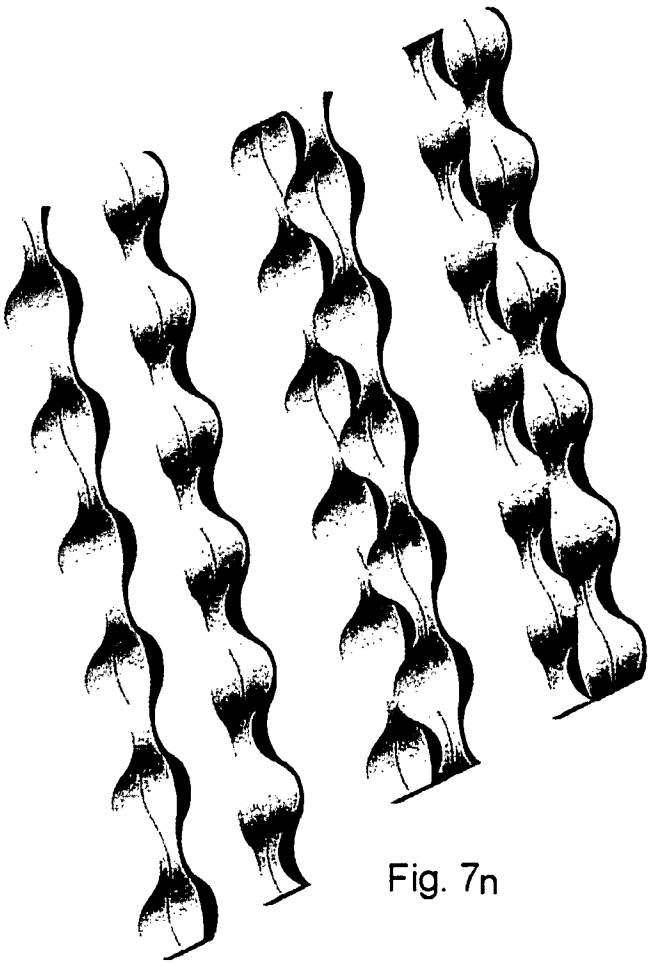
Figure 7M:
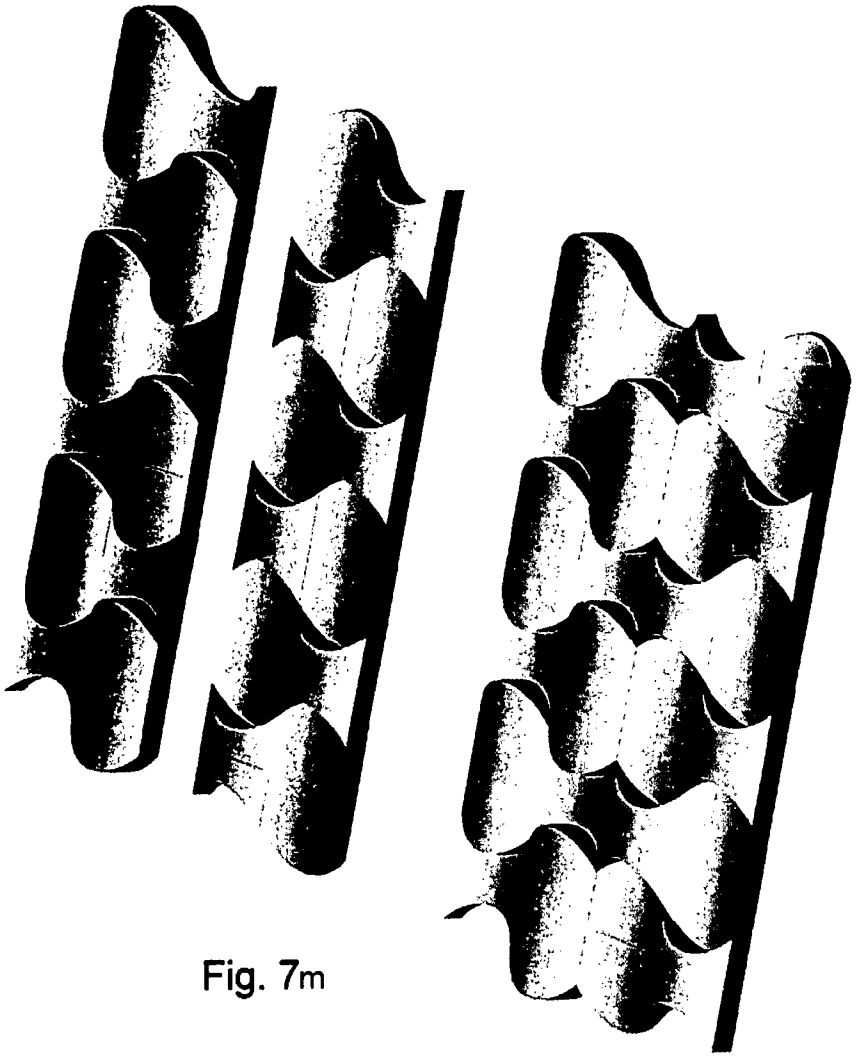
Figure 7P:
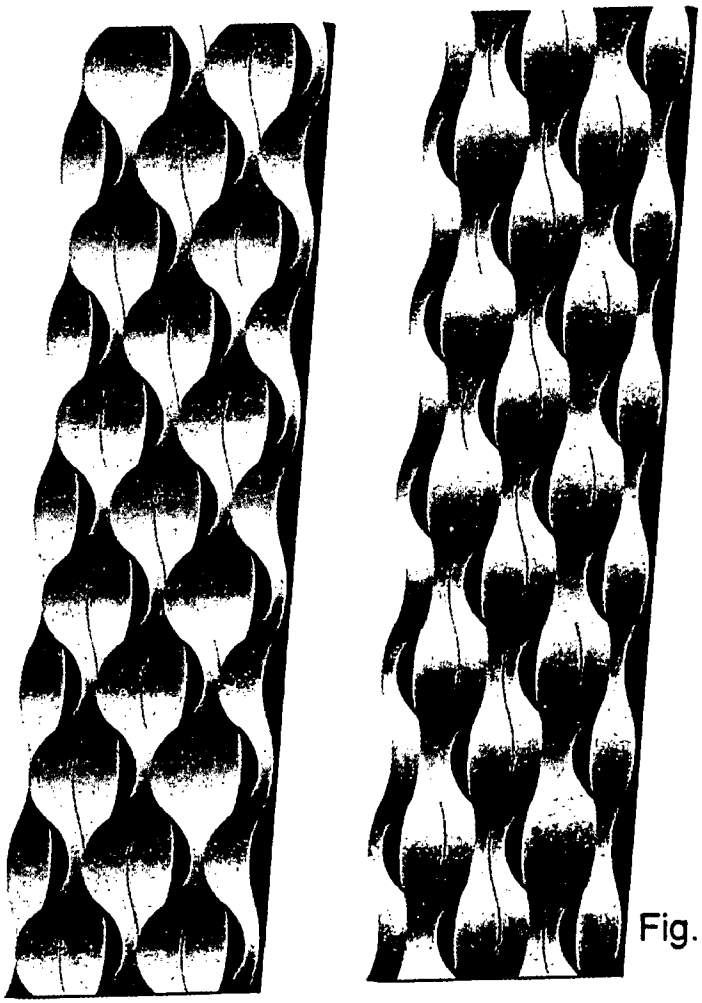
Figure 7O:
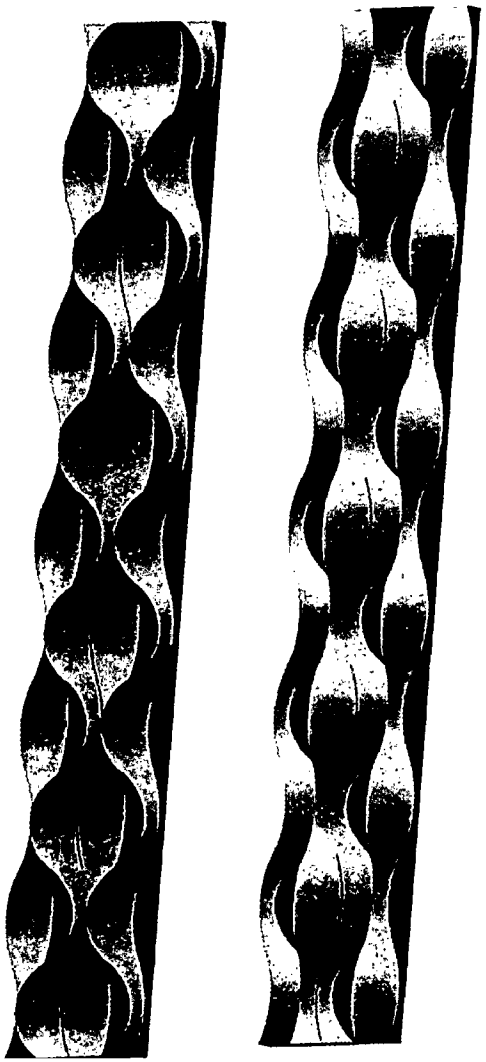
Figure 7R:
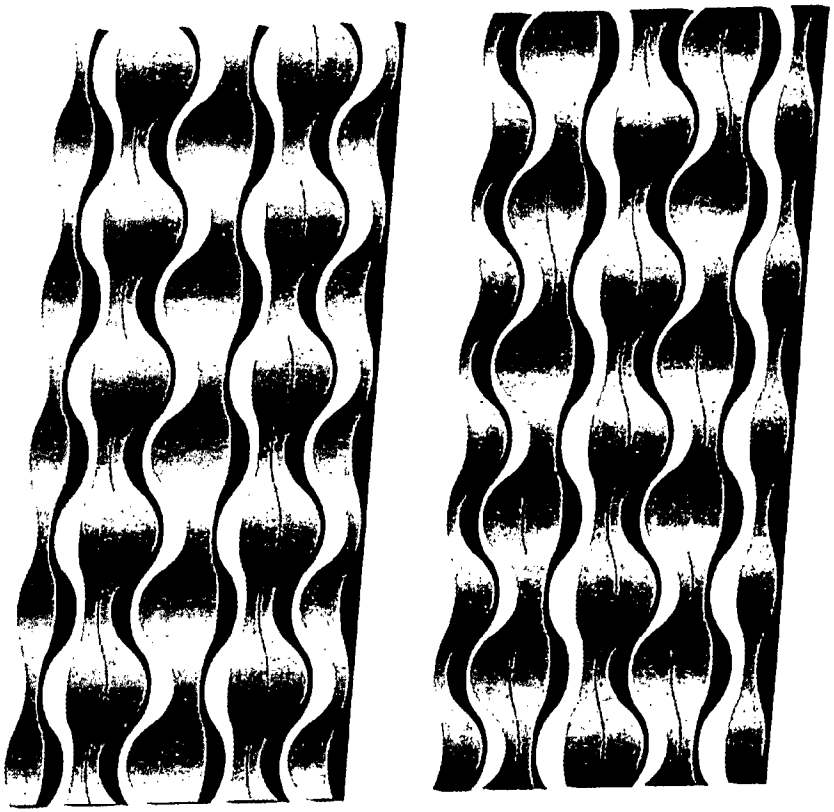
Figure 7Q:
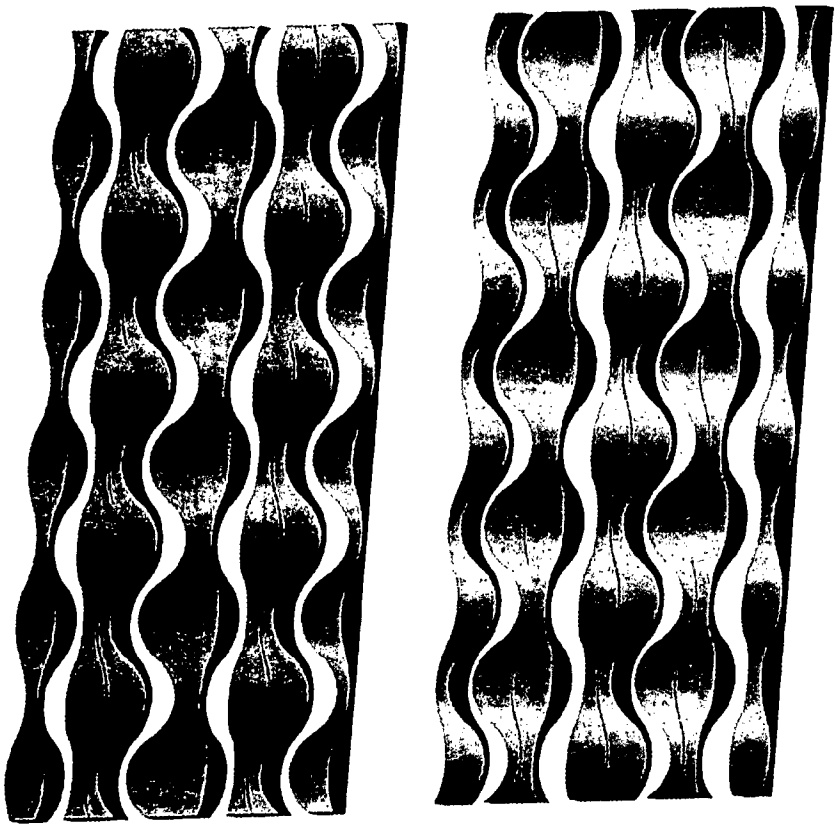
Figure 7S:
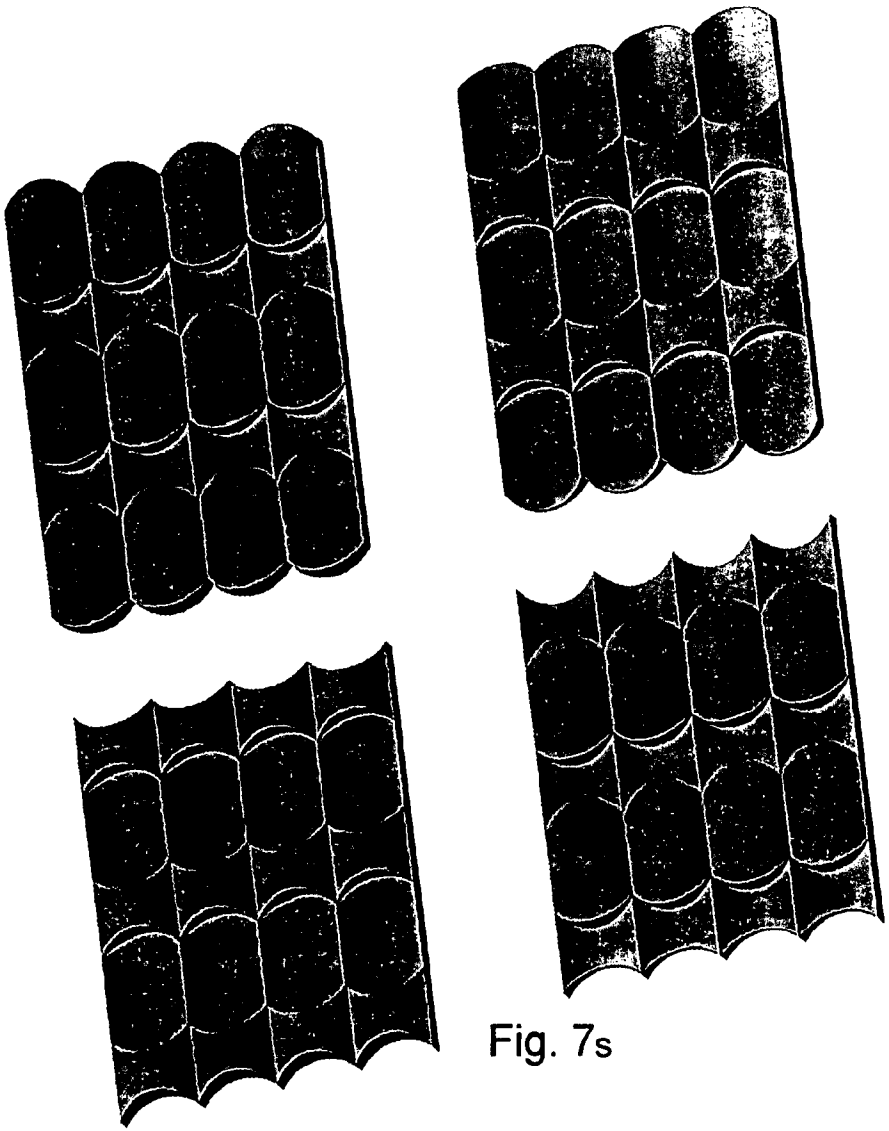
Figure 8A:
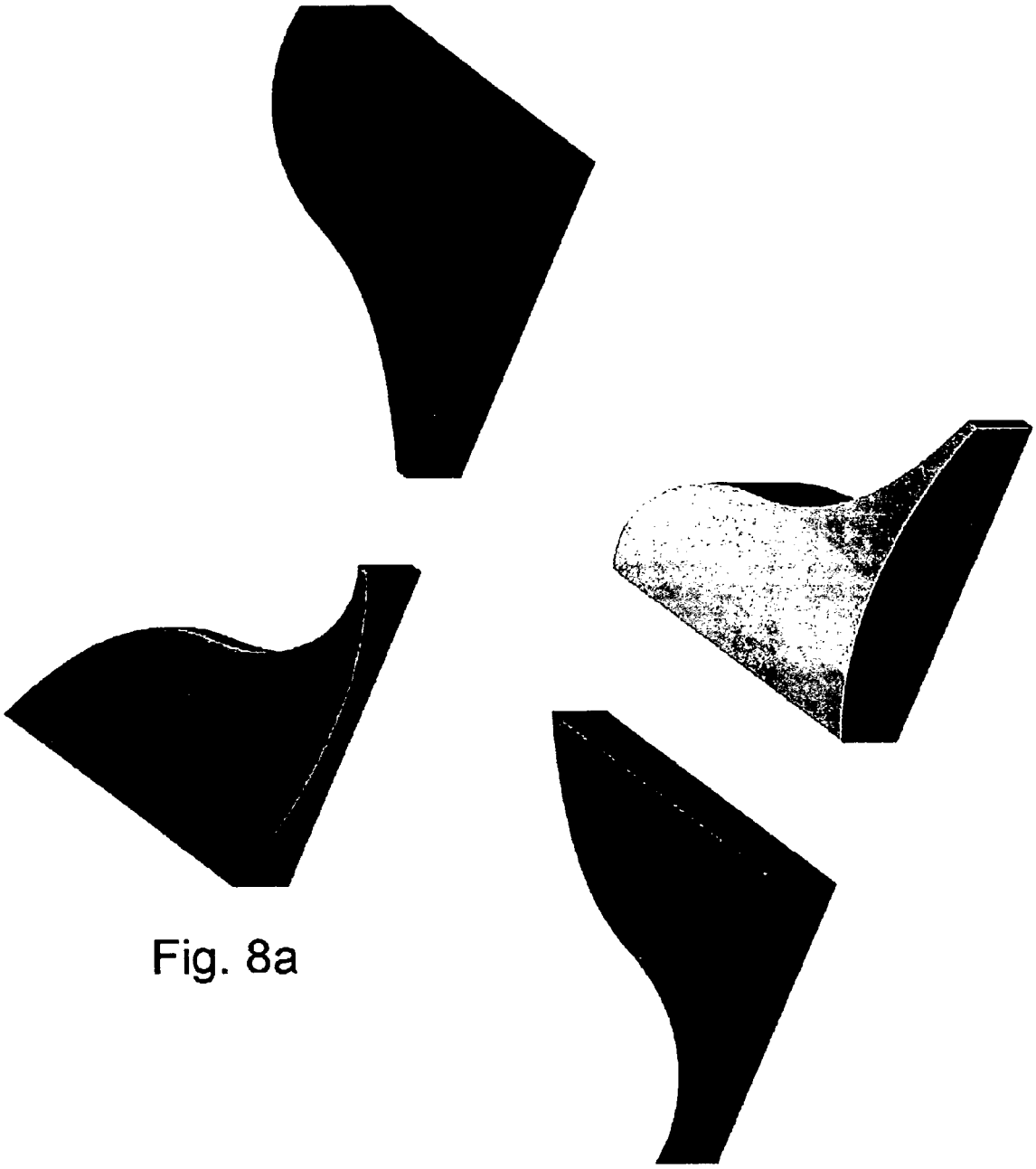
FIGS. 8*a* through 8*w* illustrate another embodiment of the invention, several arrangements as installed on a wall or ceiling, and a packing/unpacking configuration.
Figure 8B:
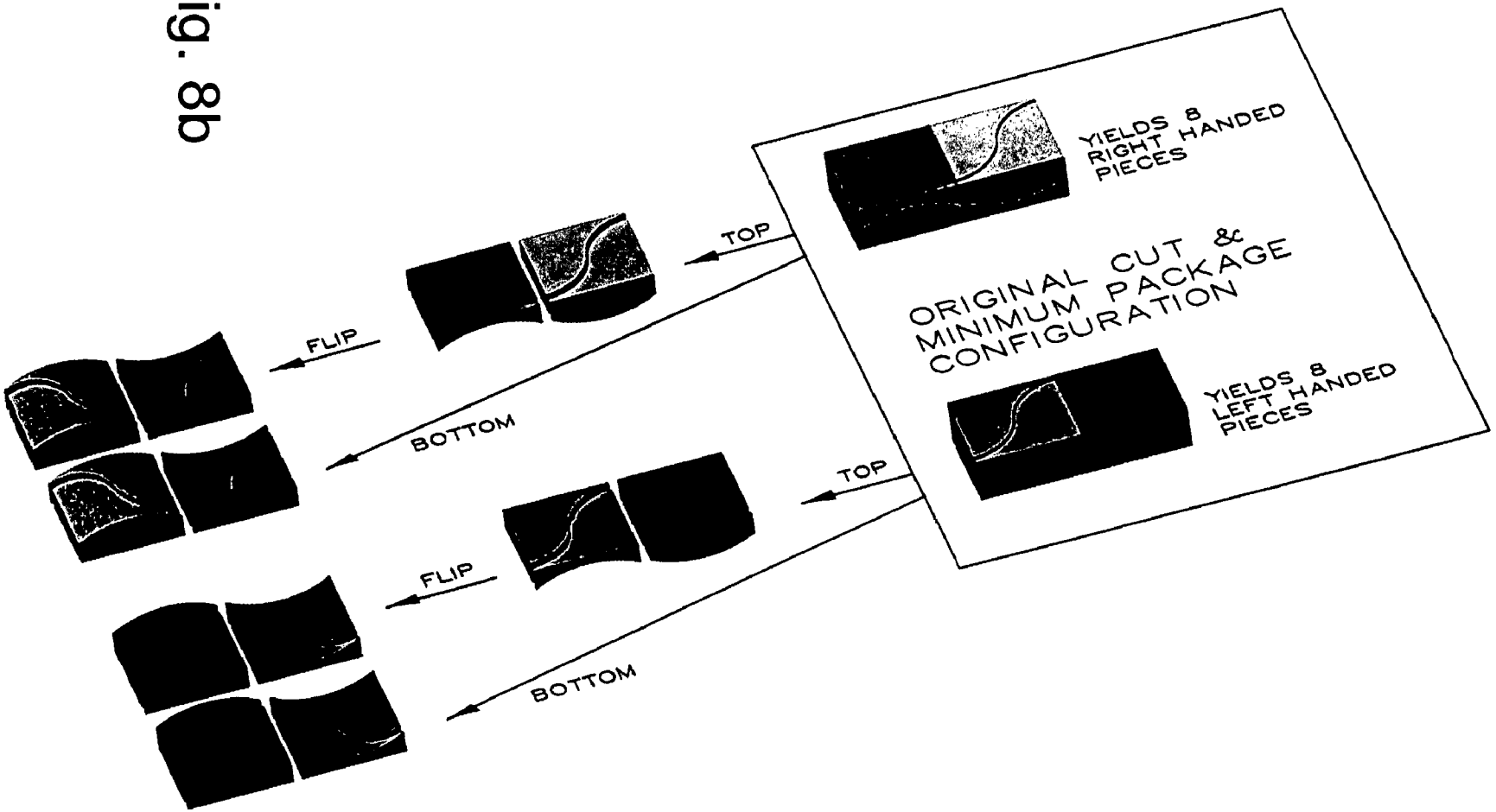
Figure 8C:
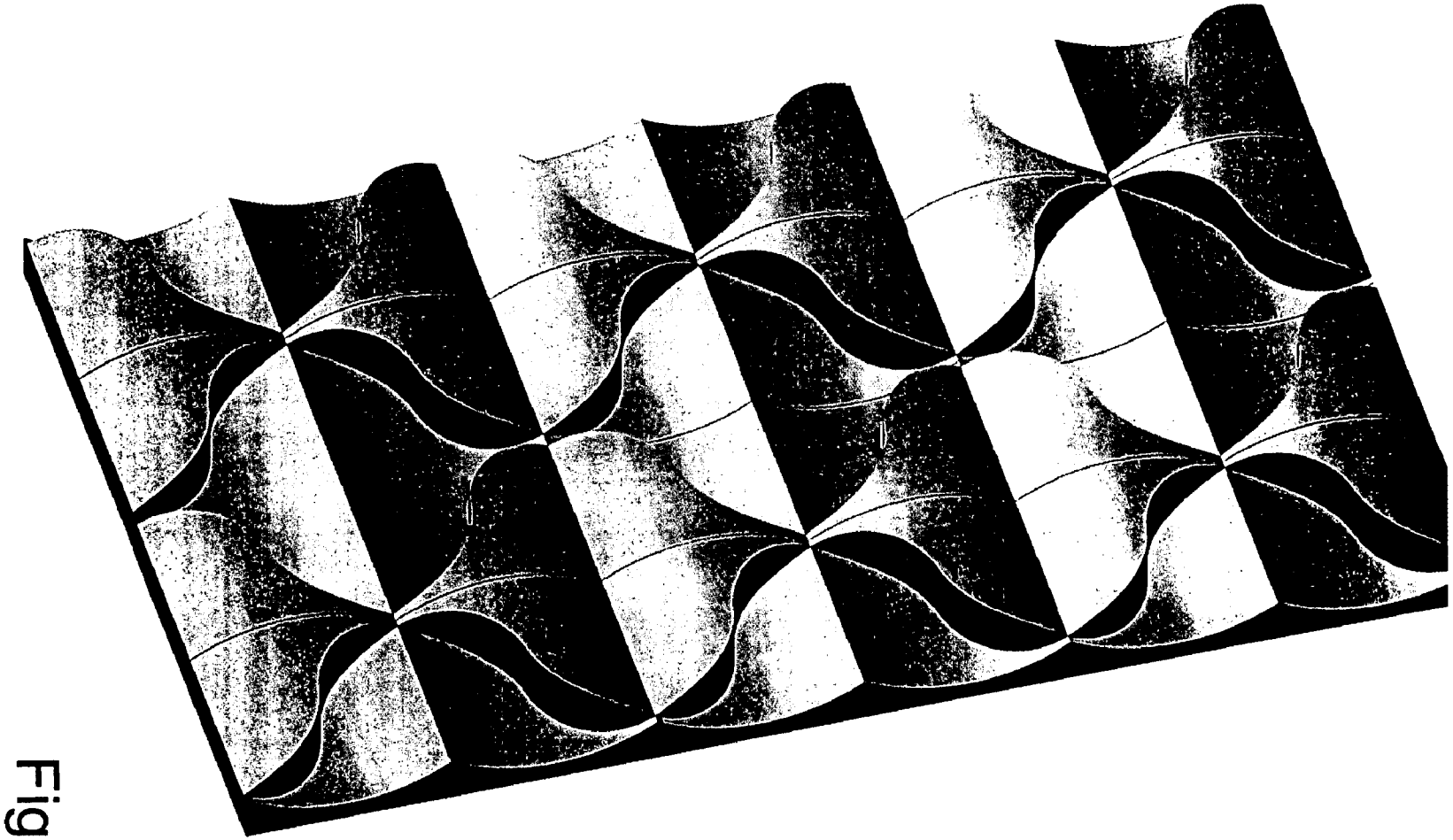
Figure 8D:
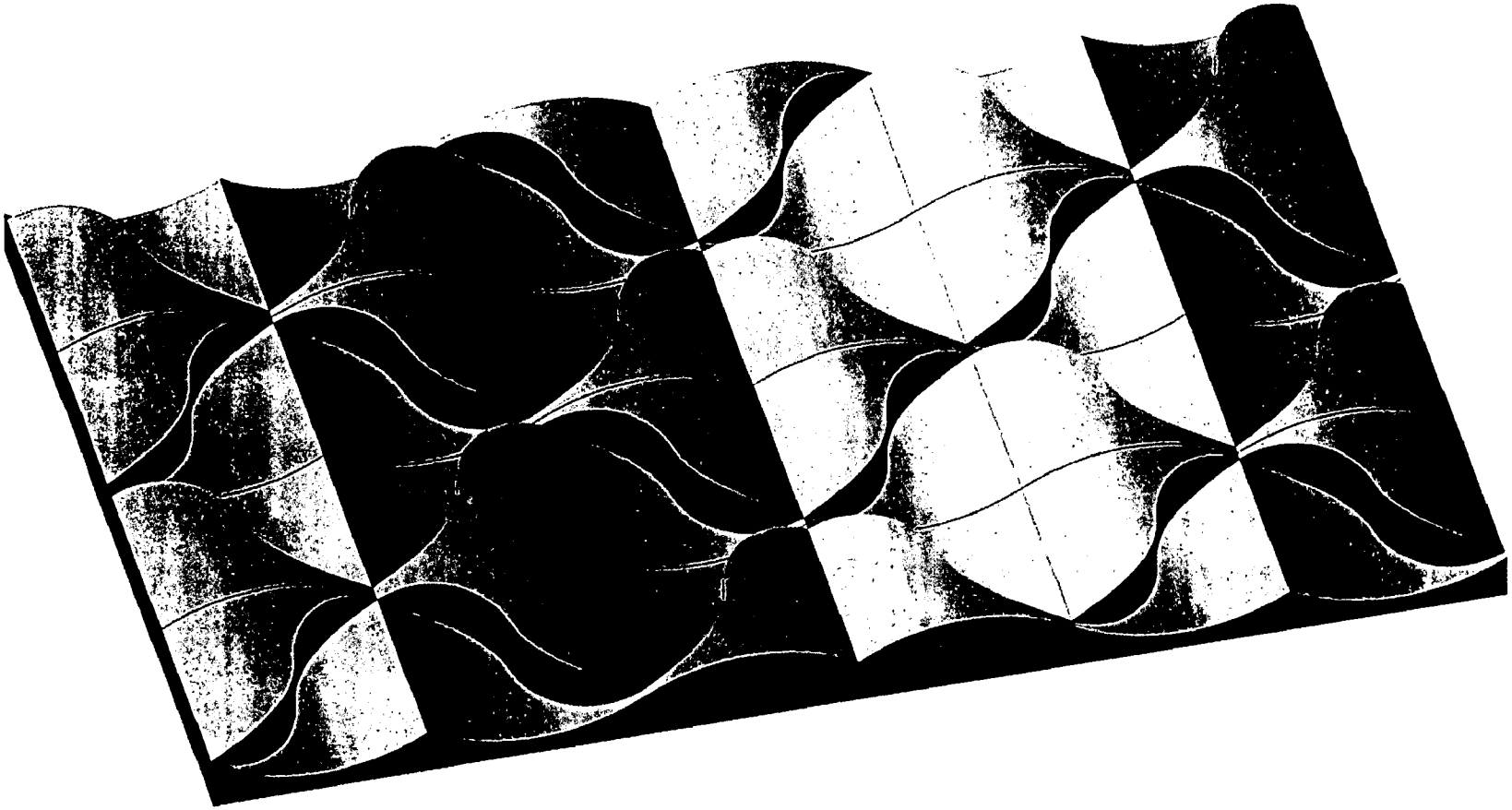
Figure 8E:
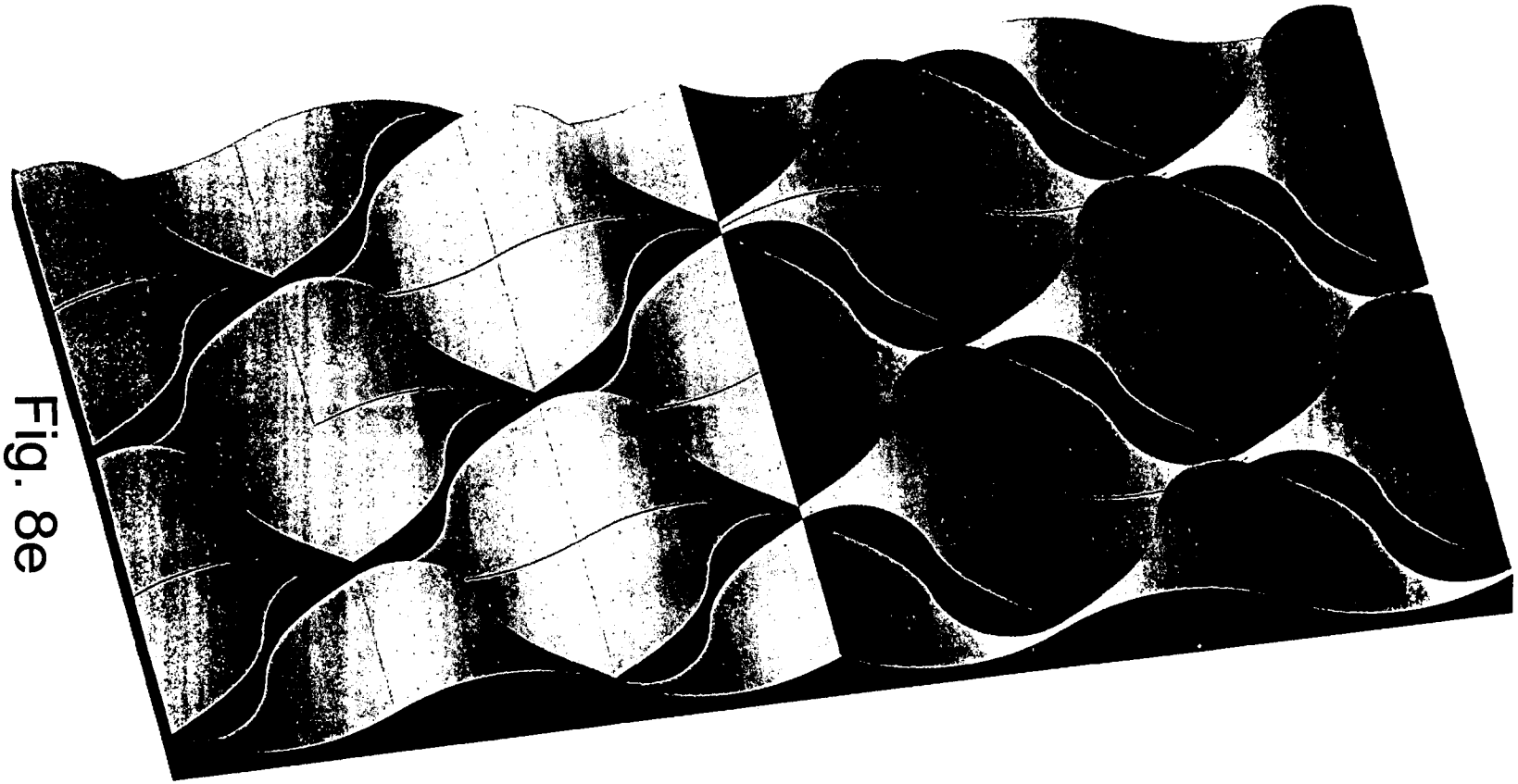
Figure 8F:
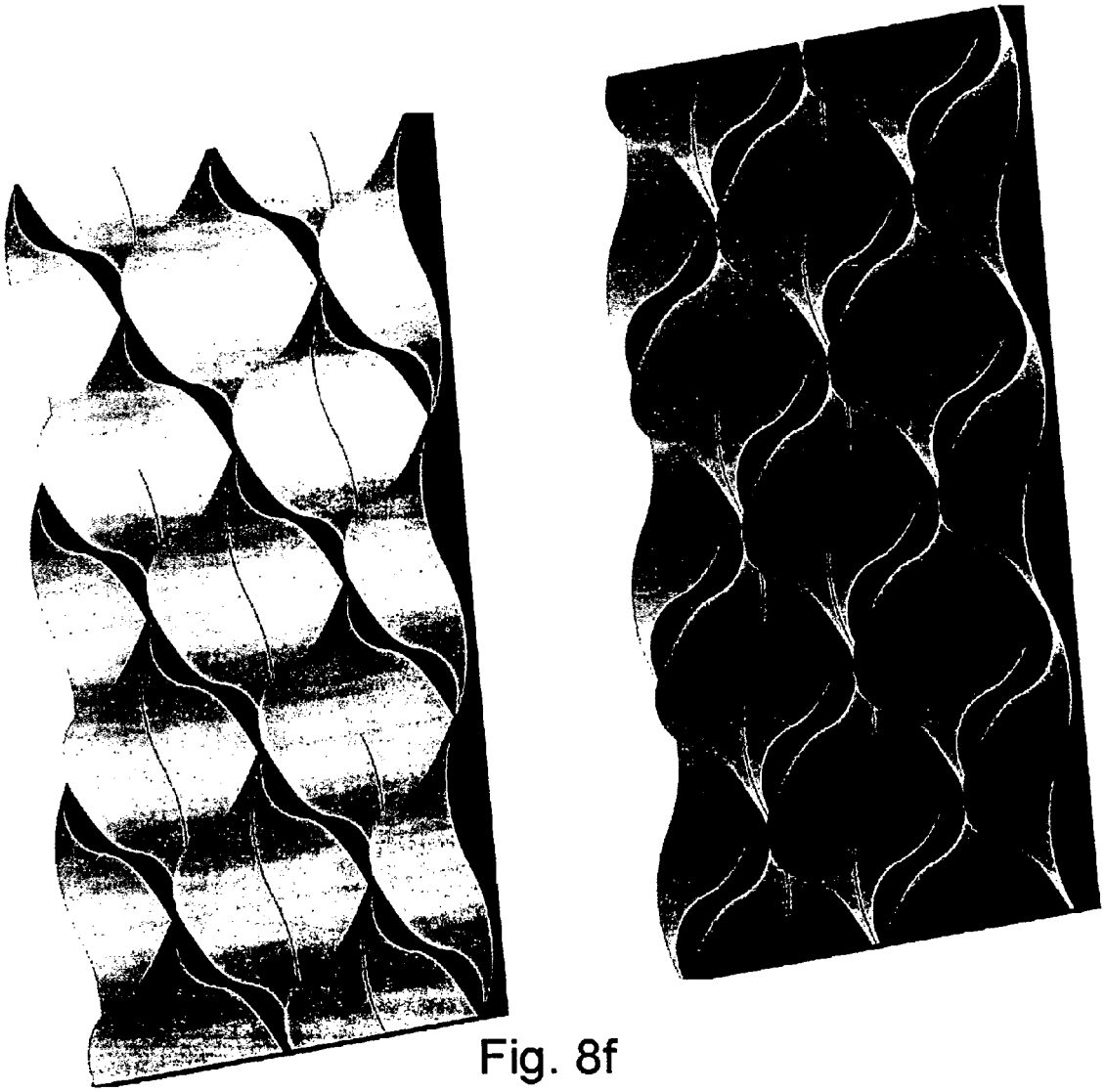
Figure 8G:
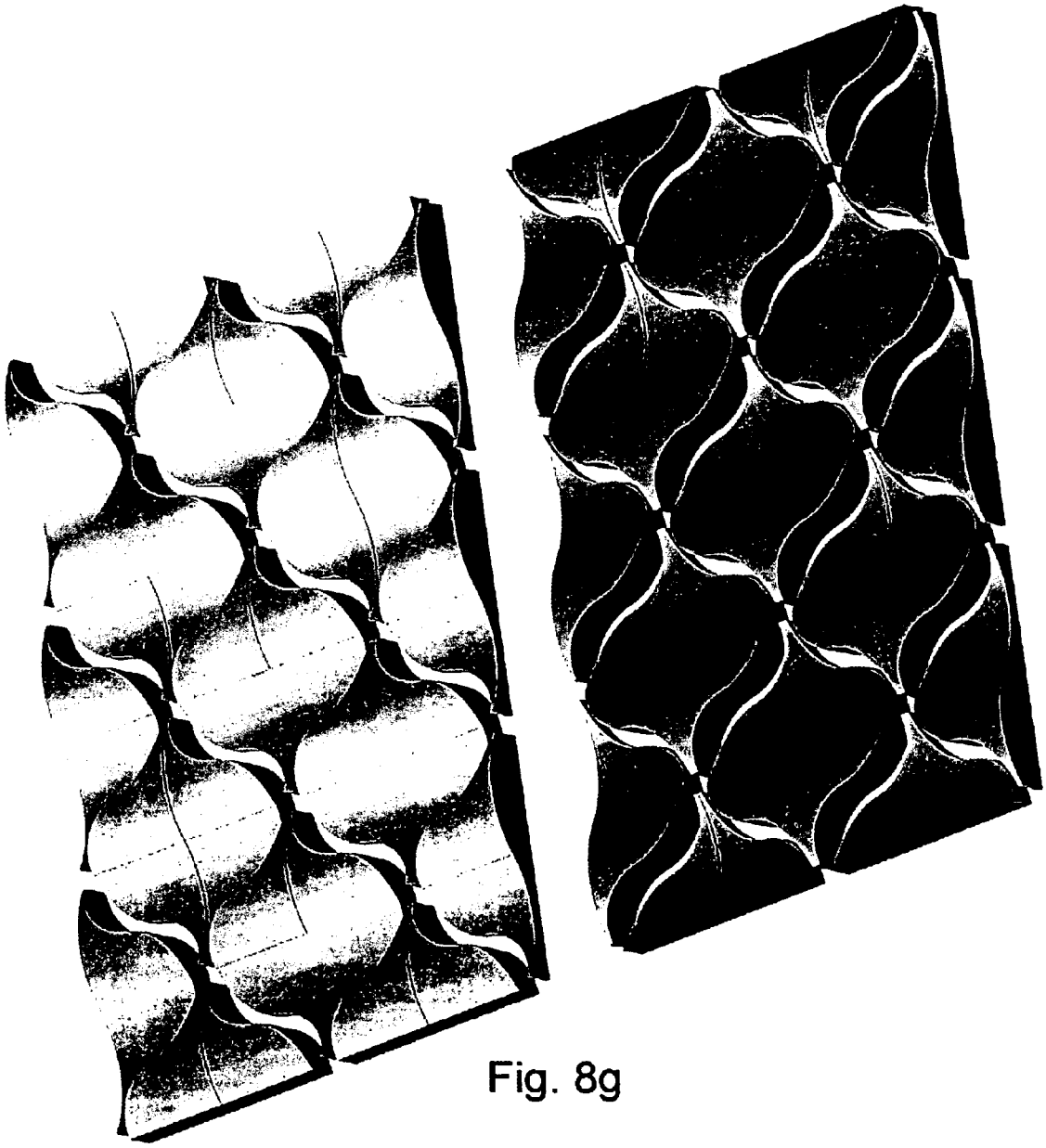
Figure 8H:
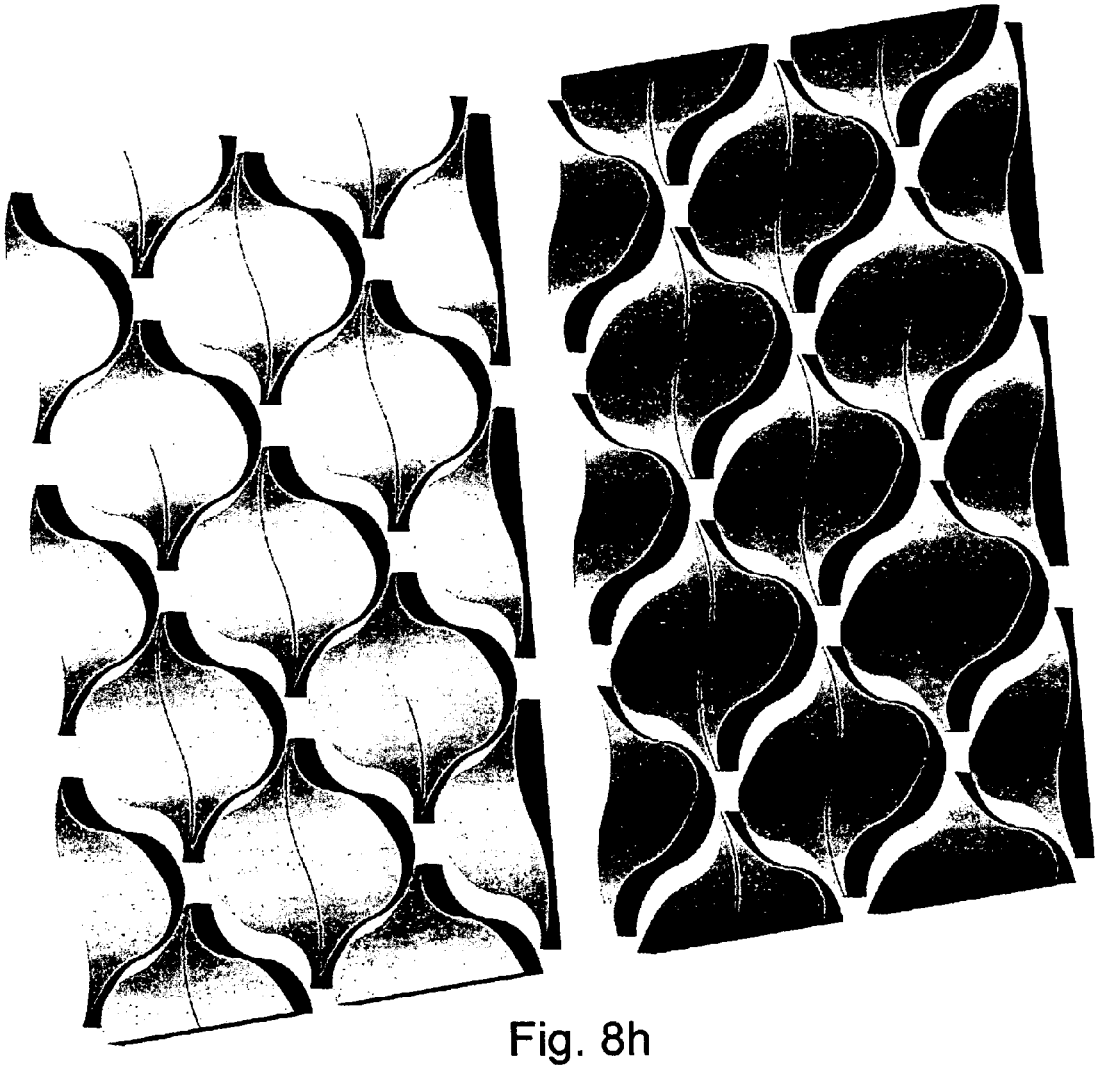
Figure 8I:
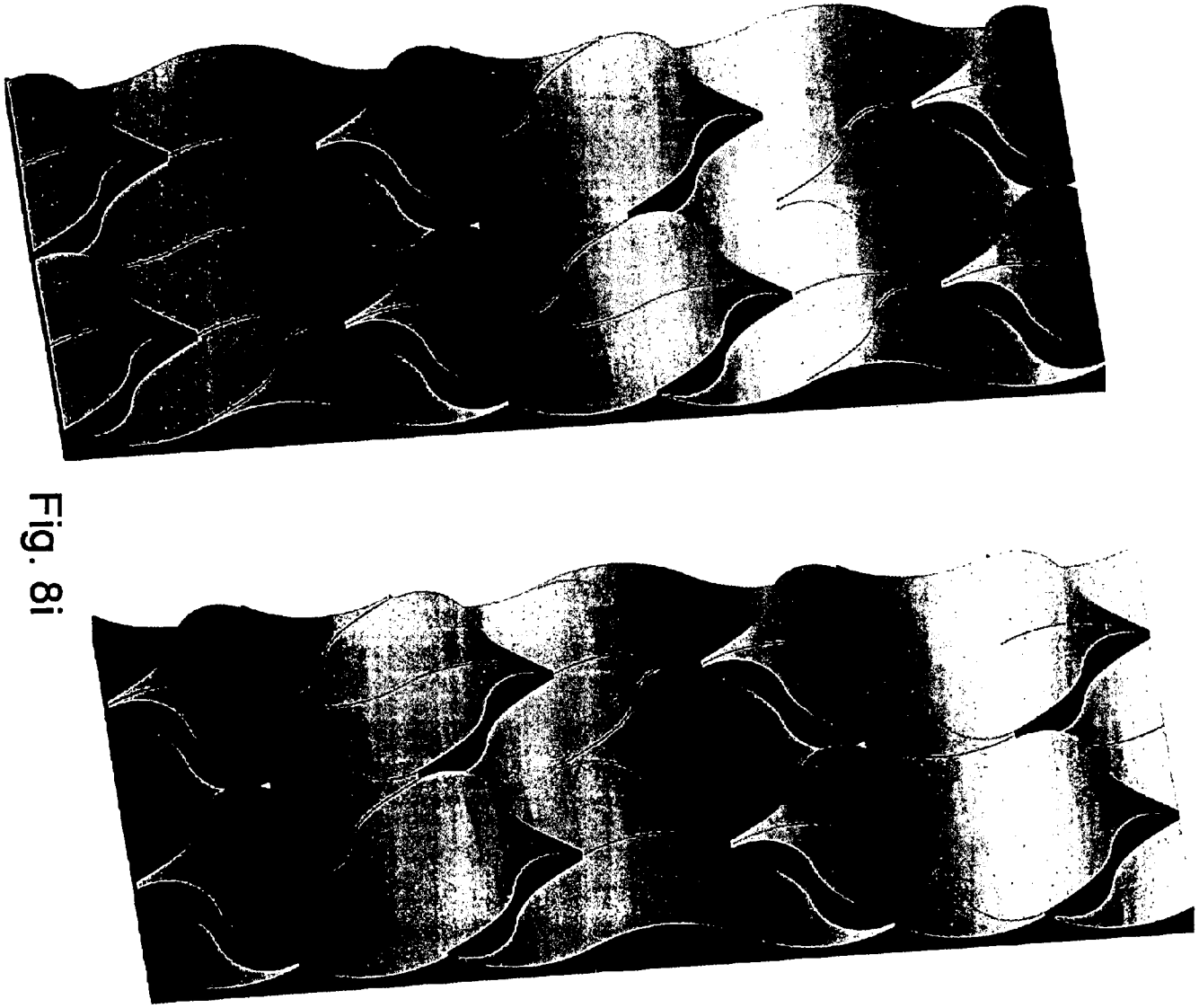
Figure 8J:
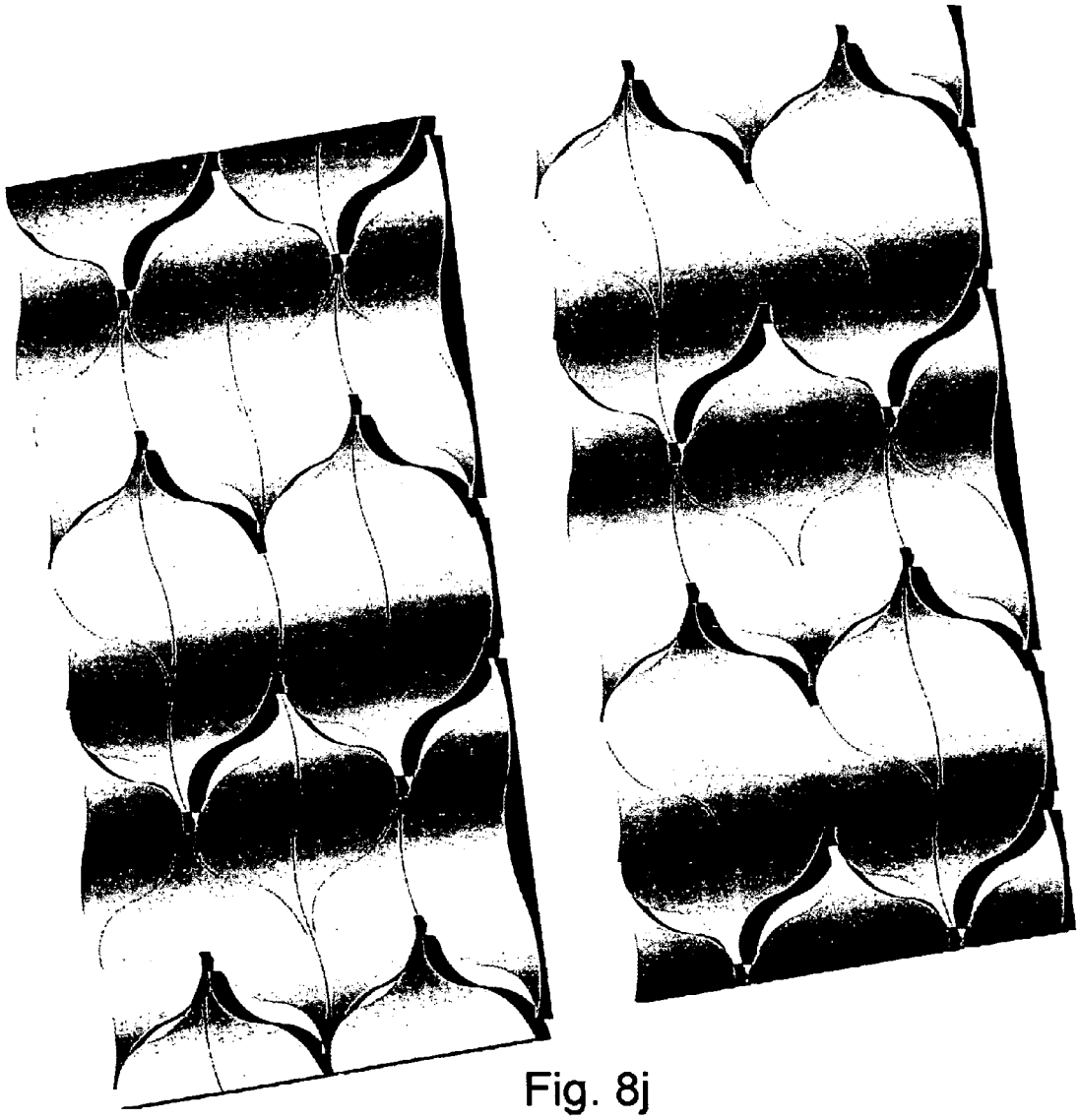
Figure 8K:
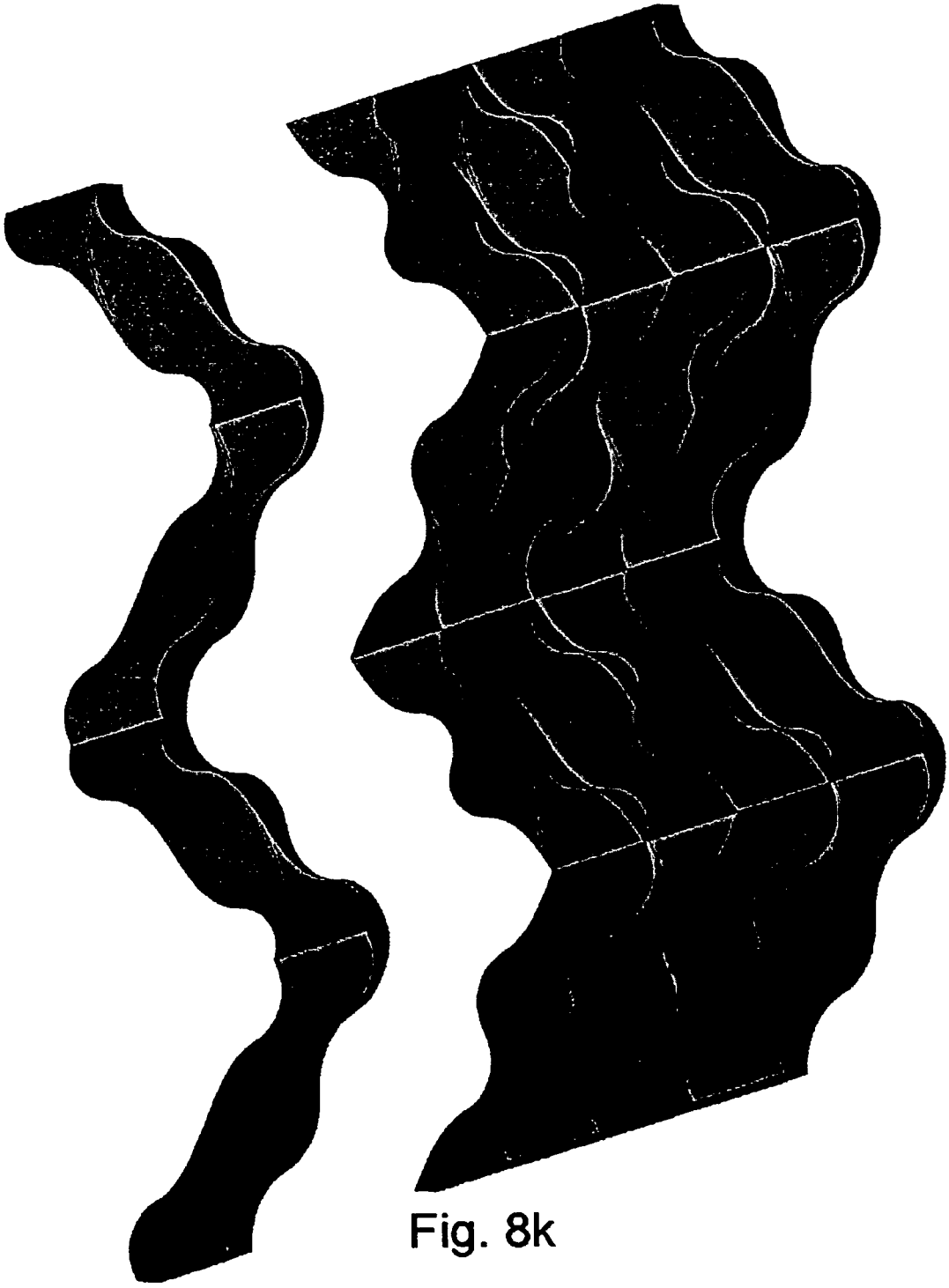
Figure 8M:
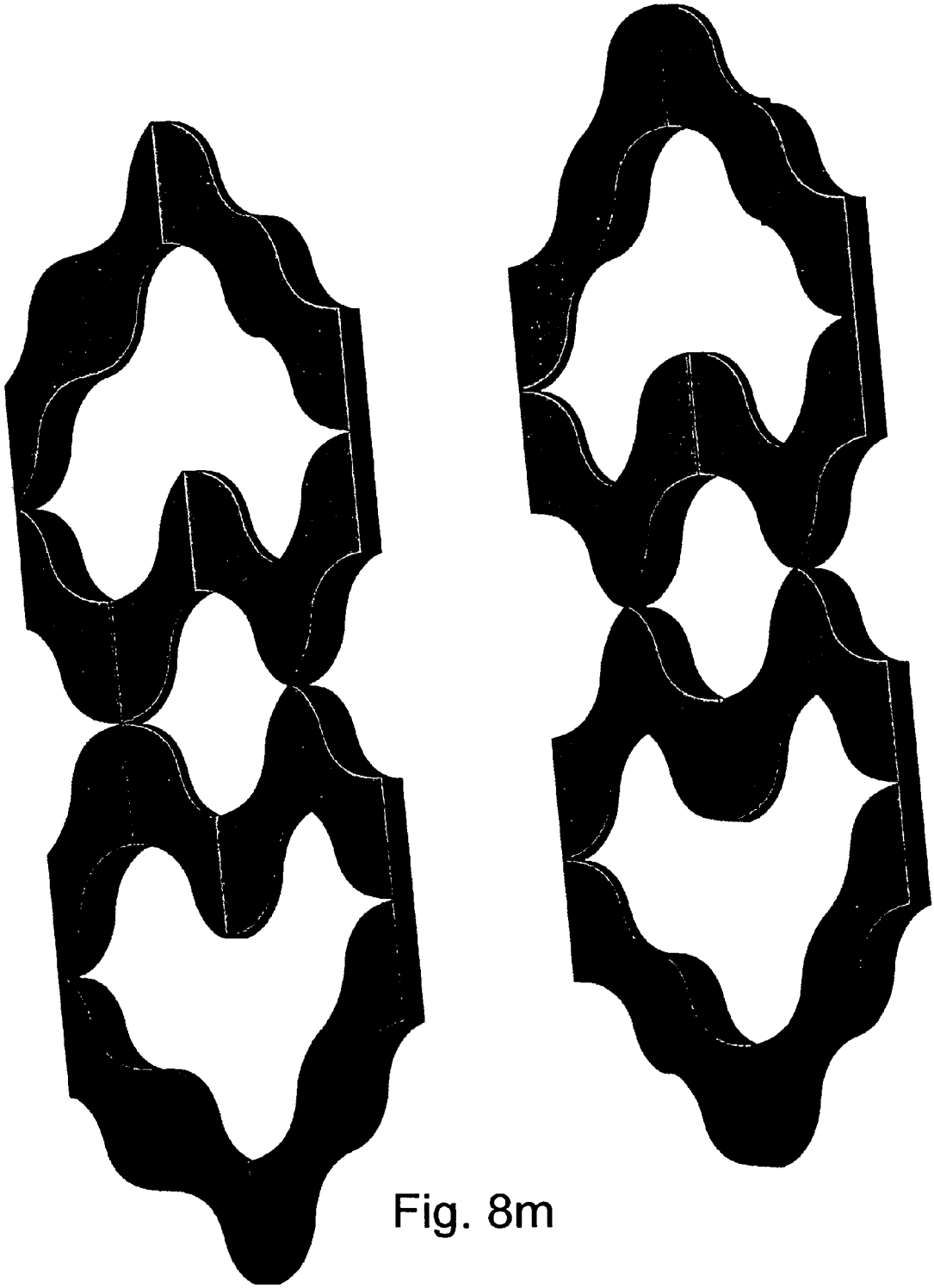
Figure 8N:
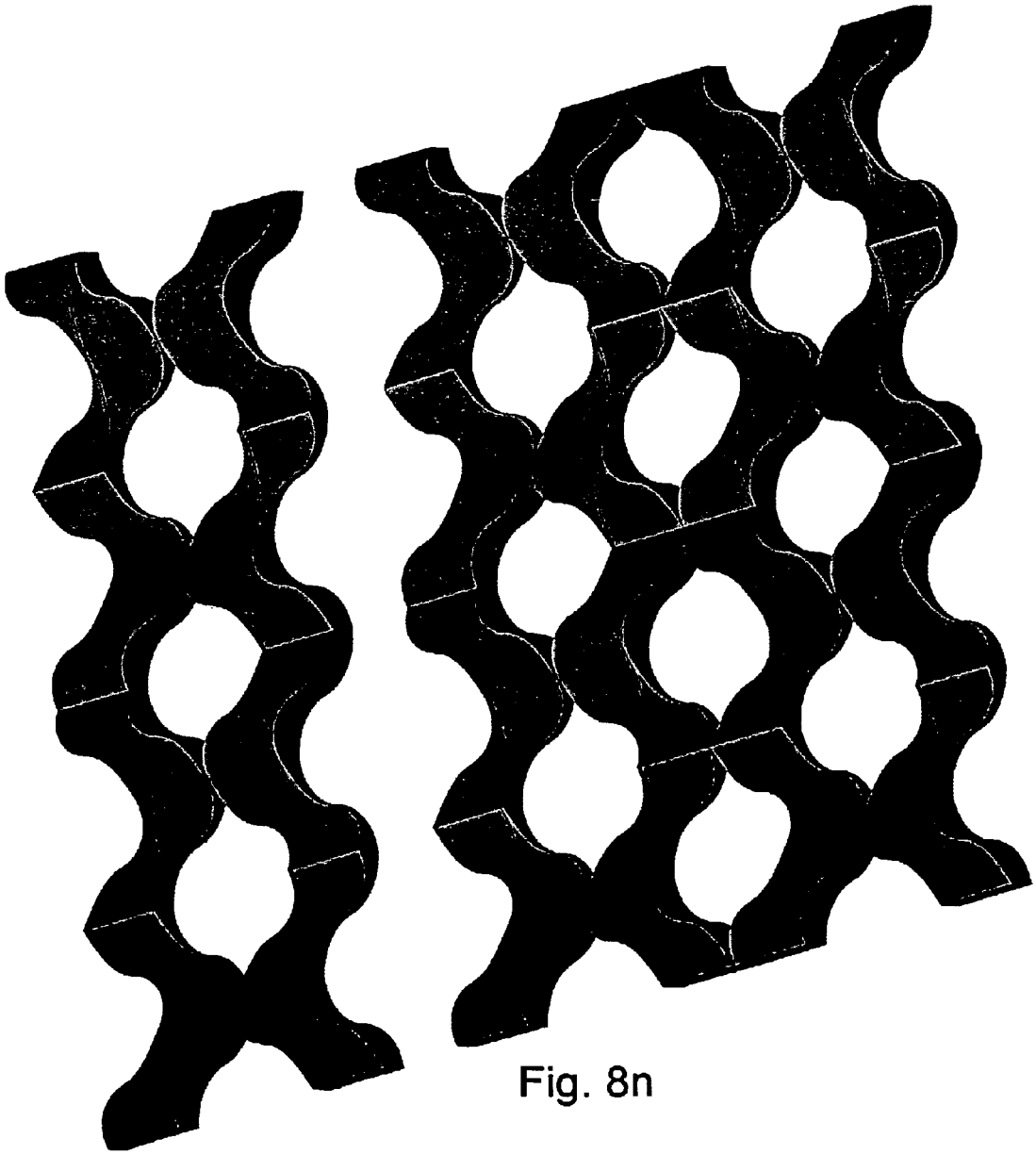
Figure 8O:
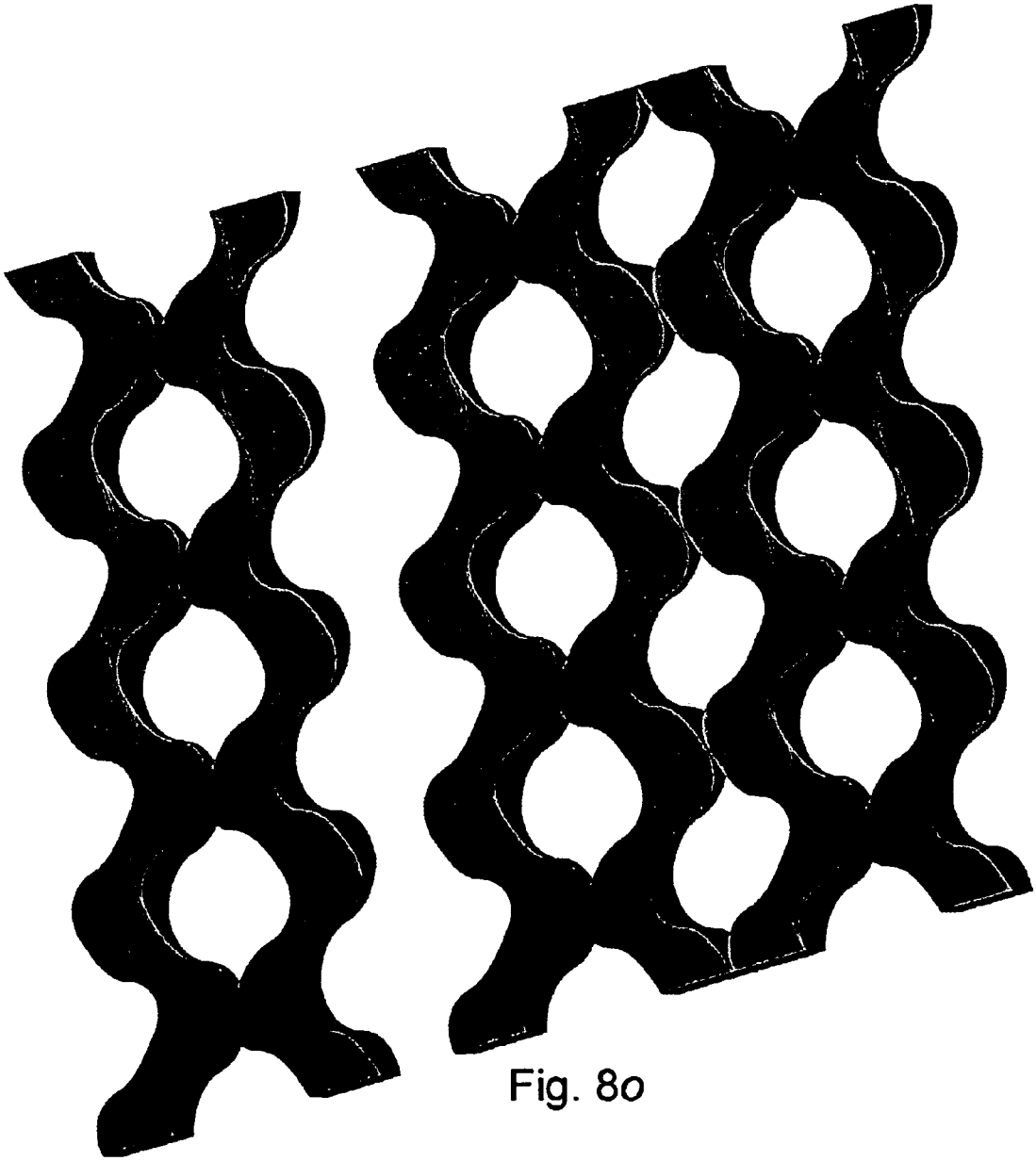
Figure 8P:
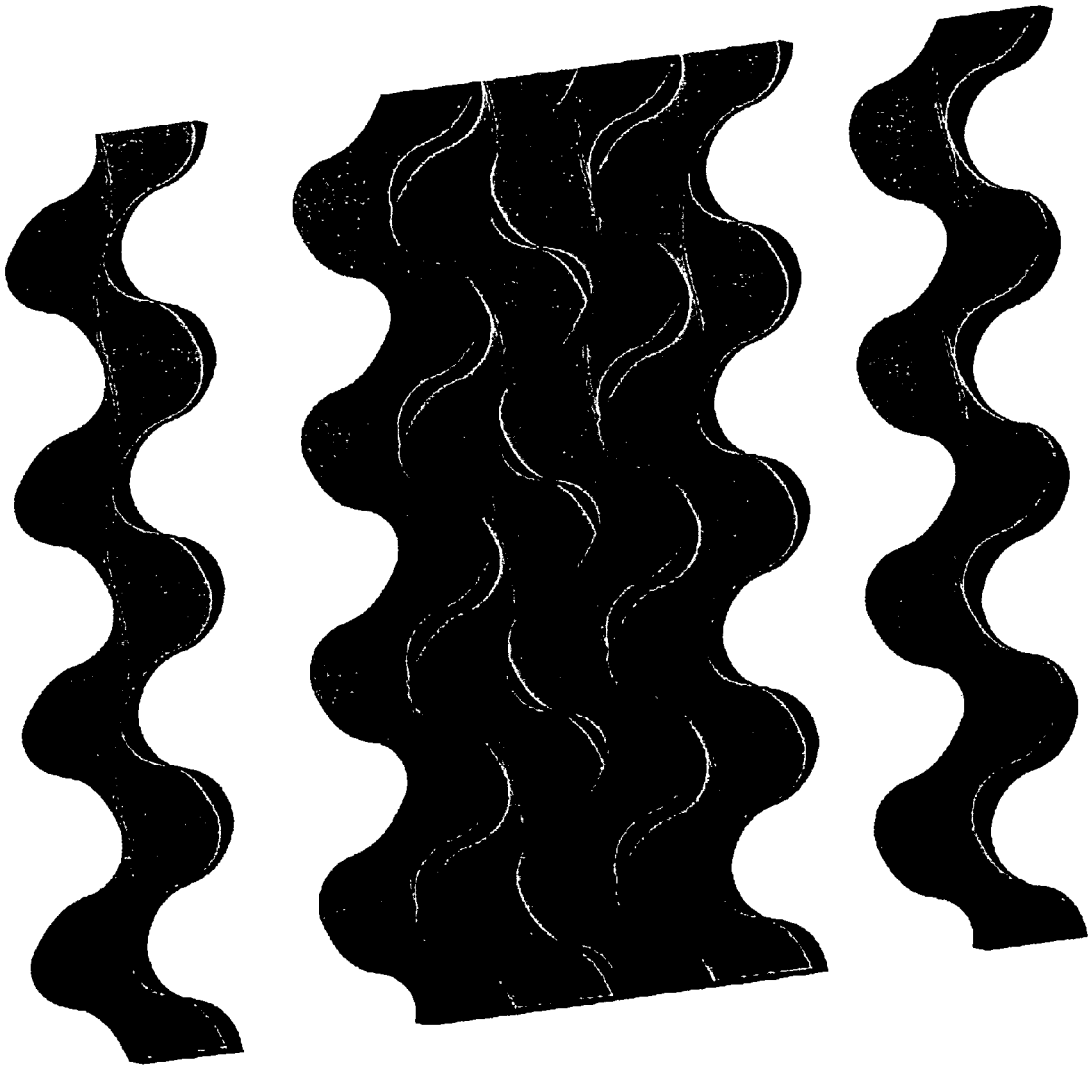
Figure 8R:
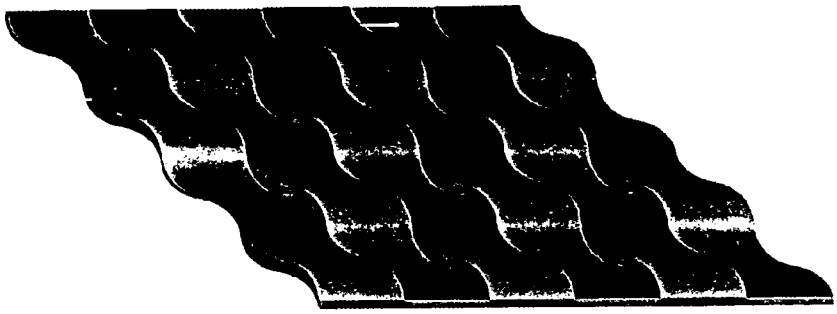
Figure 8R:
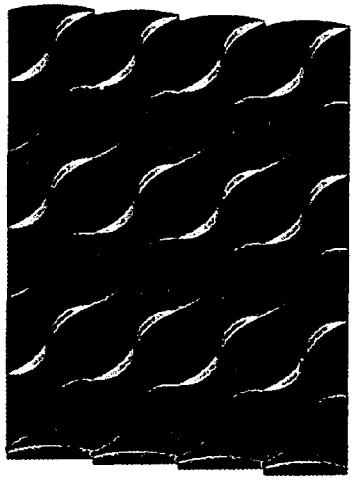
Figure 8Q:
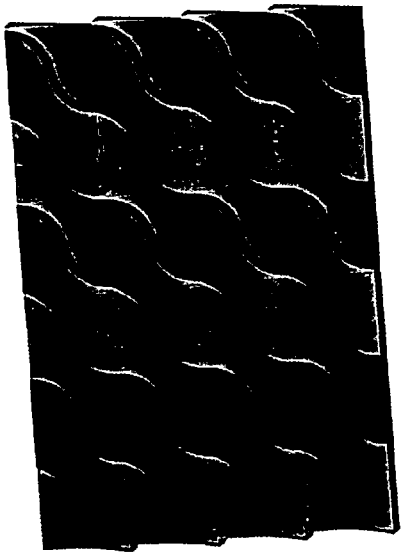
Figure 8Q:
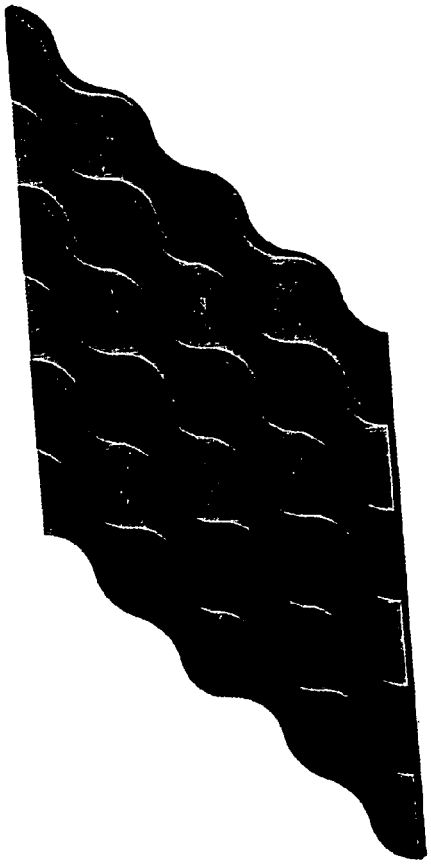
Figure 8S:
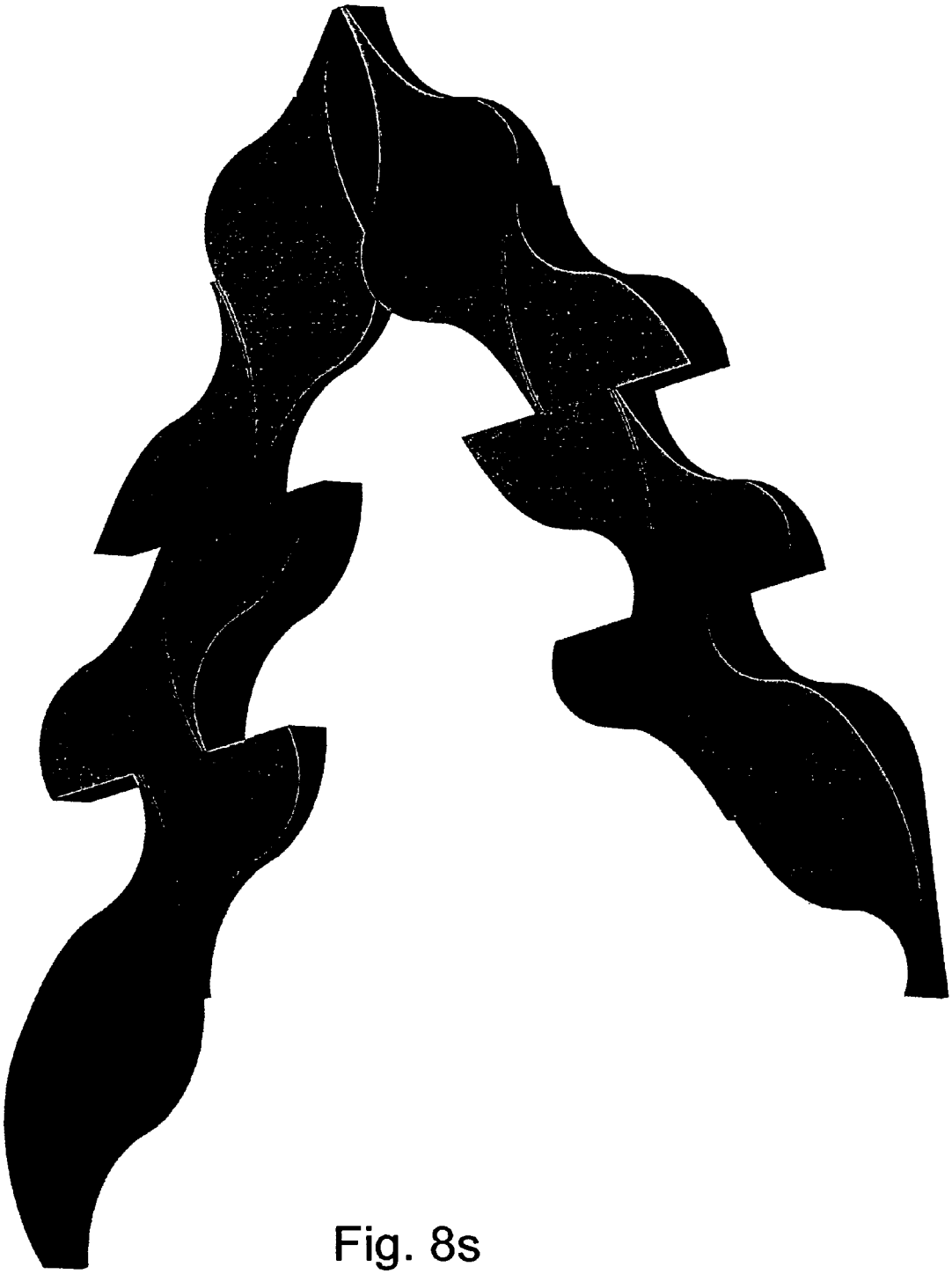
Figure 8T:
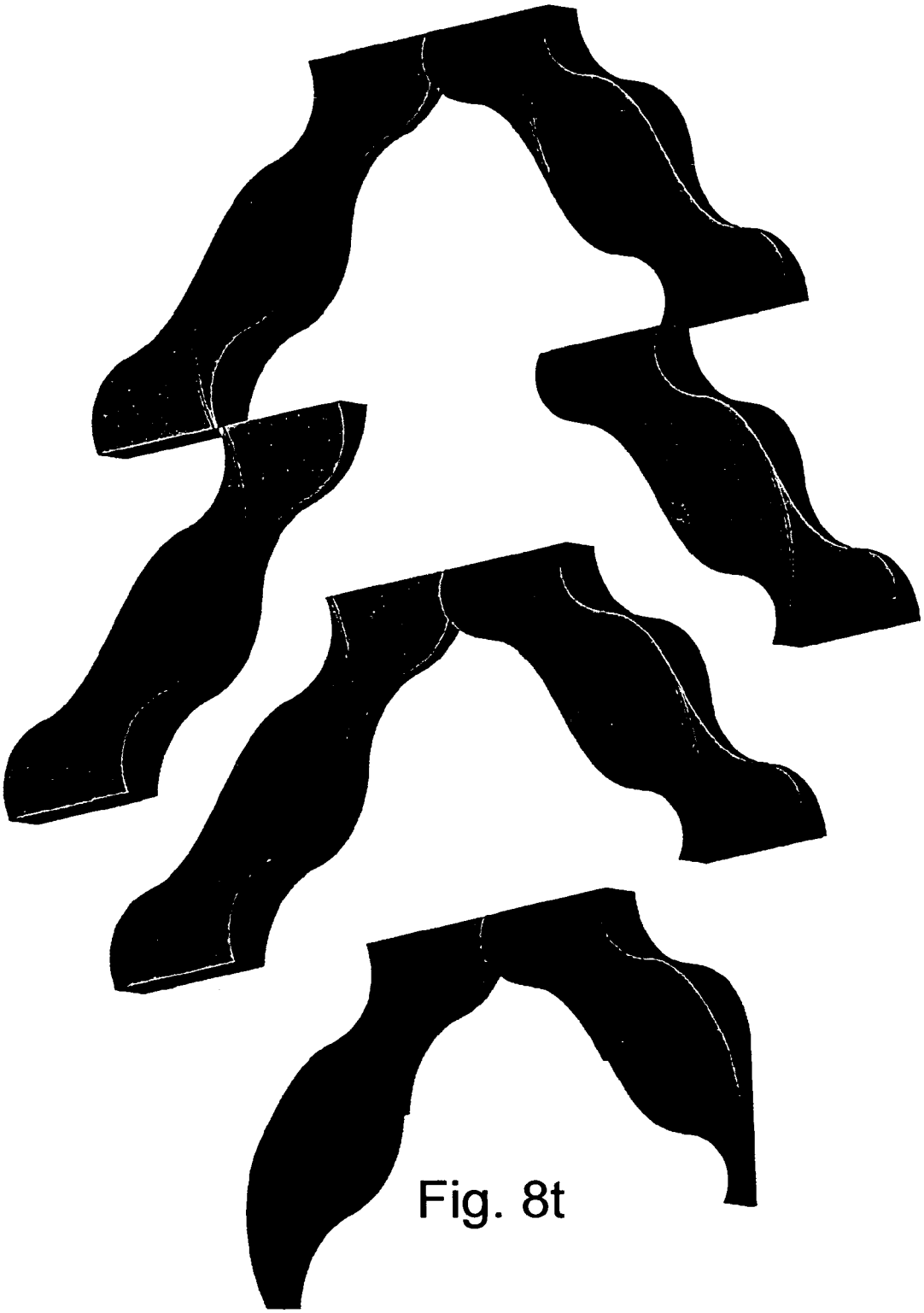
Figure 8U:
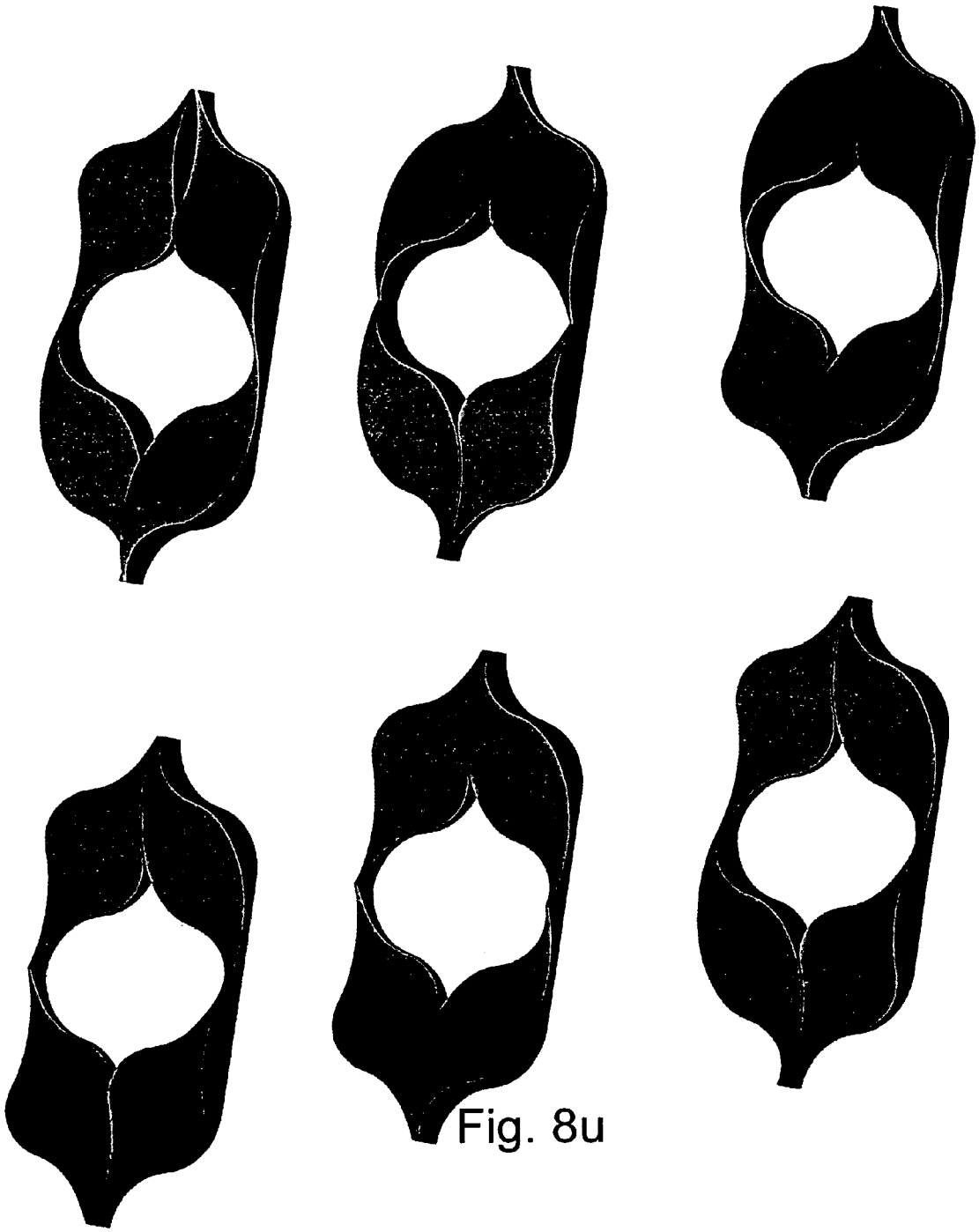
Figure 8V:
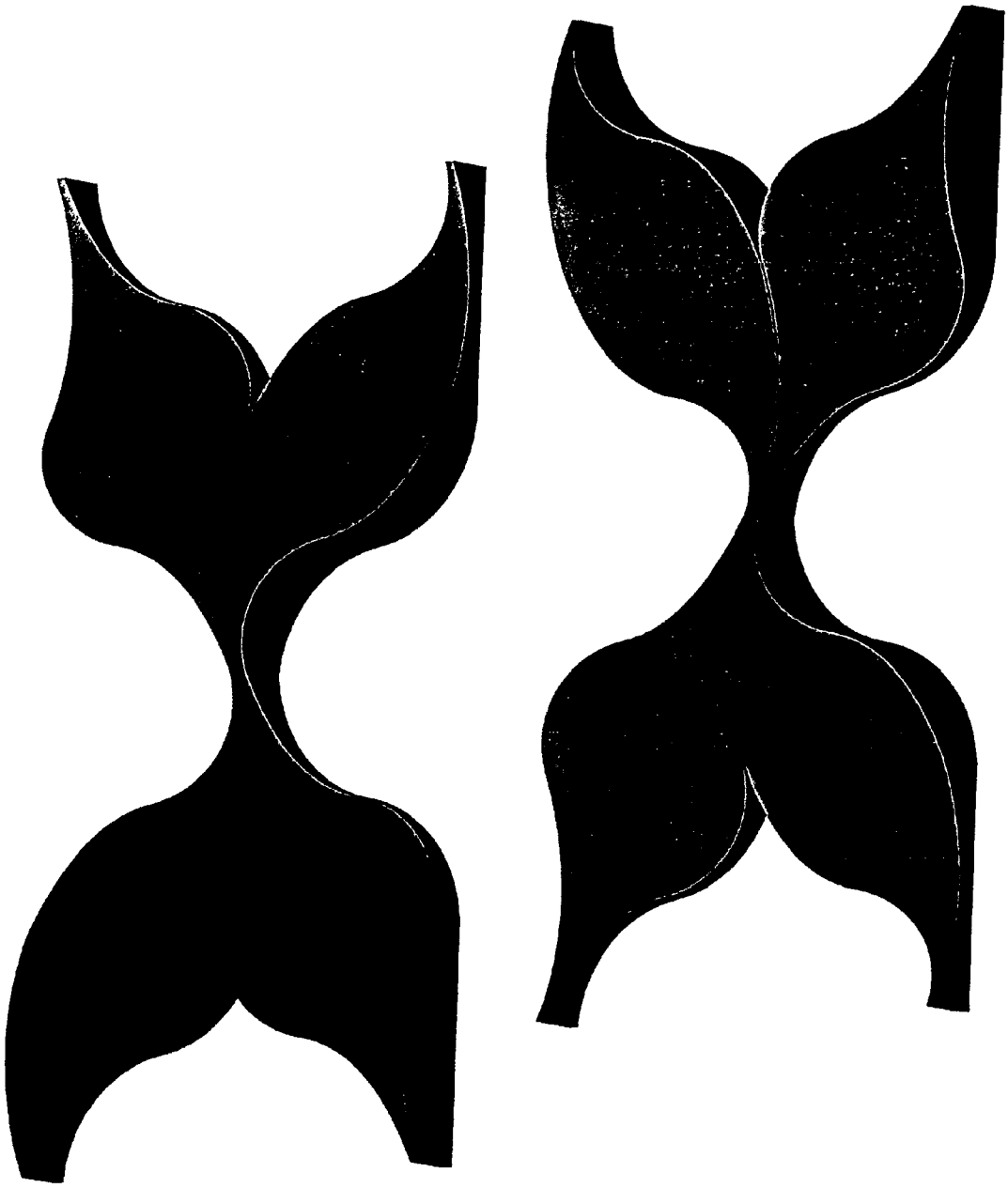
Figure 8W:
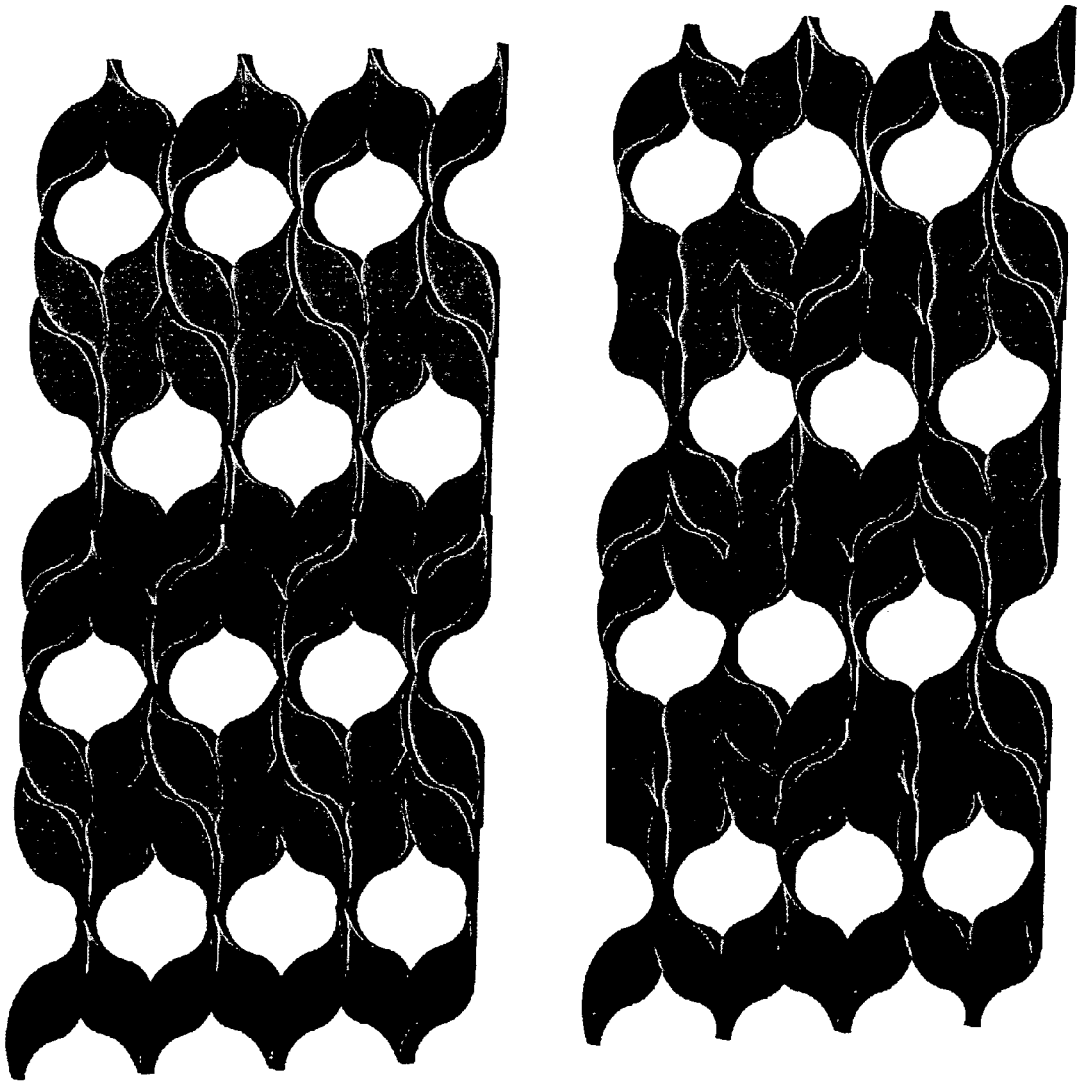
Figure 10A:
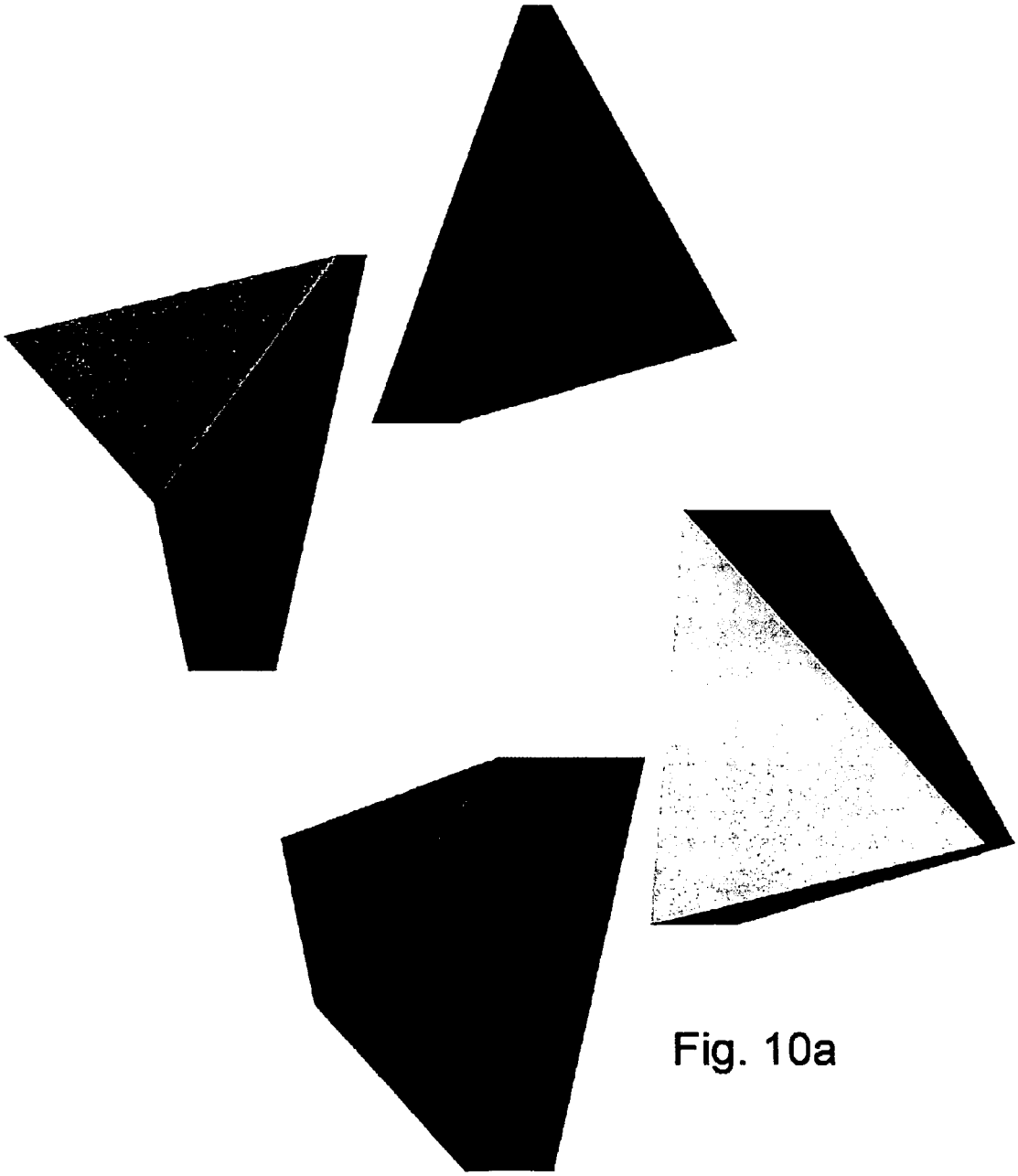
FIGS. 10*a* through 10*u* illustrate another embodiment of the invention, several arrangements as installed on a wall or ceiling, and a packing/unpacking configuration.
Figure 10B:
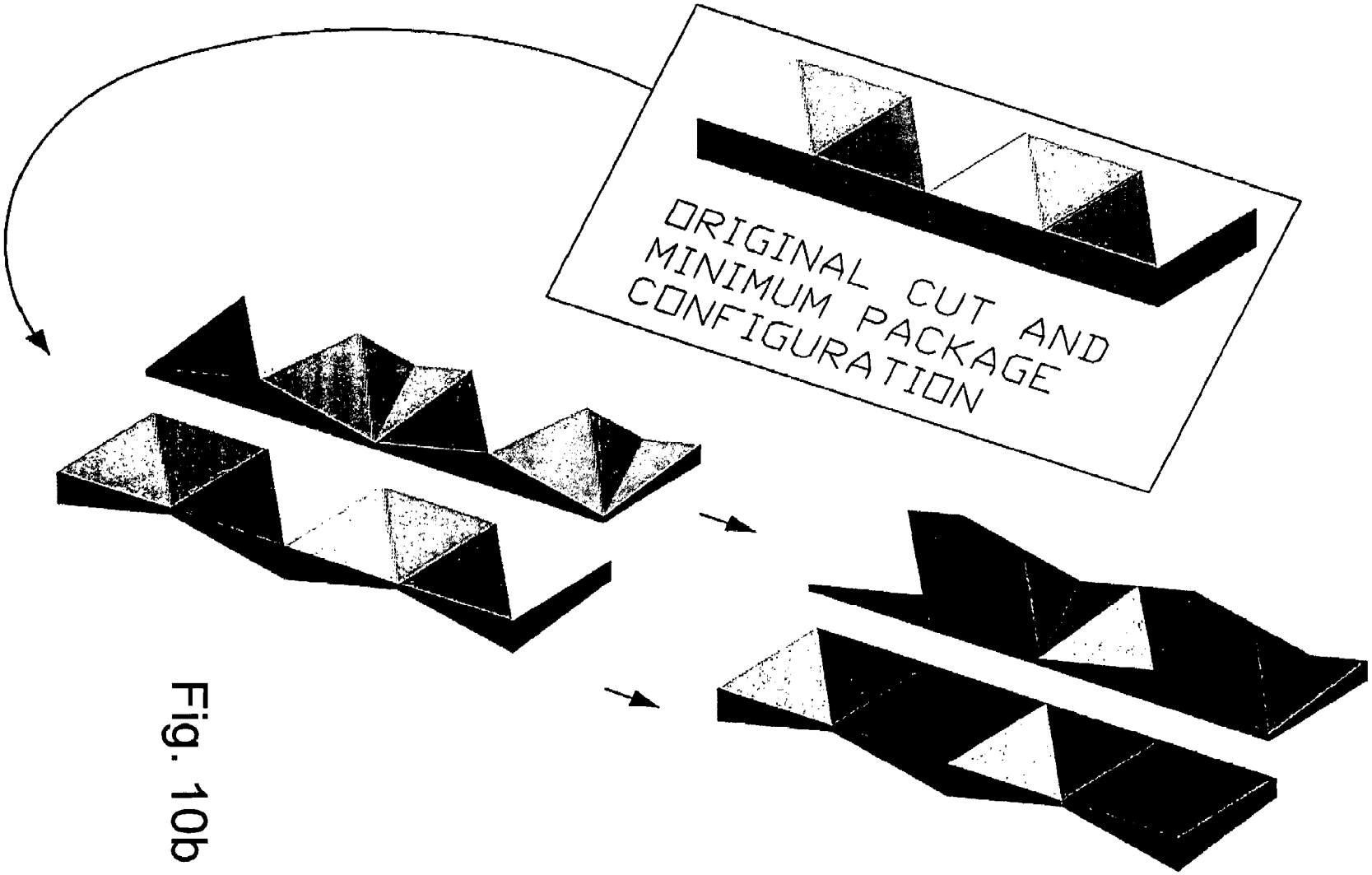
Figure 10C:
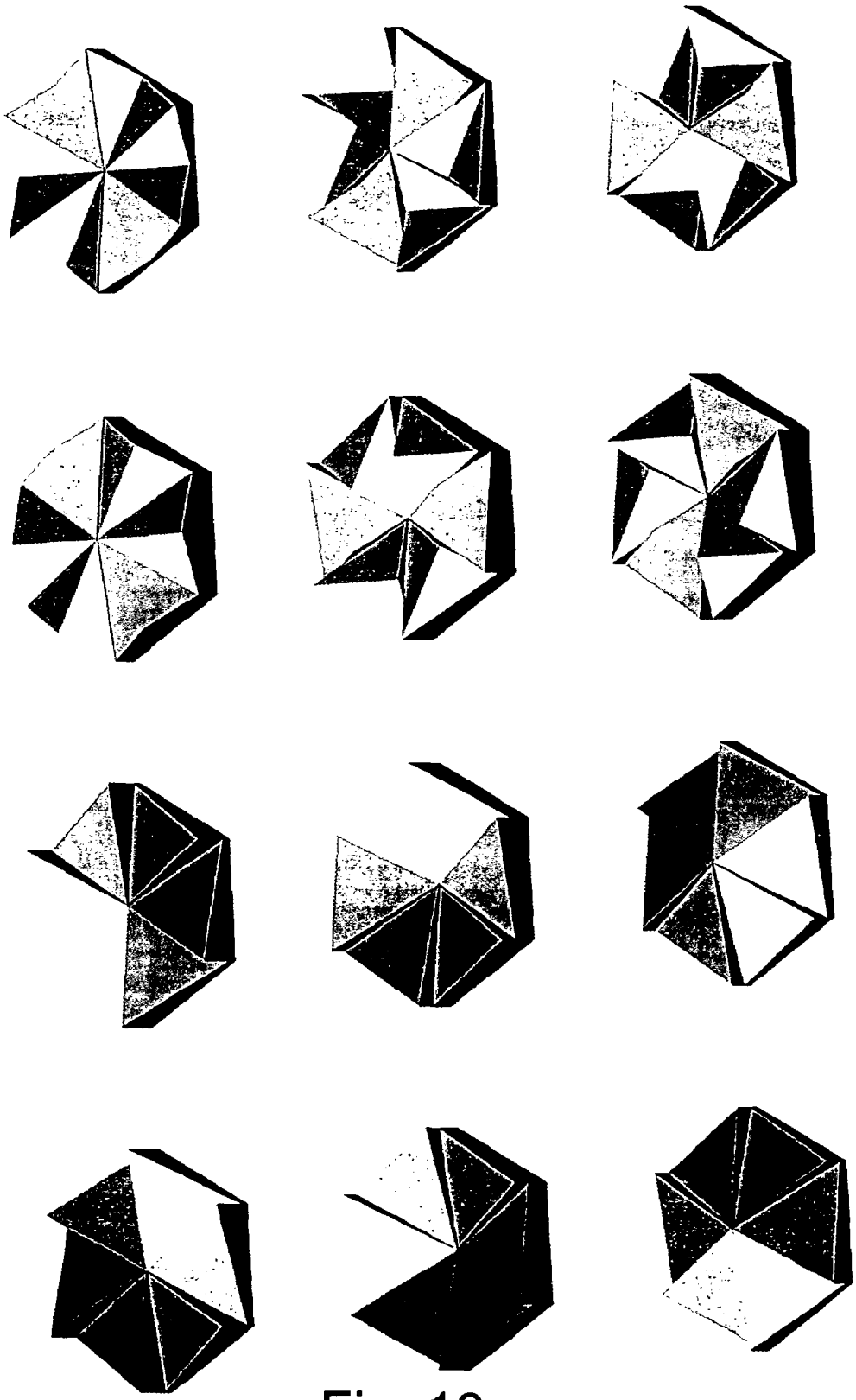
Figure 10D:
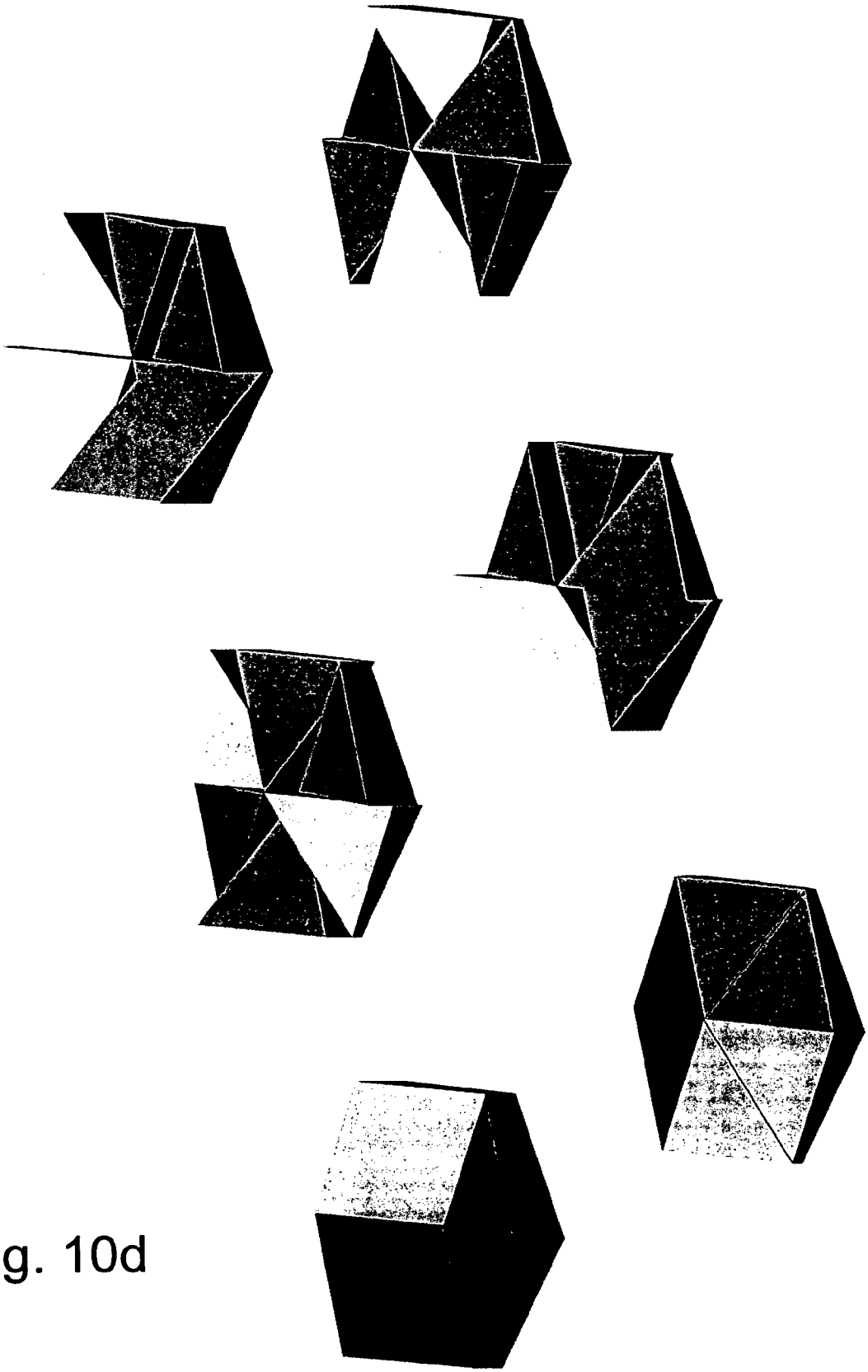
Figure 10E:
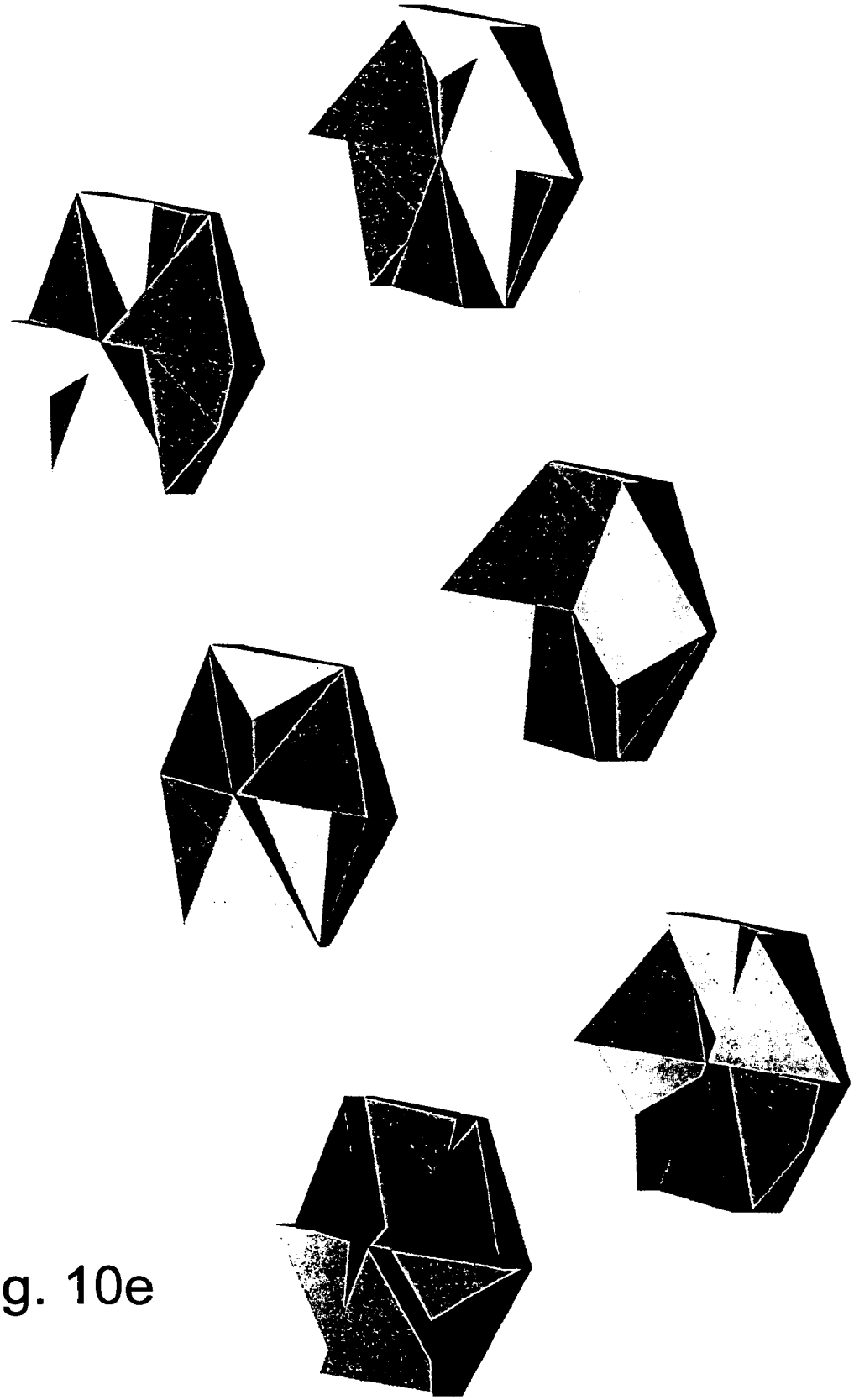
Figure 10F:
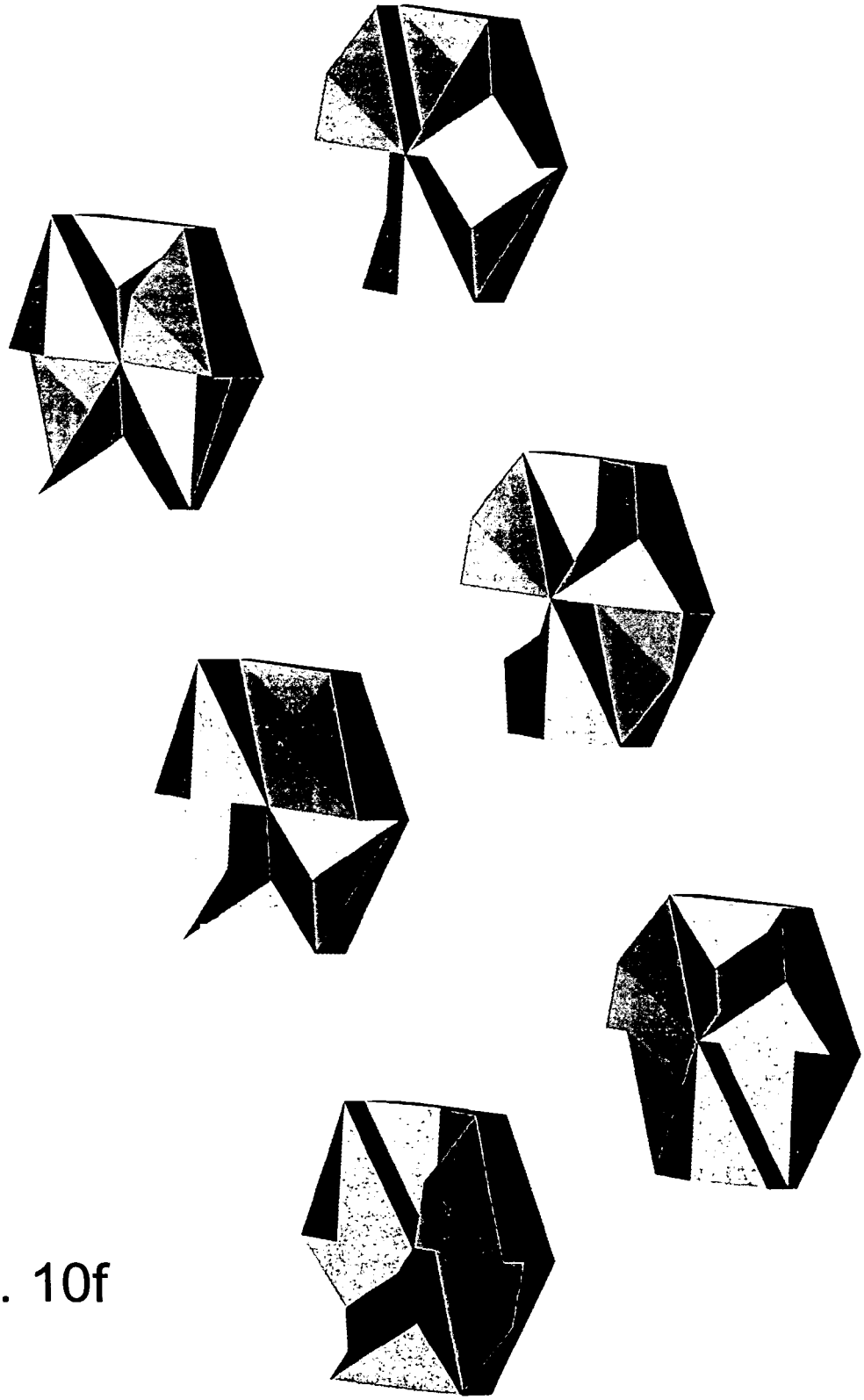
Figure 10G:
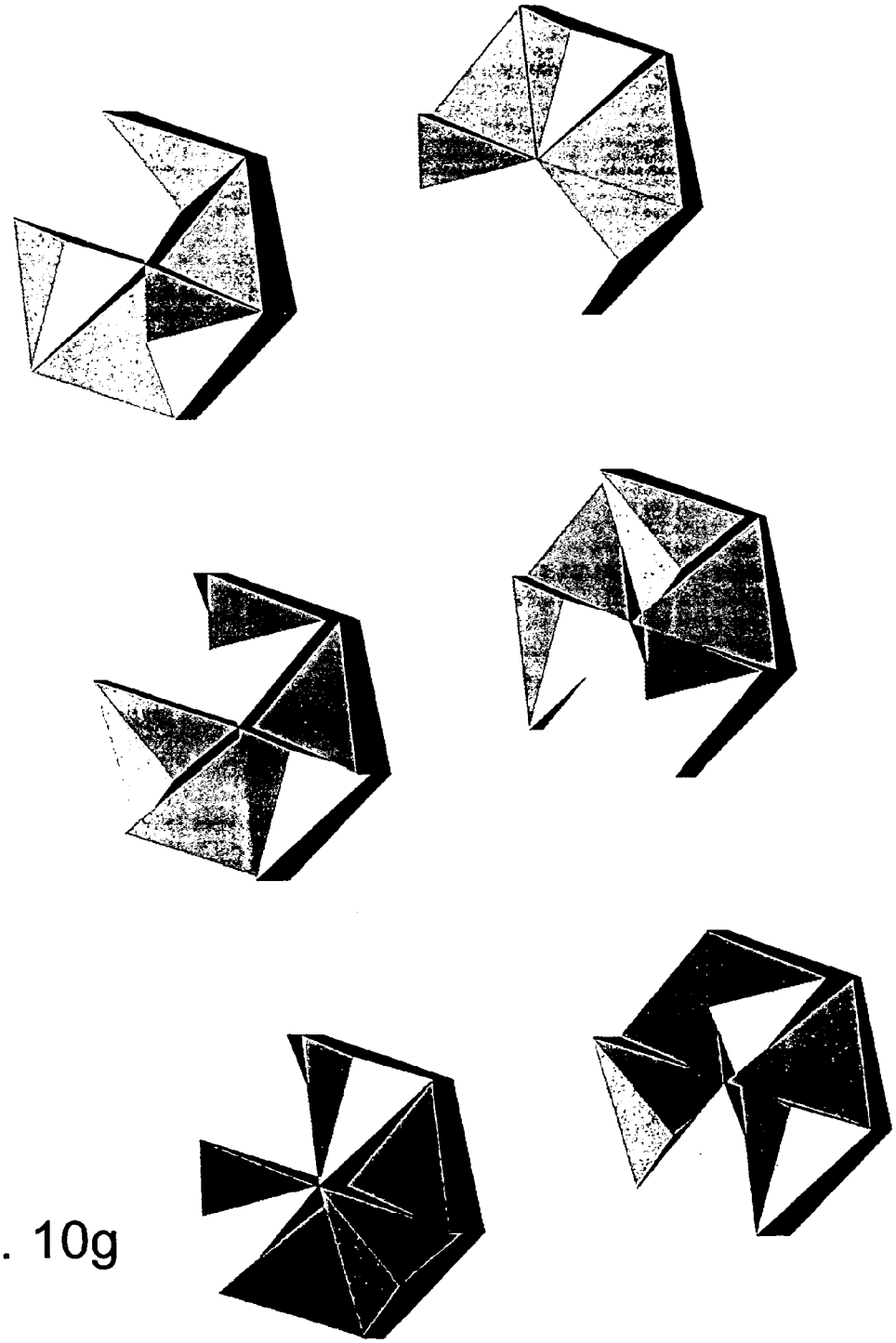
Figure 10H:
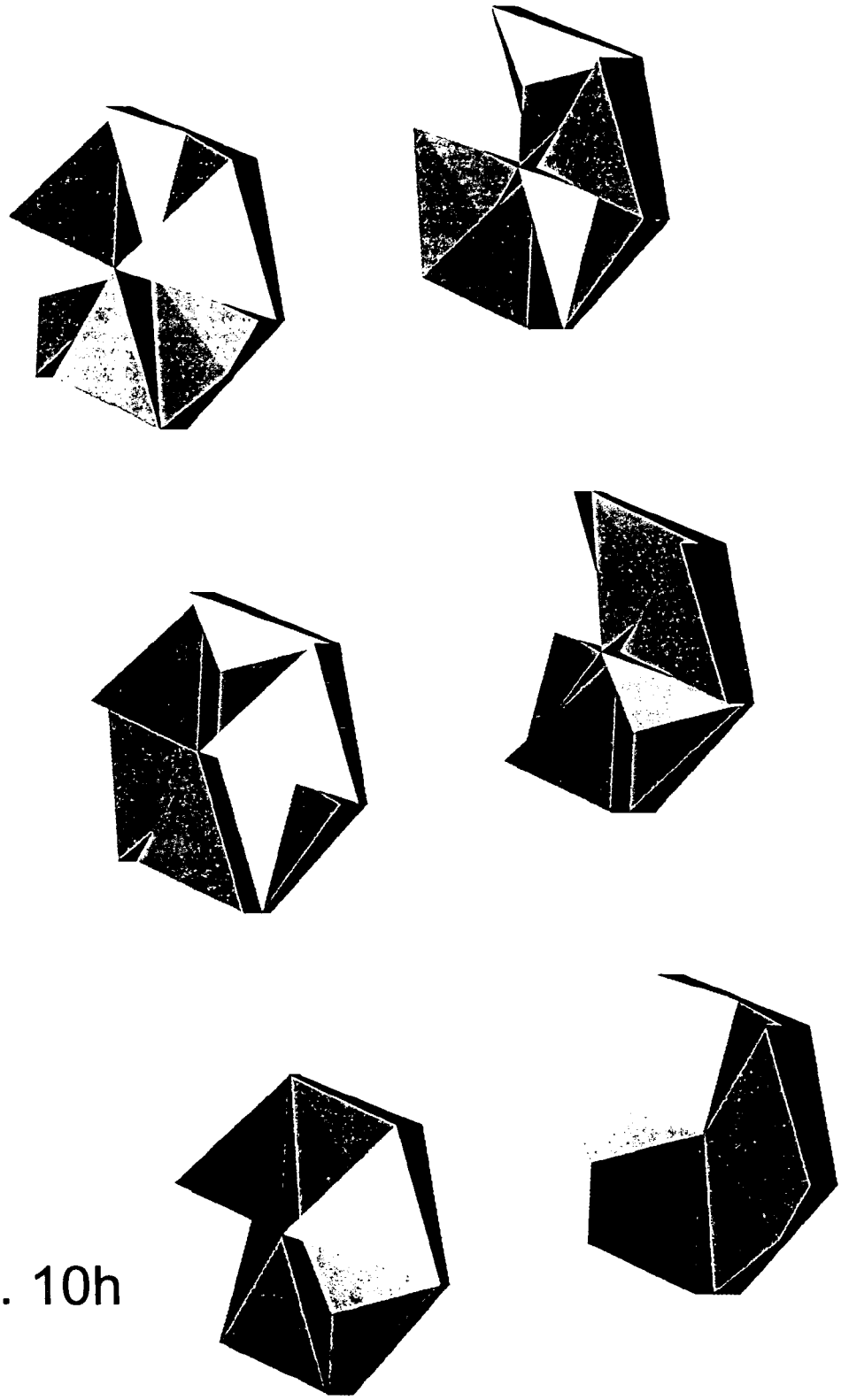
Figure 10I:
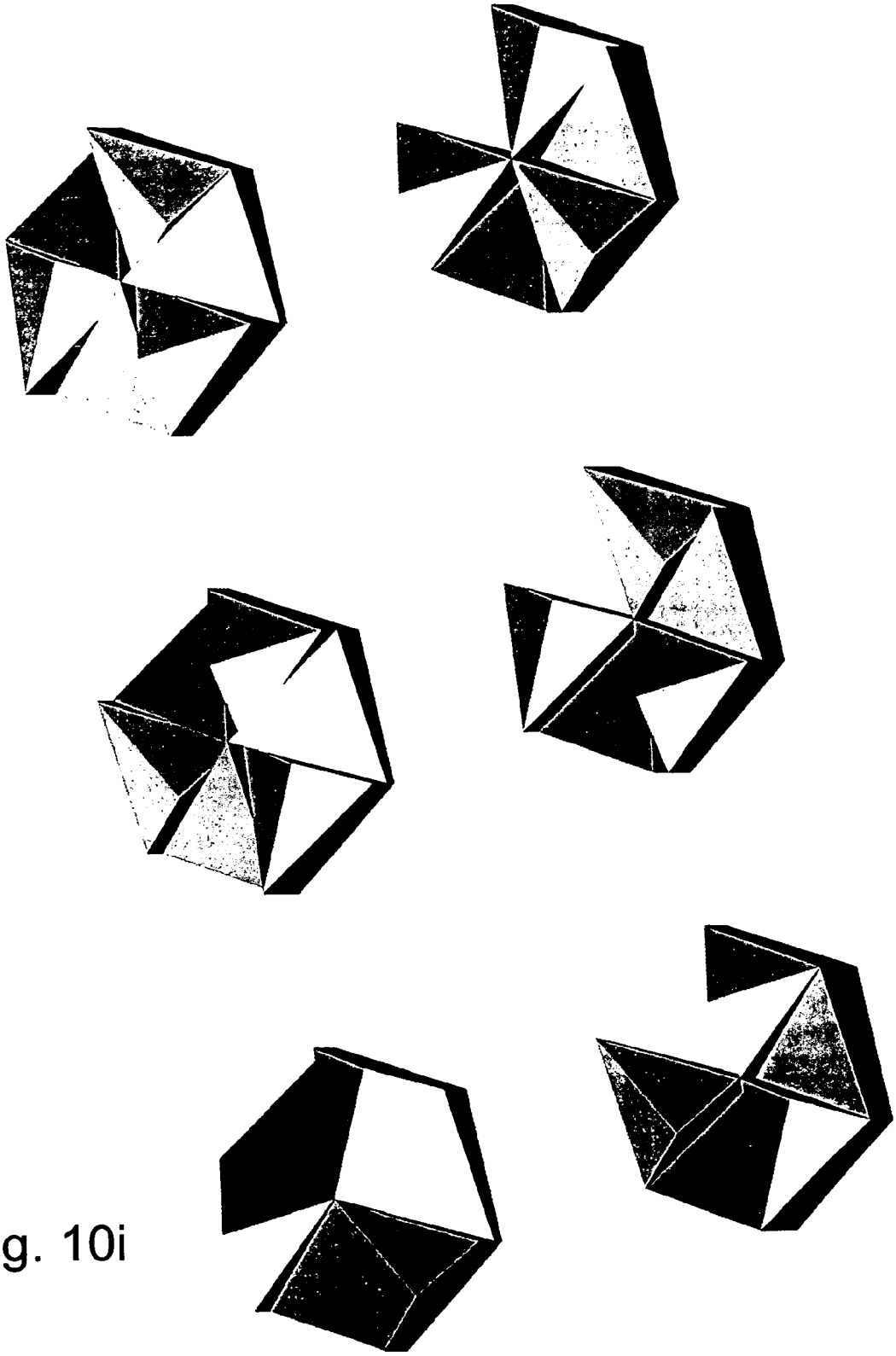
Figure 10J:
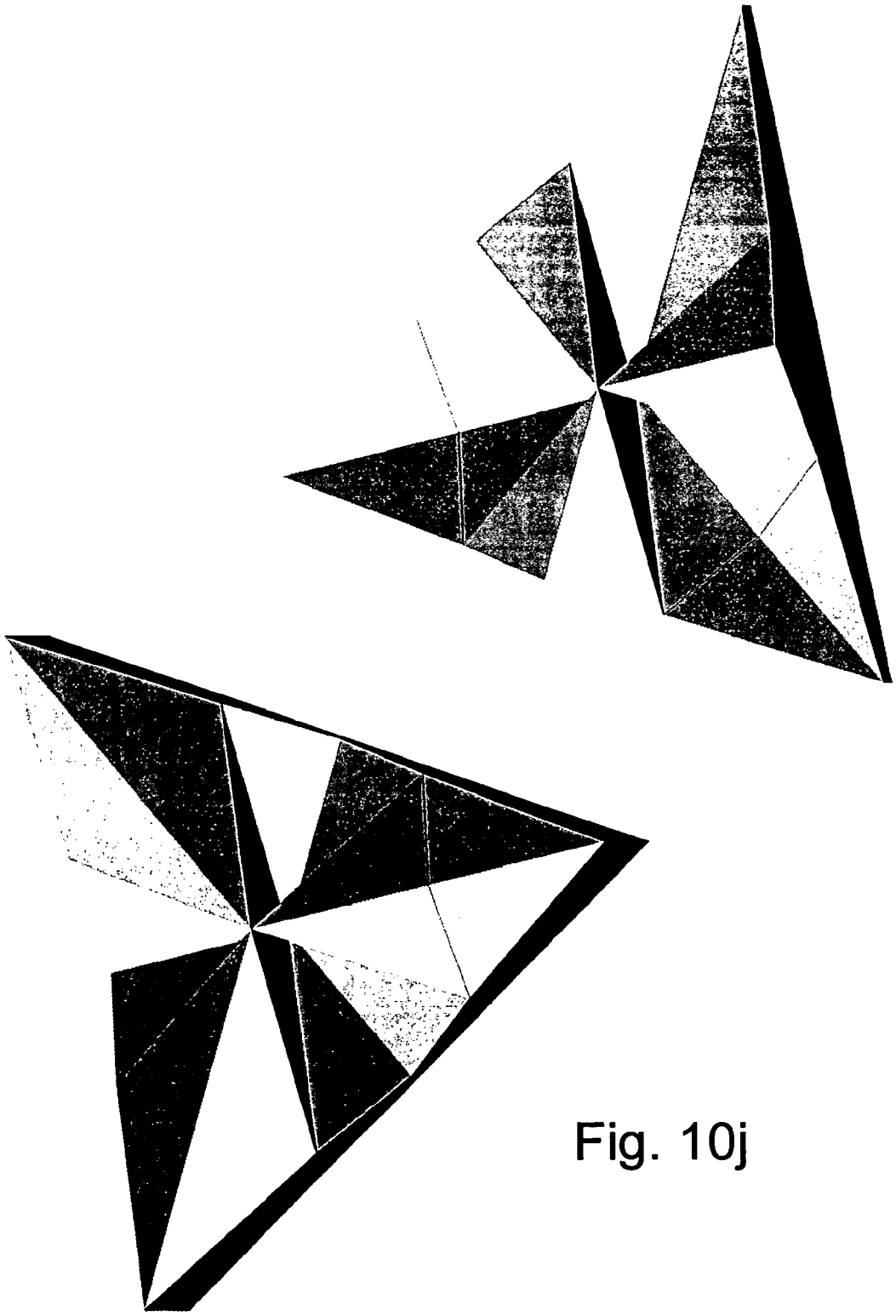
Figure 10K:
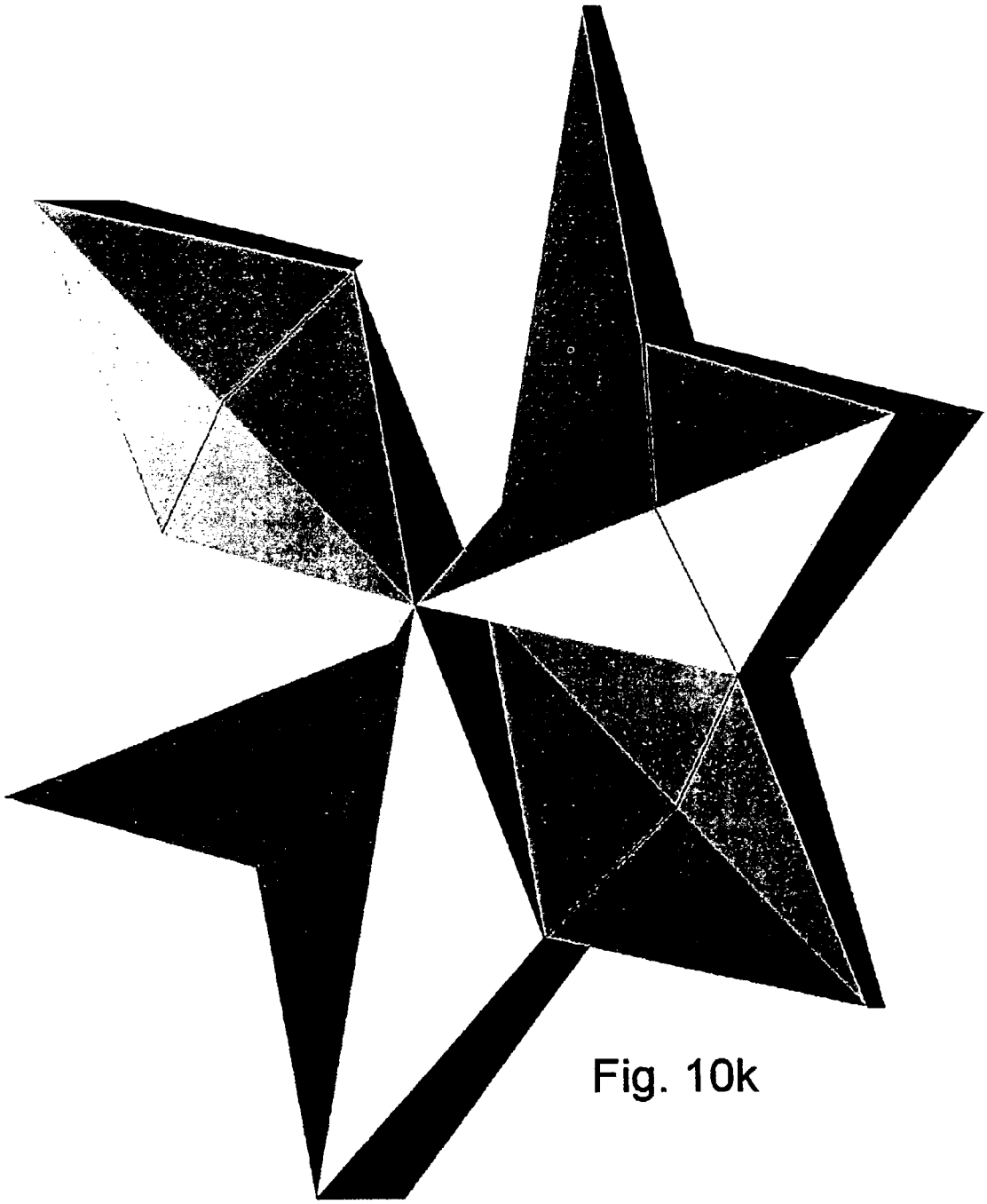
Figure 10M:
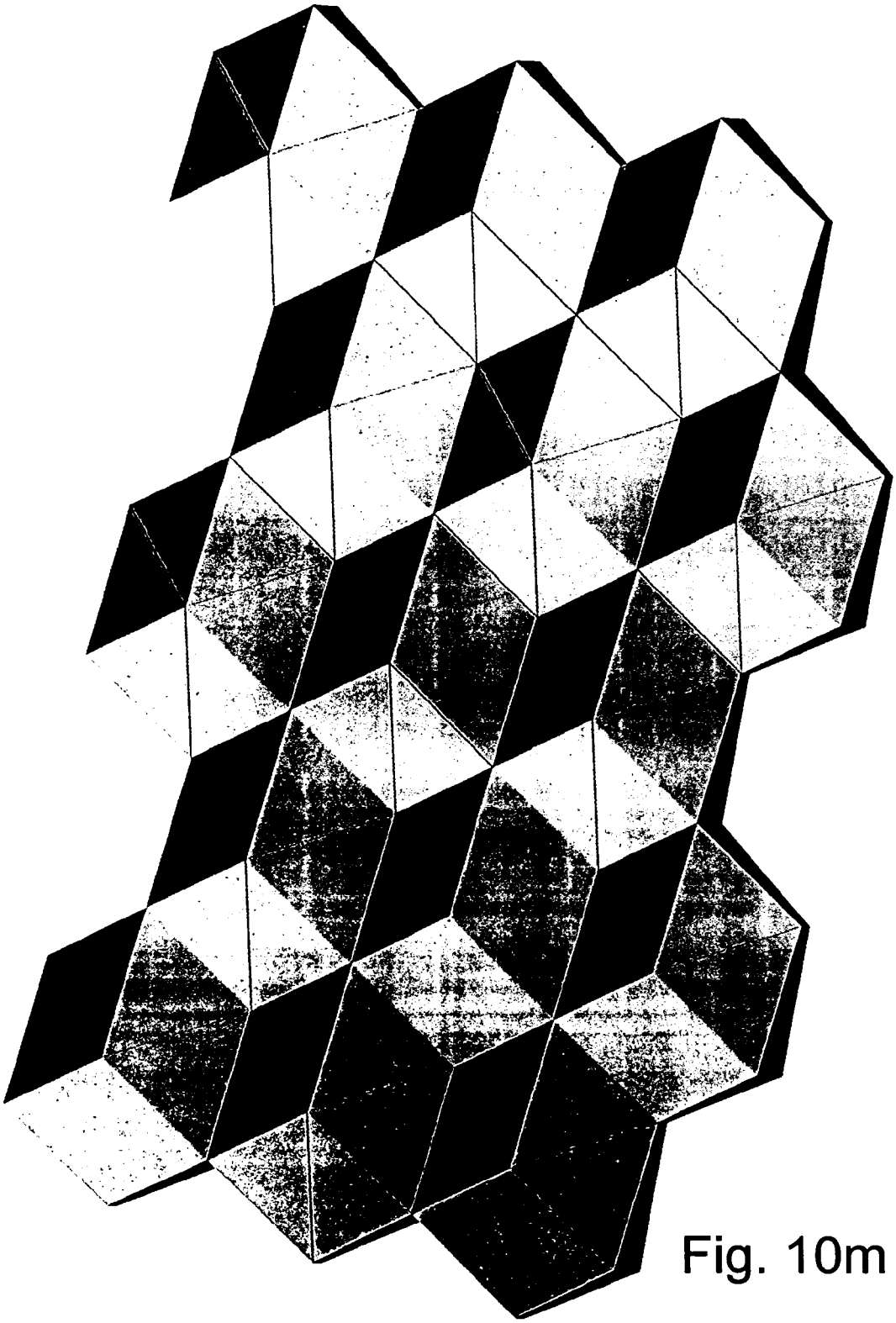
Figure 10N:
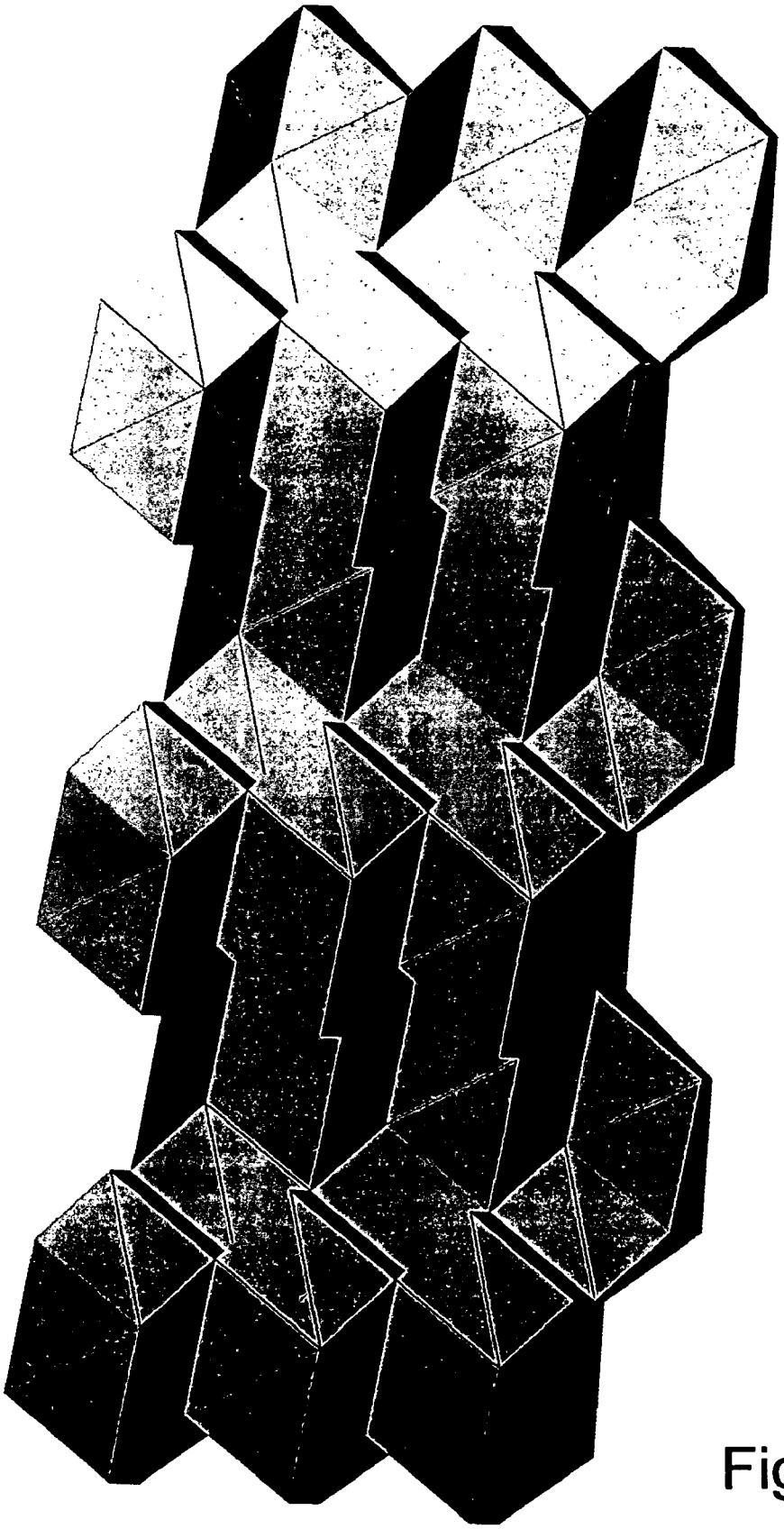
Figure 10O:
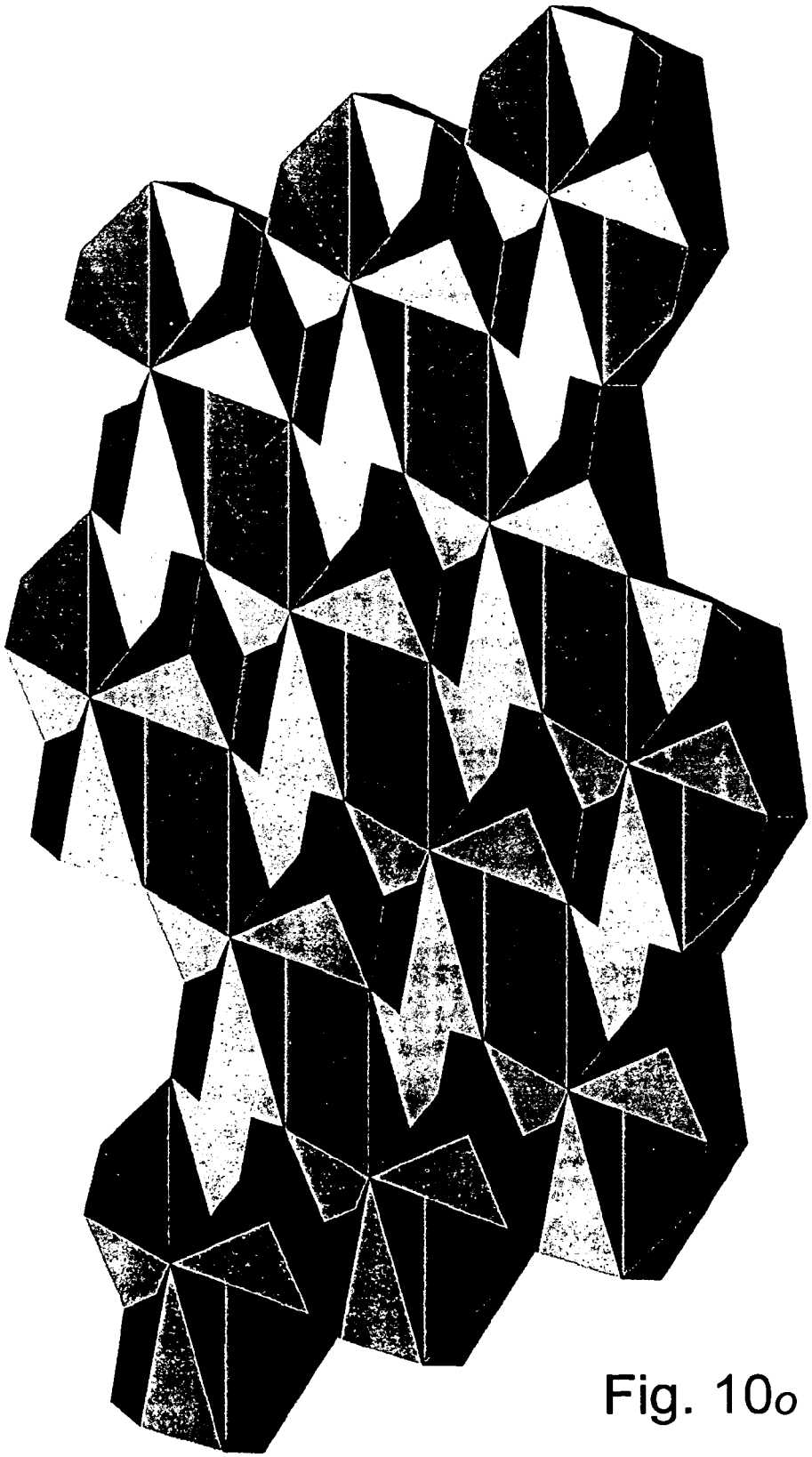
Figure 10P:
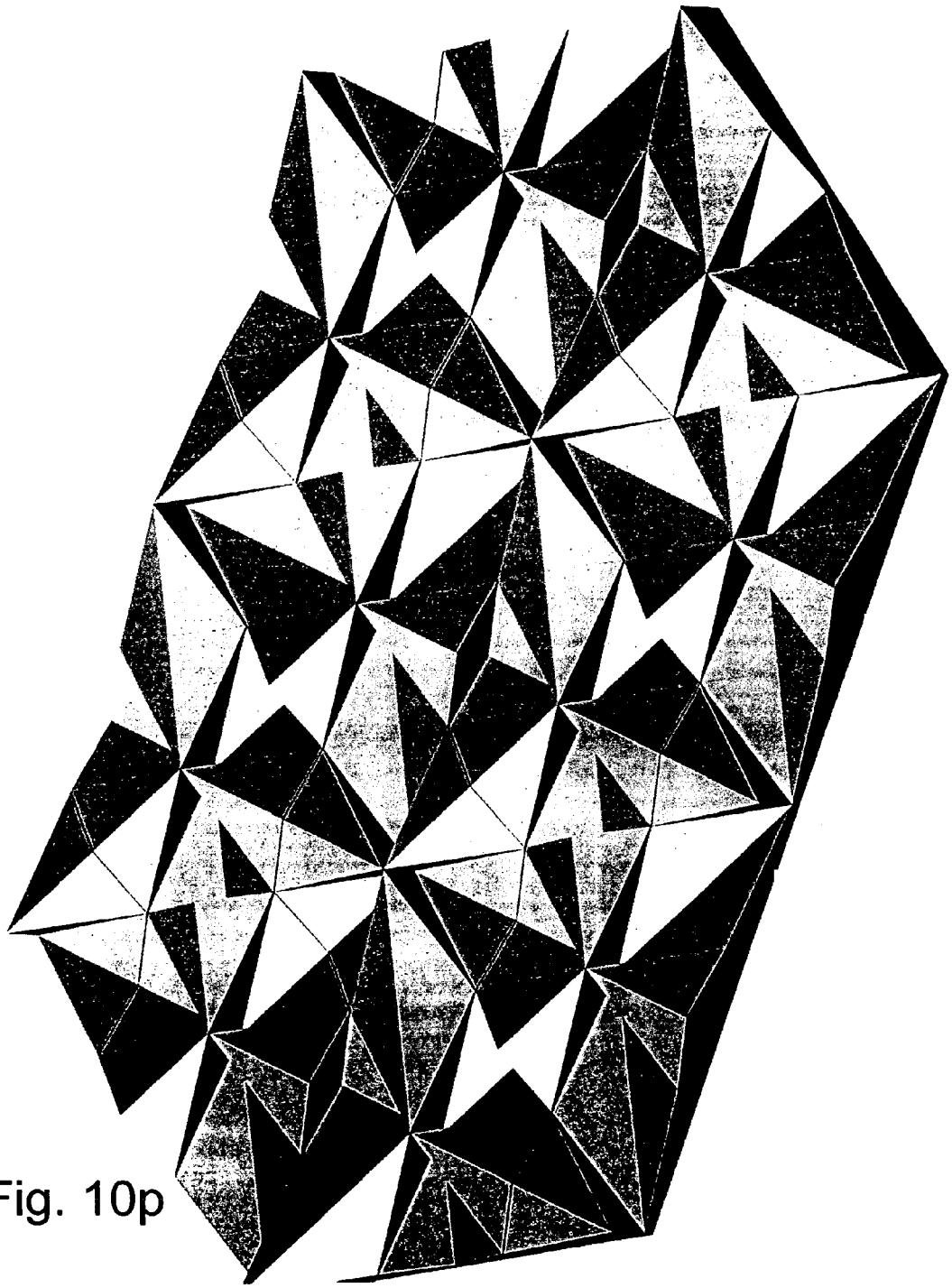
Figure 10Q:
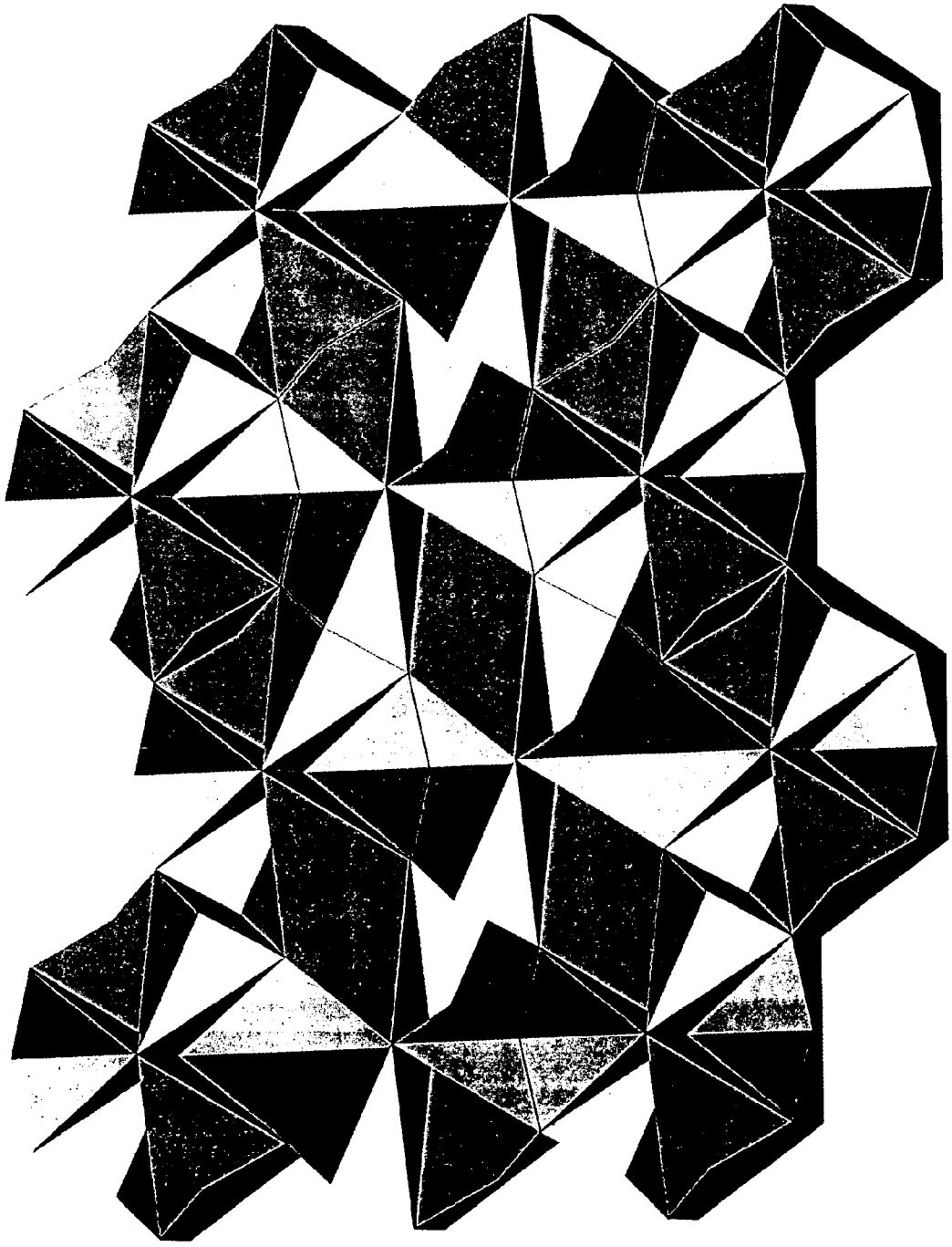
Figure 10R:
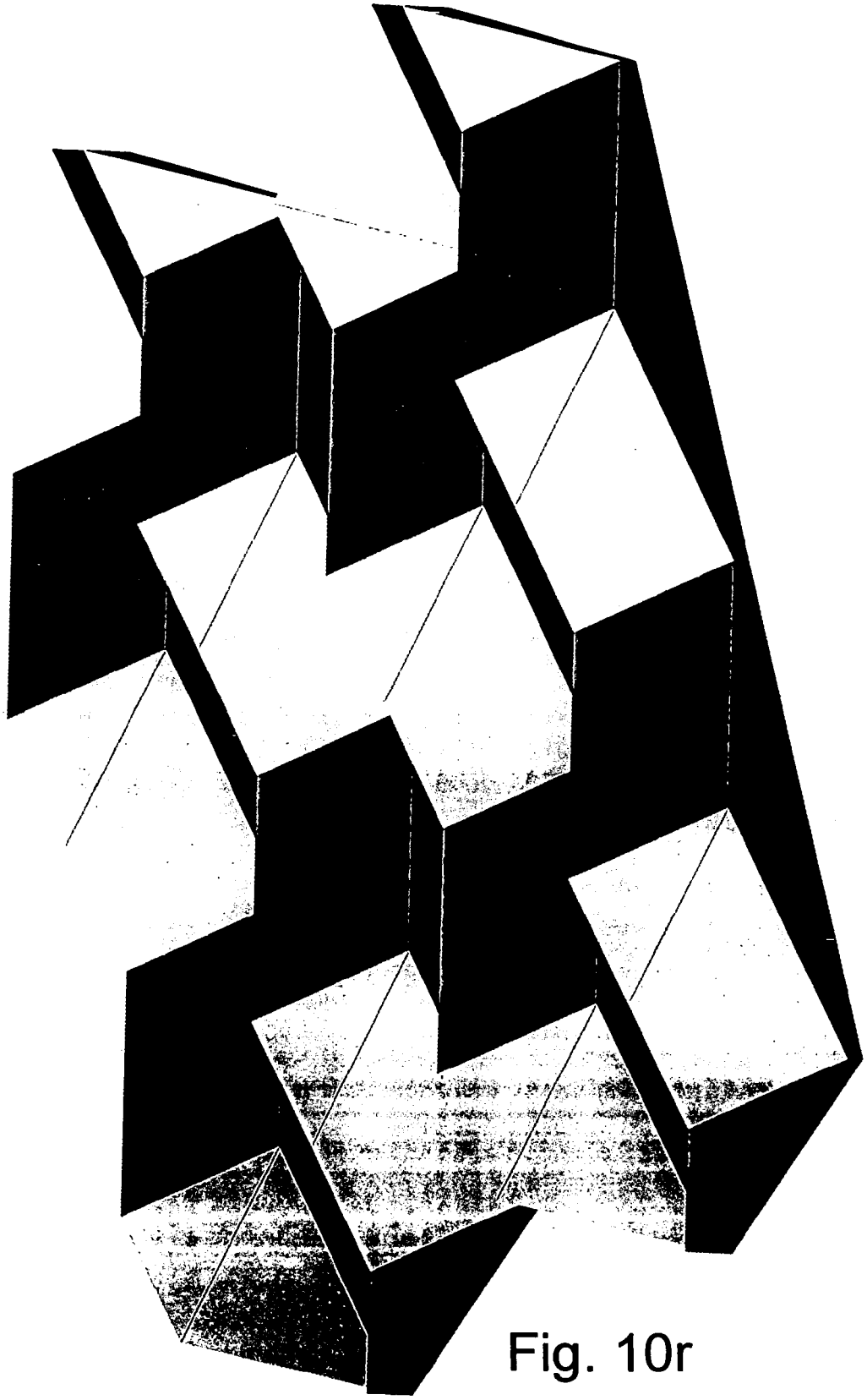
Figure 10S:
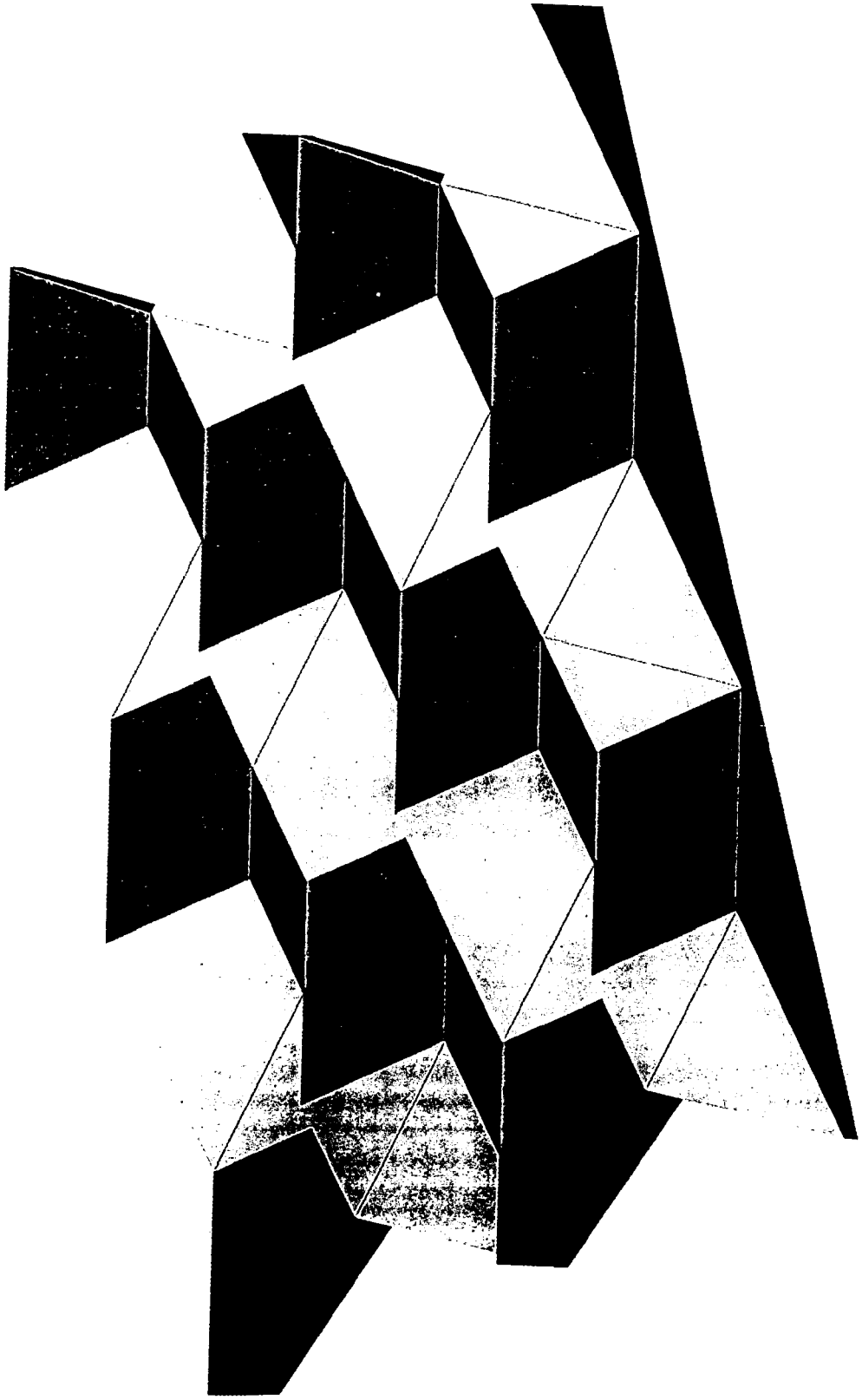
Figure 10T:
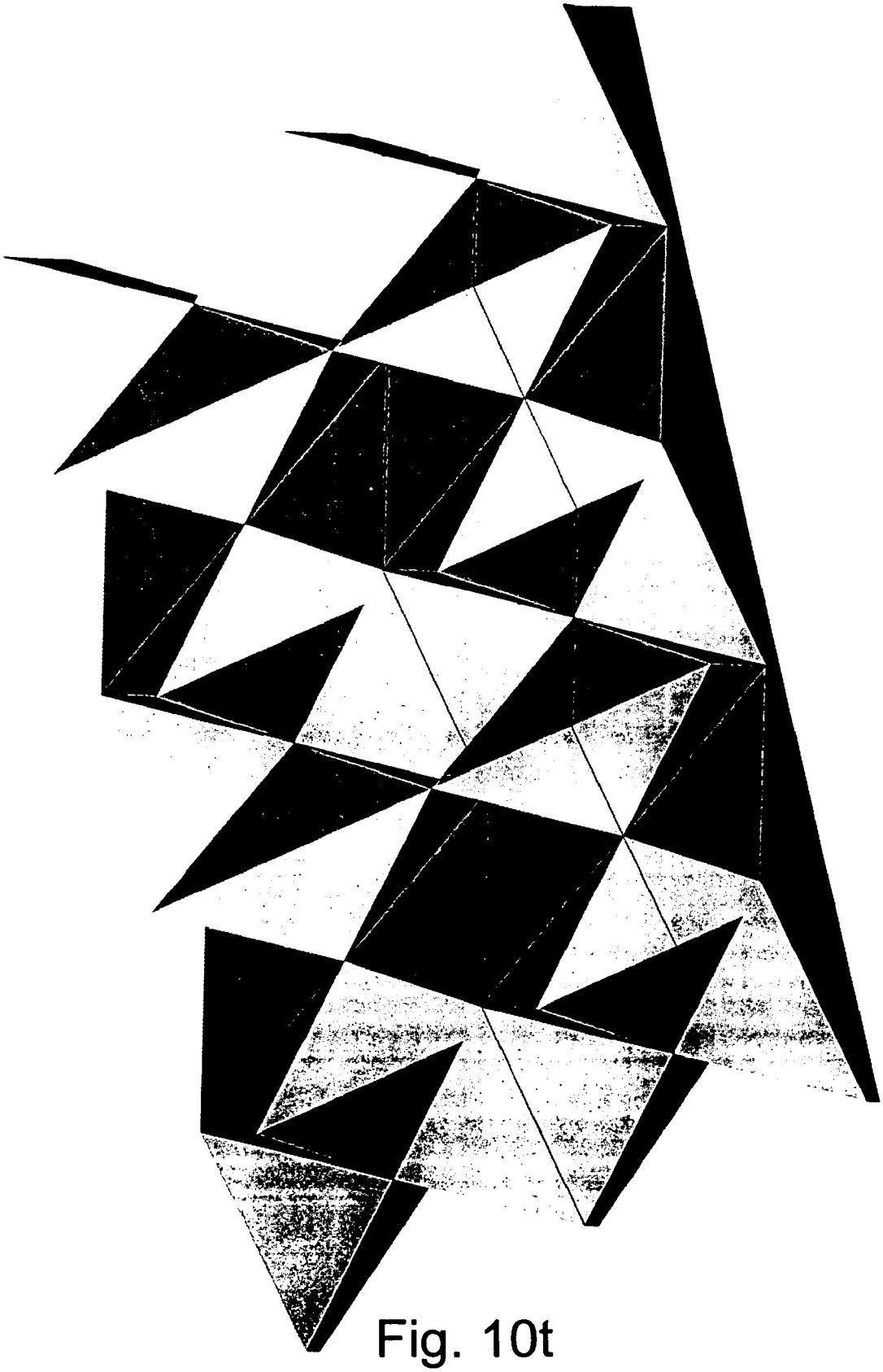
Figure 10U:
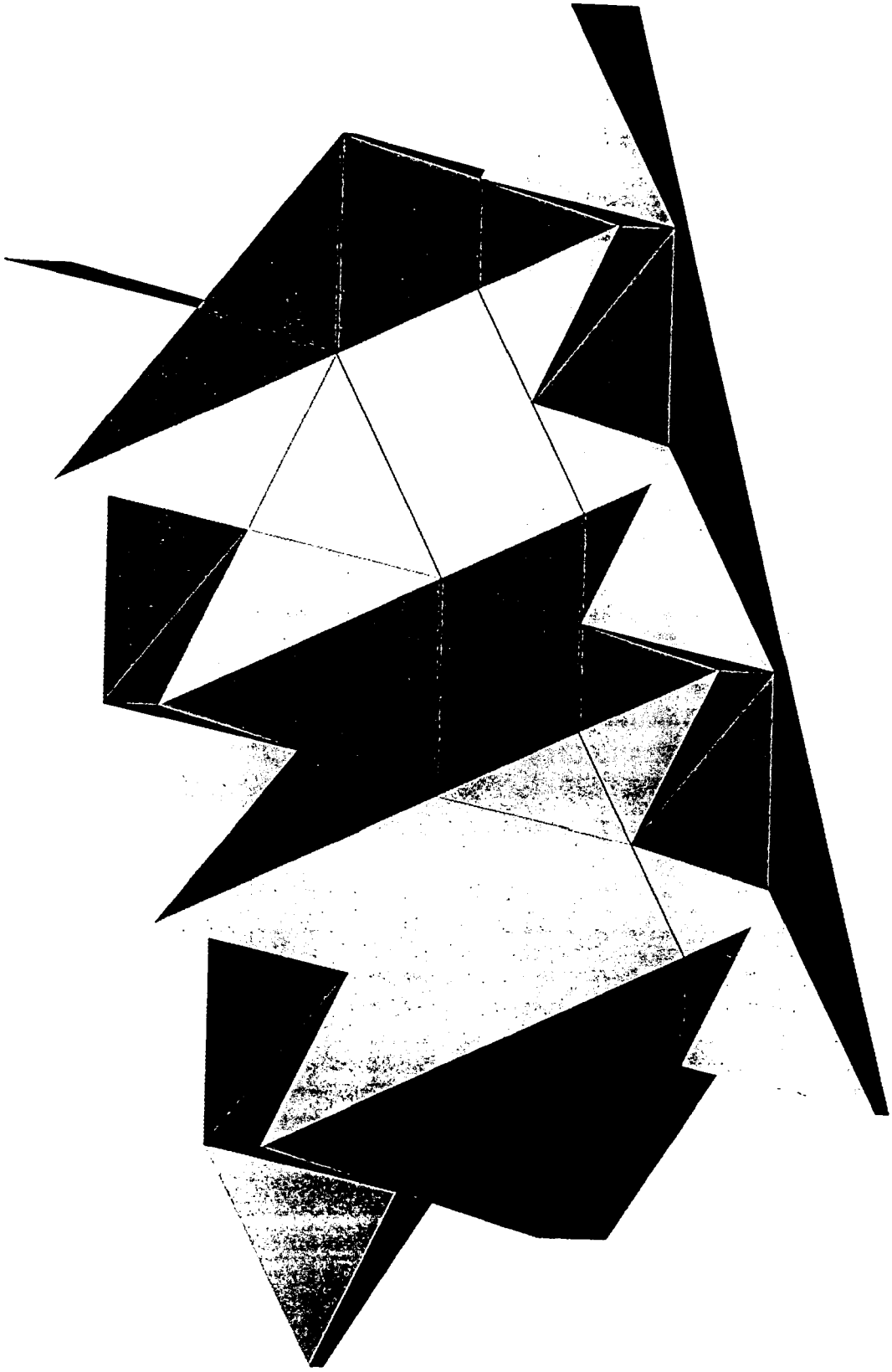
Figure 11A:
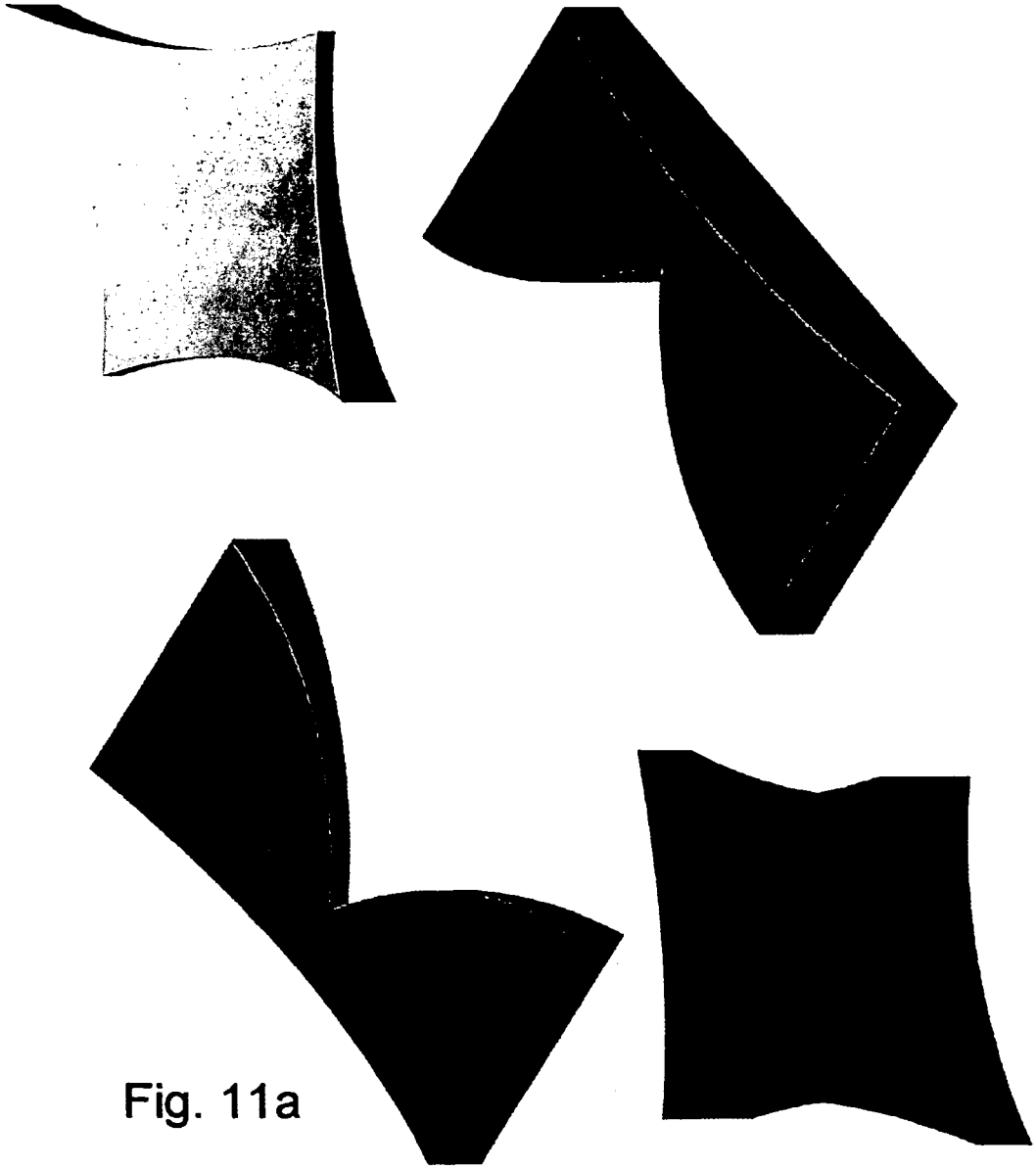
FIGS. 11*a* through 11*j* illustrate another embodiment of the invention, and several arrangements as installed on a wall or ceiling.
Figure 11B:
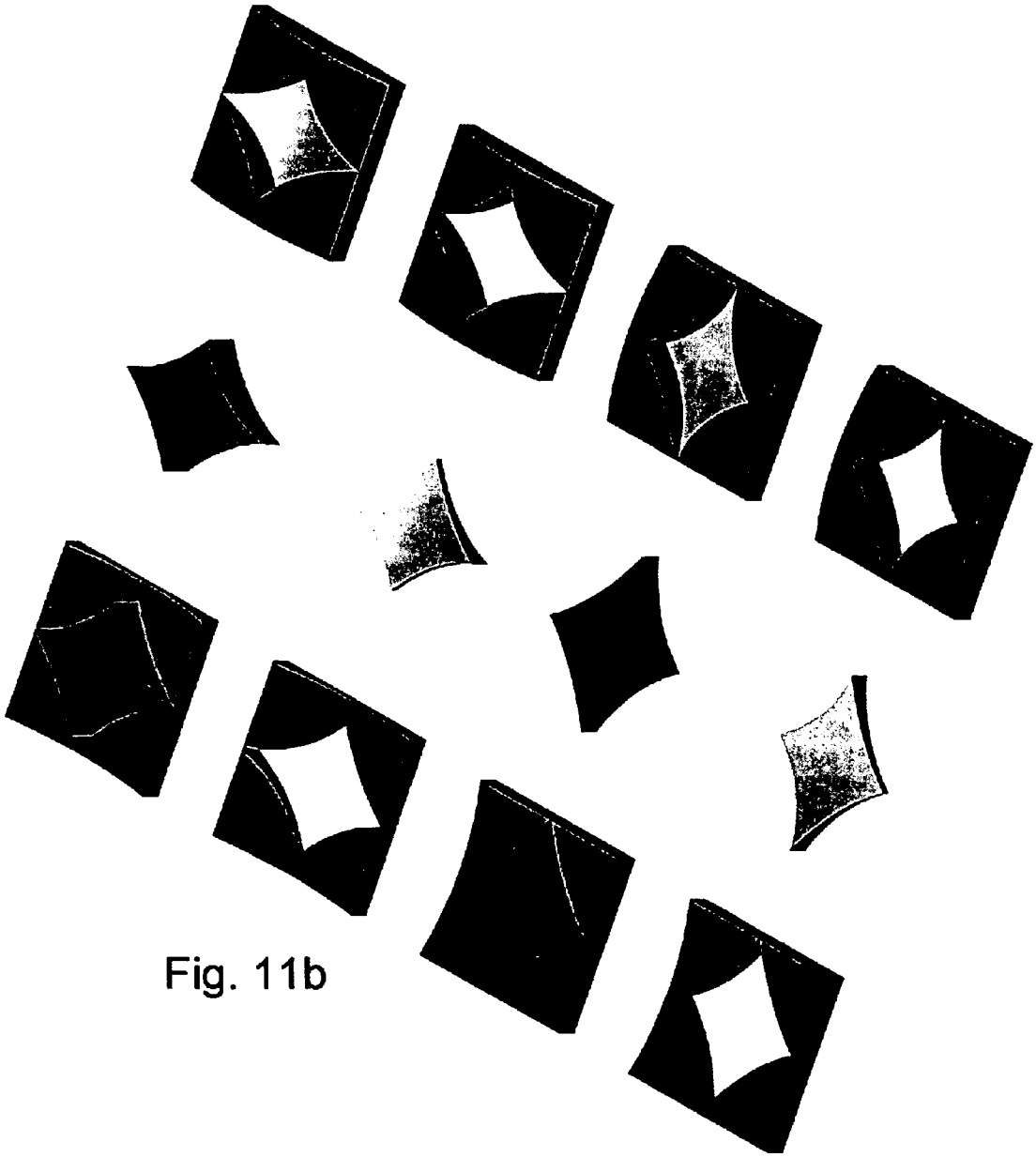
Figure 11C:
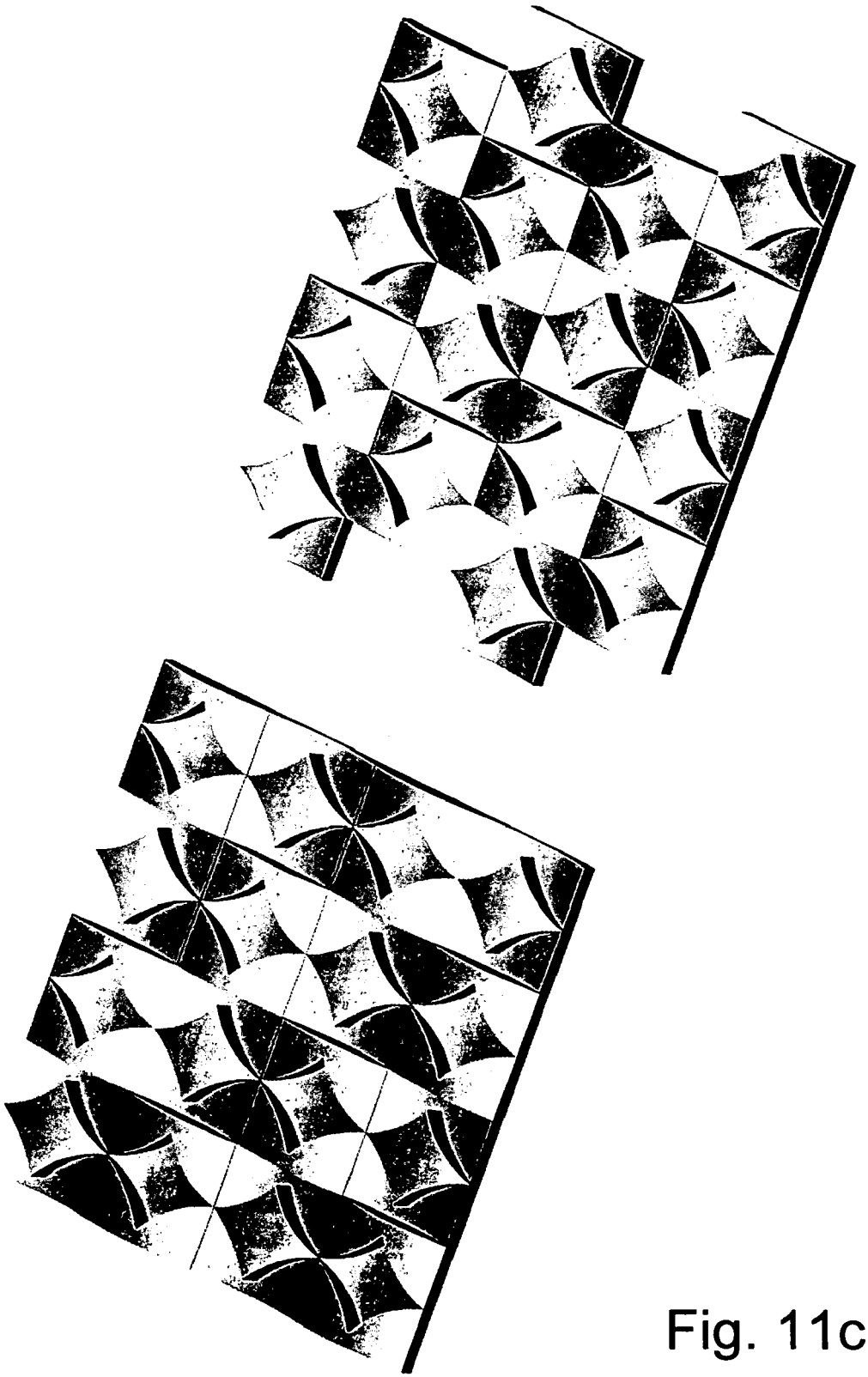
Figure 11D:
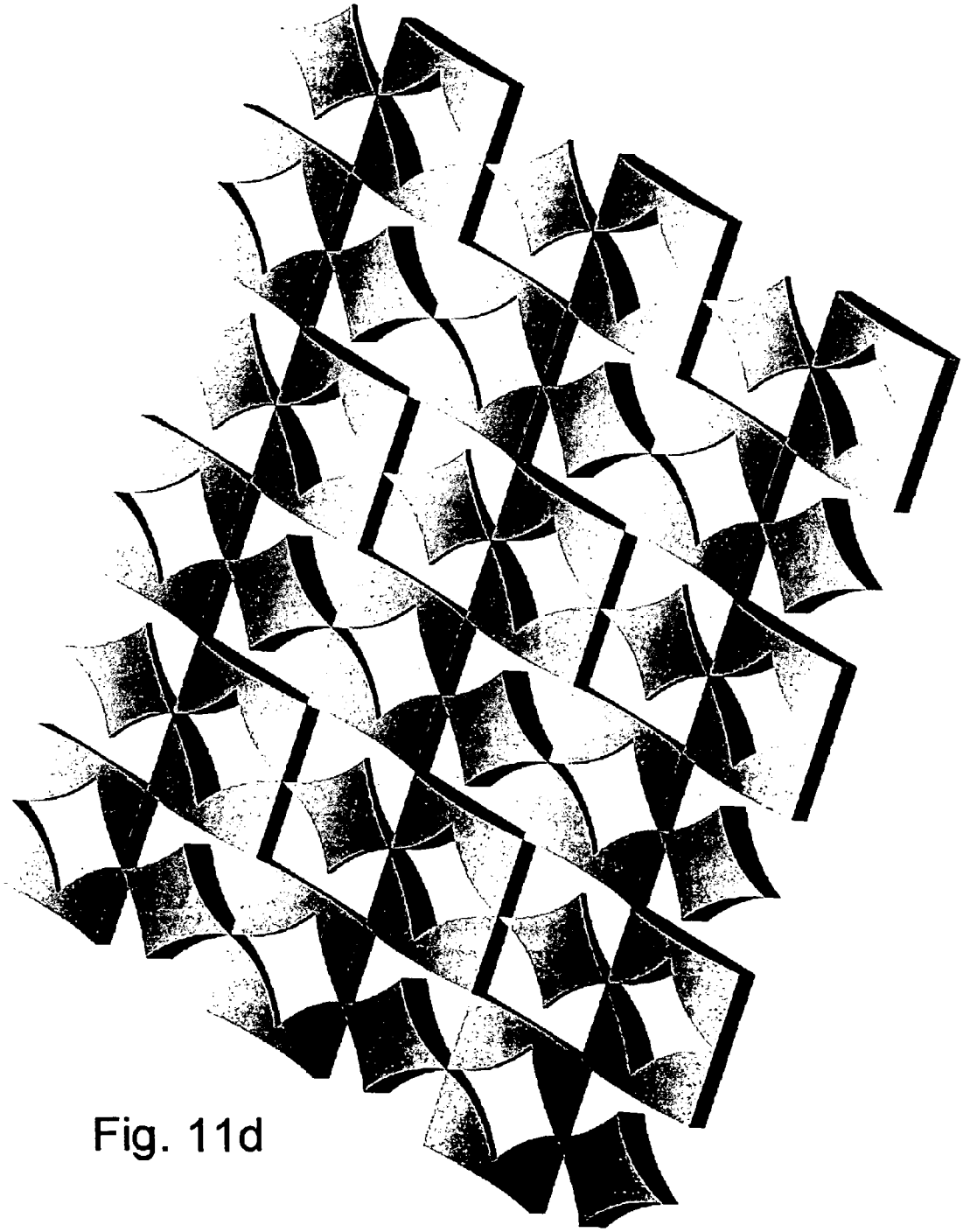
Figure 11E:
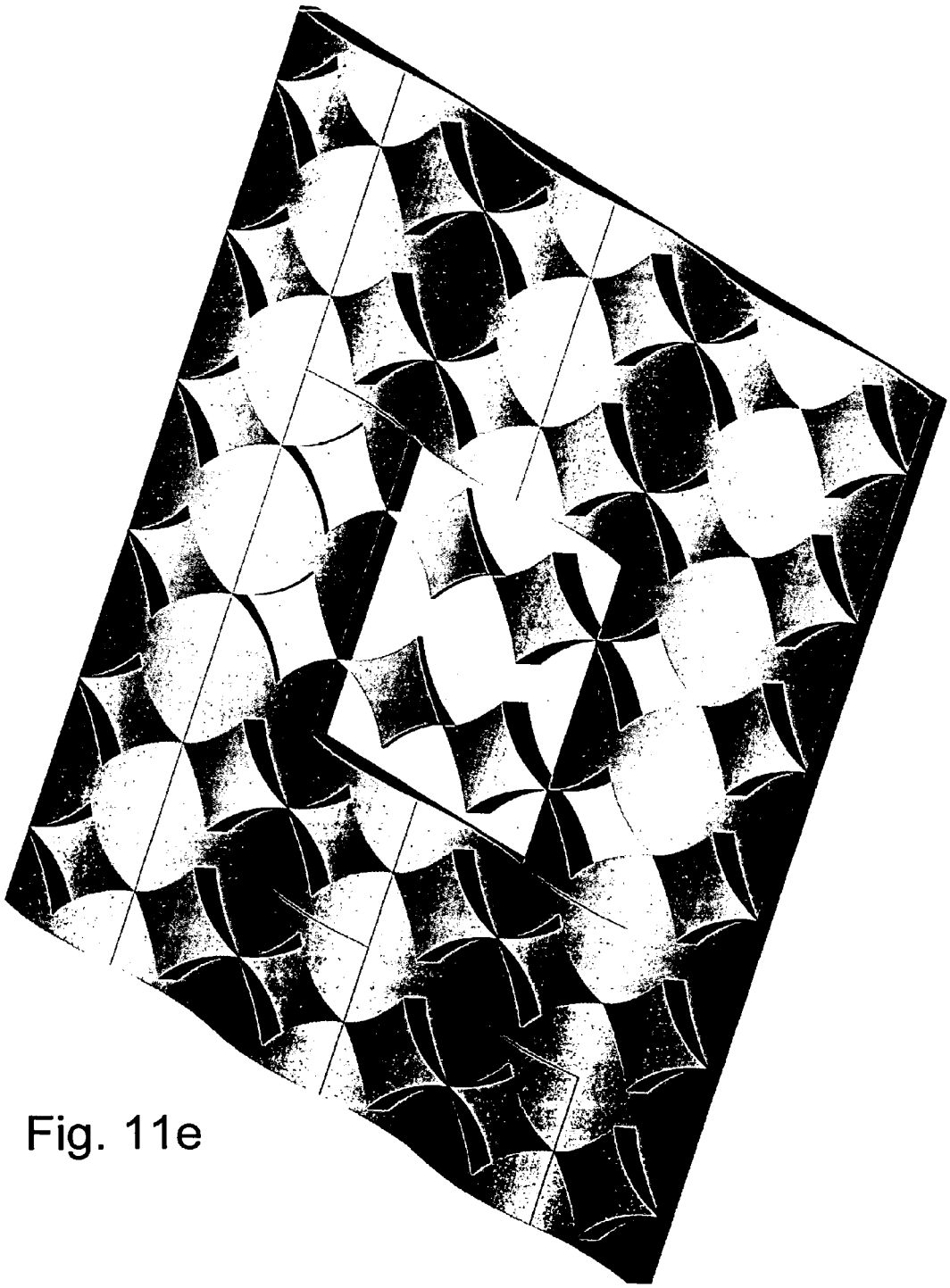
Figure 11F:
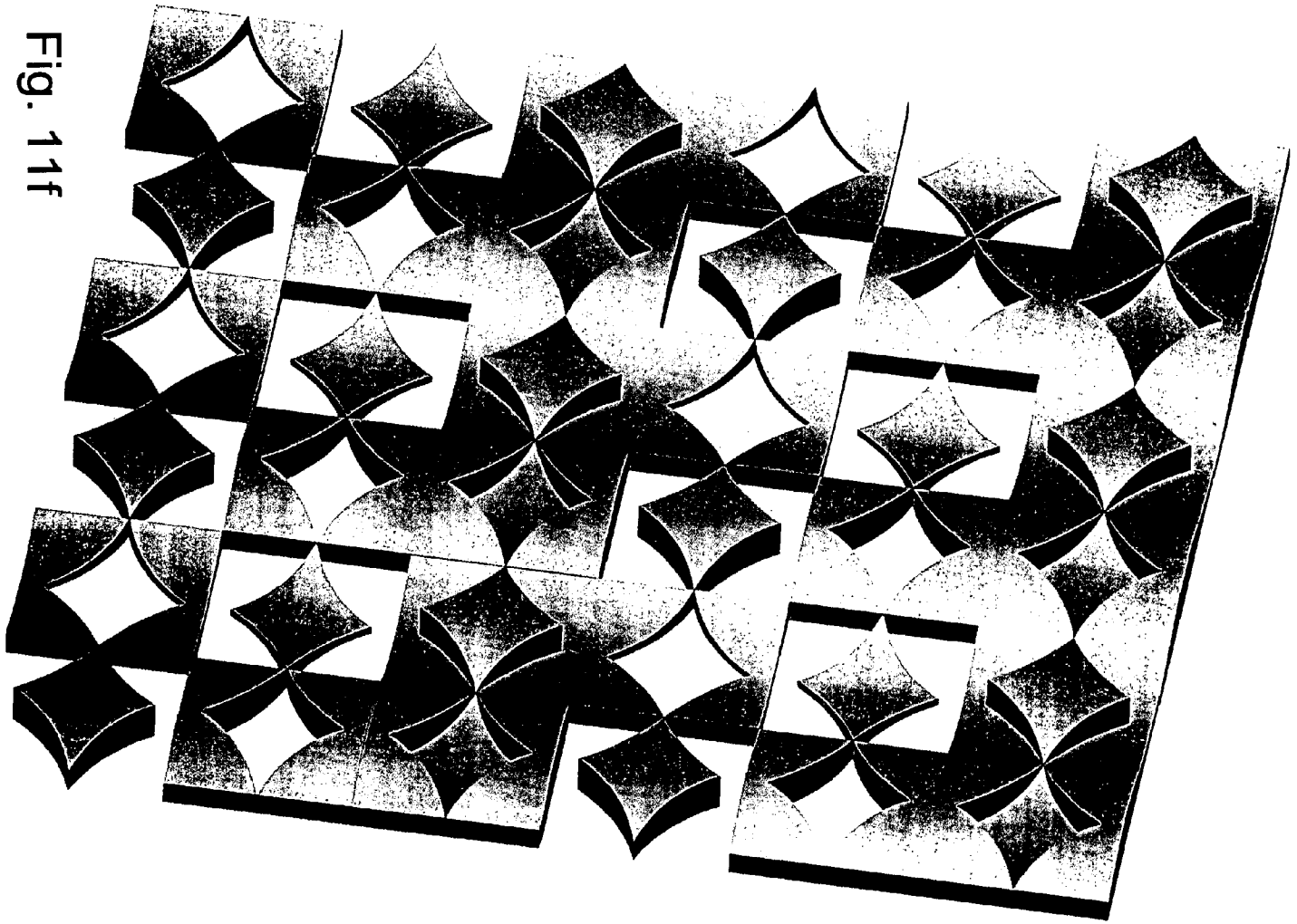
Figure 11G:
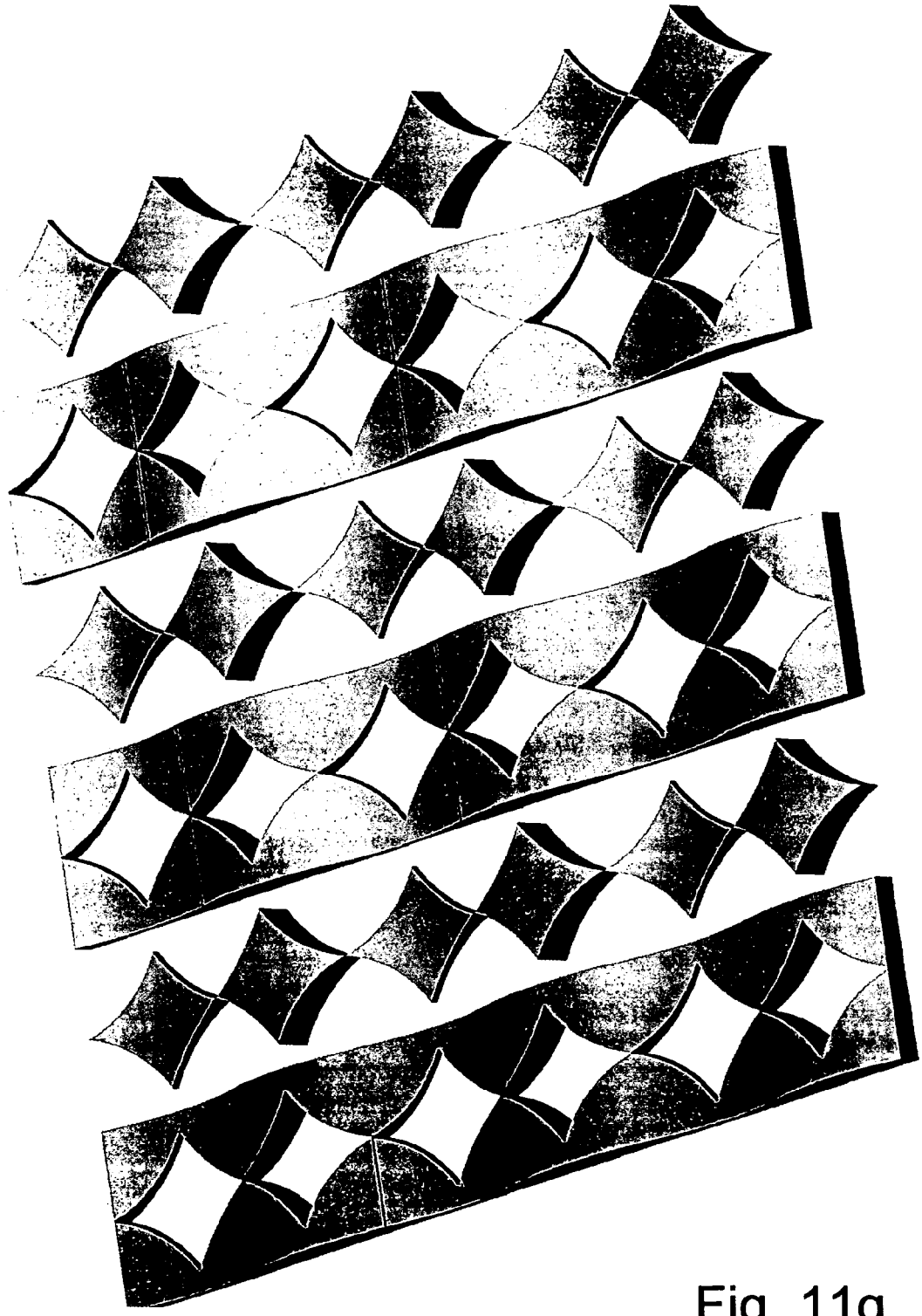
Figure 11H:
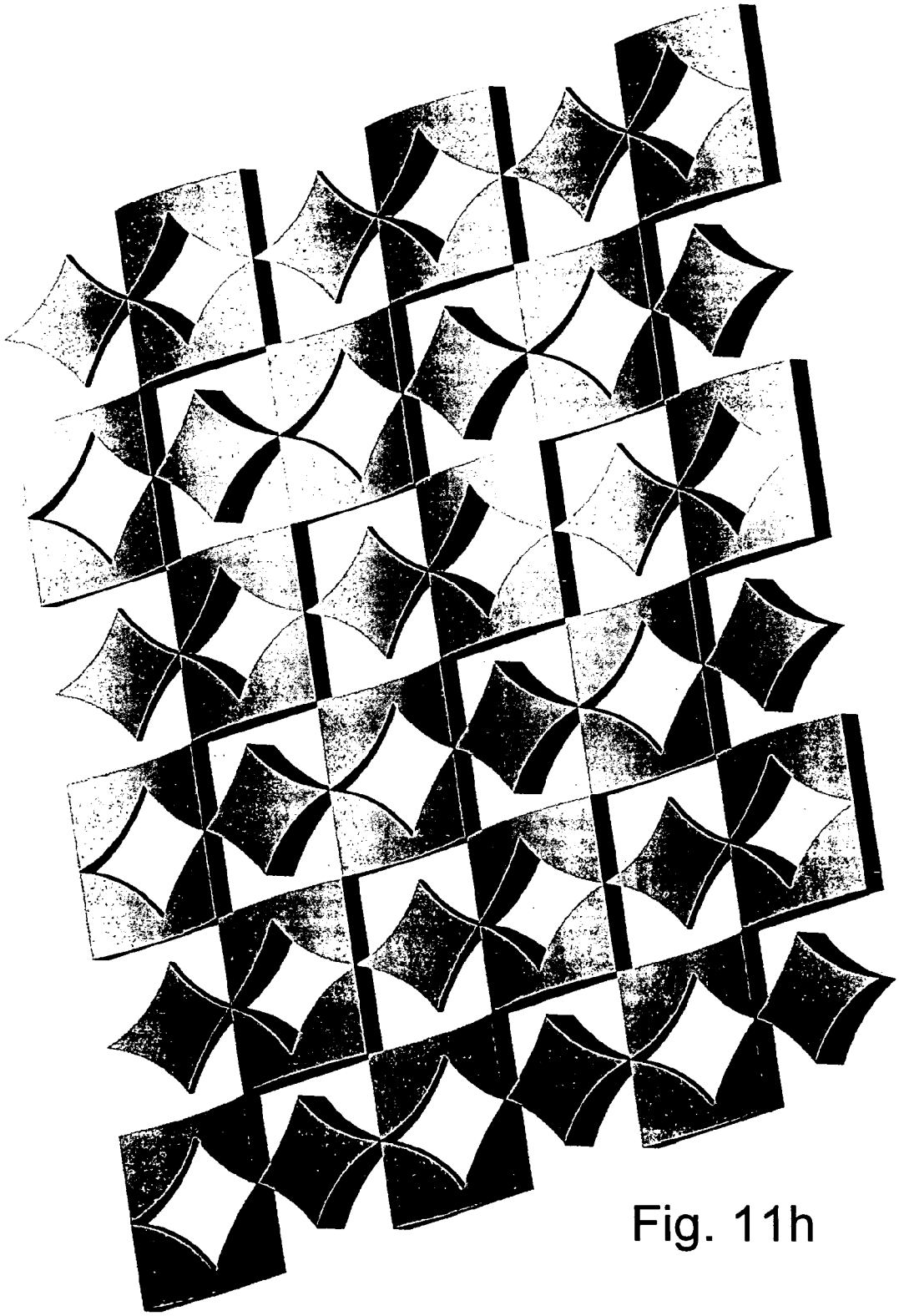
Figure 11I:
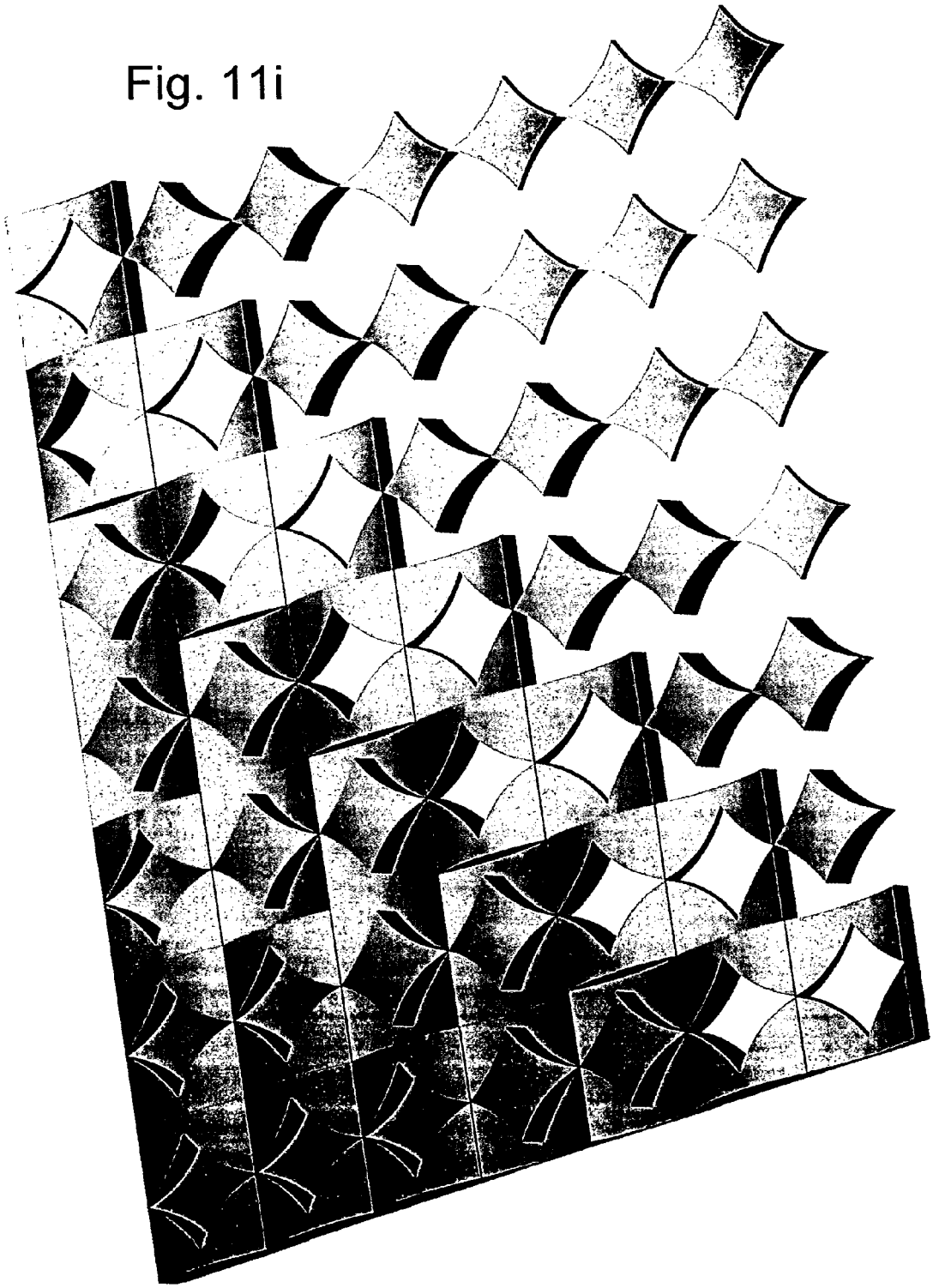
Figure 11J:
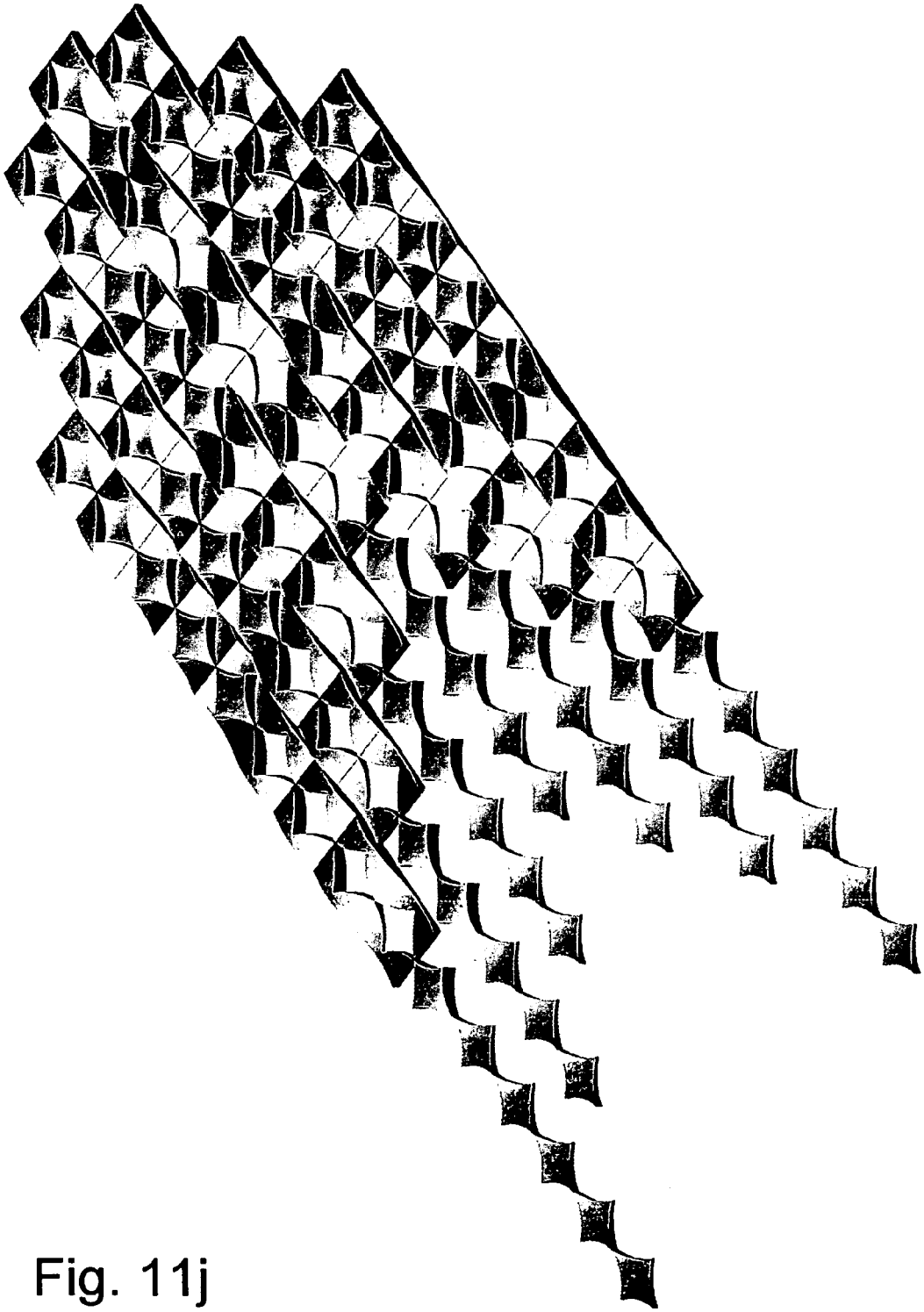
Figure 12A:
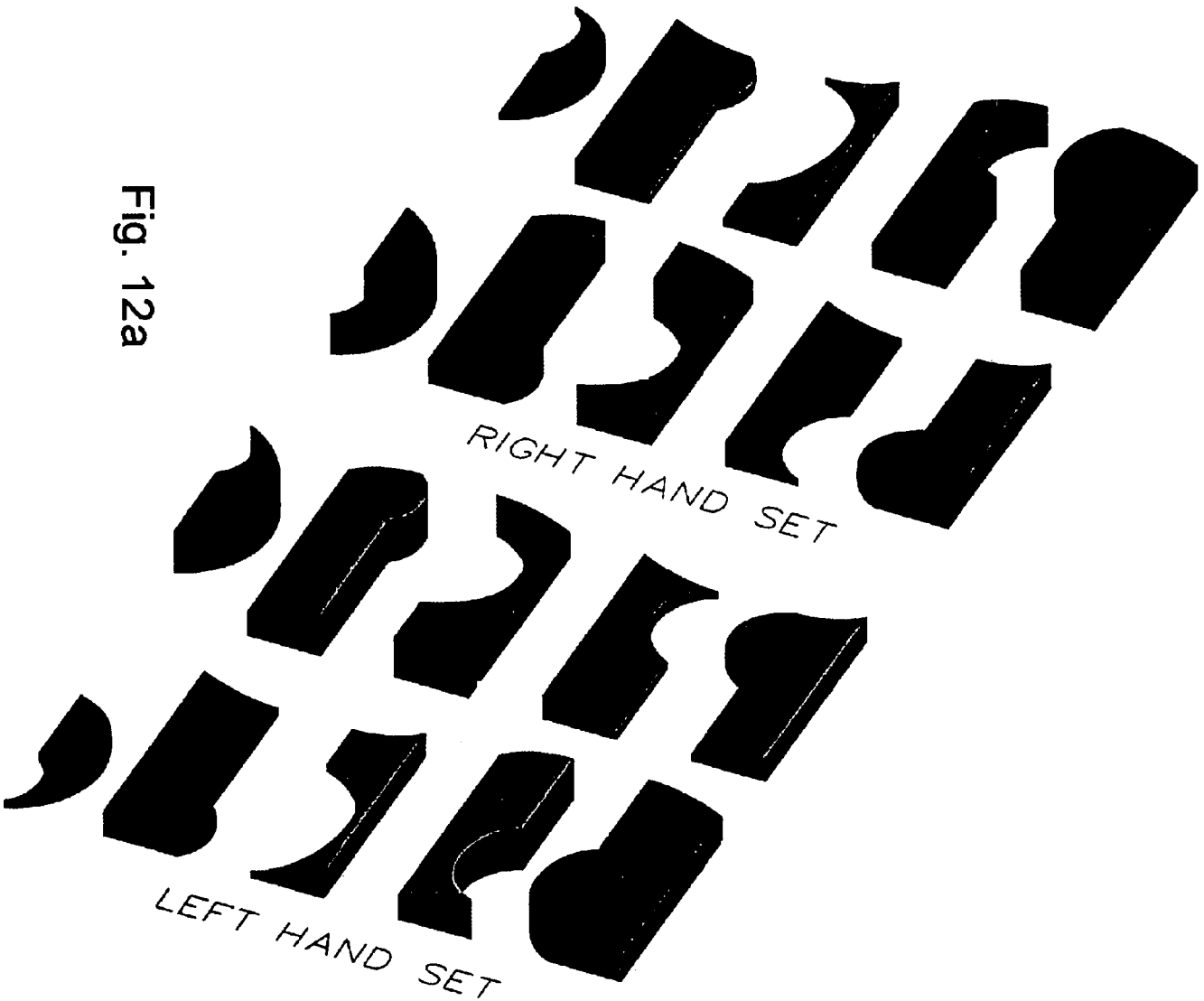
FIGS. 12*a* through 12*g* illustrate another embodiment of the invention, several arrangements as installed on a wall or ceiling, and a packing/unpacking configuration.
Figure 12B:
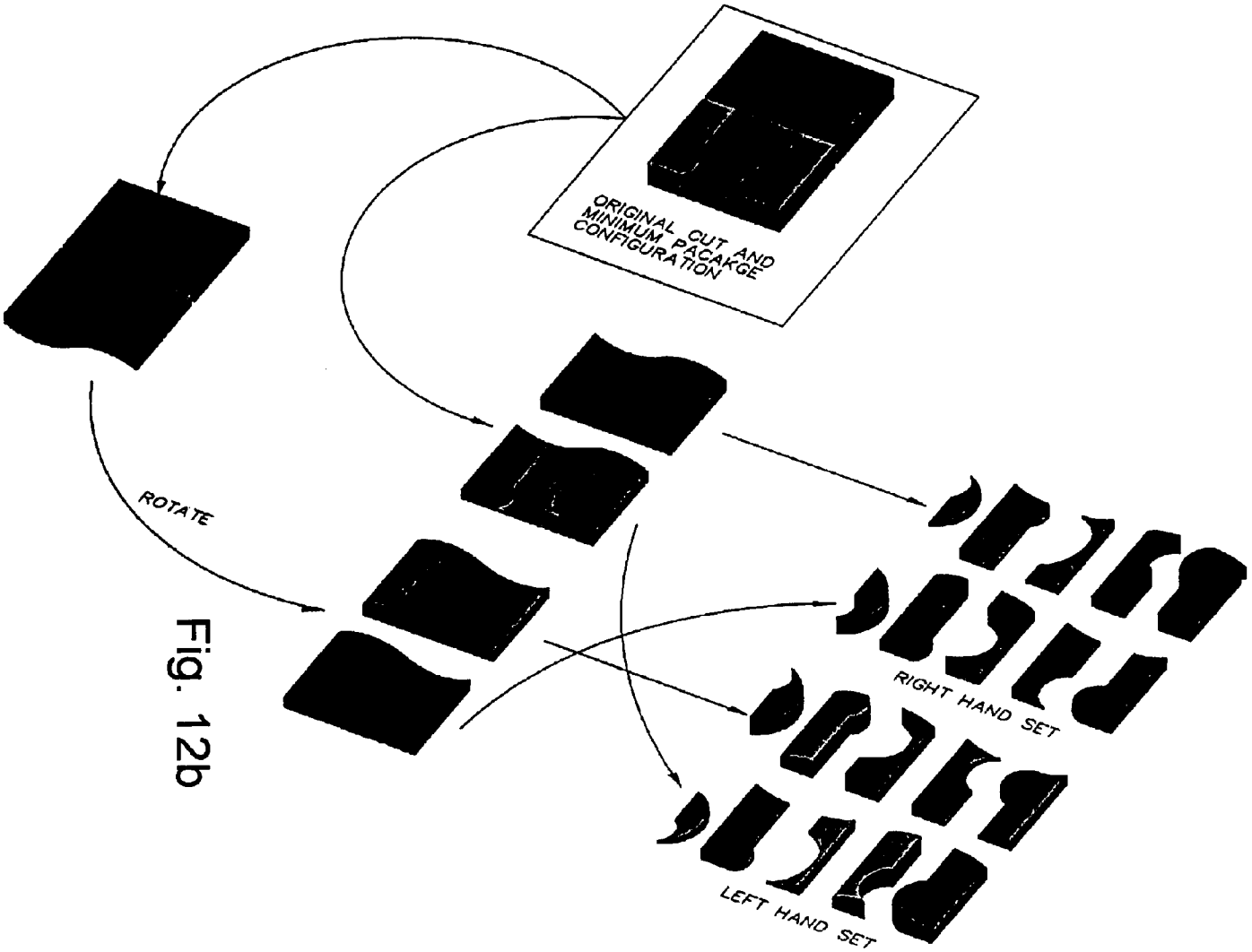
Figure 12C:
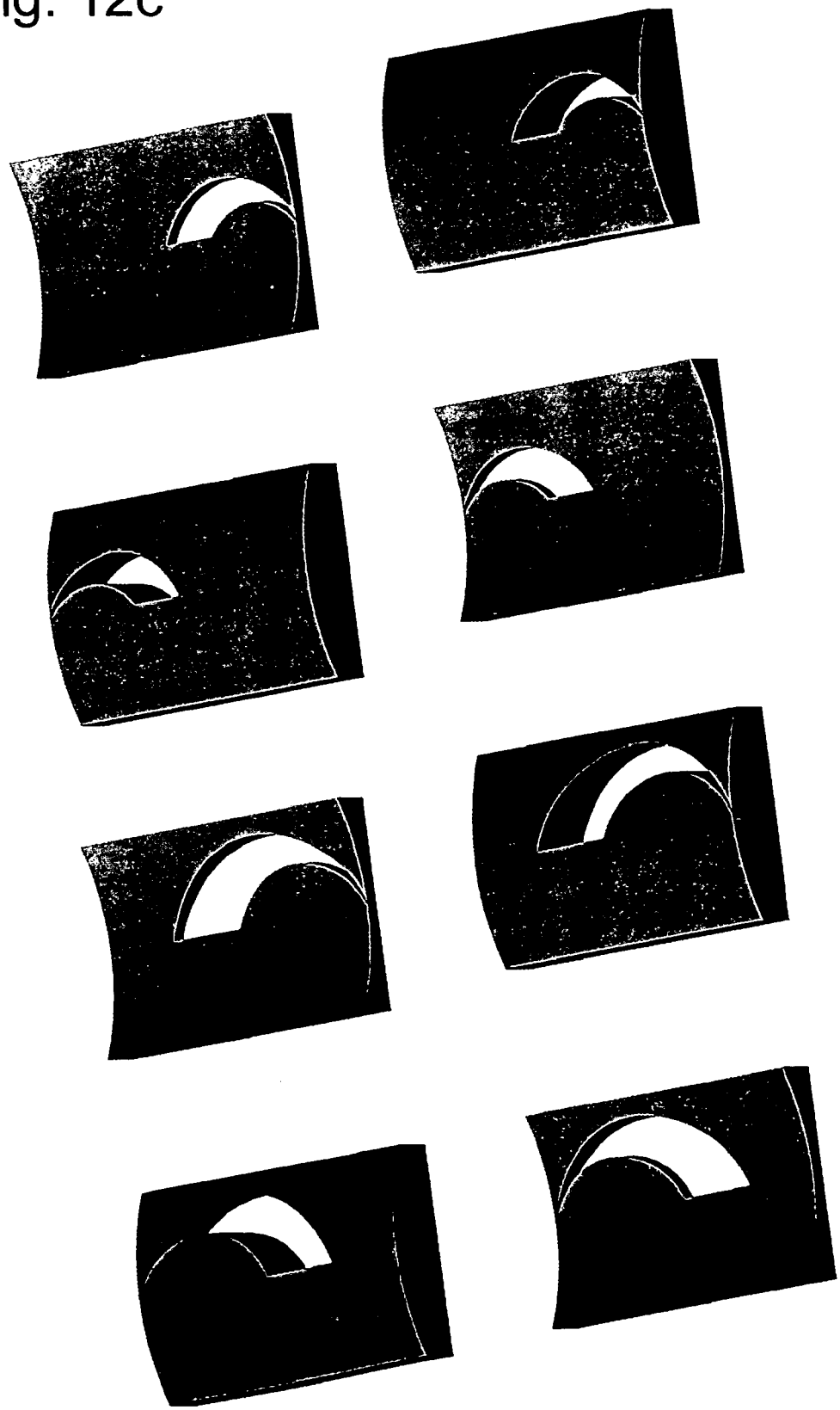
Figure 12E:
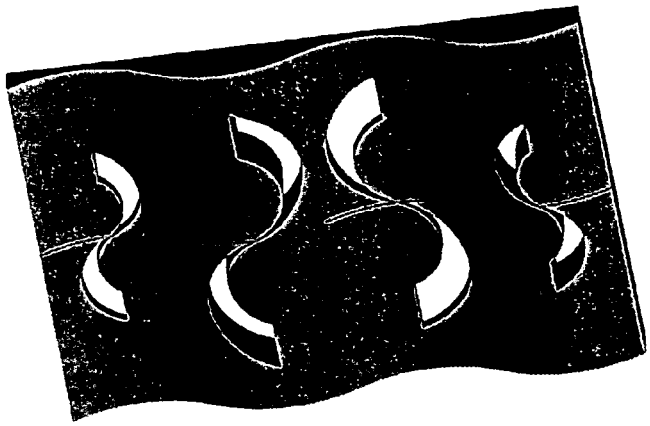
Figure 12E:
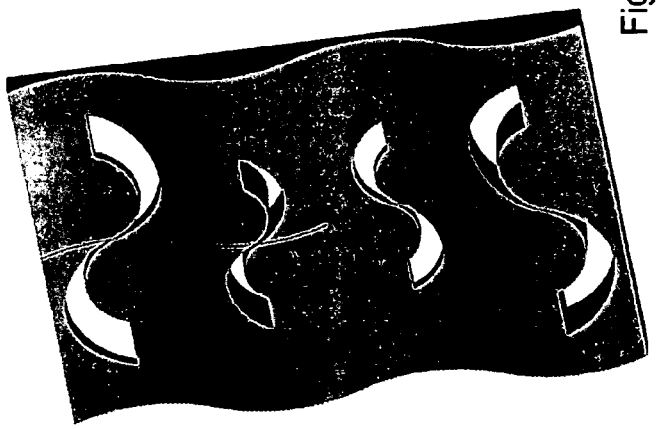
Figure 12D:
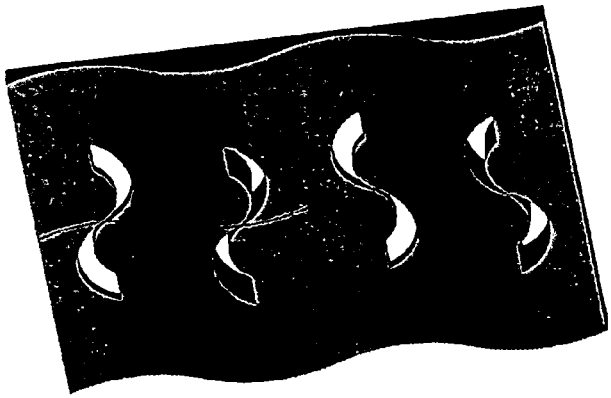
Figure 12D:
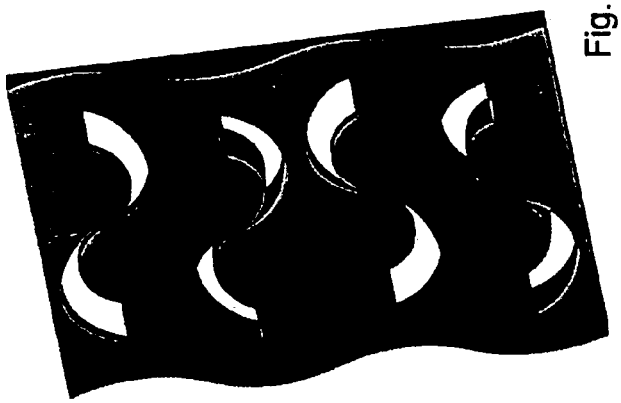
Figure 12G:
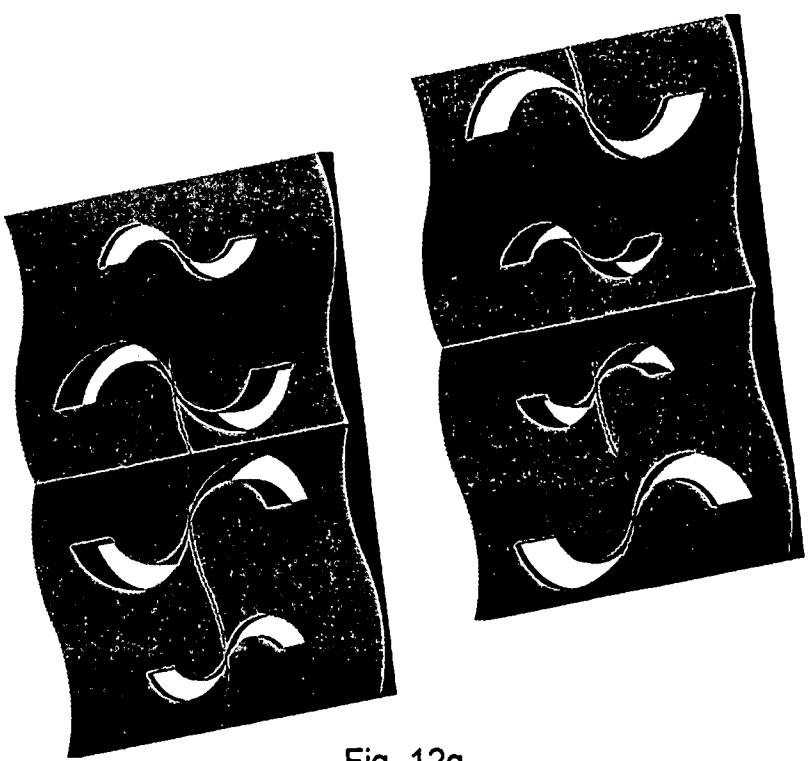
Figure 12F:
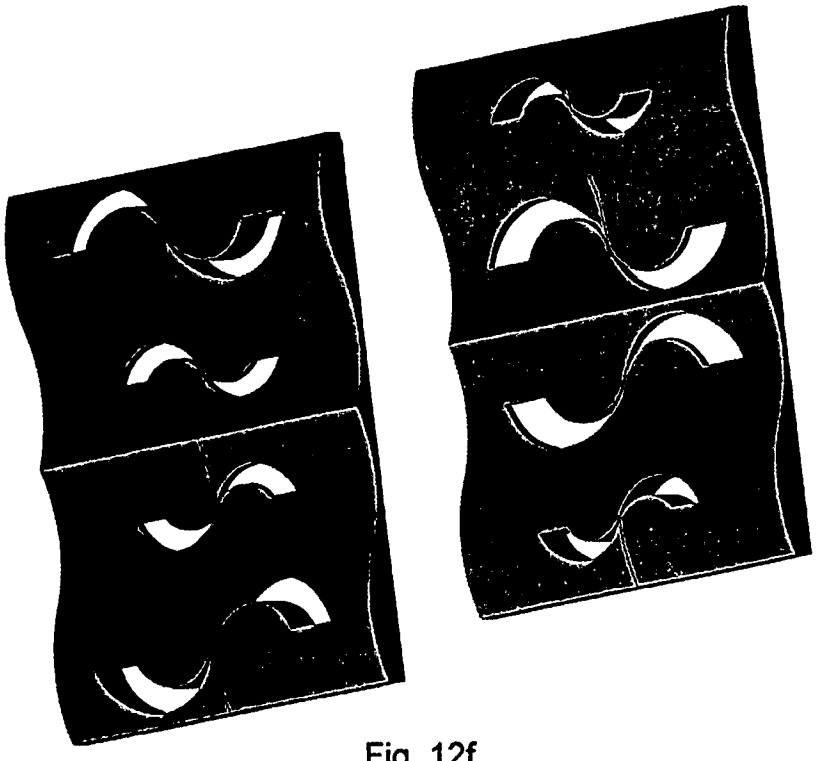
Figure 13B:
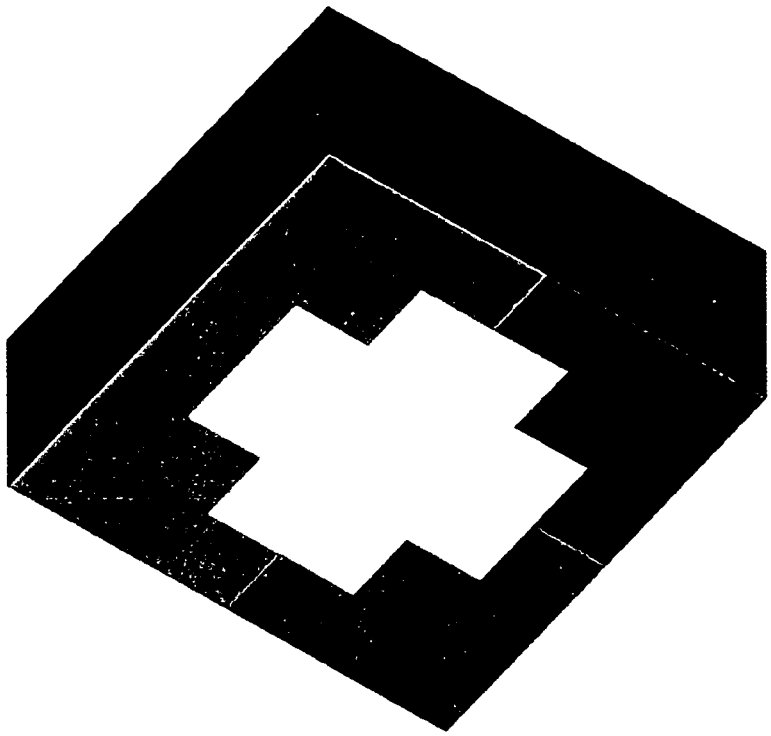
FIGS. 13*a* through 13*t* illustrate another embodiment of the invention, several arrangements as installed on a wall or ceiling, and a packing/unpacking configuration.
Figure 13A:
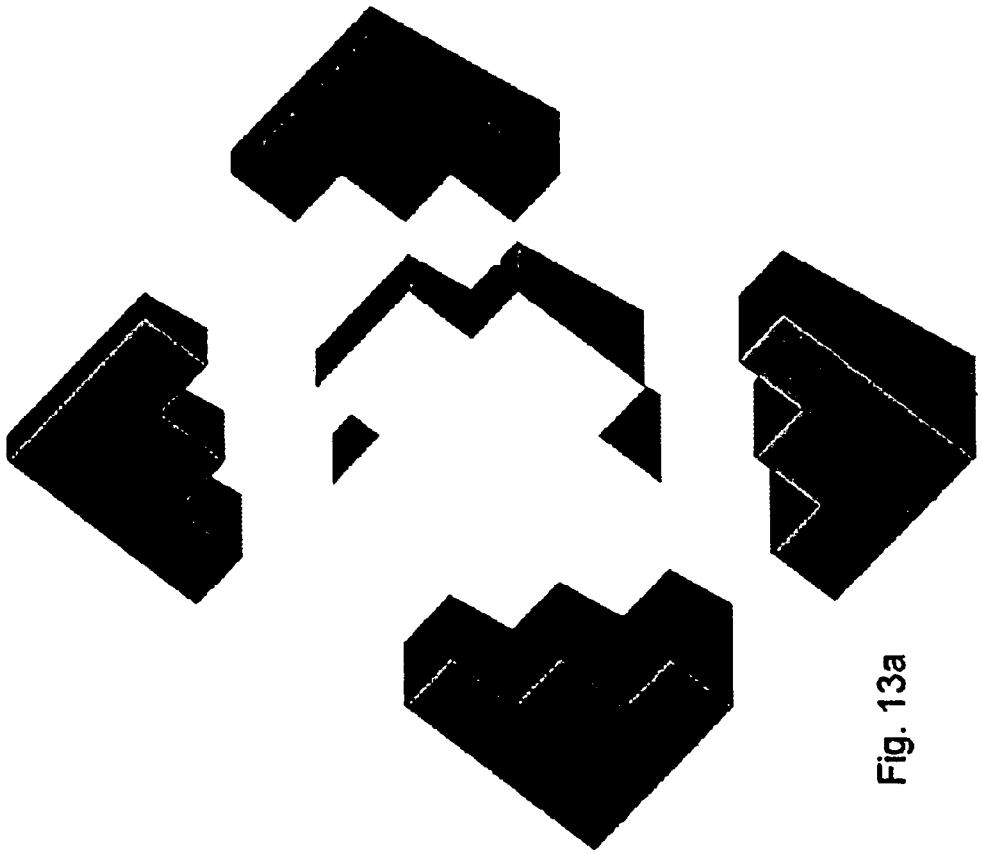
Figure 13D:
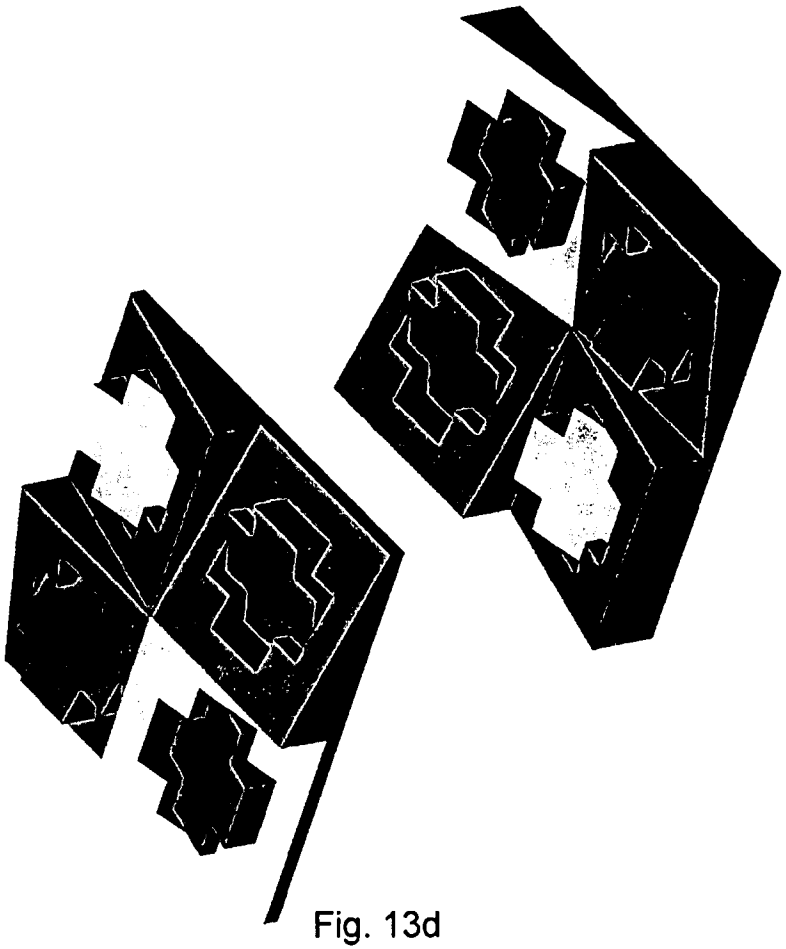
Figure 13C:
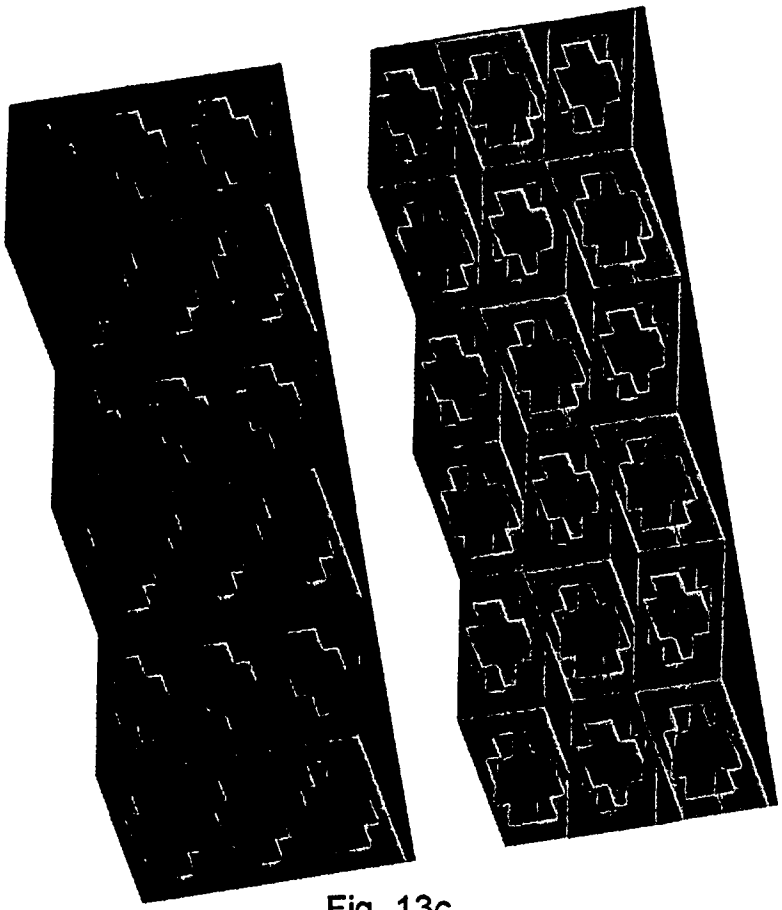
Figure 13F:
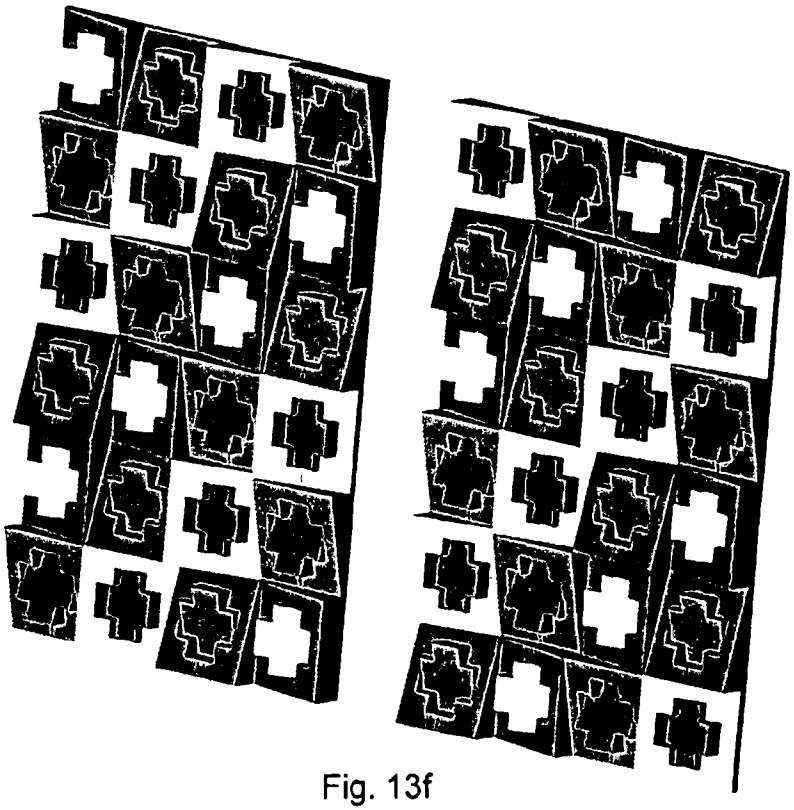
Figure 13E:
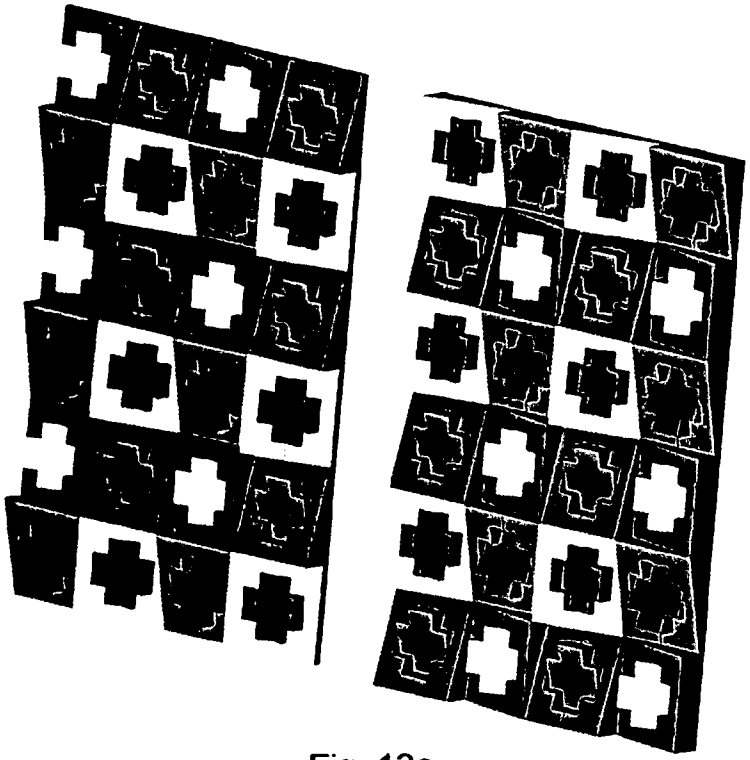
Figure 13H:
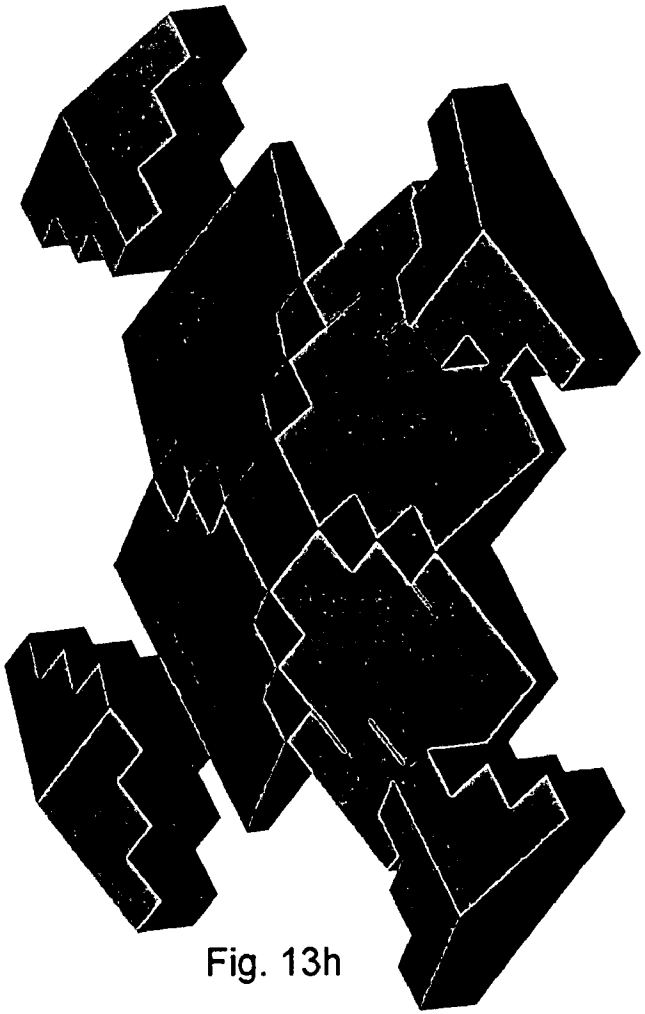
Figure 13G:
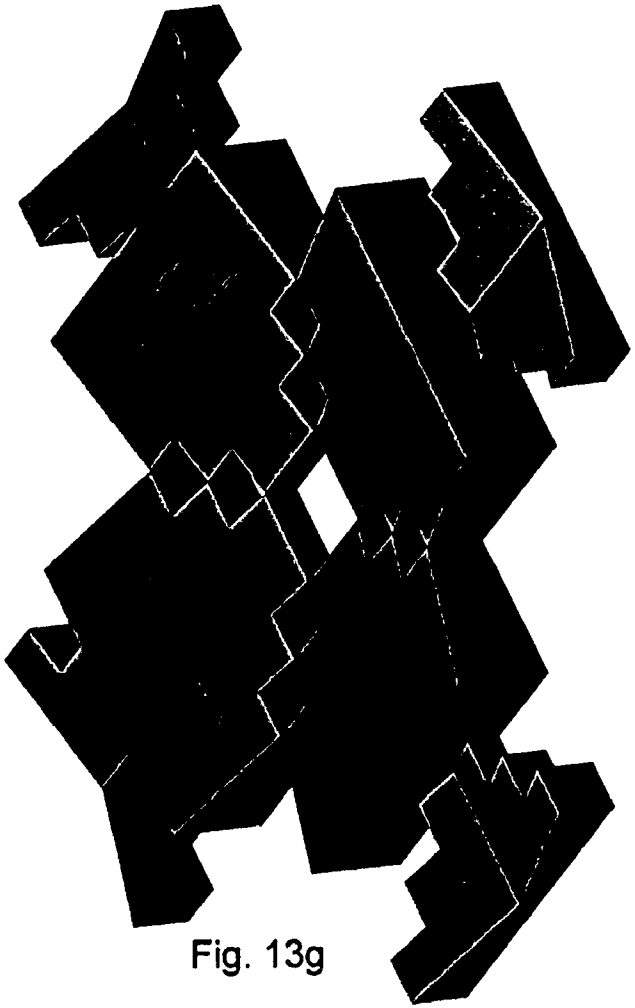
Figure 13J:
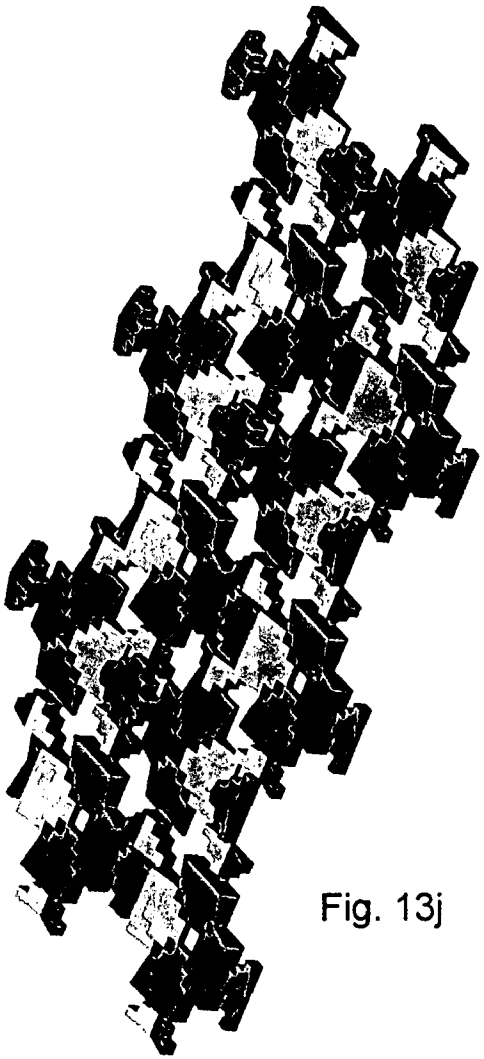
Figure 13I:
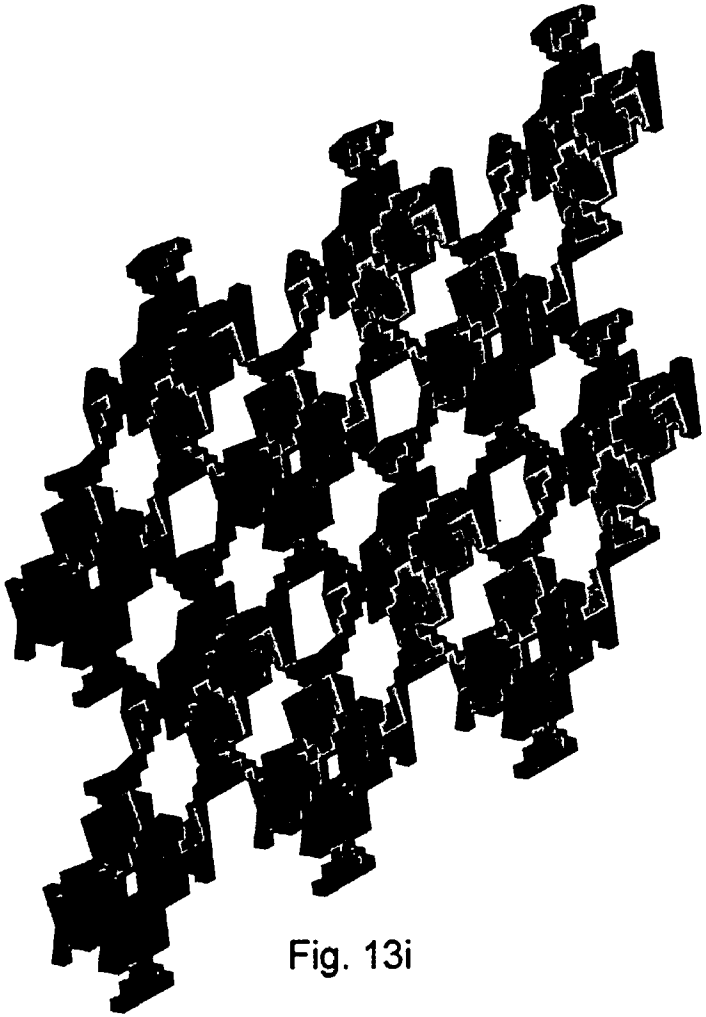
Figure 13K:
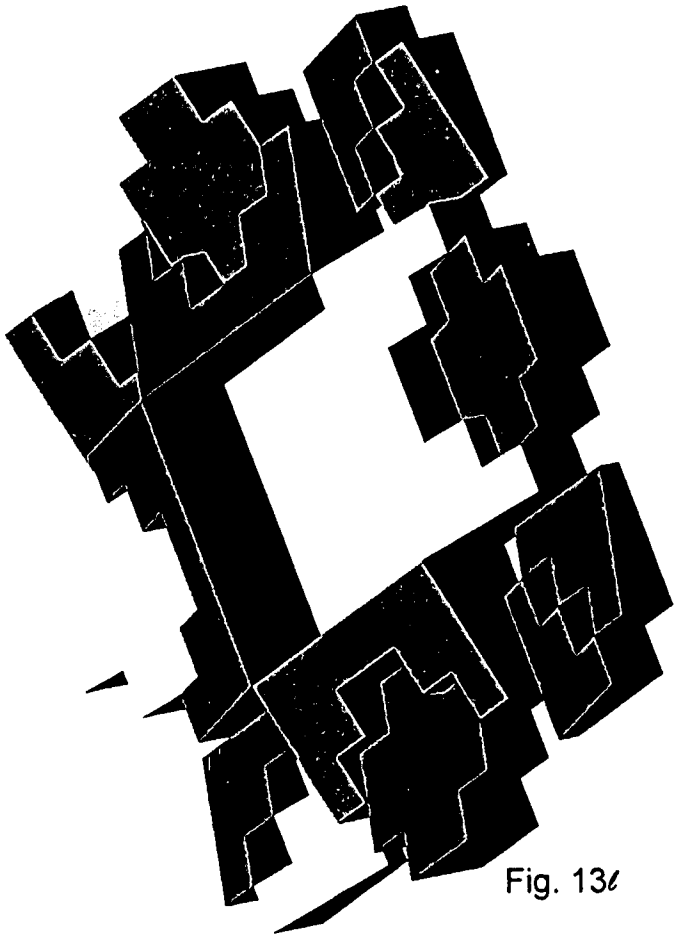
Figure 13K:
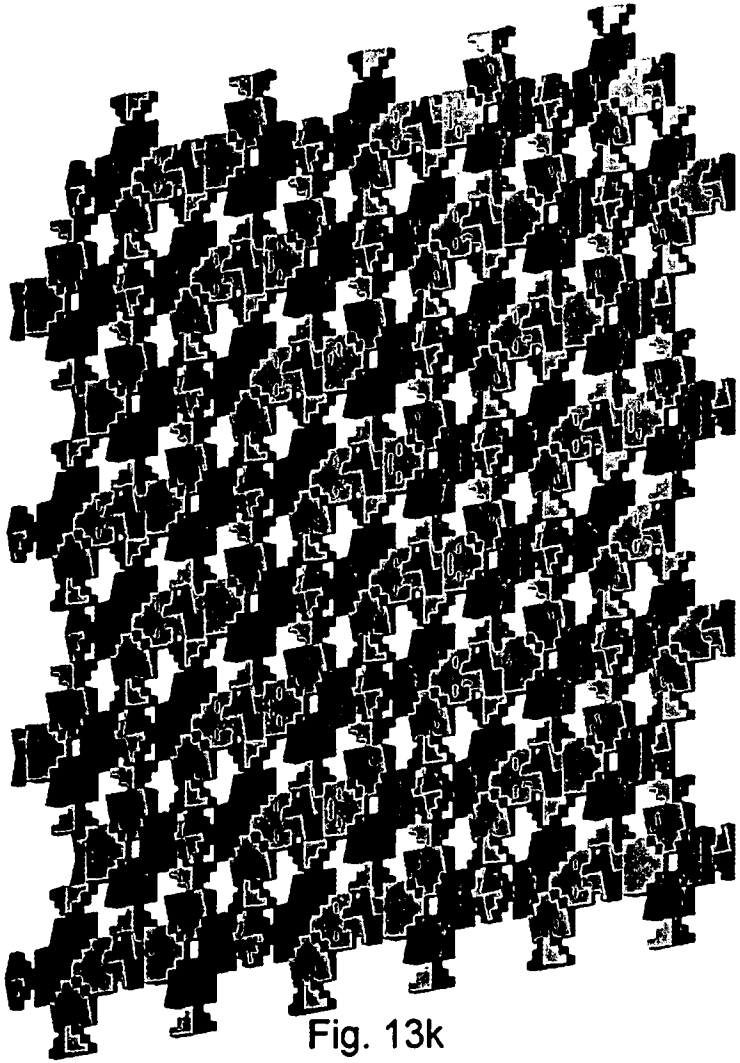
Figure 13N:
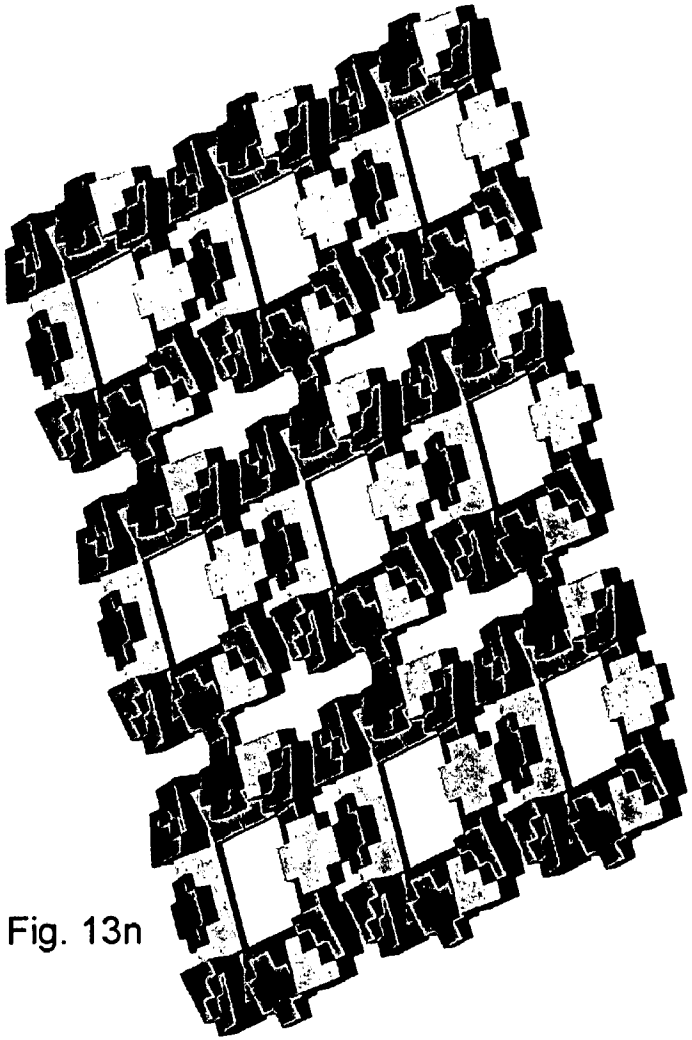
Figure 13M:
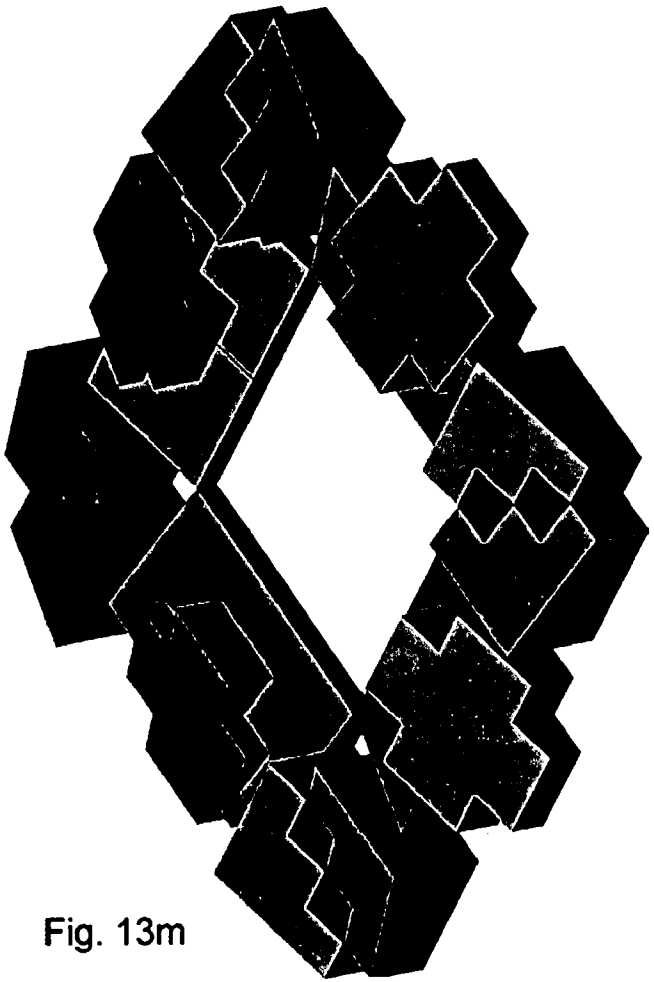
Figure 13P:
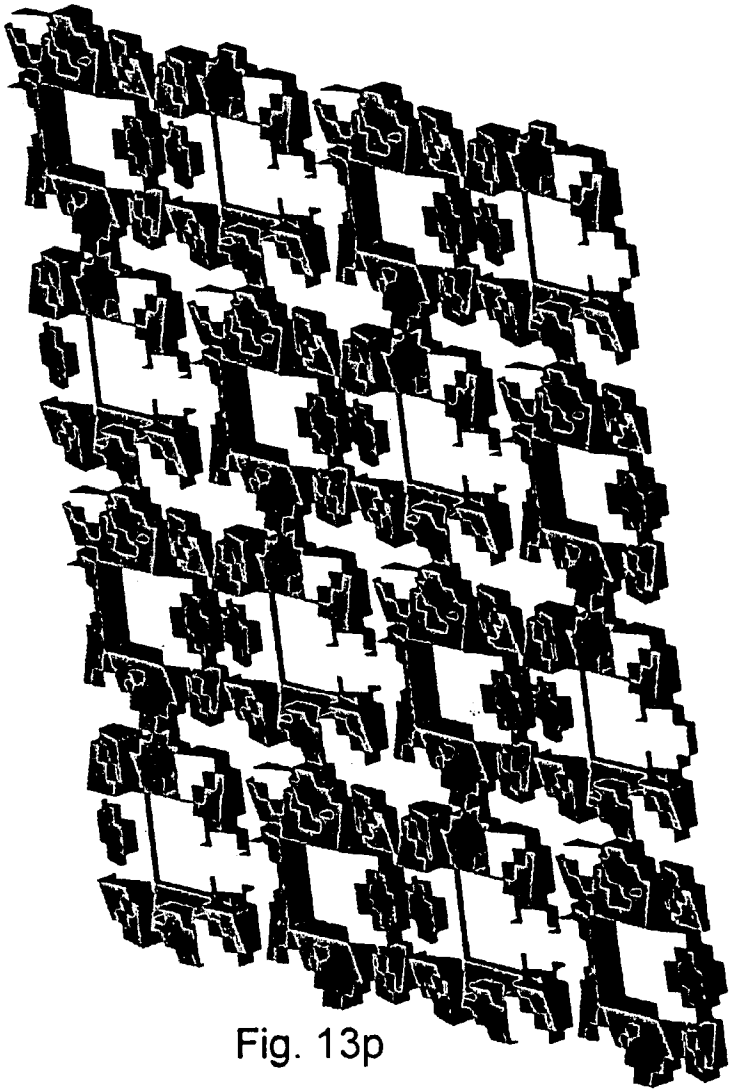
Figure 13O:
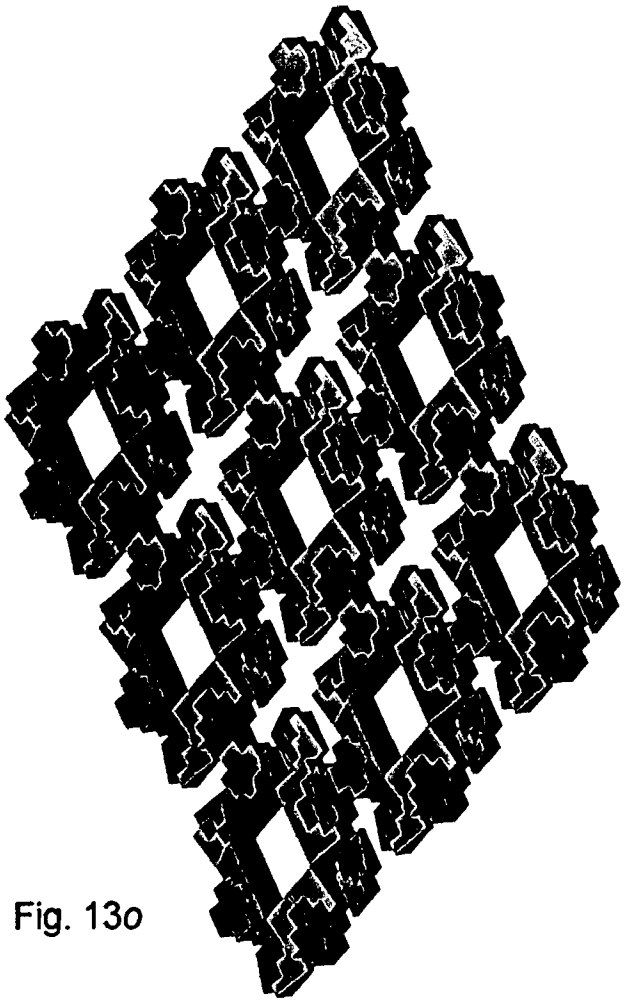
Figure 13R:
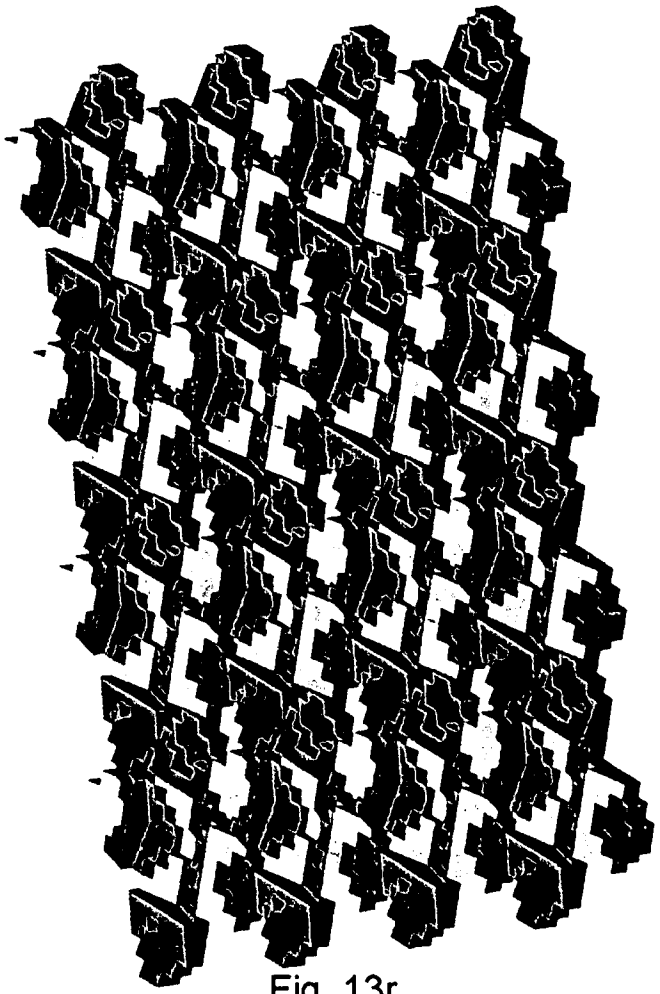
Figure 13Q:
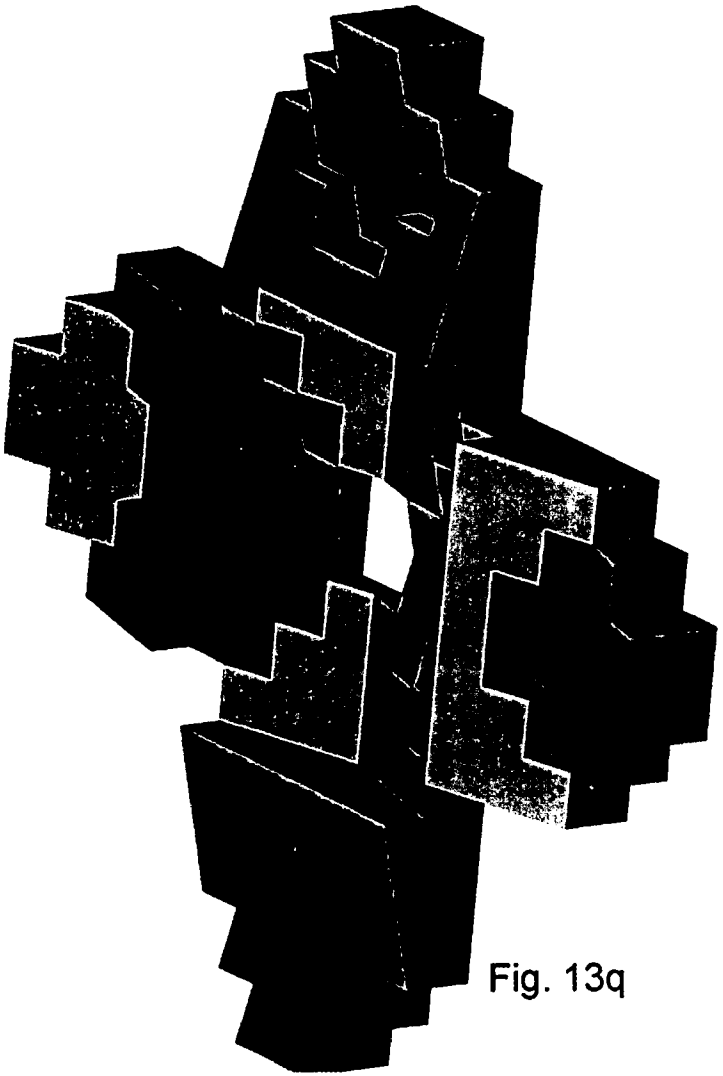
Figure 13T:
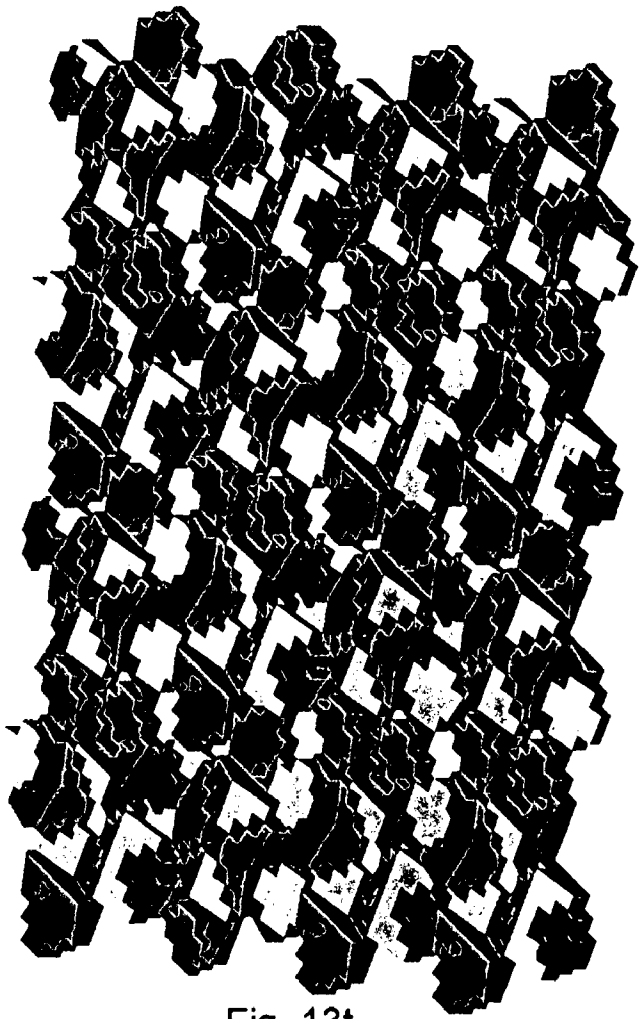
Figure 13S:
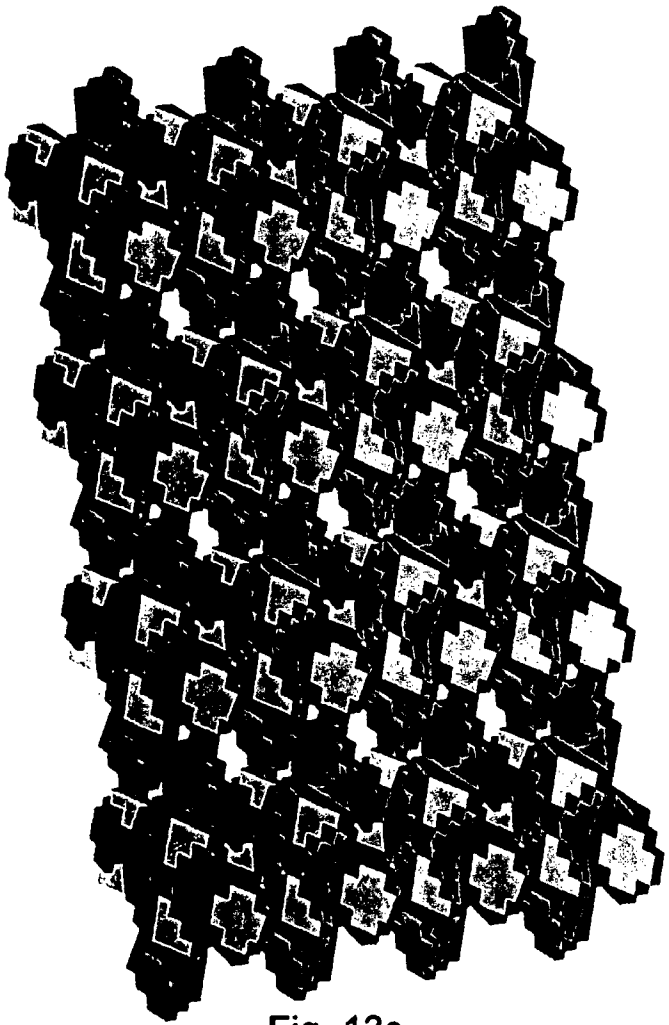
Figure 14B:
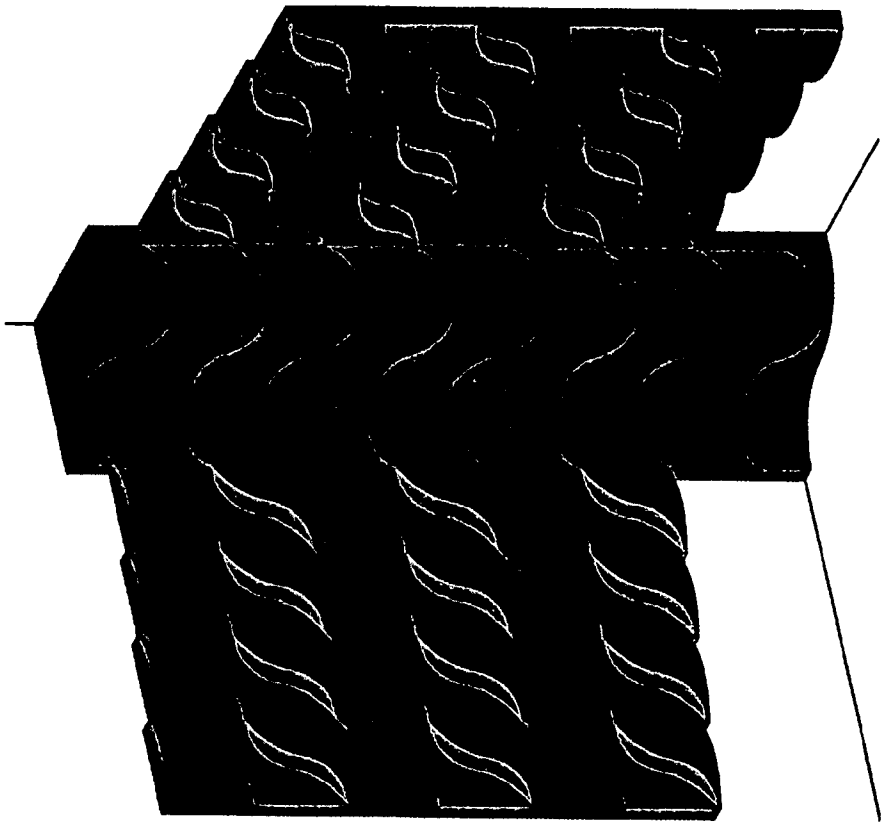
FIGS. 14*a* through 14*o* illustrate other embodiments of the invention, suitable for installation in the corner of a room, and several alternative installation arrangements.
Figure 14A:
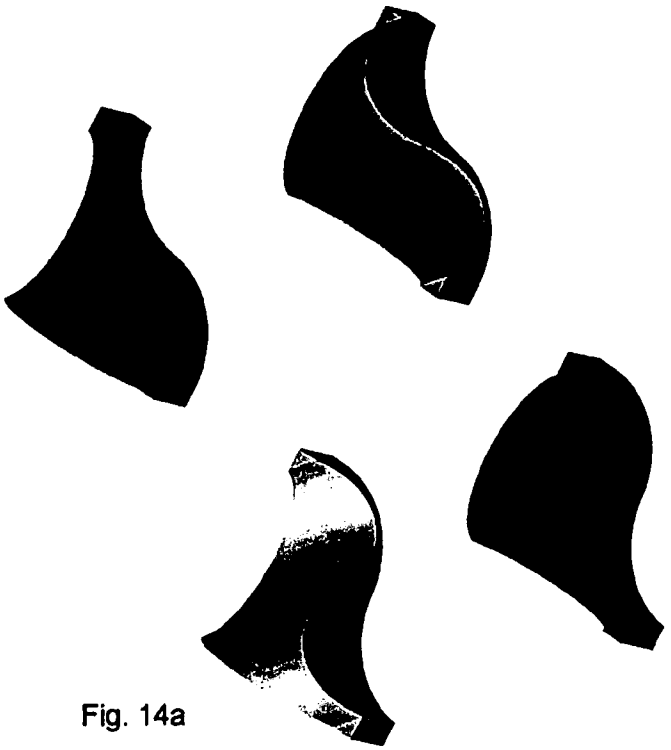
Figure 14D:
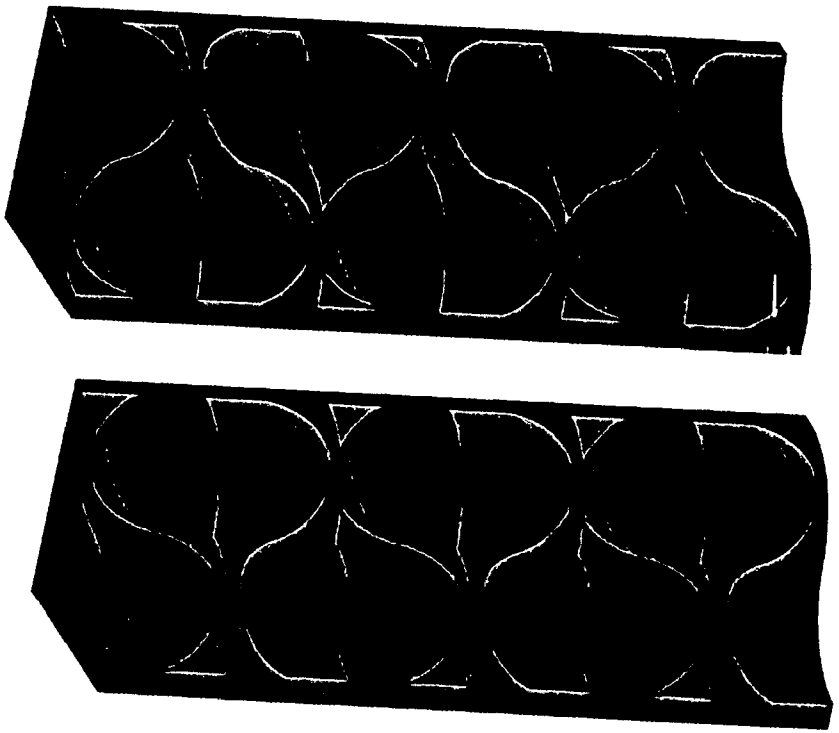
Figure 14C:
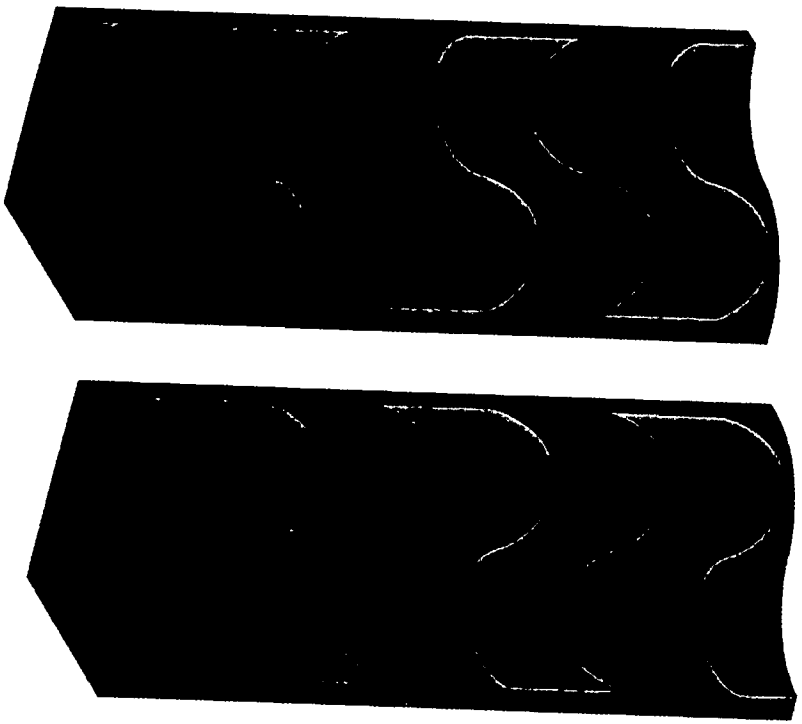
Figure 14F:
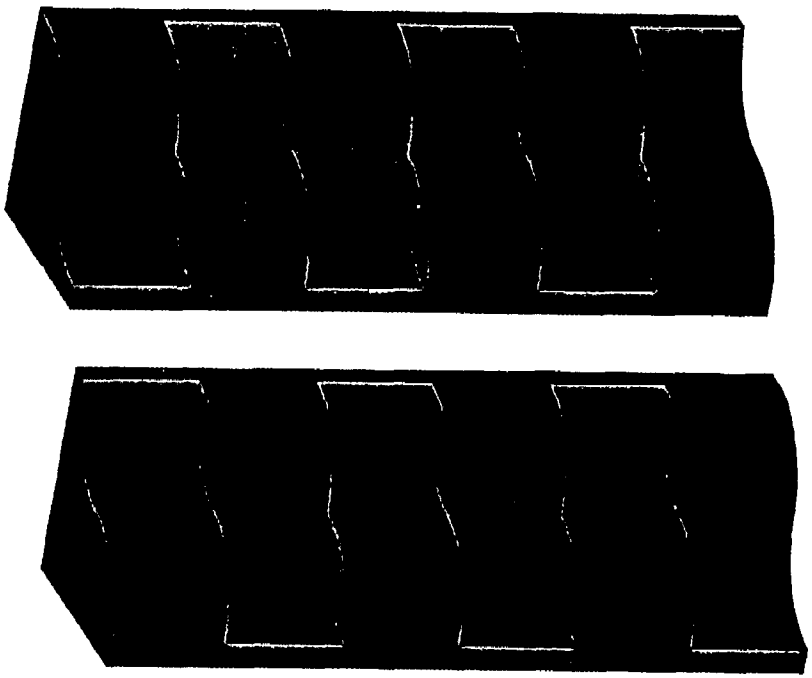
Figure 14E:
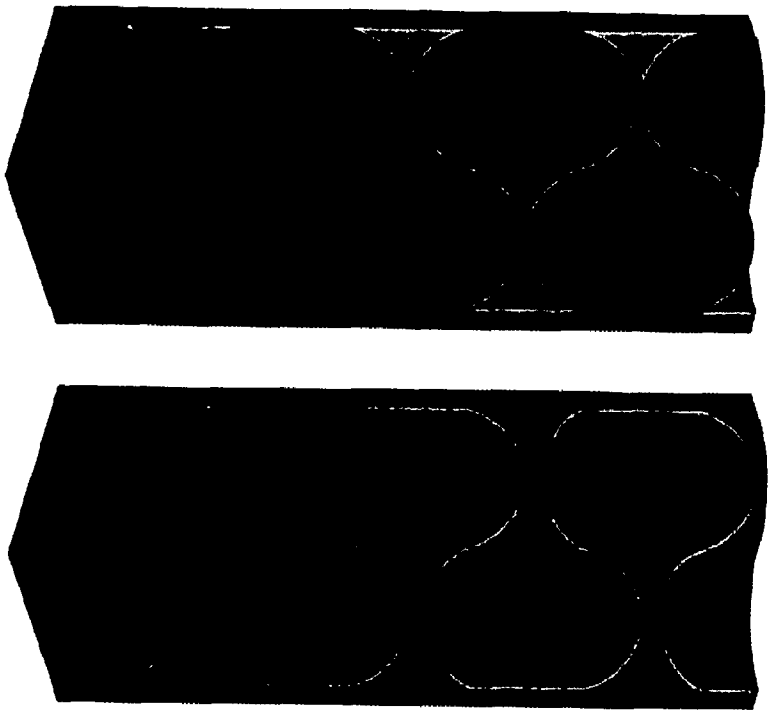
Figure 14H:
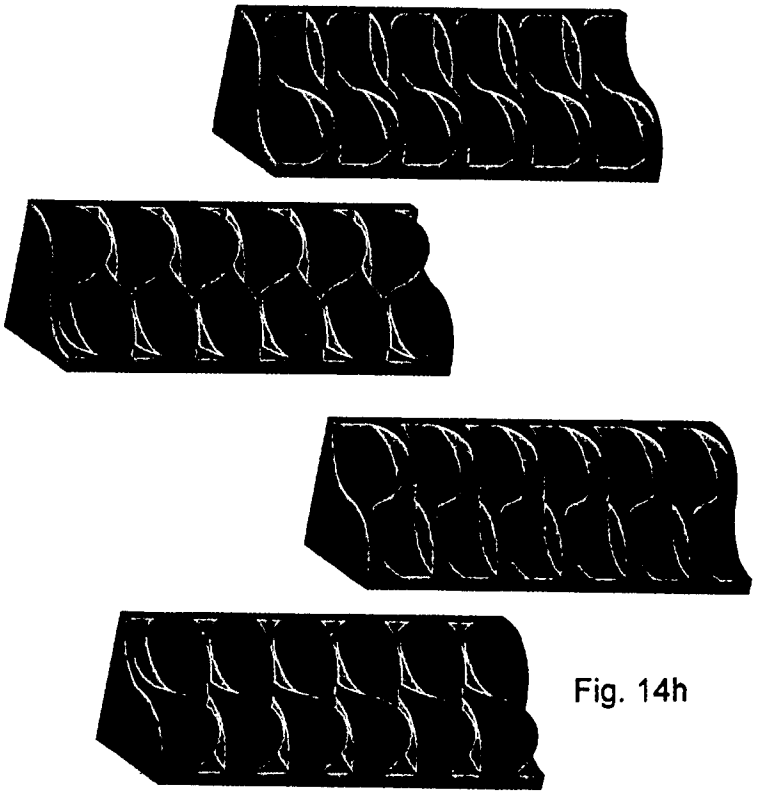
Figure 14G:
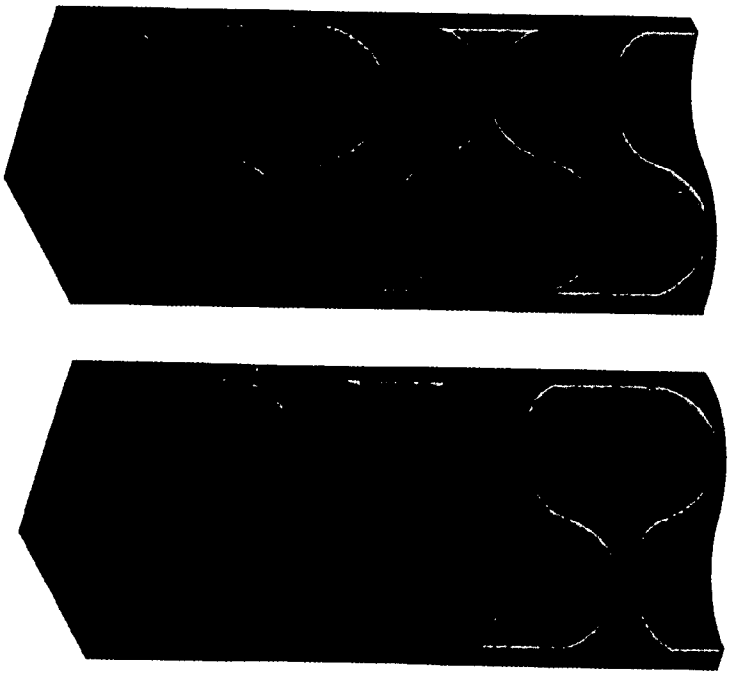
Figure 14J:
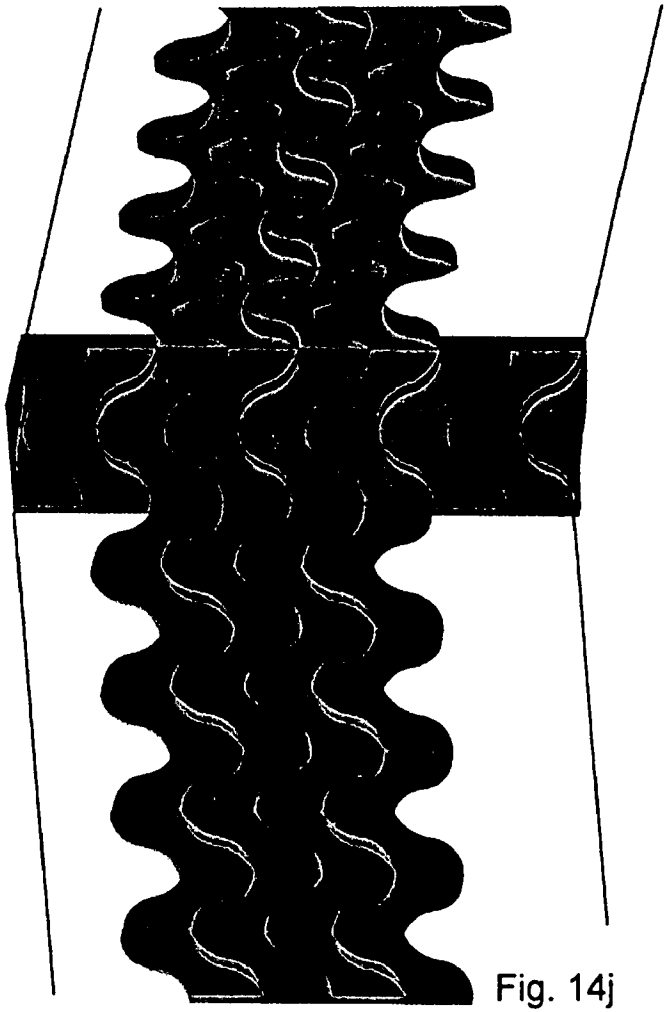
Figure 14I:
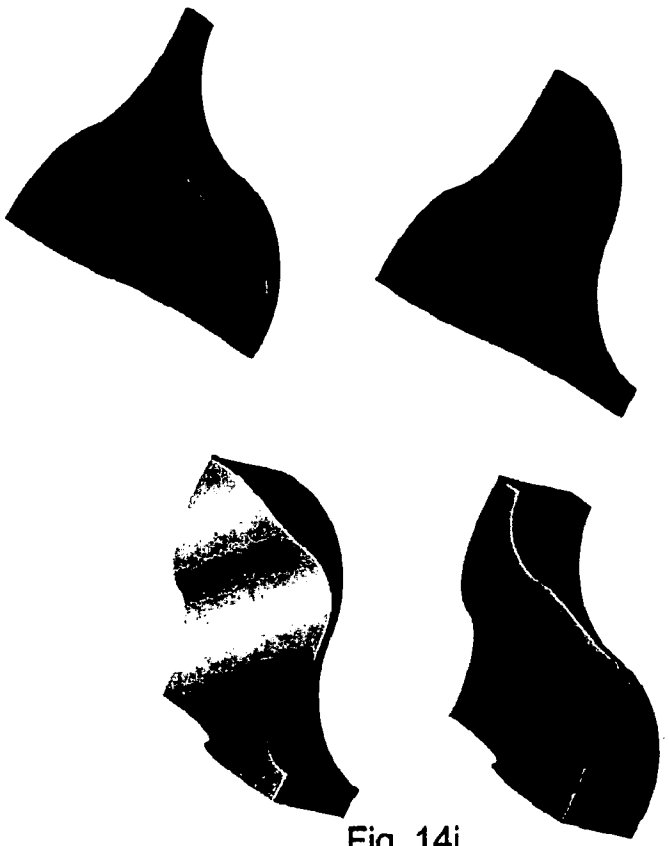
Figure 14K:
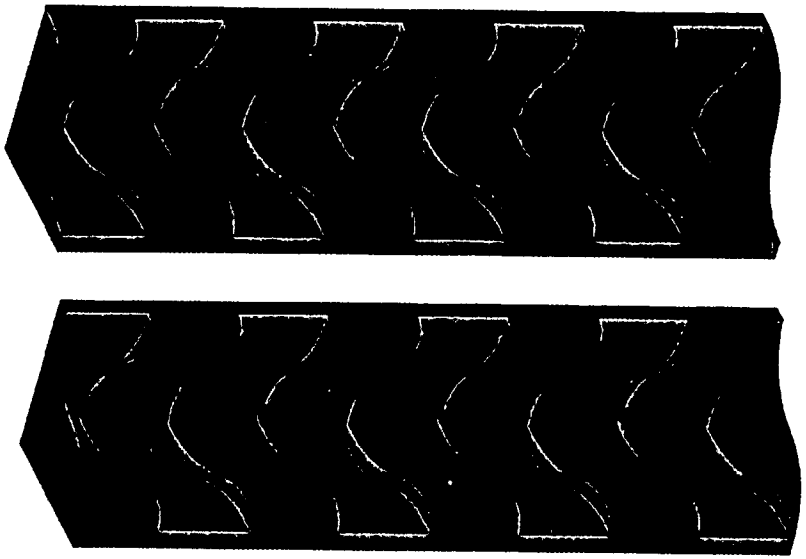
Figure 14K:
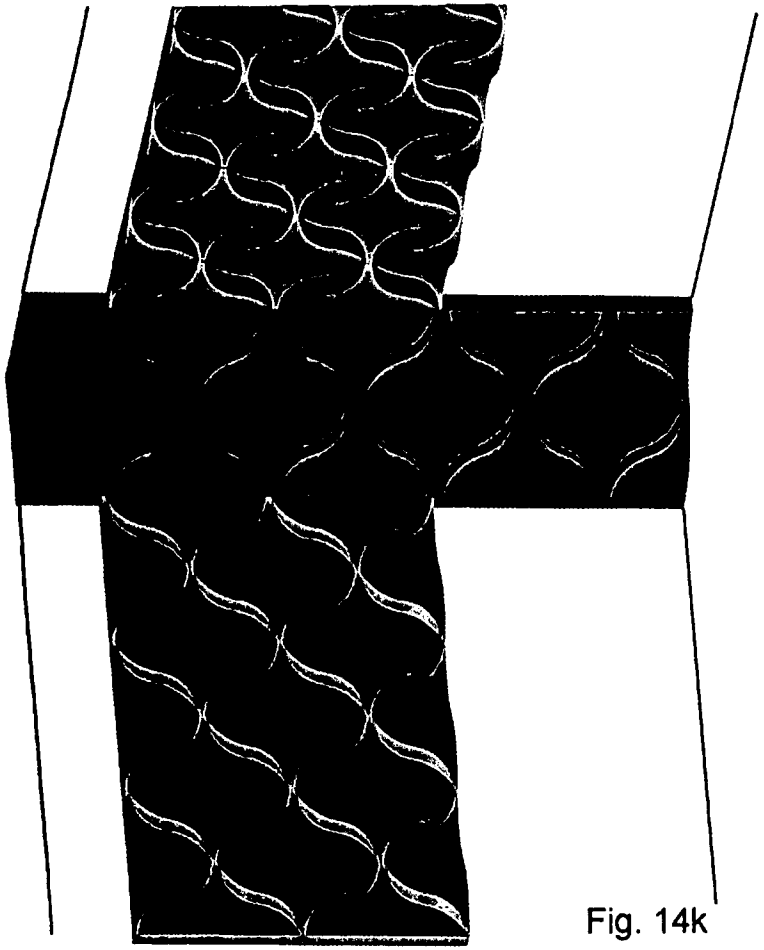
Figure 14N:
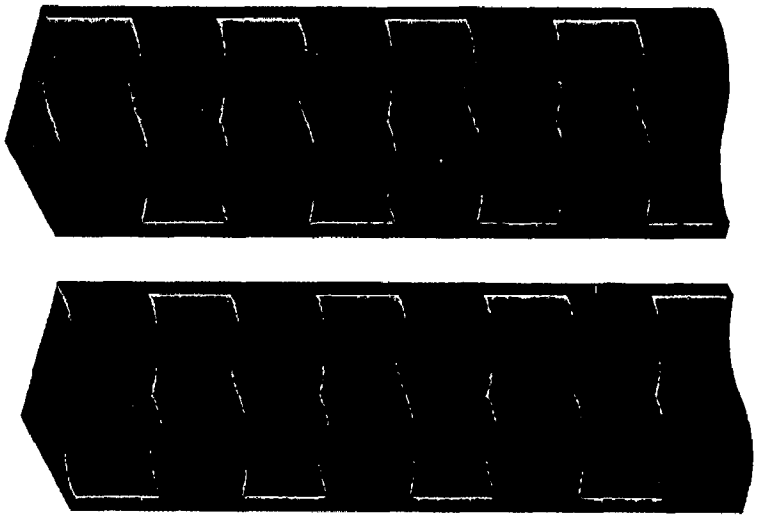
Figure 14M:
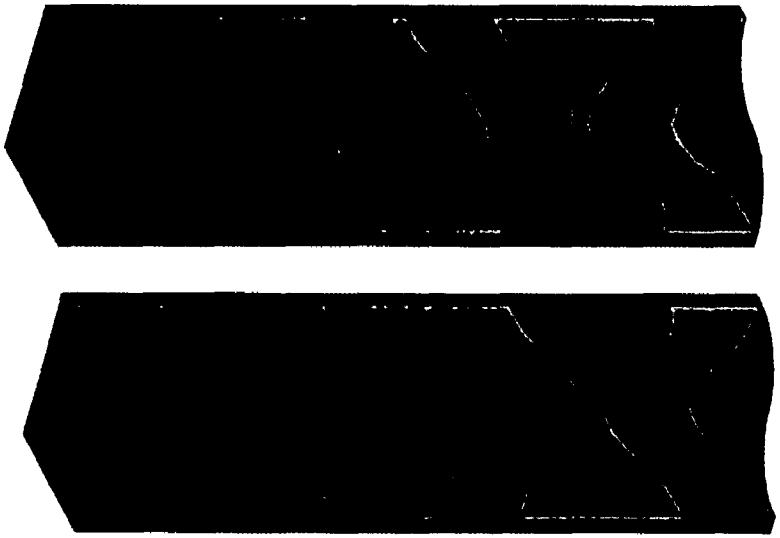
Figure 14O:
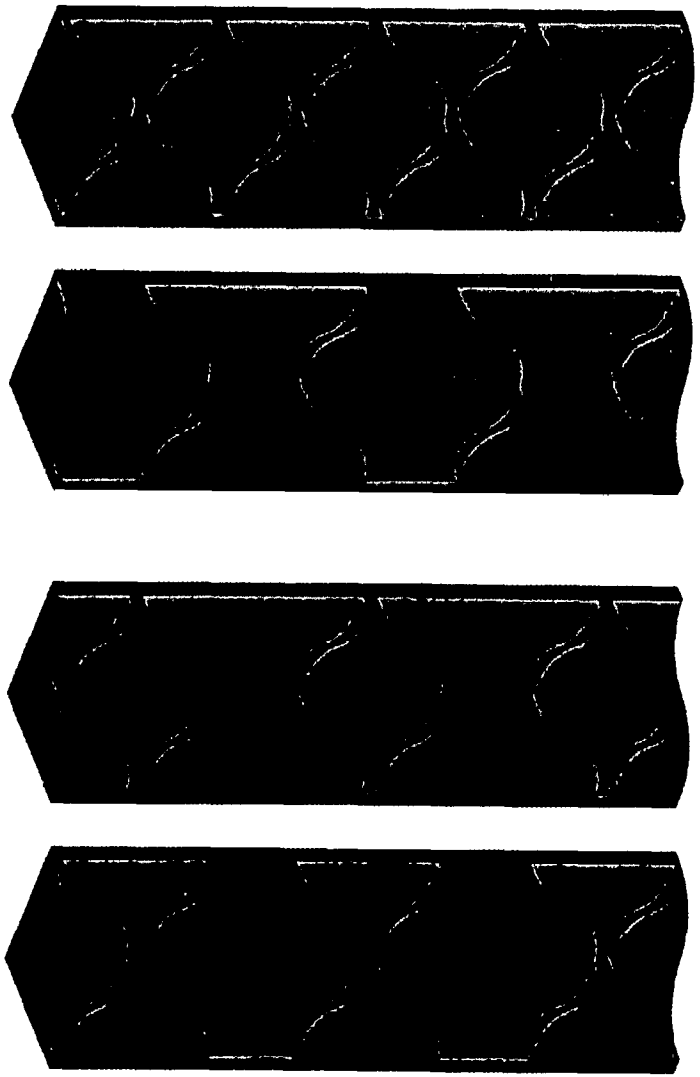
Figure 15A:
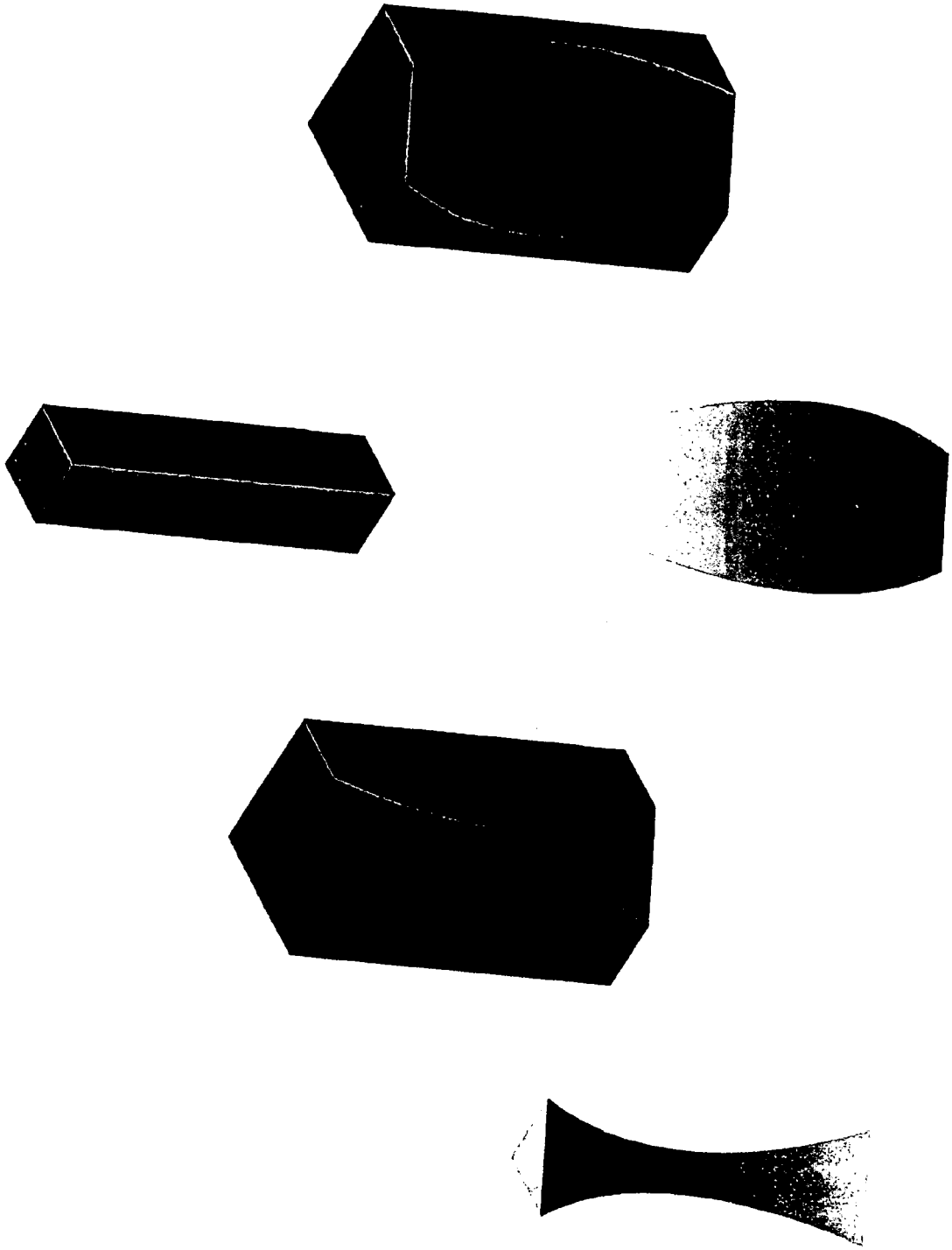
FIGS. 15*a* through 15*o* illustrate other embodiments of the invention suitable for installation in the corner of a room.
Figure 15B:
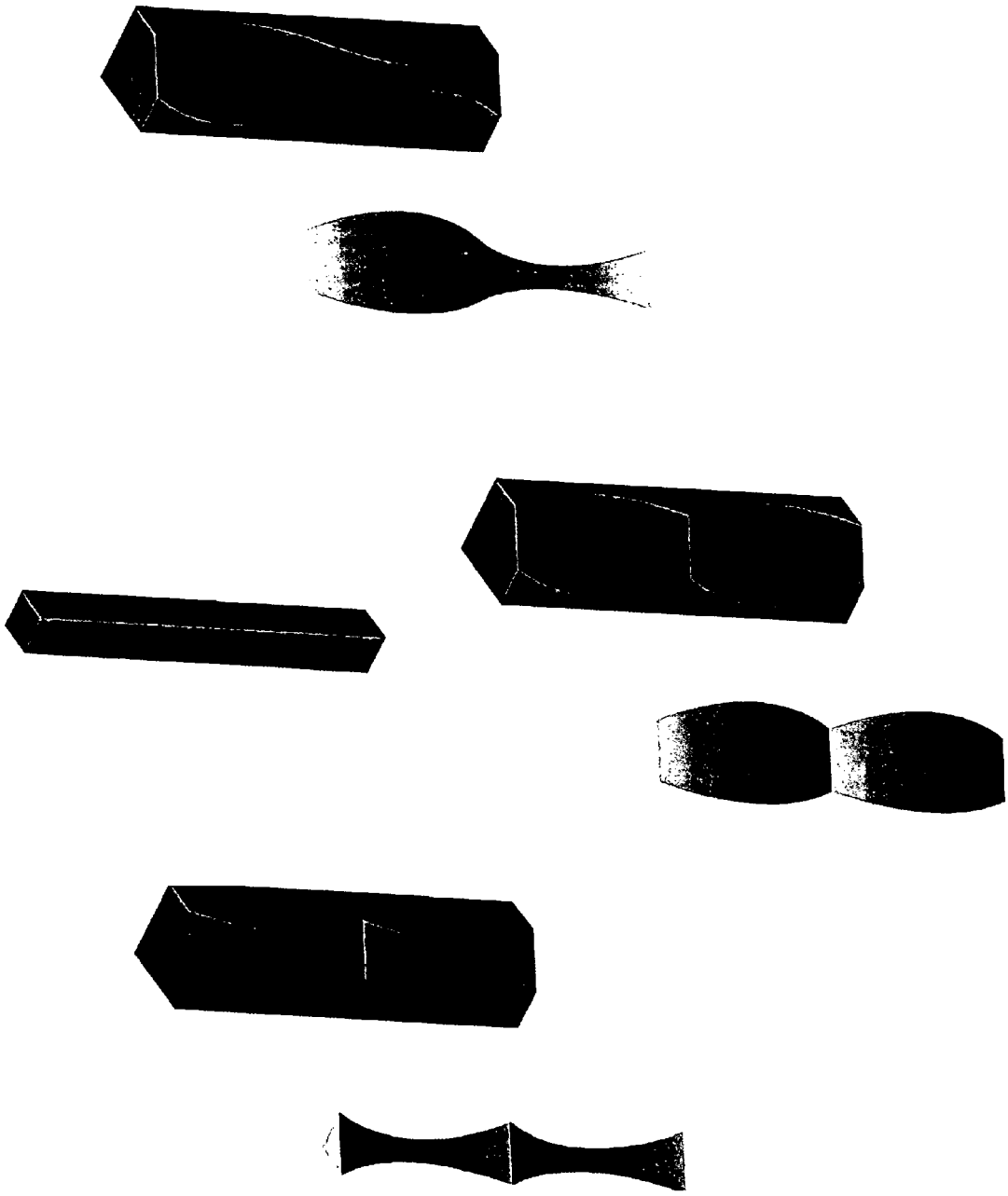
Figure 15C:
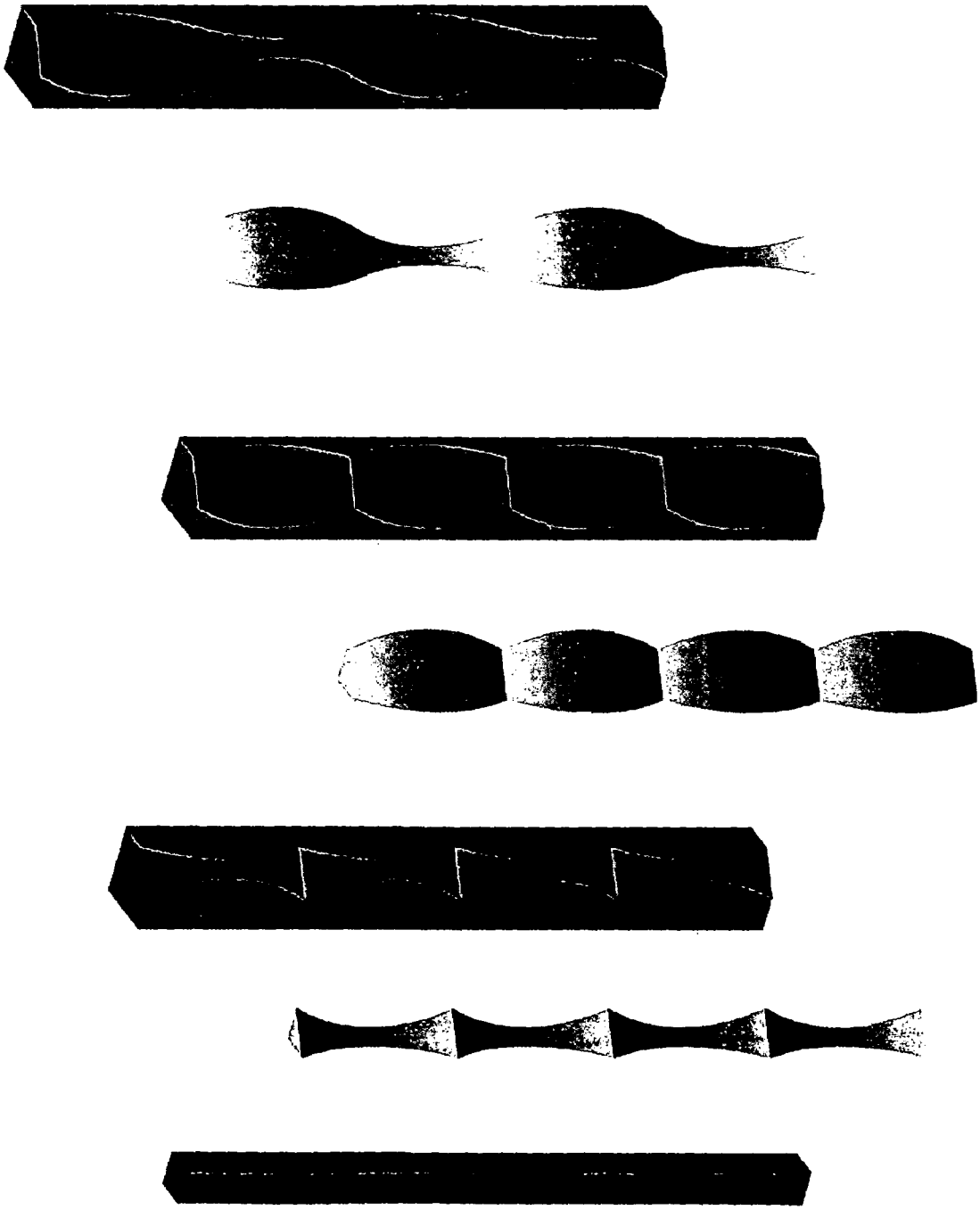
Figure 15D:
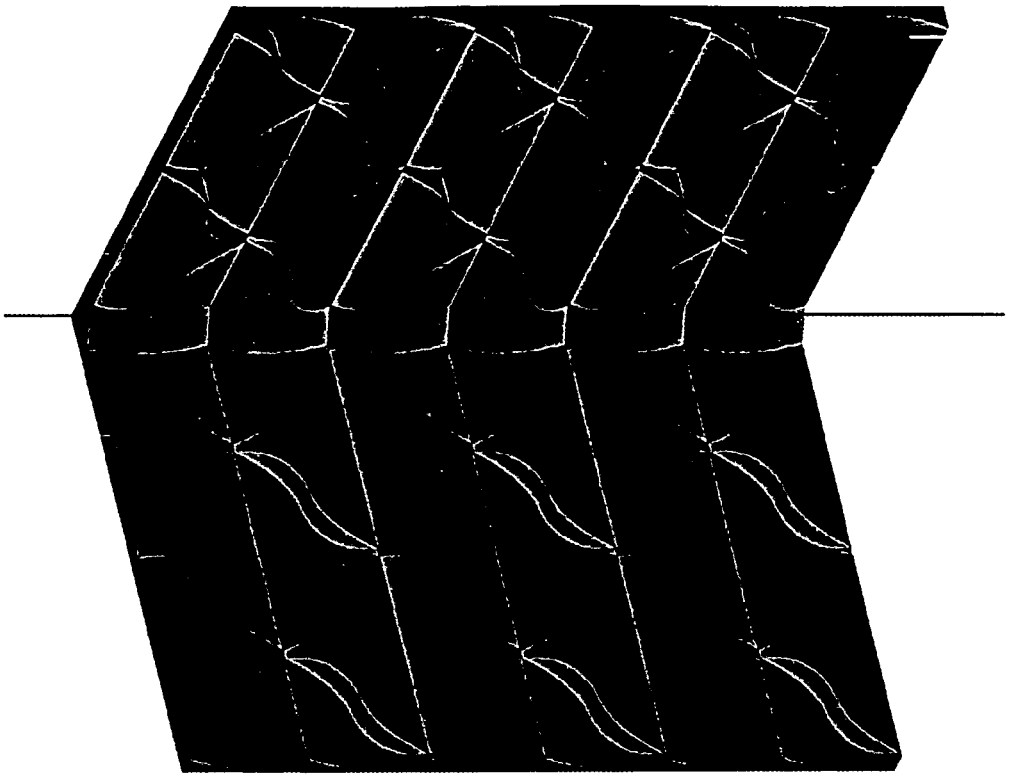
Figure 15E:
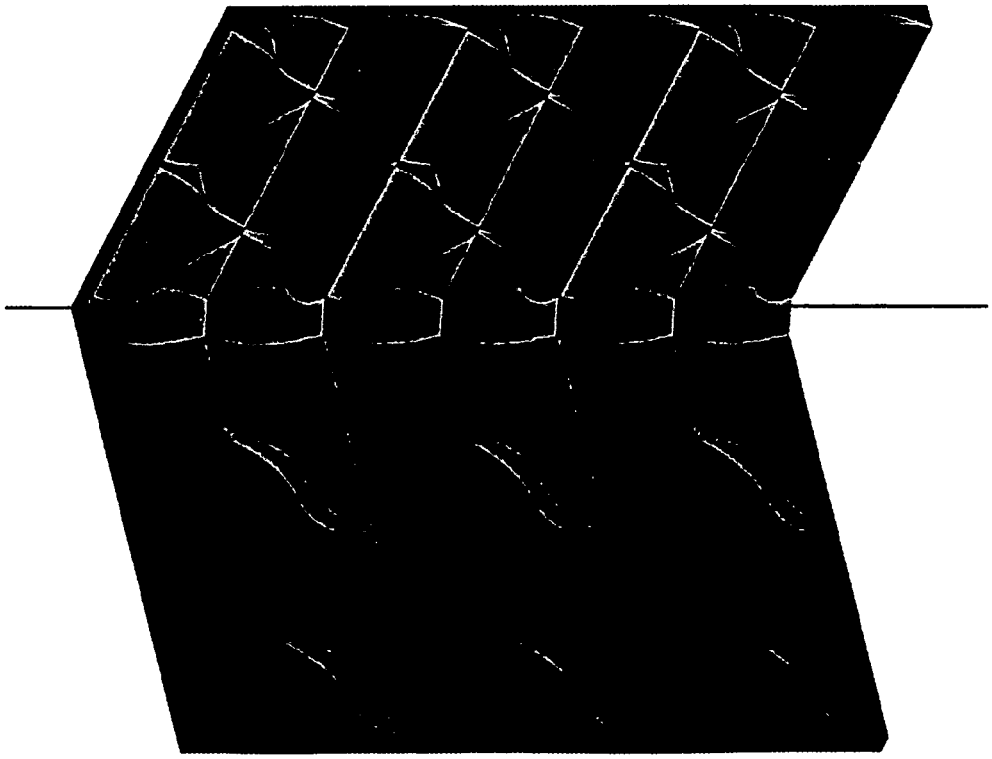
Figure 15F:
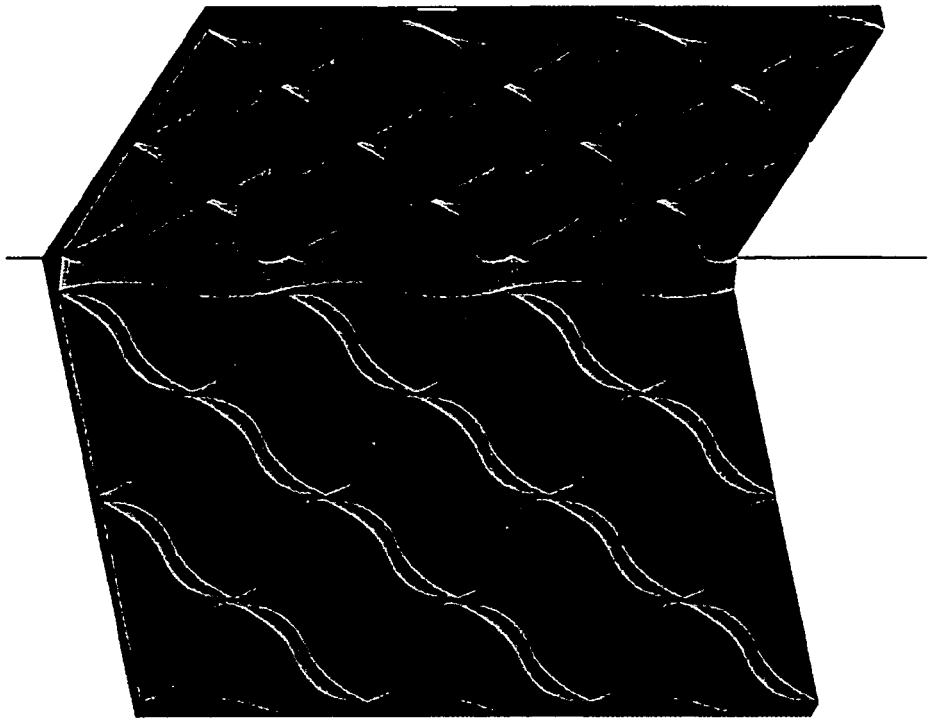
Figure 15G:
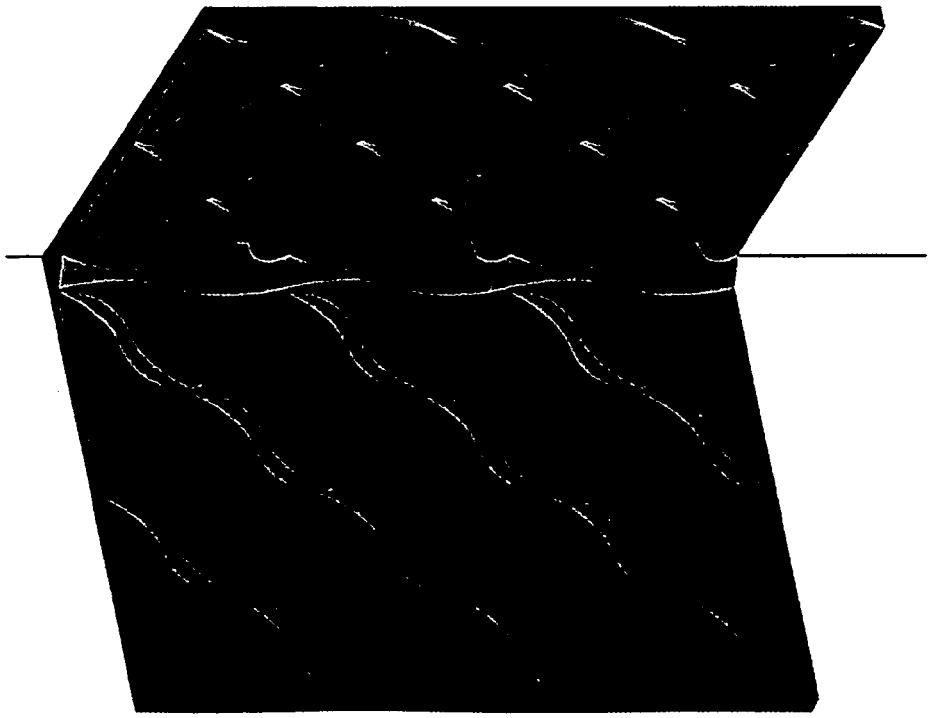
Figure 15H:
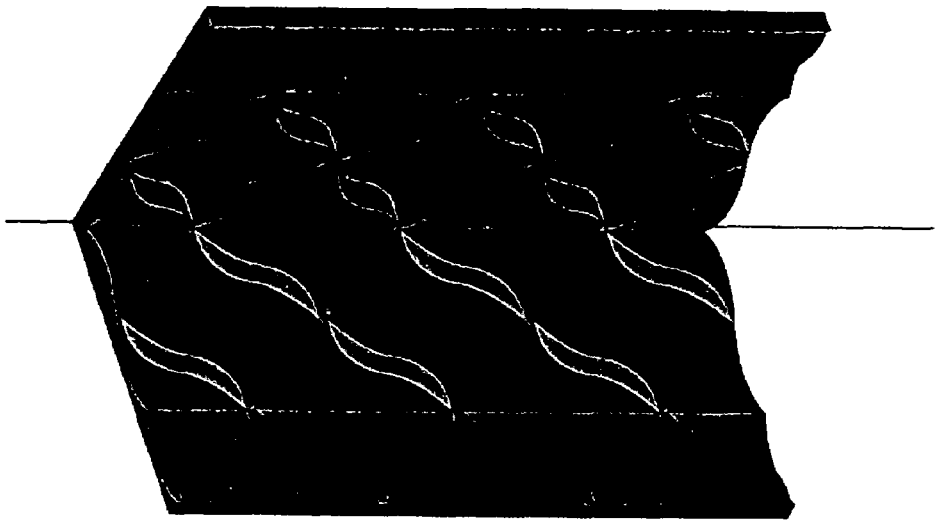
Figure 15I:
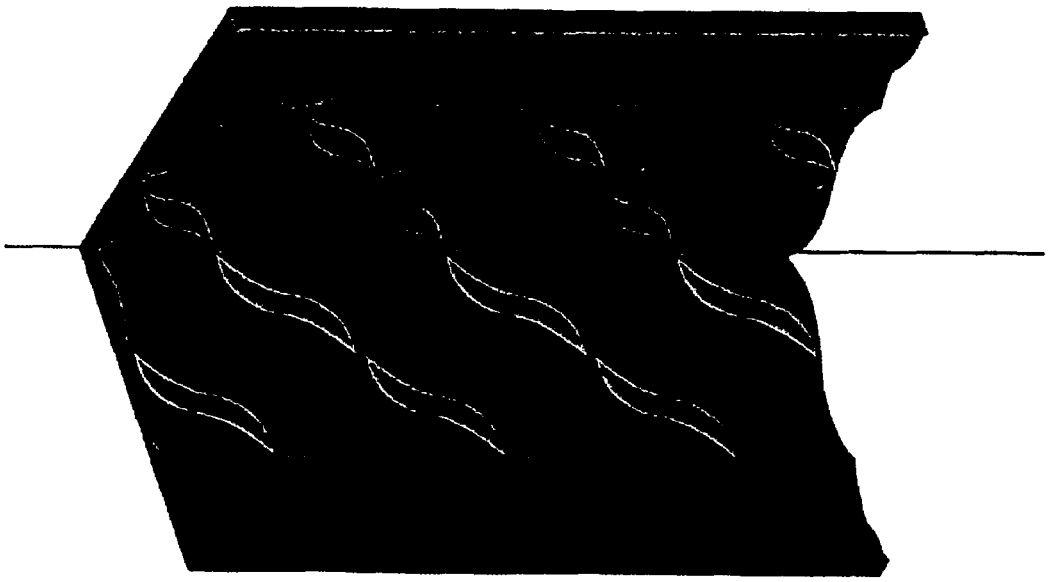
Figure 15J:
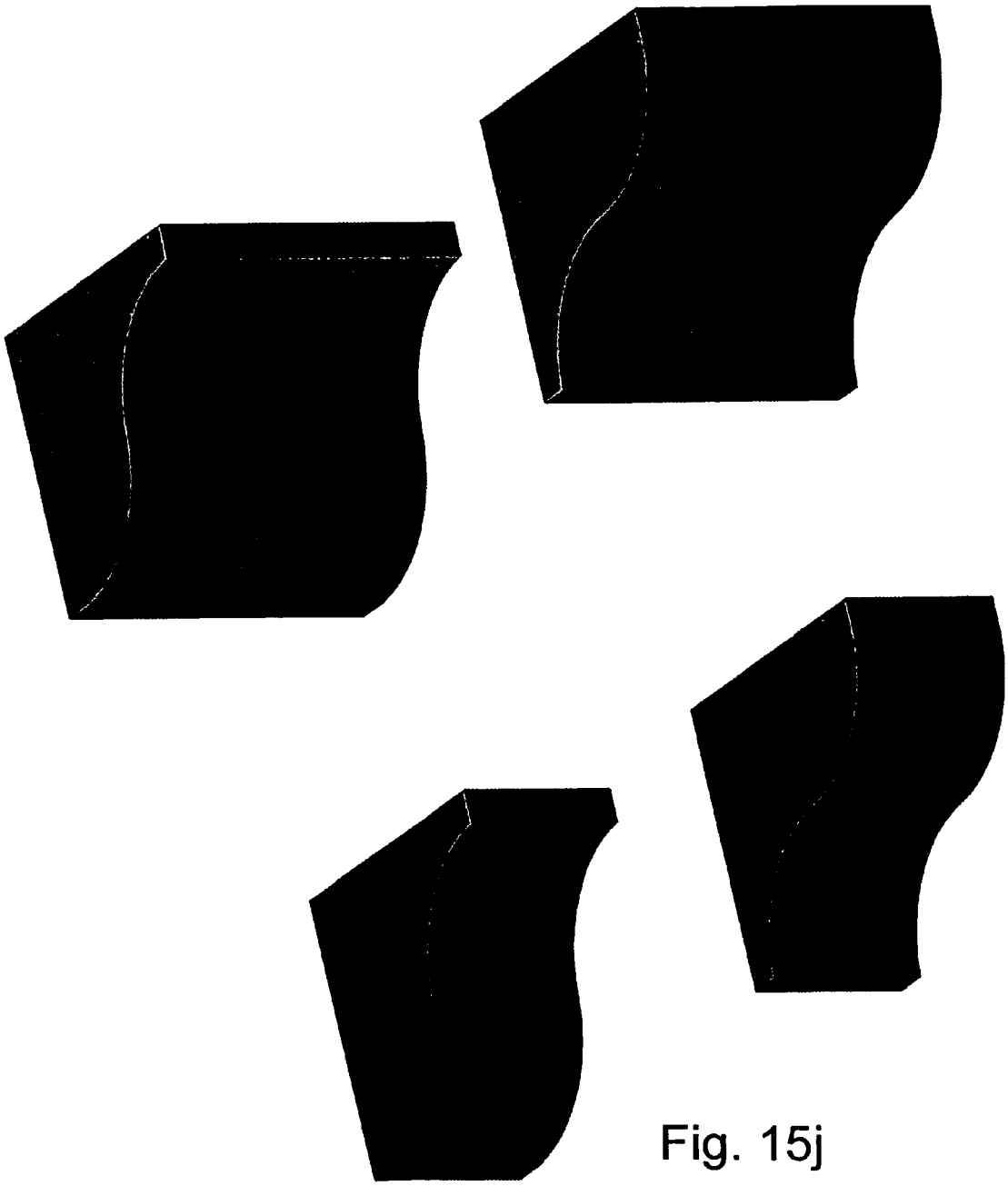
Figure 15K:
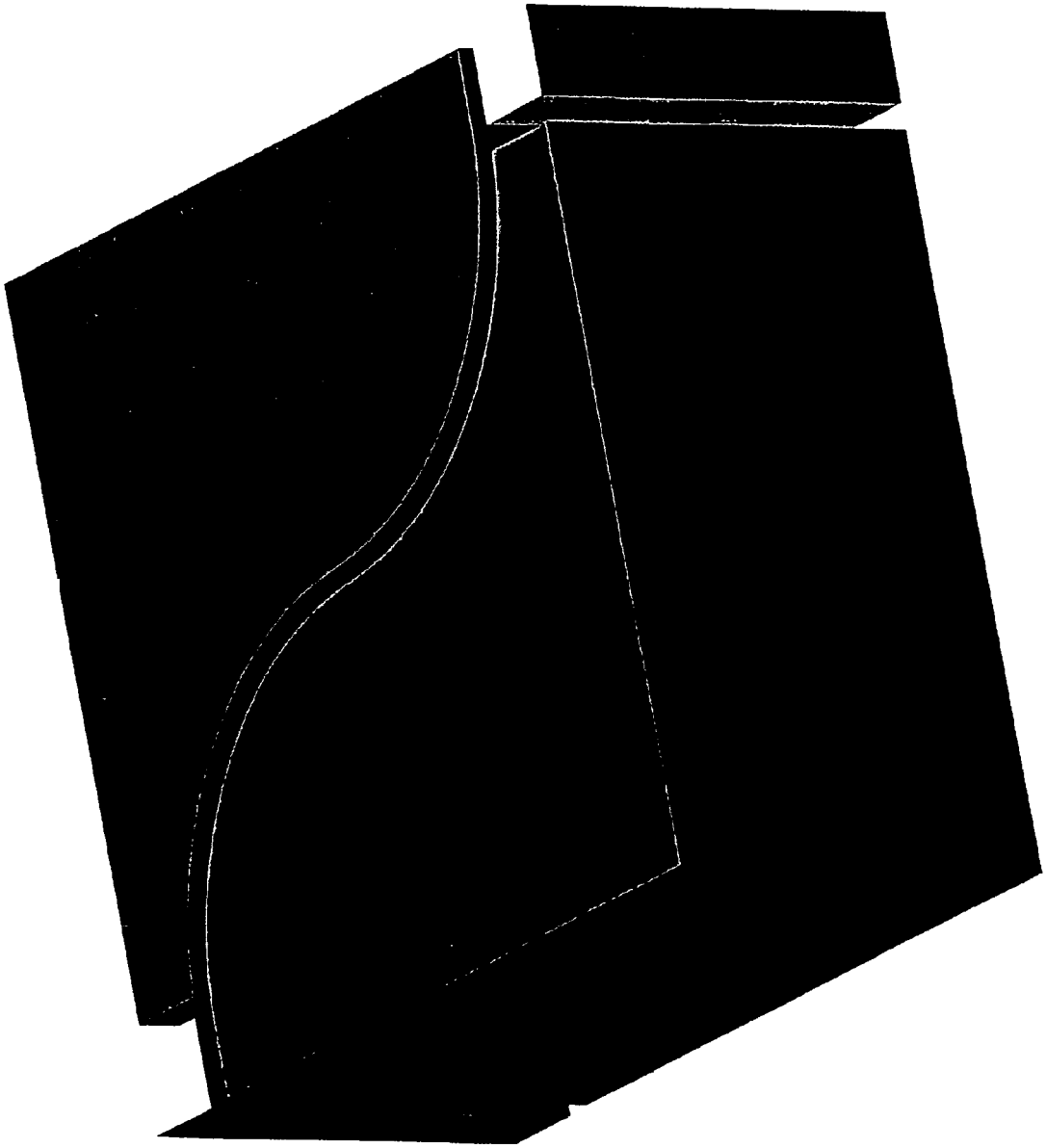
Figure 15M:
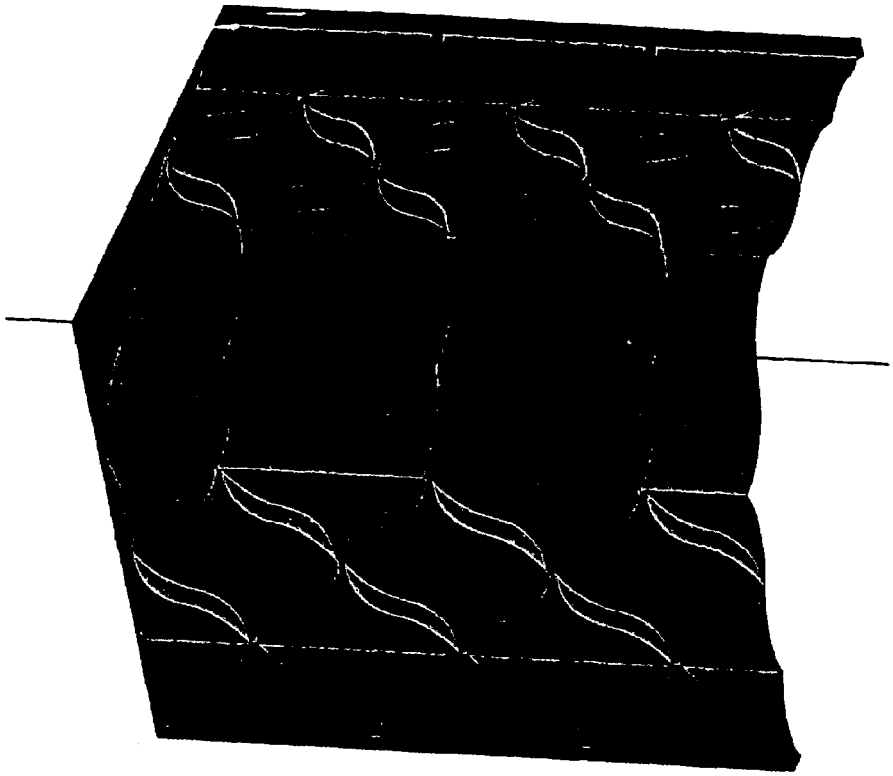
Figure 15M:
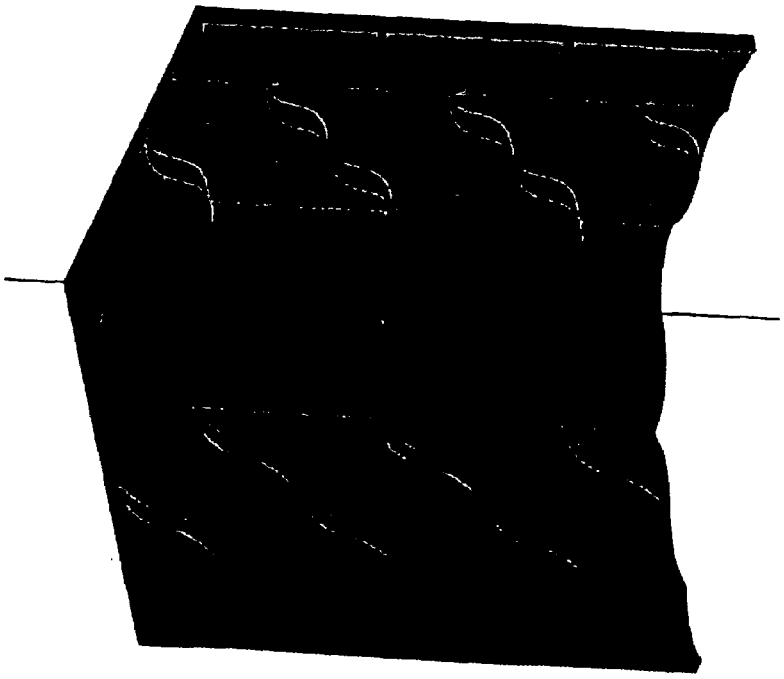
Figure 15N:
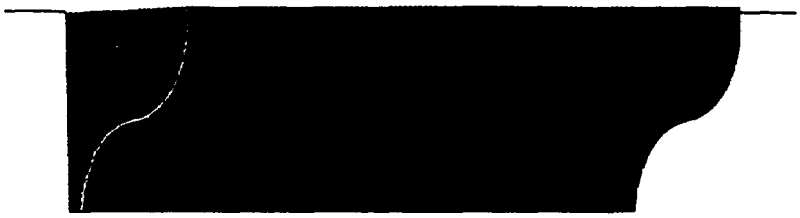
Figure 15N:
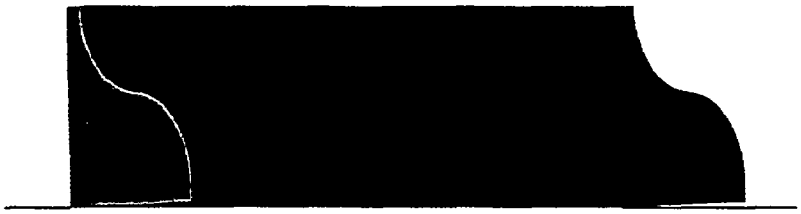
Figure 15O:
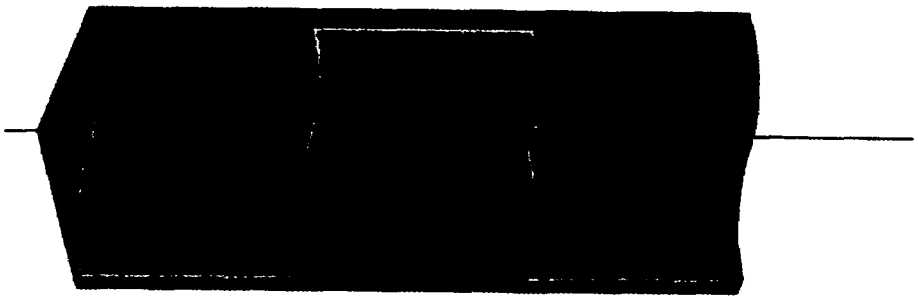
Figure 15O:
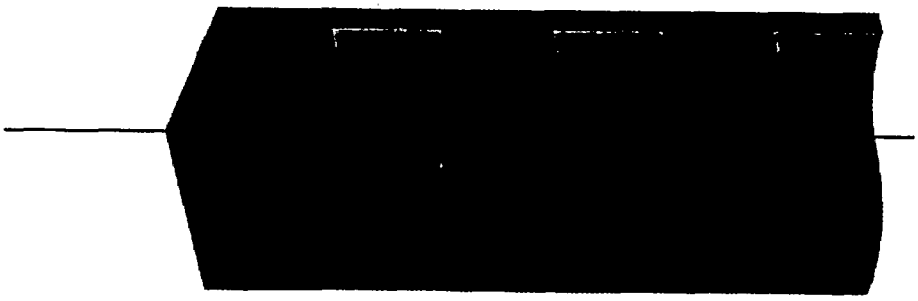
Figure 16A:
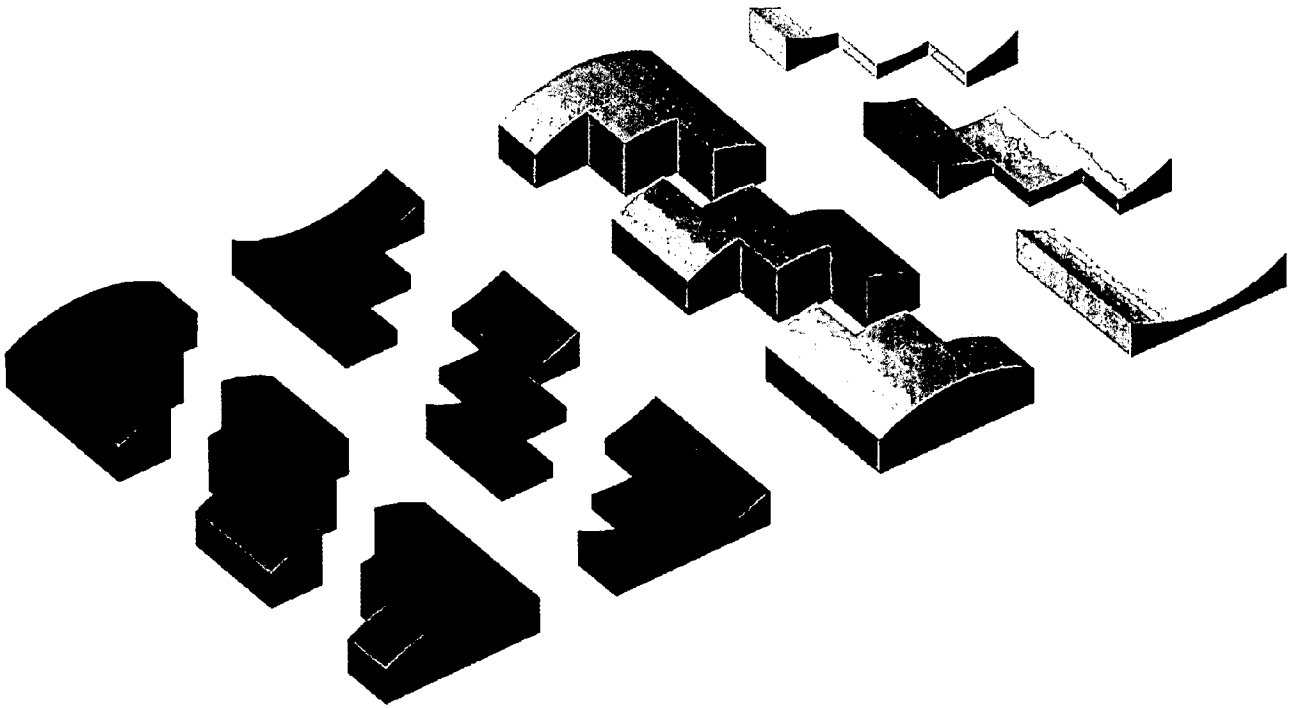
FIGS. 16*a*-16*o* illustrate another embodiment of the invention having an alternate set of complementarily tessellated shapes.
Figure 16B:
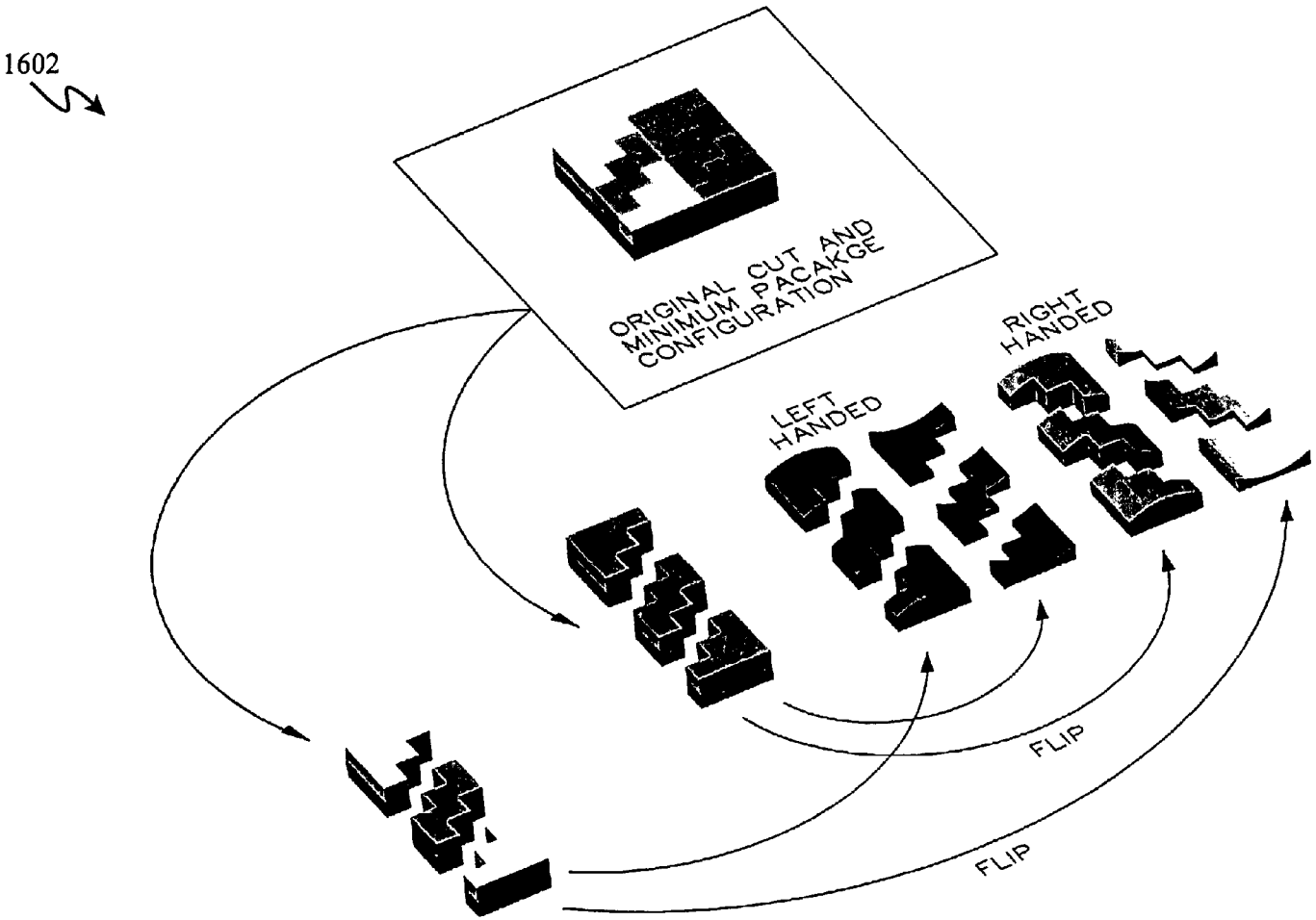
Figure 16C:
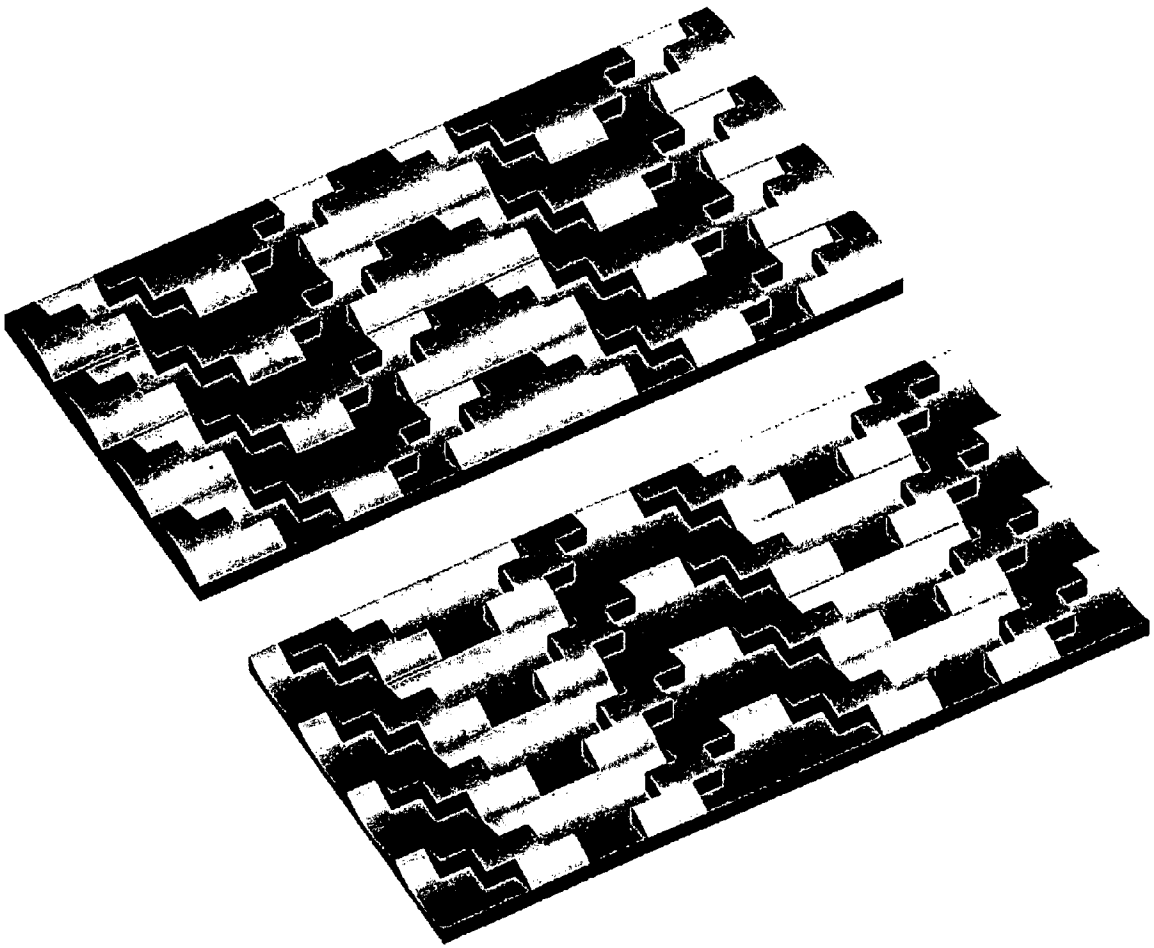
Figure 16D:
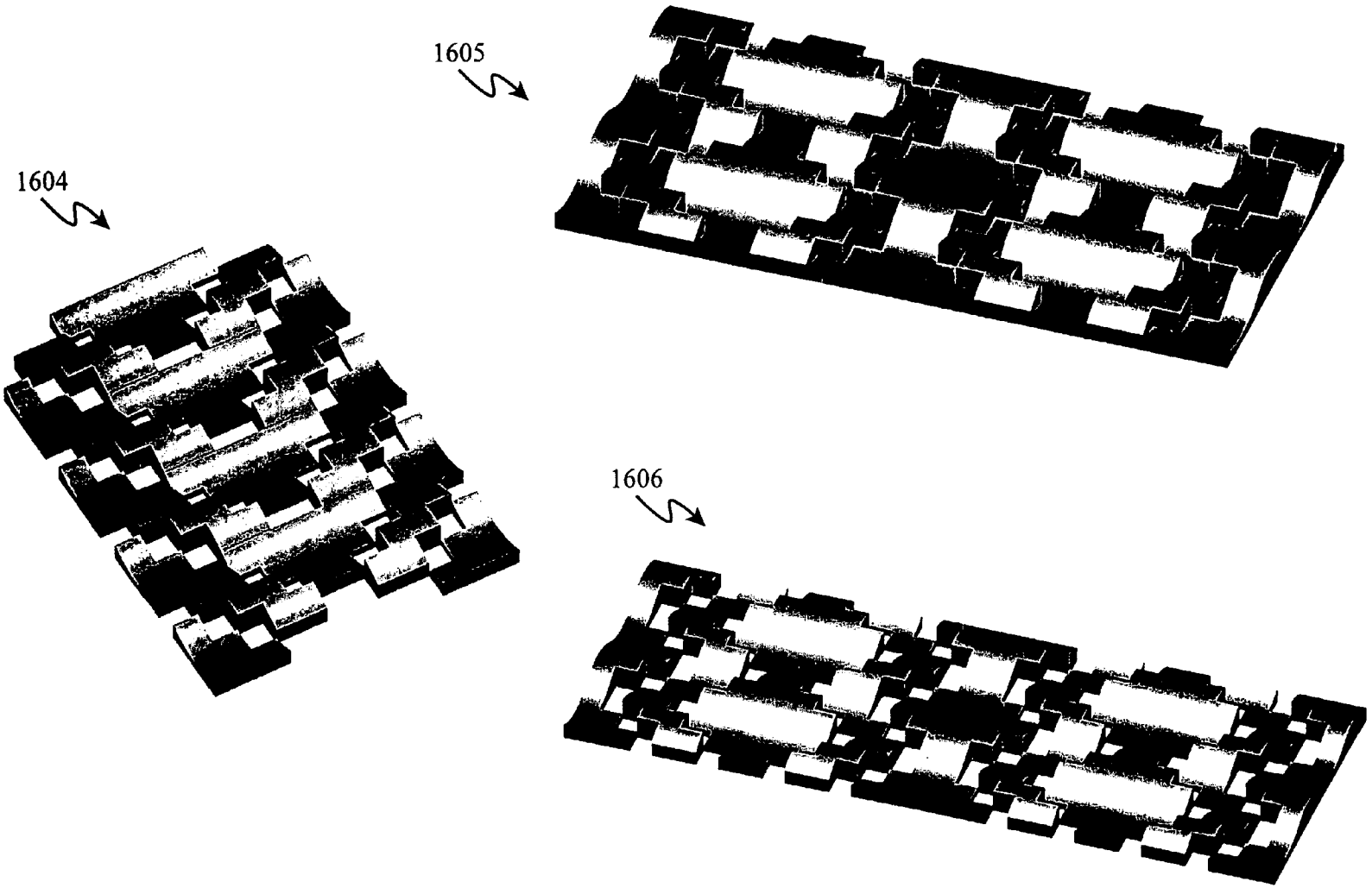
Figure 16E:
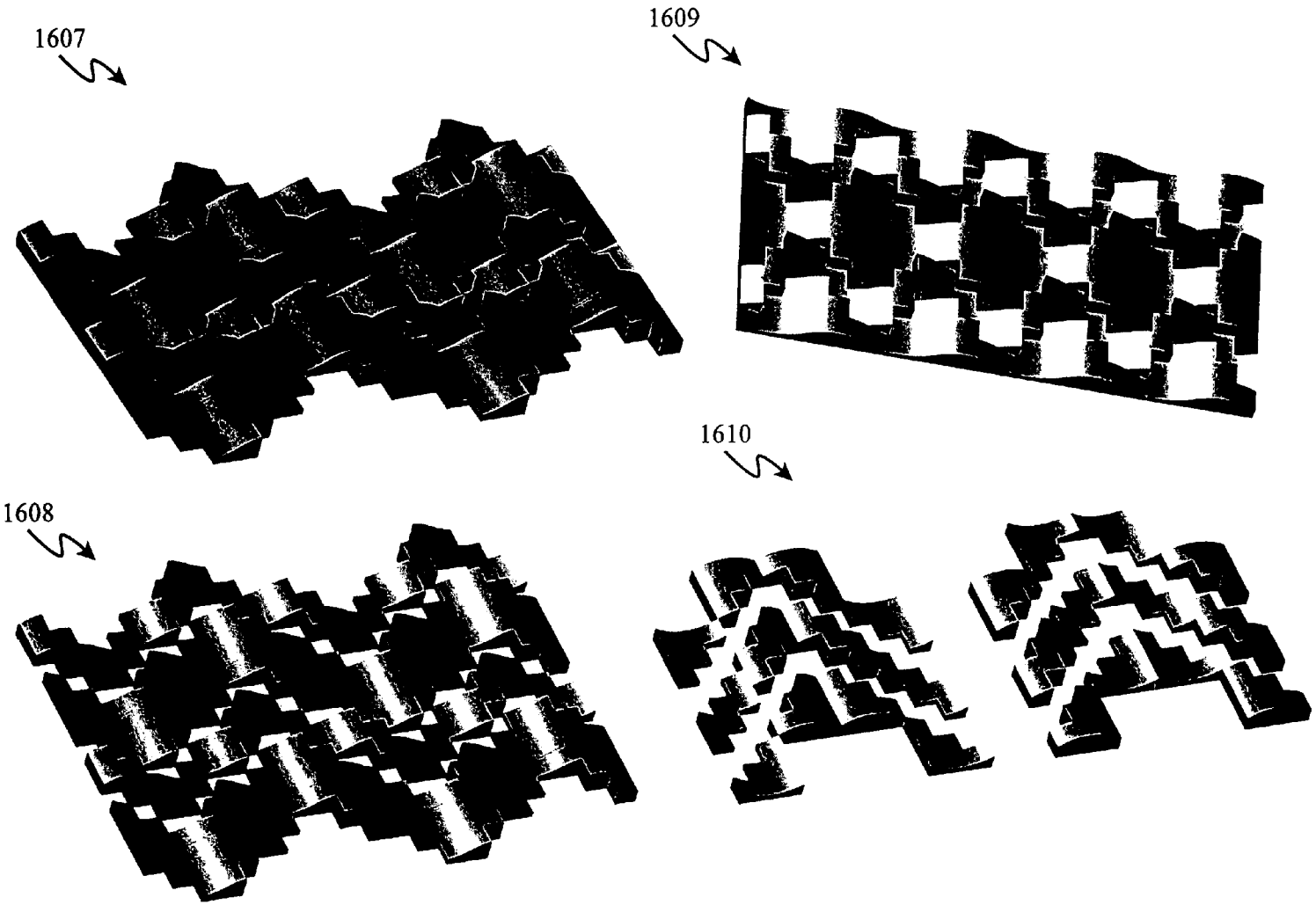
Figure 16F:
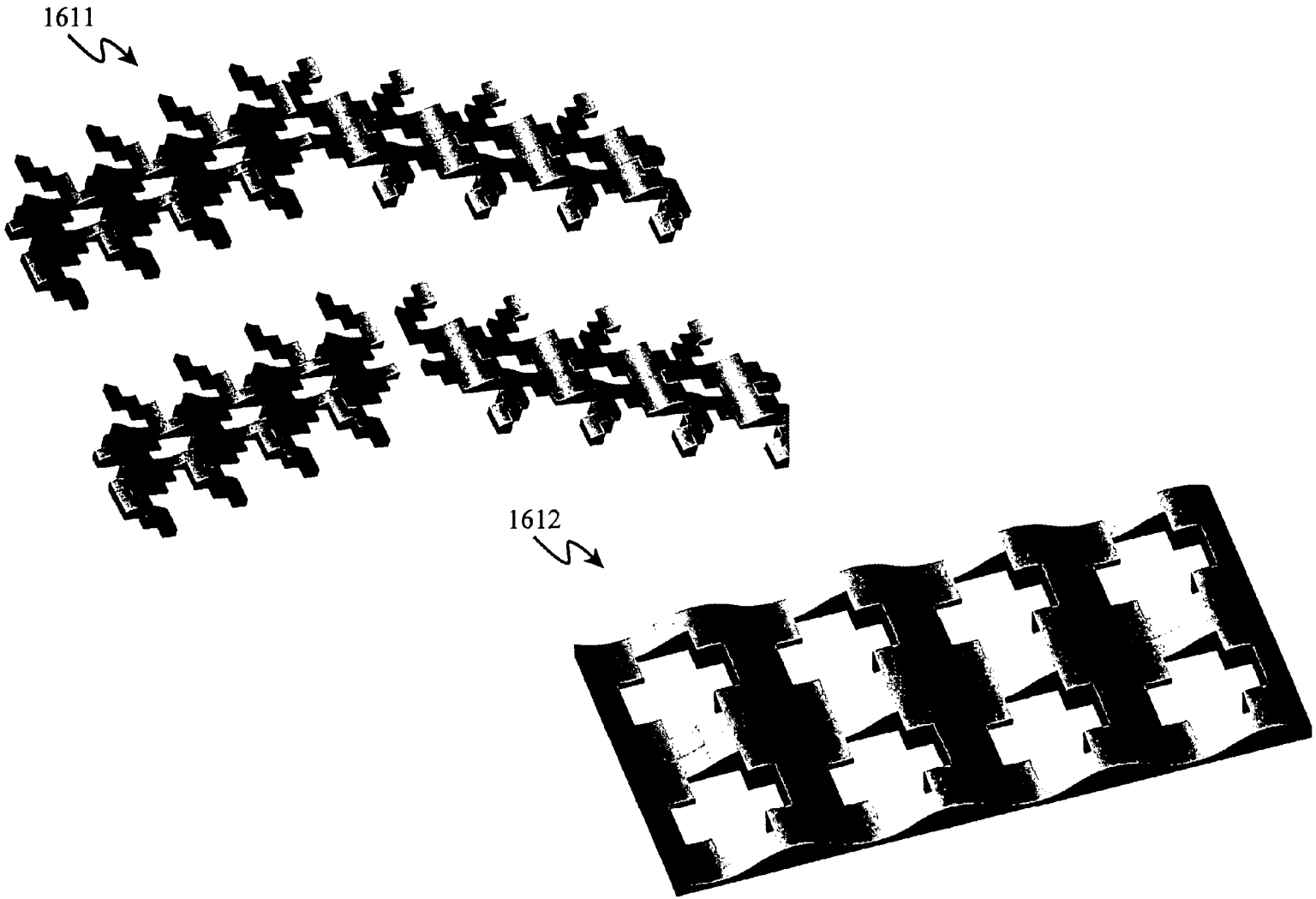
Figure 16G:
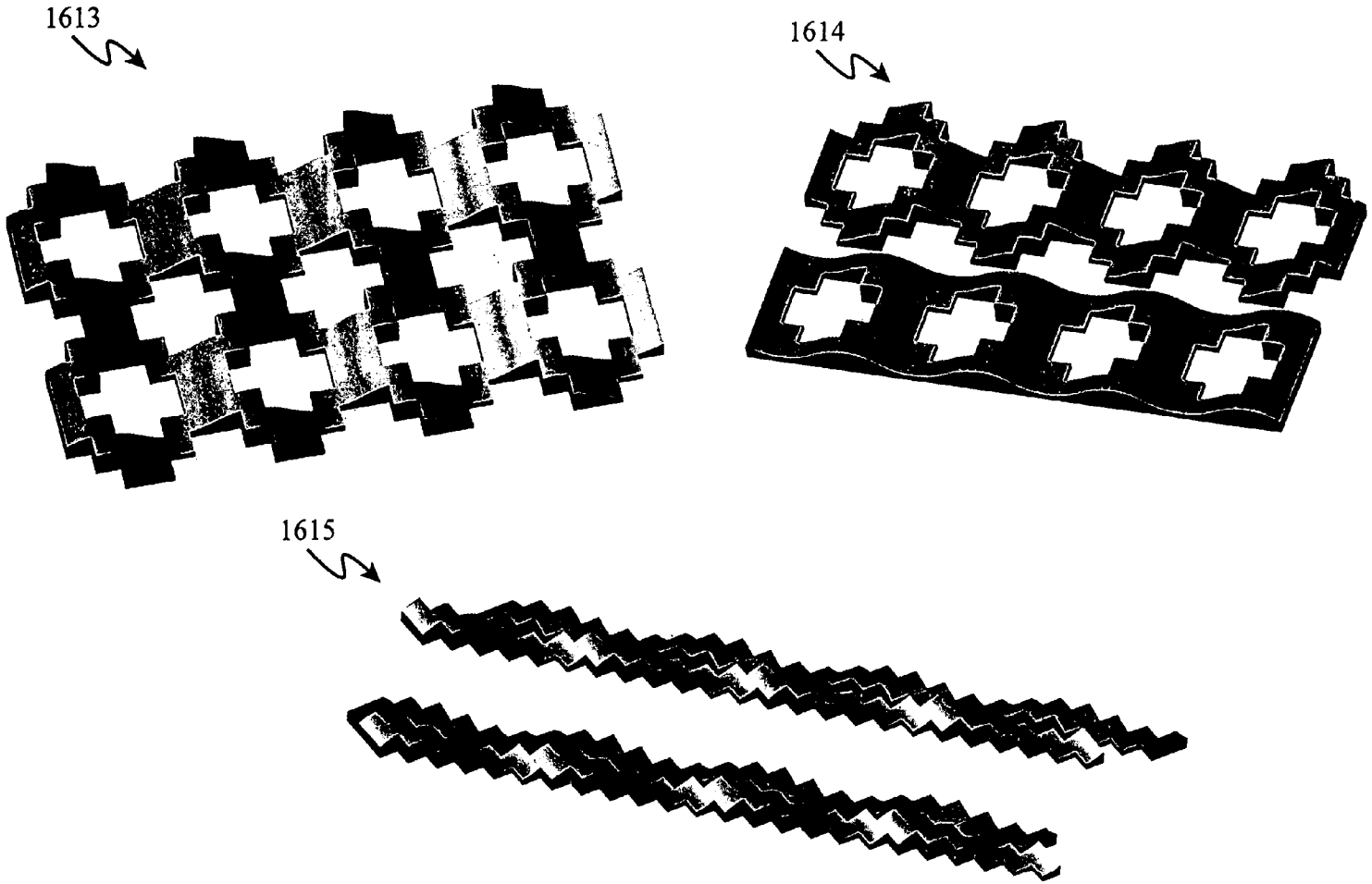
Figure 16H:
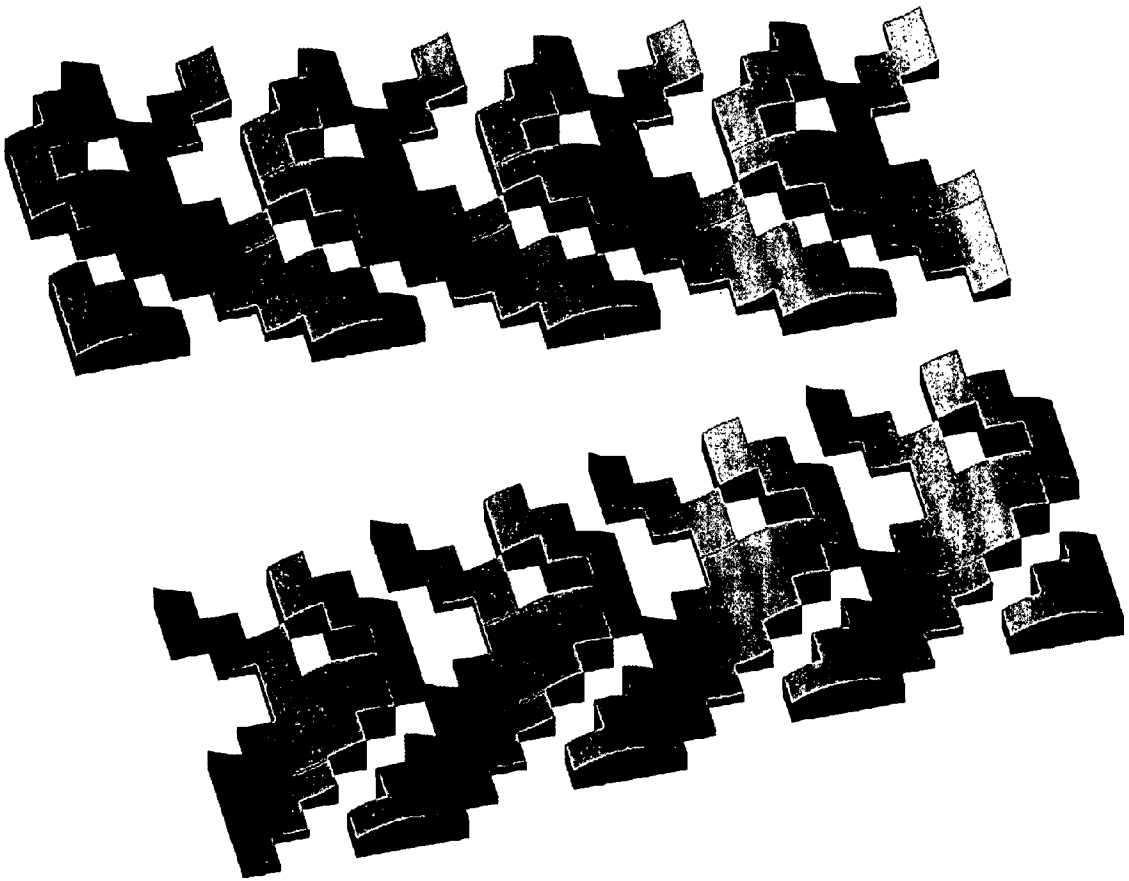
Figure 16I:
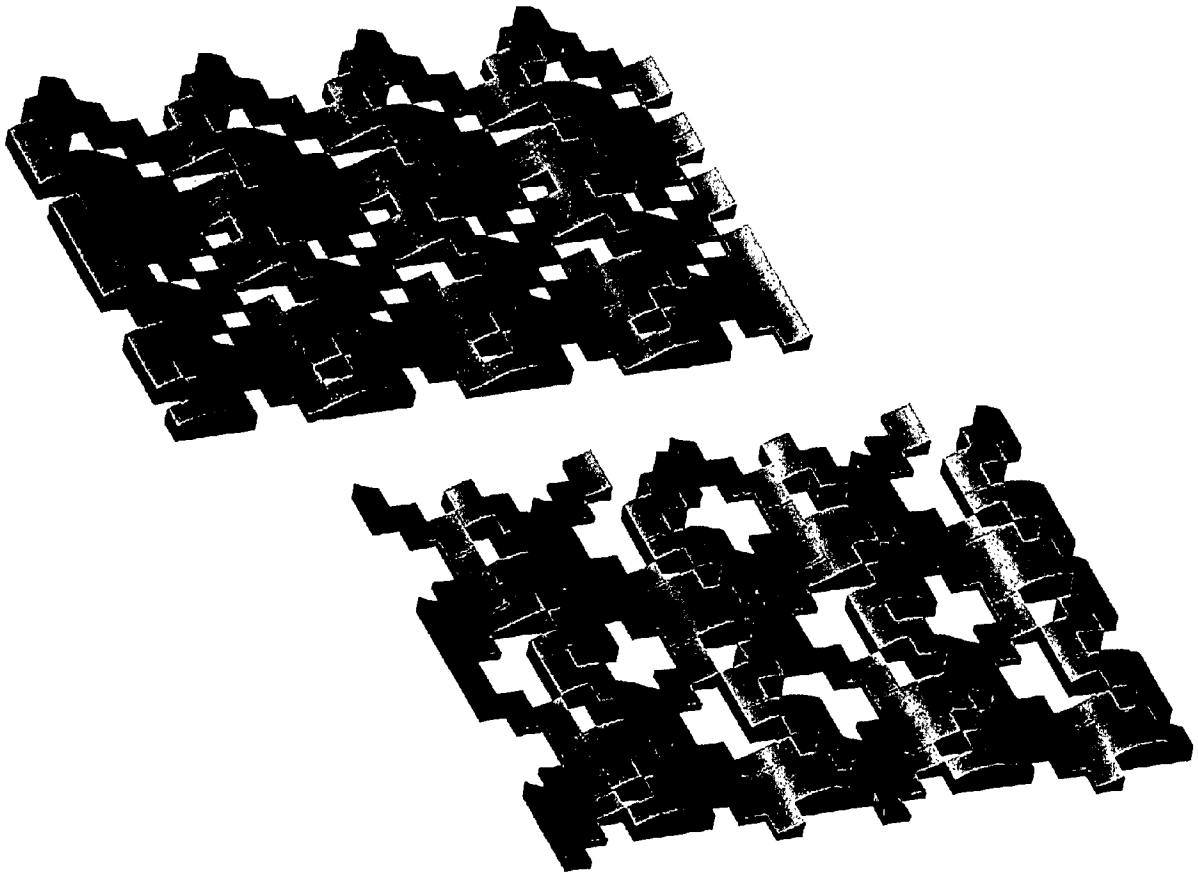
Figure 16J:
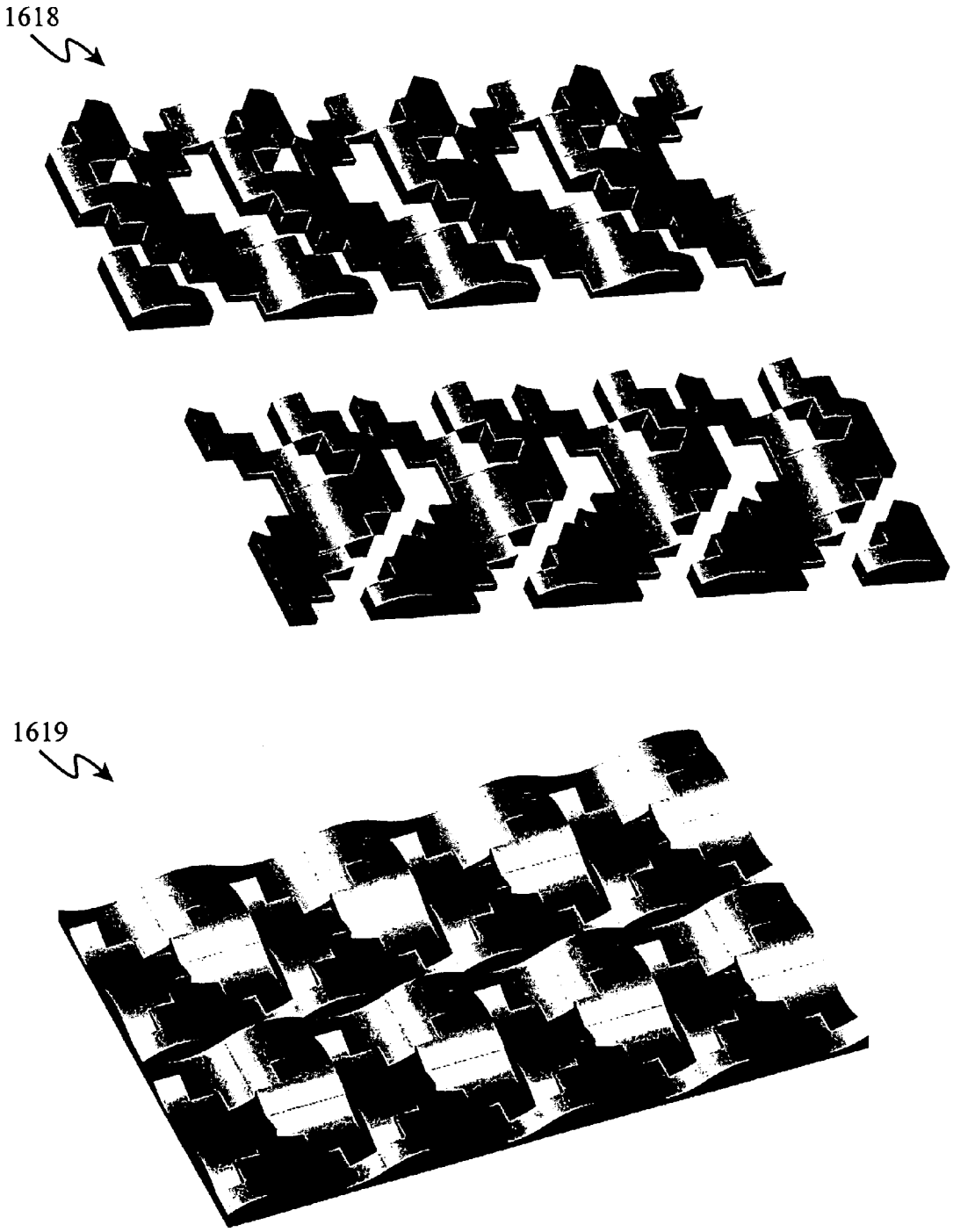
Figure 16K:
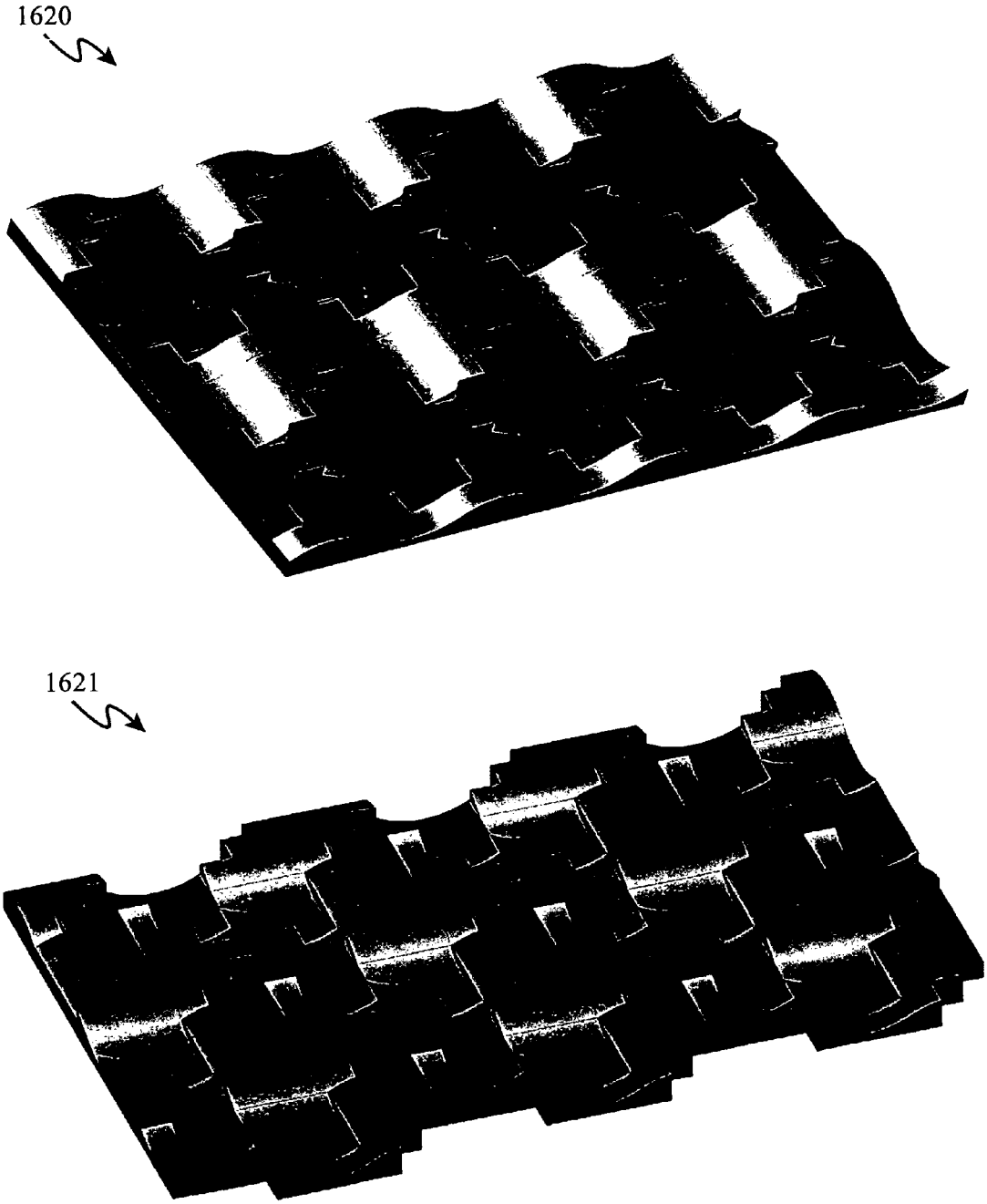
Figure 16M:
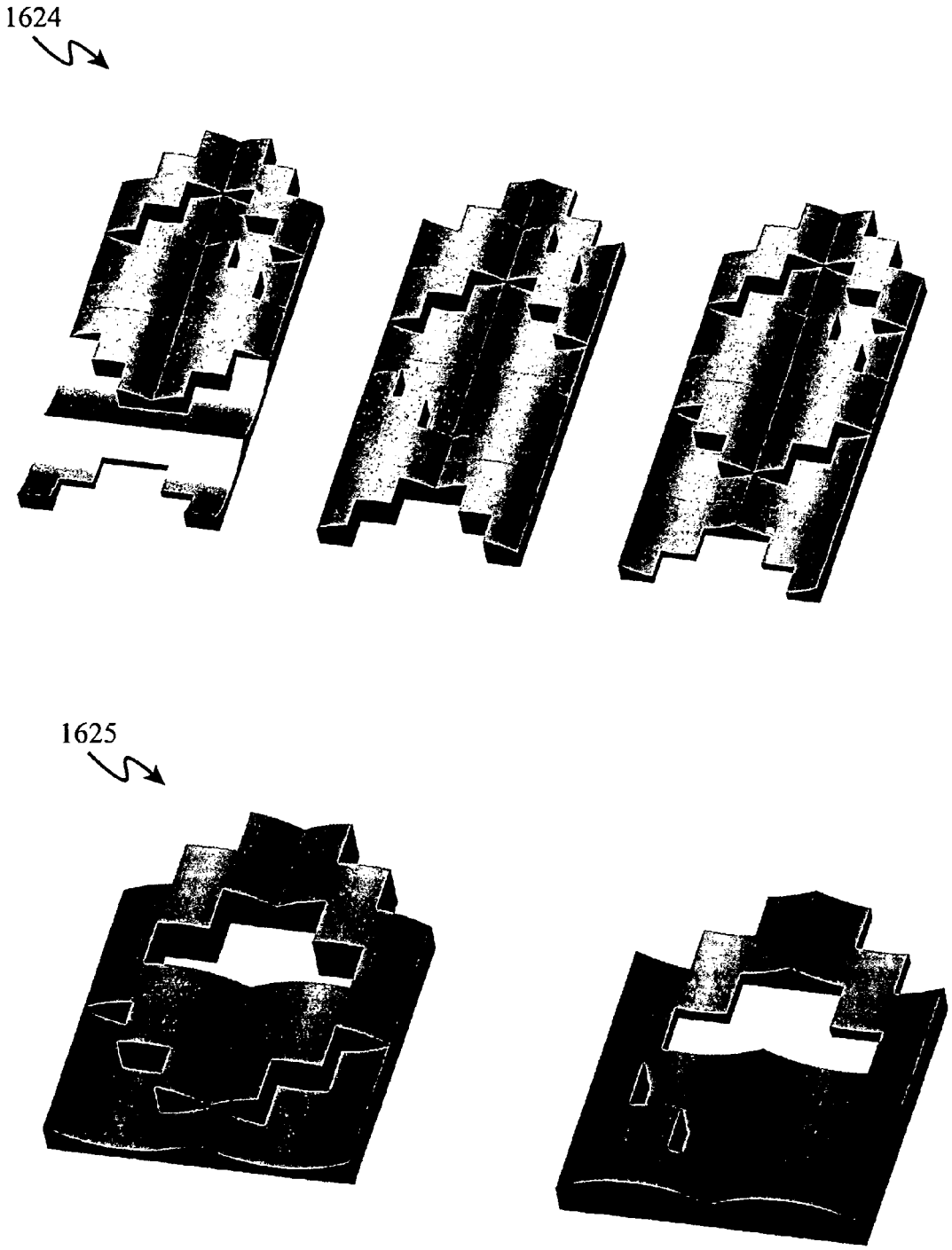
Figure 16N:
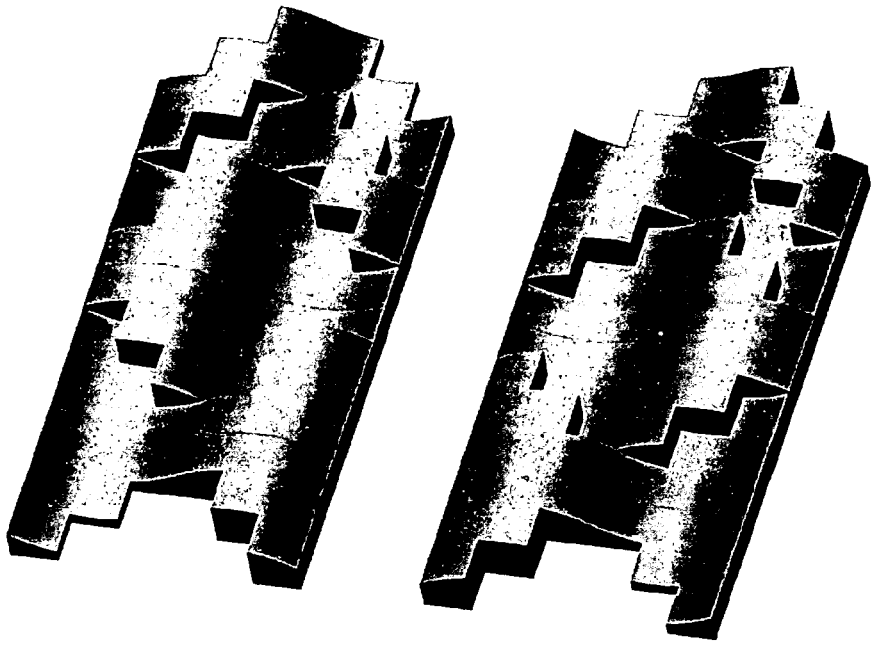
Figure 16N:
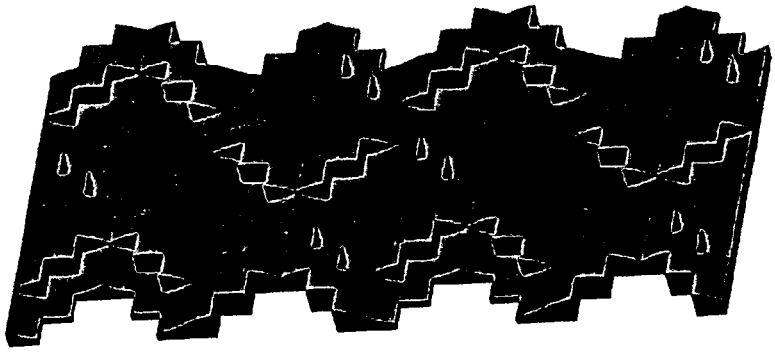
Figure 16N:
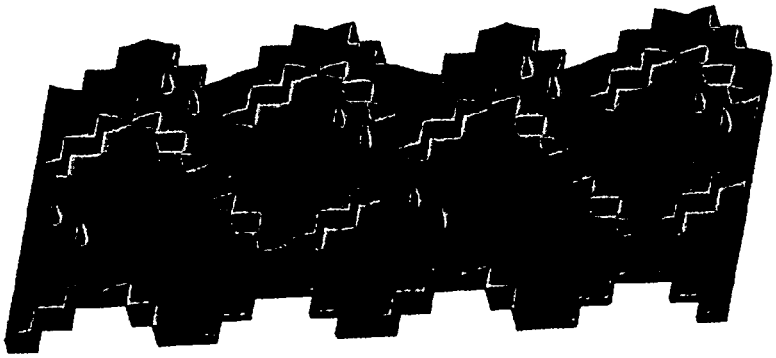
Figure 16O:
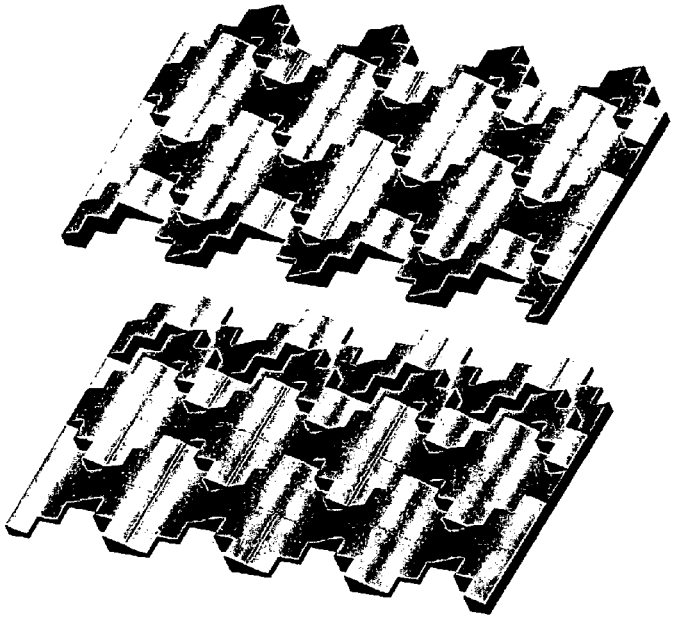
Figure 16O:
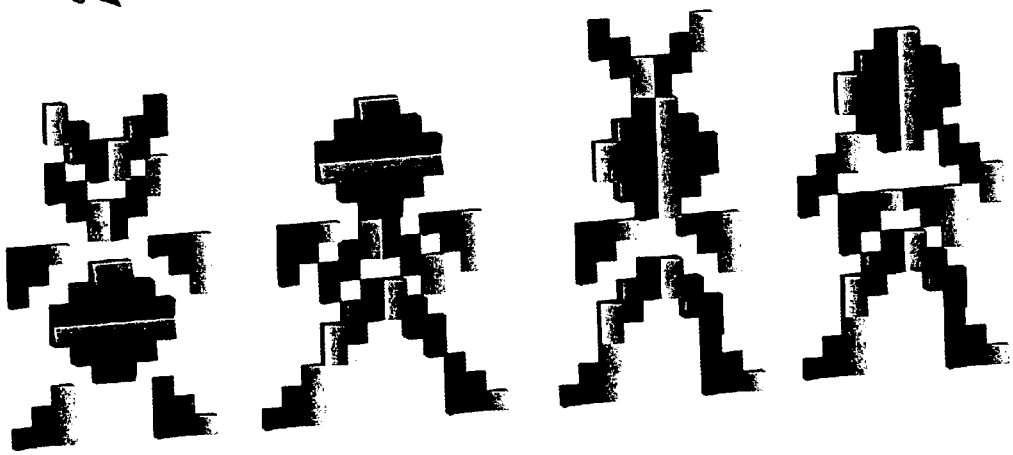
Figure 17B:
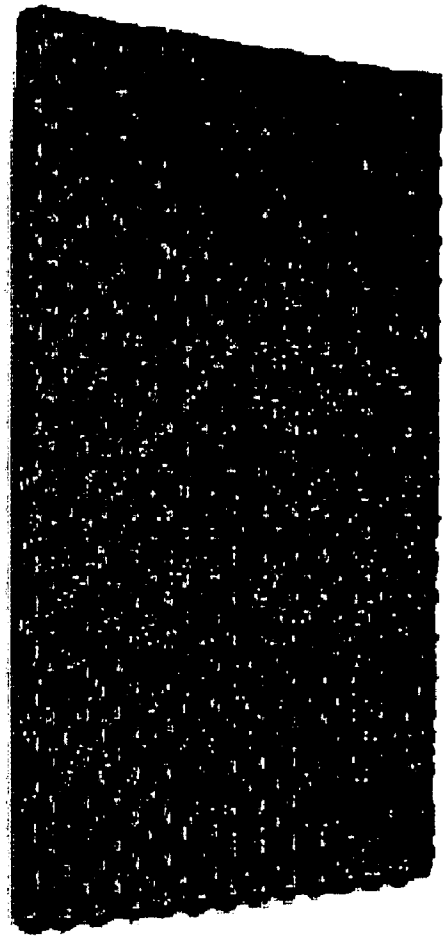
FIGS. 17*a* and 17*b* illustrate foam acoustic sheets or panels currently available on the market.
Figure 17A:
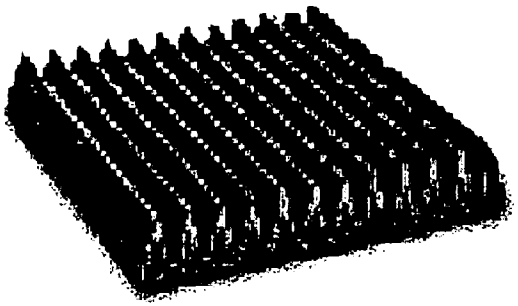

FIG. 6*a* illustrates another embodiment of acoustic foam components according to the invention, and FIGS. 6*b*-6*s* show various installation arrangements which can be achieved using the components of FIG. 6*a*. Similarly, FIGS. 7*a*, 7*c*, and 7*d* illustrate another shape set, and its unpacking/packing process in FIG. 7*b*, with a variety of installation patterns shown in FIGS. 7*e*-7*s*. Likewise, FIG. 8*a* shows an alternate shape set in which two symmetrically reversed sets (e.g. a left hand set and a right hand set) are provided, FIG. 8*b* illustrates the packing and unpacking process for this set, while FIGS. 8*c*-8*w* illustrate a wide variety of installation patterns for the shape set. Turning to FIG. 10*a*, another embodiment option is shown, which is packed and unpacked as illustrated in FIG. 10*b*, and can be installed in a pattern such as one of the patterns shown in FIGS. 10*c*-10*u*. Yet another optional shape set according to the invention is shown in FIG. 11*a*, along with a number of possible installation patterns in FIGS. 11*b*-11*j* for this shape set. FIG. 12*a* illustrates another set of tessellated foam components according to the present invention, using several curved cuts to yield a number of possible installation patterns as shown in FIGS. 12*c*-12*g*, and which can be packed and unpacked as illustrated in FIG. 12*b*. Similarly, FIGS. 13*a*-13*t* illustrate another foam component set, packing, unpacking, and installation configurations.

FIGS. 14*a*-14*o*, and FIGS. 15*a*-15*o* depict bi-planar components in a special embodiment of the invention suitable for installing in corners of rooms. The fabrication approach is similar to the co-planar components, except that two orthogonal flat surfaces are yielded on each component. These orthogonal surfaces mate to the substrates (e.g. walls, ceilings, panels, etc.) in the corners of a room, while other edges of the components may be abutted or aligned with edges of other components.

Alternate embodiments of the invention allow for other shape sets to be arranged with similar exposed areas of the wall or ceiling upon which they are installed, including shape sets having curved and straight cuts.

Alternative Materials

The foregoing examples have primarily discussed production of acoustic components from acoustic foam. However, other acoustically absorptive materials may be used to realize the invention, such as polyester, glass fiber, mineral fiber, and organic fiber. Some materials may provide desirable characteristics such as a fire rating, renewable resource content, etc., which may make them preferable in certain jurisdictions, applications, and locales. According to the material, alternative fabrication methods may be utilized, such as molding, stamping, or shaping.

Additionally, acoustically reflective materials, such as wood, plastic, metal, etc., may be employed to yield some components of the shape set. In this embodiment, acoustically reflective components can be utilized in conjunction with complementarily shaped acoustically absorptive components to produce the same sculpture-like patterns previously discussed, but yielding different acoustic properties for the entire treatment on the building feature.

According to another optional embodiment, substantially non-absorptive components of a set may be tuned by microperforation of one or more surfaces. Such perforation can modify the absorption coefficient of the component to yield certain characteristics as needed.

Conclusion

As will be recognized by those skilled in the art, the present invention includes a method of producing co-planar three-dimensional tessellated acoustic foam components, the components themselves, and methods of shipping and installation of those components. Certain examples have been provided to illustrate the invention, but these example embodiments do not represent the limits of the invention, and many variations and combinations of the features, materials, and techniques from those disclosed herein may be made without departing from the spirit and scope of the invention. Therefore, the scope of the present invention should be determined by the following claims.

What is claimed is:

1. A component system for creating an acoustic sculpture with functionally selective absorption, diffusion, and reflection of acoustic energy comprising:

a set of three or more solid acoustic treatment components having three or more geometric shapes unique within said set, said unique shapes having complementary three-dimensional block tessellation shape relationship with all other components in said set, and each component having at least one substantially flat side;

wherein said set of components nests into a substantially rectangular parallelepiped volume in a storage and shipment arrangement having no substantial voids within said volume;

wherein said components provide a combination acoustic treatment of absorption, diffusion, and reflection in an installation arrangement affixed to a substantially planar building surface upon said component flat sides, and wherein said combination acoustic treatment of absorption, diffusion, and reflection is selectively determined according to an installation pattern through rotation and spacing of said components within said set on said planar building surface, said installation pattern forming a three-dimensional sculpture other than a repeating egg-crate pattern. a repeating pyramidal pattern, a repeating wedge pattern, and a cylinder.

2. The system as set forth in claim 1 wherein at least one of the components is substantially acoustically absorptive.

3. The system as set forth in claim 2 wherein the absorptive component comprises a material selected from the group of acoustical foam, polyester, glass fiber, mineral fiber, and organic fiber.

4. The system as set forth in claim 2 further comprising an acoustically reflective skin disposed upon at least one surface of a component.

5. The system as set forth in claim 4 wherein the reflective skin comprises a directly applied material selected from the group of paint, latex, foam coating, and polyurethane.

6. The system as set forth in claim 4 wherein the skin comprises a chemically or thermally hardened component surface.

7. The system as set forth in claim 4 wherein the skin comprises a material preformed to a component shape and adhesively applied to a component surface.

8. The system as set forth in claim 7 wherein the skin material is selected from the group of polyvinyl chloride, wood, metal, vinyl, closed-cell foam, and plastic.

9. The system as set forth in claim 4 further comprising a coating applied to said preformed skin selected from the group of paint, latex, and polyurethane.

10. The system as set forth in claim 8 further comprising a veneer adhered to said preformed skin selected from the group of wood, metal, vinyl, plastic, paper, or cloth.

11. The system as set forth in claim 1 wherein at least one component is substantially acoustically non-absorptive.

12. The system as set forth in claim 11 wherein the non-absorptive component comprises a material selected from the group of polyvinyl chloride, closed-cell foam, wood, metal, vinyl, and plastic.

13. The system as set forth in claim 11 further comprising a perforated surface on said non-absorptive component to increase absorption of acoustic energy.

14. A method of providing an acoustic sculpture for treating a building feature for functionally selective absorption, diffusion, and reflection of acoustic energy, comprising:

receiving a set of three or more solid acoustic treatment components having three or more geometric shapes unique within said set, said unique shapes having complementary three-dimensional block tessellation shape relationship with all other components in said set, and each component having at least one substantially flat side, said set of components being nested in a substantially rectangular parallelepiped volume in a storage and shipment arrangement having no substantial voids within said volume;

removing three or more components from the nested arrangement; and forming a substantially planar sculpture installation arrangement of said removed components by affixing said removed components along said flat sides to a building feature;

wherein said components provide a combination acoustic treatment of absorption, diffusion, and reflection in said installation arrangement; and wherein said combination acoustic treatment of absorption, diffusion, and reflection is selectively determined according to an installation pattern through rotation and spacing of said components within said set on said planar building surface, said installation pattern forming a three-dimensional sculpture other than a repeating egg-crate pattern, a repeating pyramidal pattern, a repeating wedge pattern. and a cylinder.

15. The method as set forth in claim 14 wherein the building feature comprises a wall.

16. The method as set forth in claim 14 wherein the building feature comprises a ceiling.

17. The method as set forth in claim 14 wherein at least one surface of a removed component is substantially absorptive.

18. The method as set forth in claim 14 wherein at least one surface of a removed components is substantially acoustically non-absorptive.

19. The method as set forth in claim 14 wherein said planar arrangement comprises areas of exposed portions of the building feature without cutting the components.

20. The method as set forth in claim 14 wherein said planar arrangement completely covers a treated area of the building feature without cuffing the components.

21. A method of producing a set of acoustic sculpture components with functionally selective absorption, diffusion, and reflection of acoustic energy comprising:

fabricating from an acoustically absorptive material a set of three or more solid acoustic treatment components having three or more geometric shapes unique within said set, said unique shapes having complementary three-dimensional block tessellation shape relationship with all other components in said set, and each component having at least one substantially flat side;

wherein said components nest into a substantially rectangular parallelepiped volume in a storage and shipment arrangement having no substantial voids within said volume;

wherein said components provide a combination acoustic treatment of absorption, diffusion, and reflection in an installation arrangement affixed to a substantially planar building surface upon said component flat sides, and wherein said combination acoustic treatment of absorption, diffusion, and reflection is selectively determined according to an installation pattern through rotation and spacing of said components within said set on said planar building surface, said installation pattern forming a three-dimensional sculpture other than a repeating egg-crate pattern, a repeating pyramidal pattern. a repeating wedge pattern, and a cylinder.

22. The method as set forth in claim 21 wherein fabricating comprises:

providing a substantially rectangular parellelepiped portion of said selected material, the portion having a plurality of sides;

selecting a plurality of cutting lines, curves, or both to define the component shapes; and executing a plurality of linear point-to-point cuts through two or more of the sides according to the selected cutting lines, curves, or both lines and curves.

23. The method as set forth in claim 22 wherein the-step-of executing cuts is preceded by:

performing a first linear point-to-point cut through a first pair of sides; and performing a second linear point-to-point cut through a second pair of sides other than the first pair of sides.

24. The method as set forth in claim 22 wherein at least one of the point-to-point cuts is executed at an angle relative to at least one of the sides other than a substantially right angle.

25. The method as set forth in claim 22 wherein at least one of the point-to-point cuts is executed in a path through the sides to yield a curved surface on at least two of the components.

26. The method as set forth in claim 22 wherein at least one of the point-to-point cuts is executed using a profile cutter.

27. The method as set forth in claim 22 wherein at least one of the point-to-point cuts is executed using a hot wire knife.

28. The method as set forth in claim 22 wherein at least one of the point-to-point cuts is executed using a water knife.

29. The method as set forth in claim 22 wherein at least one of the point-to-point cuts is executed using a die cutter.

30. The method as set forth in claim 22 wherein at least one of the point-to-point cuts is executed using a laser cutter.

31. The method as set forth in claim 21 wherein the components are produced by a molding process.

32. The method as set forth in claim 21 wherein the components are produced molding or cutting sheets of material to the shapes of the individual component faces; and assembling the individual faces into the three-dimensional tessellated components.

33. The method as set forth in claim 21 further comprising disposing a substantially acoustically reflective skin upon at least one surface of the components.

34. The method as set forth in claim 33 wherein the step of disposing a skin comprises directly applying to the component surface a material selected from the group of paint, latex, foam coating, and polyurethane.

35. The method as set forth in claim 33 wherein the step of disposing a skin comprises chemically or thermally hardening the component surface.

36. The method as set forth in claim 33 wherein disposing a skin comprises:

preforming a skin material to a component shape; and adhesively applying the material to the component surface.

37. The method as set forth in claim 36 wherein the skin material is selected from a group comprising polyvinyl chloride, wood, metal, vinyl, closed-cell foam, and plastic.

38. The method as set forth in claim 36 further comprising applying to the preformed skin a coating selected from the group of paint, latex, and polyurethane.

39. The method as set forth in claim 36 further comprising adhering to the pre-formed skin a veneer selected from a group comprising wood, metal, vinyl, plastic, paper, or cloth.

40. The method as set forth in claim 21 further comprising perforating at least one surface of the components to increase absorption of acoustic energy.

41. The method as set forth in claim 21 further comprising the step of packing the components into a substantially rectangular parallelepiped arrangement.

42. The method as set forth in claim 41 further comprising the step of shipping the packed components.

43. The method as set forth in claim 42 further comprising:

receiving the packed components;

removing the components from the stacked arrangement; and repositioning and installing the components into a three-dimensional planar formation onto a building feature.

44. The method as set forth in claim 43 wherein the building feature comprises a wall.

45. The method as set forth in claim 43 wherein the building feature is a ceiling.

46. The method as set forth in claim 43 wherein the formation includes components of at least two different types of components selected from a group comprising acoustically absorptive components, acoustically non-absorptive components, components with a reflective skin, and components with at least one perforated surface.

47. The method as set forth in claim 43 wherein the formation provides areas of exposed portions of the building feature without cutting the components.

48. The method as set forth in claim 43 wherein the formation completely covers the treated area of the building feature without cutting the components.

* * * * *

UNITED STATES PATENT AND TRADEMARK OFFICE

CERTIFICATE OF CORRECTION

PATENT NO. : 7,703,575 B2
APPLICATION NO. : 11/526343
DATED : April 27, 2010
INVENTOR(S) : Russell E. Berger, II, Charles M. Chiles and Richard Schrag It is certified that error appears in the above-identified patent and that said Letters Patent is hereby corrected as shown below:

In the list of the inventor names on the first page, change 'Charles M Chiles' to -- Charles M. Chiles --.

Col. 6, line 3, change 'aback' to -- a back --.

Col. 9, line 2, change 'pattern.' to -- pattern, --.

Col. 10, line 2, change 'pattern.' to -- pattern, --.

Col. 10, line 43, change 'pattern.' to -- pattern, --.

Col. 10, line 55, delete "the-step-of".

Signed and Sealed this

First Day of June, 2010

David J. Kappos

David J. Kappos
*Director of the United States Patent and Trademark Office*